US012421834B2

(12) United States Patent
Hurst et al.

(10) Patent No.: US 12,421,834 B2
(45) Date of Patent: Sep. 23, 2025

(54) SYSTEMS AND METHODS USING A BELLOWS PUMP TO PERFORM OPERATIONS FOR A SUBTERRANEAN FORMATION

(71) Applicant: Halliburton Energy Services, Inc., Houston, TX (US)

(72) Inventors: Justin Lee Hurst, Duncan, OK (US); Timothy Holiman Hunter, Duncan, OK (US); Andrew Silas Clyburn, Duncan, OK (US); Kurt R. Harpold, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/398,936

(22) Filed: Dec. 28, 2023

(65) Prior Publication Data

US 2024/0376809 A1 Nov. 14, 2024

Related U.S. Application Data

(60) Provisional application No. 63/502,061, filed on May 12, 2023.

(51) Int. Cl.
*E21B 43/12* (2006.01)

(52) U.S. Cl.
CPC ..... *E21B 43/129* (2013.01)

(58) Field of Classification Search
CPC ..... E21B 43/129
See application file for complete search history.

(56) References Cited

U.S. PATENT DOCUMENTS

| | | | |
|---|---|---|---|
| 1,256,127 | A | 2/1918 | Gould |
| 1,301,485 | A | 4/1919 | Mueller |
| 1,650,377 | A | 11/1927 | Nixon |
| 1,832,257 | A | 11/1931 | Stephens |

(Continued)

FOREIGN PATENT DOCUMENTS

| | | | |
|---|---|---|---|
| CN | 201982789 U | | 9/2011 |
| CN | 104763410 A | * | 7/2015 |

(Continued)

OTHER PUBLICATIONS

Filing Receipt, Specification and Drawings for U.S. Appl. No. 18/398,878, filed Dec. 28, 2023, entitled "Direct Connect Piston-Driven Bellows Pump," 96 pages.

(Continued)

*Primary Examiner* — Crystal J Lee
(74) *Attorney, Agent, or Firm* — Conley Rose, P.C.; Rodney B. Carroll

(57) ABSTRACT

Exemplary systems for introducing treatment fluid into a well can include a bellows pump and a make-up system configured to maintain a controlled volume of fluid between the piston and the bellows of the bellows pump. The make-up system can be fluidly coupled to the bellows and to at least one additional component of the system. In embodiments, the make-up system can be configured to receive heat via circulation of fluid with the at least one additional component of the system, and to discharge heat via circulation of the fluid with the bellows, for example with the bellows conducting heat from the fluid to the treatment fluid for heat discharge.

20 Claims, 51 Drawing Sheets

(56) References Cited

U.S. PATENT DOCUMENTS

| | | | |
|---|---|---|---|
| 2,464,095 | A | 3/1949 | Nies |
| 2,546,302 | A | 3/1951 | Gehres et al. |
| 2,613,607 | A | 10/1952 | Sheen et al. |
| 2,735,369 | A | 2/1956 | Turvey |
| 2,807,215 | A | 9/1957 | Hawxhurst |
| 3,134,508 | A | 5/1964 | Bayer et al. |
| 3,151,562 | A | 10/1964 | Swartz |
| 3,192,860 | A | 7/1965 | Hardison |
| 3,338,170 | A | 8/1967 | Swartz |
| 3,411,452 | A | 11/1968 | Czarnecki et al. |
| 3,433,161 | A | 3/1969 | Vetter |
| 3,524,714 | A | 8/1970 | Grove et al. |
| 3,680,981 | A | 8/1972 | Wagner |
| RE29,055 | E | 11/1976 | Wagner |
| 4,003,679 | A | 1/1977 | McManigill |
| 4,080,107 | A | 3/1978 | Ferrentino |
| 4,406,595 | A | 9/1983 | Robertson et al. |
| 4,439,112 | A | 3/1984 | Kitsnik |
| 4,594,057 | A | 6/1986 | Morgan |
| 4,948,349 | A | 8/1990 | Koiwa |
| 5,220,943 | A | 6/1993 | Zink |
| 5,246,351 | A | 9/1993 | Horn et al. |
| 5,249,932 | A | 10/1993 | Van Bork |
| 5,308,230 | A | 5/1994 | Moore |
| 6,419,462 | B1 | 7/2002 | Horie et al. |
| 6,554,578 | B1 | 4/2003 | Siegel |
| 9,243,413 | B2 | 1/2016 | Robol et al. |
| 9,518,577 | B2 | 12/2016 | van Boeyen et al. |
| 10,408,204 | B2 | 9/2019 | Suzuki |
| 10,408,207 | B2 | 9/2019 | Yamada et al. |
| 10,480,296 | B2 | 11/2019 | Beisel |
| 10,895,254 | B2 | 1/2021 | Beisel |
| 10,947,967 | B1 | 3/2021 | Surjaatmadja et al. |
| 11,125,225 | B2 | 9/2021 | Beisel |
| 11,268,502 | B2 | 3/2022 | Mollatt |
| 11,286,920 | B2 | 3/2022 | Mollatt |
| 11,346,336 | B2 | 5/2022 | Surjaatmadja et al. |
| 11,401,792 | B2 | 8/2022 | Mollatt |
| 11,415,123 | B2 | 8/2022 | Hunter et al. |
| 2003/0031565 | A1 | 2/2003 | Kleibrink |
| 2006/0008364 | A1 | 1/2006 | Traylor |
| 2007/0065305 | A1 | 3/2007 | Budde et al. |
| 2007/0074872 | A1 | 4/2007 | Du et al. |
| 2008/0145248 | A1 | 6/2008 | Kato et al. |
| 2009/0041588 | A1 | 2/2009 | Hunter et al. |
| 2012/0091165 | A1 | 4/2012 | Cedrone et al. |
| 2012/0308409 | A1 | 12/2012 | Levine |
| 2015/0148919 | A1* | 5/2015 | Watson ..... G06N 5/043 700/31 |
| 2016/0097384 | A1 | 4/2016 | Menjoh et al. |
| 2016/0123313 | A1 | 5/2016 | Simmons |
| 2018/0313196 | A1 | 11/2018 | Frantz, III et al. |
| 2019/0383279 | A1 | 12/2019 | Simmons et al. |
| 2020/0217186 | A1* | 7/2020 | Mollatt ..... F04B 9/00 |
| 2020/0256333 | A1 | 8/2020 | Surjaatmadja et al. |
| 2020/0277951 | A1 | 9/2020 | Hunter et al. |
| 2020/0309113 | A1 | 10/2020 | Hunter et al. |
| 2021/0140294 | A1 | 5/2021 | Mollatt |
| 2021/0148354 | A1 | 5/2021 | Adams |
| 2021/0173111 | A1* | 6/2021 | Therrien ..... E21B 47/113 |
| 2021/0190065 | A1 | 6/2021 | Ferden et al. |
| 2021/0246894 | A1 | 8/2021 | Mollatt |
| 2022/0178368 | A1 | 6/2022 | Montilla Jimenez et al. |
| 2024/0376809 | A1 | 11/2024 | Hurst et al. |
| 2024/0376881 | A1 | 11/2024 | Hurst et al. |
| 2024/0376887 | A1 | 11/2024 | Hurst et al. |
| 2025/0163784 | A1 | 5/2025 | Clyburn et al. |

FOREIGN PATENT DOCUMENTS

| | | | |
|---|---|---|---|
| CN | 106761573 | B | 4/2019 |
| DE | 596227 | C | 7/1934 |
| DE | 2253288 | A1 | 5/1974 |
| DE | 3706338 | A1 | 9/1988 |
| EP | 1602830 | A1 | 7/2005 |
| EP | 2913525 | A1 | 2/2015 |
| EP | 4286688 | A1 | 6/2023 |
| FR | 1441747 | A | 6/1966 |
| FR | 2367203 | A2 | 5/1978 |
| GB | 2185291 | A | 7/1987 |
| JP | H11159464 | A | 6/1999 |
| JP | 2006200464 | B2 | 8/2006 |
| JP | 2007100663 | A | 4/2007 |
| KR | 1020170016059 | A | 8/2018 |
| SU | 1359482 | A1 | 12/1987 |
| WO | 2015078487 | A1 | 6/2015 |
| WO | 2022099219 | A1 | 5/2022 |
| WO | 2022164034 | A1 | 8/2022 |

OTHER PUBLICATIONS

Filing Receipt, Specification and Drawings for U.S. Appl. No. 18/398,885, filed Dec. 28, 2023, entitled "Improved Cooling for Bellows Pump," 80 pages.

Filing Receipt, Specification and Drawings for U.S. Appl. No. 18/398,905, filed Dec. 28, 2023, entitled "Valve Monitoring System for a Bellows Pump," 91 pages.

Filing Receipt, Specification and Drawings for U.S. Appl. No. 18/398,923, filed Dec. 28, 2023, entitled "Active Bellows Pump Valve Management," 81 pages.

Filing Receipt, Specification and Drawings for U.S. Appl. No. 18/399,058, filed Dec. 28, 2023, entitled Protection of Make-Up System for High Pressure Bellows-Stylepump System, 91 pages.

Foreign Communication from Related Application—International Search Report and Written Opinion of the International Searching Authority, International Application No. PCT/US2023/086392, dated Apr. 19, 2024, 11 pages.

Filing Receipt, Specification and Drawings for U.S. Appl. No. 18/398,858, filed Dec. 28, 2023, entitled "Bellows Failure Detection for a Pump," 70 pages.

Foreign Communication from Related Application—International Search Report and Written Opinion of the International Searching Authority, International Application No. PCT/US2023/086404, dated Apr. 24, 2024, 10 pages.

Foreign Communication from Related Application—International Search Report and Written Opinion of the International Searching Authority, International Application No. PCT/US2023/086394, dated Apr. 24, 2024, 11 pages.

Foreign Communication from Related Application—International Search Report and Written Opinion of the International Searching Authority, International Application No. PCT/US2023/086395, dated Apr. 30, 2024, 11 pages.

Foreign Communication from Related Application—International Search Report and Written Opinion of the International Searching Authority, International Application No. PCT/US2023/086389, dated May 1, 2024, 11 pages.

Foreign Communication from Related Application—International Search Report and Written Opinion of the International Searching Authority, International Application No. PCT/US2023/086385, dated May 7, 2024, 11 pages.

Foreign Communication from Related Application—International Search Report and Written Opinion of the International Searching Authority, International Application No. PCT/US2023/086397, dated May 7, 2024, 10 pages.

First Office Action dated Apr. 28, 2025 (45 pages), U.S. Appl. No. 18/398,878, filed Dec. 28, 2023.

First Office Action dated Jun. 2, 2025 (44 pages), U.S. Appl. No. 18/399,058, filed Dec. 28, 2023.

First Office Action dated Jun. 23, 2025 (47 pages), U.S. Appl. No. 18/399,058, filed Dec. 28, 2023.

First Office Action dated Jul. 2, 2025 (40 pages), U.S. Appl. No. 18/398,905, filed Dec. 28, 2023.

First Office Action dated May 2, 2025 (28 pages), U.S. Appl. No. 18/398,923, filed Dec. 28, 2023.

* cited by examiner

SYSTEMS AND METHODS USING A BELLOWS PUMP TO PERFORM OPERATIONS FOR A SUBTERRANEAN FORMATION

CROSS-REFERENCE TO RELATED APPLICATIONS

This application claims priority benefit under 35 U.S.C. 119(e) of U.S. Provisional Patent Application Ser. No. 63/502,061 (filed May 12, 2023), which is incorporated by reference herein in its entirety.

STATEMENT REGARDING FEDERALLY SPONSORED RESEARCH OR DEVELOPMENT

Not applicable.

FIELD

This disclosure relates generally to the field of pumping, for example pumping of fluids downhole in a well. More particularly, this disclosure relates to systems and methods relating to bellows pumps.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), treatment, such as a stimulation operation, may be performed to enhance hydrocarbon production into the wellbore. Examples of some common stimulation operations involve hydraulic fracturing, acidizing, fracture acidizing, and hydro-jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a treatment/stimulation fluid (which may comprise a clean fluid and a proppant) may be mixed at the surface before being pumped downhole in order to induce fractures or perforations in the formation of interest. The creation of such fractures or perforations will increase the production of hydrocarbons by increasing the flow paths into the wellbore.

Various types of pumps have been used in well operations such as hydraulic fracturing. However, given the difficult conditions and related wear and reliability issues that may arise when pumping treatment fluids for a hydrocarbon well, there is need for improved pumps and related systems and methods.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 36 is a cross-sectional view of an exemplary piston-driven bellows pump, according to an embodiment of the disclosure;

FIG. 46A is a schematic illustration of an exemplary bellows pump system having a make-up system configured for fluid cooling, according to an embodiment of the disclosure;

FIG. 46B is a schematic illustration of the exemplary bellows pump system of FIG. 46A, illustrating a leak in the bellows, which may result in isolation of the bellows from the make-up fluid system, according to an embodiment of the disclosure;

FIG. 49A is a schematic illustration of an exemplary bellows pump system having a make-up system, also illustrating one or more exemplary sensor, according to an embodiment of the disclosure;

FIG. 49B is a schematic illustration of the exemplary bellows pump system of FIG. 49A, illustrating a leak in the bellows, according to an embodiment of the disclosure;

DETAILED DESCRIPTION

Figure 1:
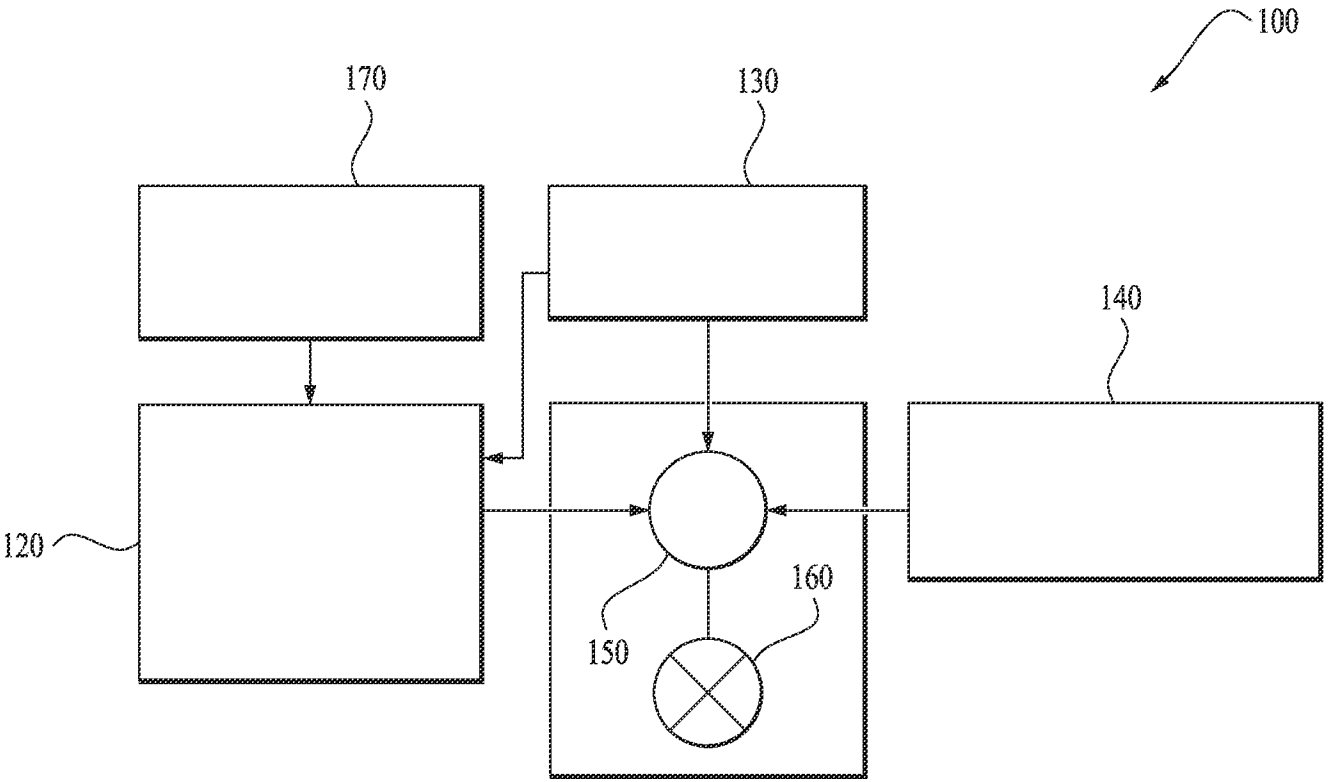
FIG. 1 is a schematic illustration of an exemplary well treatment system, such as an exemplary fracturing system, according to an embodiment of the disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Disclosed embodiments illustrate exemplary devices, systems, and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, drilling, cementing, and the like. For example, treatment fluid may be introduced into a wellbore (e.g. which penetrates a subterranean formation) at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiment, a treatment fluid may be introduced at a pressure sufficient to create or enhance one or more fractures within the formation, and/or one or more of the treatment fluids may include a proppant material which subsequently may be introduced into the formation. In embodiments, treatment fluid can be any fluid (and may in some instances include solid particles therein) which can be pumped into a well. In embodiments, treatment fluid may differ from drive fluid used within a pump mechanism.

By way of example, FIG. 1 schematically illustrates an exemplary fracturing system 100. The fracturing system 100 may be implemented using the systems, methods, and techniques described herein. In particular, the disclosed systems, methods, and techniques may directly or indirectly affect one or more components or pieces of equipment associated with the example fracturing system 100, according to one or more embodiments. In embodiments, the fracturing system 100 may comprise one or more of the following: a fracturing fluid producing apparatus 120, a fluid source 130, a solid source 140, an additive source 170, and a pump and blender system 150. All or an applicable combination of these components of the fracturing system 100 may reside at the surface at a well site/fracturing pad where a well 160 can be located.

During a fracturing job, the fracturing fluid producing apparatus 120 may access the fluid source 130 for introducing/controlling flow of a fluid, e.g. a treatment fluid such as fracturing fluid, in the fracturing system 10. While only a single fluid source 130 is shown, the fluid source 130 may include a plurality of separate fluid sources (e.g. storage tanks). In some embodiments, the fracturing fluid producing apparatus 120 may be omitted from the fracturing system 100, with the fracturing fluid instead being sourced directly from the fluid source 130 during a fracturing job rather than through the intermediary fracturing fluid producing apparatus 120.

The fracturing fluid may be an applicable fluid for forming fractures during a fracture stimulation treatment of the well 160. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 160. In certain embodiments, the fracturing fluid may include a gel pre-cursor with fluid, e.g. liquid or substantially liquid, from fluid source 130. Accordingly, the gel pre-cursor with fluid may be mixed by the fracturing fluid producing apparatus 120 to produce a hydrated fracturing fluid for forming fractures.

The solid source 140 may include a volume of one or more solids which may be mixed with a fluid, e.g. the fracturing fluid, to form a solid-laden fluid. The solid-laden fluid may be pumped into the well 160 as part of a solid-laden fluid stream that is used to form and stabilize fractures in the well 160 during a fracturing job. The one or more solids within the solid source 140 may include applicable solids that may be added to the fracturing fluid of the fluid source 130. Specifically, the solid source 140 may contain one or more proppants for stabilizing fractures after they are formed during a fracturing job, e.g. after the fracturing fluid flows out of the formed fractures. For example, the solid source 140 may contain sand.

The fracturing system 100 may also include an additive source 170. The additive source 170 may contain/provide one or more applicable additives that may be mixed into fluid, e.g. the fracturing fluid, during a fracturing job. For example, the additive source 170 may include solid-suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 160 to one or more perforations.

The pump and blender system 150 functions to pump treatment fluid into the well 160. Specifically, the pump and blender system 150 of FIG. 1 may pump fracture fluid from the fluid source 130, e.g. fracture fluid that is received through the fracturing fluid producing apparatus 120, into the well 160 for forming and potentially stabilizing fractures as part of a fracture job. The pump and blender system 150 may include one or more pumps. Specifically, the pump and blender system 150 may include a plurality of pumps that may operate together, e.g. concurrently, to form fractures in a subterranean formation as part of a fracturing job. The one or more pumps included in the pump and blender system 150 may be any applicable type of fluid pump. For example, the pumps in the pump and blender system 150 may include electric pumps and/or hydrocarbon and hydrocarbon mixture powered pumps, such as diesel-powered pumps, natural gas-powered pumps, and diesel combined with natural gas-powered pumps. In one or more embodiments, one or more of the pumps in the pump and blender system 150 may be a bellows pump.

In some embodiments, the pump and blender system 150 may also function to receive the fracturing fluid and combine it with other components and solids (e.g. with the pump and blender system 150 optionally comprising a blender unit). Specifically, the pump and blender system 150 may combine the fracturing fluid with volumes of solid particles, e.g. proppant, from the solid source 140 and/or additional fluid and solids from the additive source 170. In turn, the pump and blender system 150 may pump the resulting mixture down the well 160 at a sufficient pumping rate to create or enhance one or more fractures in a subterranean zone, for example, to stimulate production of fluids from the zone. While the pump and blender system 150 is described to perform both pumping and mixing of fluids and/or solid particles, in various embodiments, the pump and blender system 150 may function to just pump a fluid stream, e.g. a treatment and/or fracture fluid stream, down the well 160 to create or enhance one or more fractures in a subterranean zone. In some embodiments, a separate pump and/or separate blender may be used (e.g. independently of each other or alone).

In embodiments, one or more elements/components of the system may be monitored (e.g. using one or more sensor). For example, the fracturing fluid producing apparatus 120, fluid source 130, and/or solid source 140 may be equipped with one or more monitoring devices (not shown). The monitoring devices may be used to control the flow of fluids, solids, and/or other compositions to the pumping and blender system 150. Such monitoring devices may effectively allow the pumping and blender system 150 to source from one, some, or all of the different sources at a given time. In turn, the pumping and blender system 150 may provide just fracturing fluid into the well 160 at some times, just solids or solid slurries at other times, and combinations of those components at other times.

Figure 2:
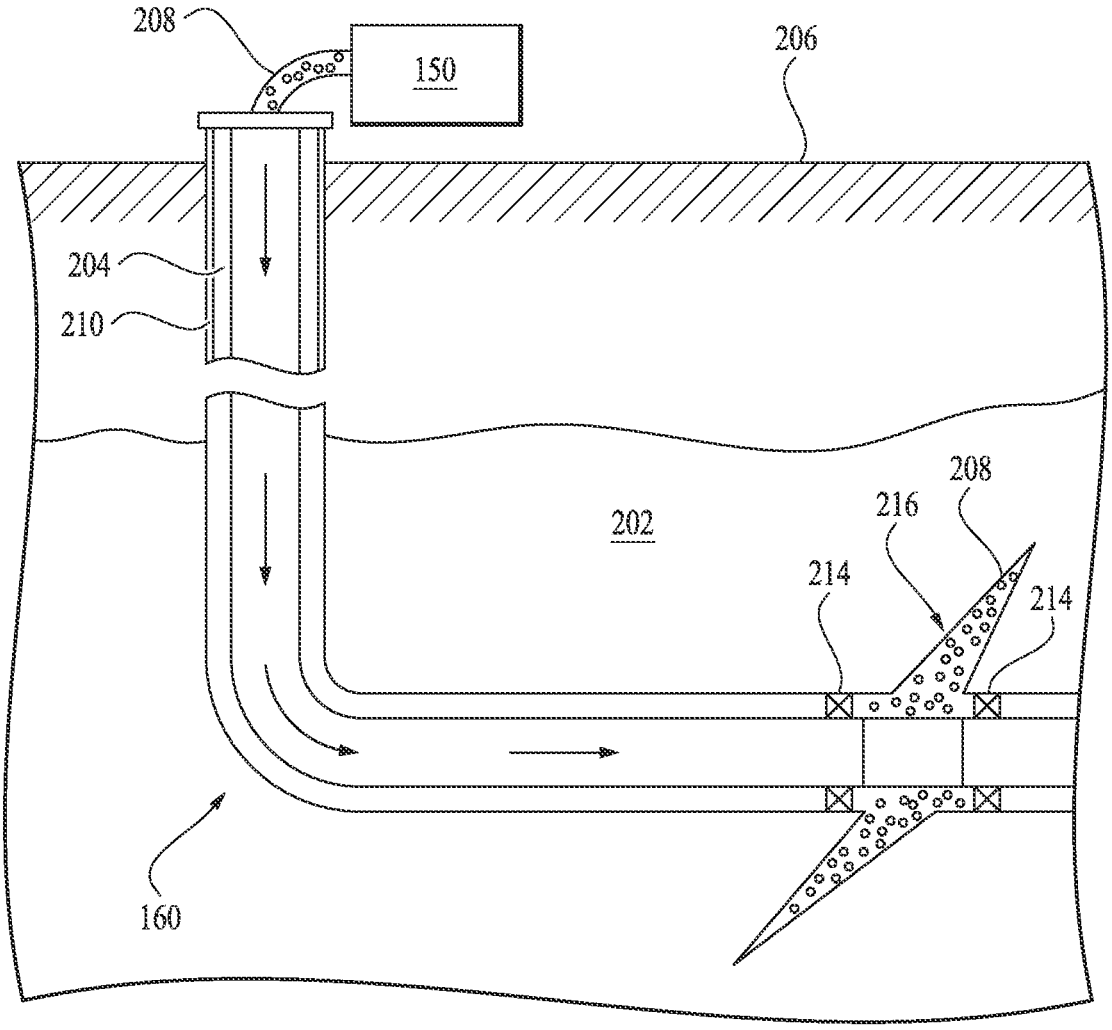
FIG. 2 is a schematic illustration of an exemplary well during a treatment operation, according to an embodiment of the disclosure.

FIG. 2 illustrates an exemplary well 160 during a treatment operation (e.g. a fracturing operation) in a portion of a subterranean formation of interest 202 surrounding a wellbore 204. In embodiments, the downhole operation may be performed using one or an applicable combination of the components in the example system 100 shown in FIG. 1. The wellbore 204 of FIG. 2 extends from a surface 206, and a fracturing fluid 208 is applied to a portion of the subterranean formation 202 (e.g. surrounding the horizontal portion of the wellbore 204). Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore 204. The wellbore 204 may include a casing 210 that is cemented or otherwise secured to the wellbore wall. The wellbore 204 may be uncased or otherwise include uncased sections. Perforations may be formed in the casing 210 to allow fracturing fluids and/or other materials to flow into the subterranean formation 202. In the example fracture operation shown in FIG. 2, a perforation is created between points 214 (which may represent one or more packer element in some embodiments) defining an isolated zone.

The pump and blender system 150 (or in some embodiments, just a pump or a separate pump and a separate blender) may be fluidly coupled to the wellbore 204 to pump treatment fluid (e.g. fracturing fluid 208), and potentially other applicable solids and solutions, into the wellbore 204. When the fracturing fluid 208 is introduced into wellbore 204, it may flow through at least a portion of the wellbore 204 to the perforation, for example defined by points 214 in FIG. 2. The fracturing fluid 208 may be pumped at a sufficient pumping rate through at least a portion of the wellbore 204 to create one or more fractures 216 through the perforation and into the subterranean formation 202. Specifically, the fracturing fluid 208 may be pumped at a sufficient pumping rate to create a sufficient hydraulic pressure at the perforation to form the one or more fractures 216. Further, solid particles, e.g. proppant from the solid source 140, may be pumped into the wellbore 204, e.g. within the fracturing fluid 208 towards the perforation. In turn, the solid particles may enter the fractures 216 where they may remain after the fracturing fluid flows out of the wellbore. These solid particles may stabilize or otherwise "prop" the fractures 216, such that fluids may flow freely through the fractures 216.

While only two perforations at opposing sides of the wellbore 204 are shown in FIG. 2, greater than two perforations may be formed in the wellbore 204 as part of a perforation cluster. Fractures may then be formed through the plurality of perforations in the perforation cluster as part of a fracturing stage for the perforation cluster. Specifically, fracturing fluid and solid particles may be pumped into the wellbore 204 and pass through the plurality of perforations during the fracturing stage to form and stabilize the fractures through the plurality of perforations.

The pump and blender system 150 may comprise a pump (e.g. a high-pressure pump), which may be used, either alone or in combination with one or more other pumps, to pressurize a treatment fluid and/or introduce the treatment fluid into wellbore 204 penetrating at least a portion of a subterranean formation to perform a treatment therein. For example, in hydraulic fracturing operations, one or more pumps may be used to pump a treatment fluid (e.g. fracturing fluid 208, which typically may be a slurry mixture of proppant and/or sand mixed with water) into the formation.

In some embodiments, the pump may comprise a bellows pump 300, which may be configured to segregate treatment fluid from drive fluid (sometimes termed power fluid). See for example FIG. 3, which schematically illustrates a bellows pump 300. The bellows pump 300 may comprise a power end 310, a fluid end 320, and an expandable bellows 330. The fluid end 320 may have a chamber 321 within a fluid end housing 323, a suction valve 326 in fluid communication with (e.g. fluidly coupled to) the chamber 321 and a source/reservoir for the treatment fluid 350 (e.g. with the suction valve 326 being configured to allow for insertion of treatment fluid into the chamber 321), and a discharge valve 328 in fluid communication with (e.g. fluidly coupled to) the chamber 321 and the well (e.g. with the discharge valve 328 being configured to allow for insertion of treatment fluid from the chamber 321 into the well or any other place where treatment fluid is intended to be pumped). While the suction valve 326 and discharge valve 328 may be disposed within the housing 323 for the fluid end 320 in some embodiments, in other embodiments, the suction valve 326 and discharge valve 328 may be located within other components (such as piping) that fluidly couples the valves to the elements/components of the pump 300 as described.

In embodiment, the power end 310 may be fluidly connected to (e.g. in fluid communication with) the bellows 330 (e.g. the inner volume of the bellows) and/or configured to reciprocally expand/inflate and contract/deflate the bellows 330 based on movement of drive fluid 311 (sometimes termed power fluid). The bellows 330 may be configured to reciprocally expand and/or retract within the chamber 321 of the fluid end 320 based on movement of the drive fluid 311. In some embodiments, the bellows 330 may be sealingly coupled to an opening in the chamber 321 of the fluid end 320 (e.g. coupled to the wall of the chamber), so that fluid communication between the power end 310 and the bellows 330 causes reciprocal movement of the bellows 330 within the chamber 321. In some embodiments, the power end 310 may be (e.g. sealingly) coupled to the fluid end 320, with no flow of treatment fluid or drive fluid therebetween (e.g. since the bellows 330 separates the fluids).

In embodiments, the bellows 330 may comprise a flexible/expandable bag or body, typically of thin, flexible material, whose inner volume (e.g. the open space therein, which may be configured to hold drive fluid) can be changed (e.g. based on the amount/pressure of fluid therein). The bellows 330 may have an opening allowing fluid communication of drive fluid 311 with the power end 310, but in some embodiments may otherwise have a form configured to retain fluid therein. For example, the bellows 330 may be configured to prevent fluid transfer between its interior and the chamber 321 of the fluid end 320 external to the bellows 330. In some embodiments, the bellows 330 may comprise an elastomeric element and/or material. In some embodiments, the bellows 330 may comprise metal material and/or may include an accordion-like configuration (e.g. having pleats or folds or convolutions). In some embodiments, exemplary metal bellows may be formed of a metal that is sufficiently flexible and/or durable and configured appropriately to effectively withstand repeated back and forth motion due to reciprocal movement without breaking or wearing to failure for a reasonable life of the bellows. For example, the bellows may comprise stainless steel, nickel alloys such as Inconel & Monel, hastealloy, and/or copper alloys. In some embodiments, the bellows 330 may not be configured to withstand significant pressure differentials. In some embodiments, the bellows 330 may be configured to separate (e.g. isolate) drive fluid 311 (e.g. clean fluid) from treatment fluid (e.g. dirty fluid, such as fluid having proppant, abrasives, and/or corrosive materials, such as from treatment fluid source 350).

The bellows 330 may be disposed in and/or configured to expand into the chamber 321 of the fluid end 320, and may be configured to serve as a separating barrier that divides the chamber 321 into a first volume 373 within the bellows 330 and a second volume 375 outside of the bellows 330. The first volume 373 (e.g. inner volume of the bellows 330) may be in fluid communication with the power end 310, and may in some embodiments contain drive fluid. The second volume 375 of the chamber 321 is in fluid communication with the suction valve 326 and discharge valve 328, and is configured for treatment fluid to flow therethrough. The bellows 330 may serve as a fluid separating barrier between the drive fluid 311 in the first volume 373 and the treatment fluid in the second volume 375. The bellows 330 may be configured to flex (e.g. expand and/or contract) to balance pressure between the first volume 373 and second volume 375 during operation of the pump 300. In some embodiments, the bellows 330 may be configured to flex axially. The power end 310 of pump 300 may be sealingly connected to the fluid end 320, to prevent entry of treatment fluid from the fluid end 320 into the power end 310.

The chamber 321 may be downstream of the fluid treatment source 350 and upstream of the well 160. Typically, the suction valve 326 can be a one-way check valve configured to allow treatment fluid from the treatment fluid source 350 to enter the chamber 321 (e.g. during a suction stroke of the pump 300), and the discharge valve 328 can be a one-way check valve configured to allow treatment fluid to exit the chamber 321 towards the well (e.g. during a power/discharge stroke of the pump 300). The reciprocating expansion and retraction of the bellows 330 in the chamber 321 (e.g. with the bellows 330 expanding/inflating for the discharge stroke and contracting/deflating for the suction stroke) can be configured to work in conjunction with the suction valve 326 and discharge valve 328 to allow the fluid end 320 to pump treatment fluid into the well 160. For example, during a discharge stroke, as drive fluid 311 enters the first volume 373 (e.g. the inner volume of the bellows 330), the bellows 330 inflates and treatment fluid is expelled from the second volume 375 of the chamber 321 through the discharge valve 328. Once the discharge stroke is complete, a suction stroke can begin. During the suction stroke, drive fluid 311 inside the first volume 373 exits the bellows 330, the bellows 330 deflates, and treatment fluid can be drawn through the suction valve 326 into the second volume 375 of the chamber 321. Once the bellows 330 is compressed to its minimum desired/permitted length, another discharge stroke can begin.

The bellows 330 may be configured to separate treatment fluid, which the pump 300 may be pumping into the well 160, from drive fluid 311 used for pump operations. By way of example, the drive fluid 311 may be chosen from a desirable group of liquids, which may include hydraulic fluid such as water or hydraulic oil. In some embodiments, the drive fluid 311 may also serve as a lubricant for the pump 300, for example forming a barrier against wear due to friction. In the case of a fracturing operation or a fracturing pump, the treatment fluid may be a fracturing fluid that may comprise a base fluid (e.g., water, oils, organic liquids, etc.) as well as any other suitable components or additives useful for the fracturing treatment. For example, the fracturing fluid may be a slurry containing sand or synthetic proppants and/or a variety of chemical additives such as gelling agents, acids, friction reducers, and solvents.

In various embodiments, any mechanism for causing reciprocal movement of the bellows 330 (e.g. by movement of the drive fluid 311) can provide the pumping action for the pump 300. In some embodiments, the power end 310 may further comprise a piston or plunger 410 configured to reciprocally move drive fluid 311 (e.g. in and out of the bellows 330). See for example FIG. 4, which schematically illustrates an embodiment of the bellows pump 300 having a piston/plunger 410. Reciprocal movement (e.g. axial translation) of the piston/plunger 410 within a bore 420 of the power end housing 413 may cause the reciprocal movement (e.g. expanding and contracting) of the bellows 330 (e.g. within the chamber 321 of the fluid end 320), for example with the piston/plunger 410 displacing fluid (e.g. hydraulic drive fluid 311) which is located in the bore 420 between the driven end of the piston/plunger 410 (e.g. the end in proximity to the bellows 330) and the bellows 330. Since the bore 420 is fluidly coupled to (e.g. in fluid communication with) the bellows 330, the piston/plunger 410 reciprocally displacing drive fluid 311 can induce reciprocal movement (e.g. expansion and contraction) of the bellows 330. As used herein, reference to "piston" shall include both conventional piston and plunger elements for convenience of reference.

Figure 4:
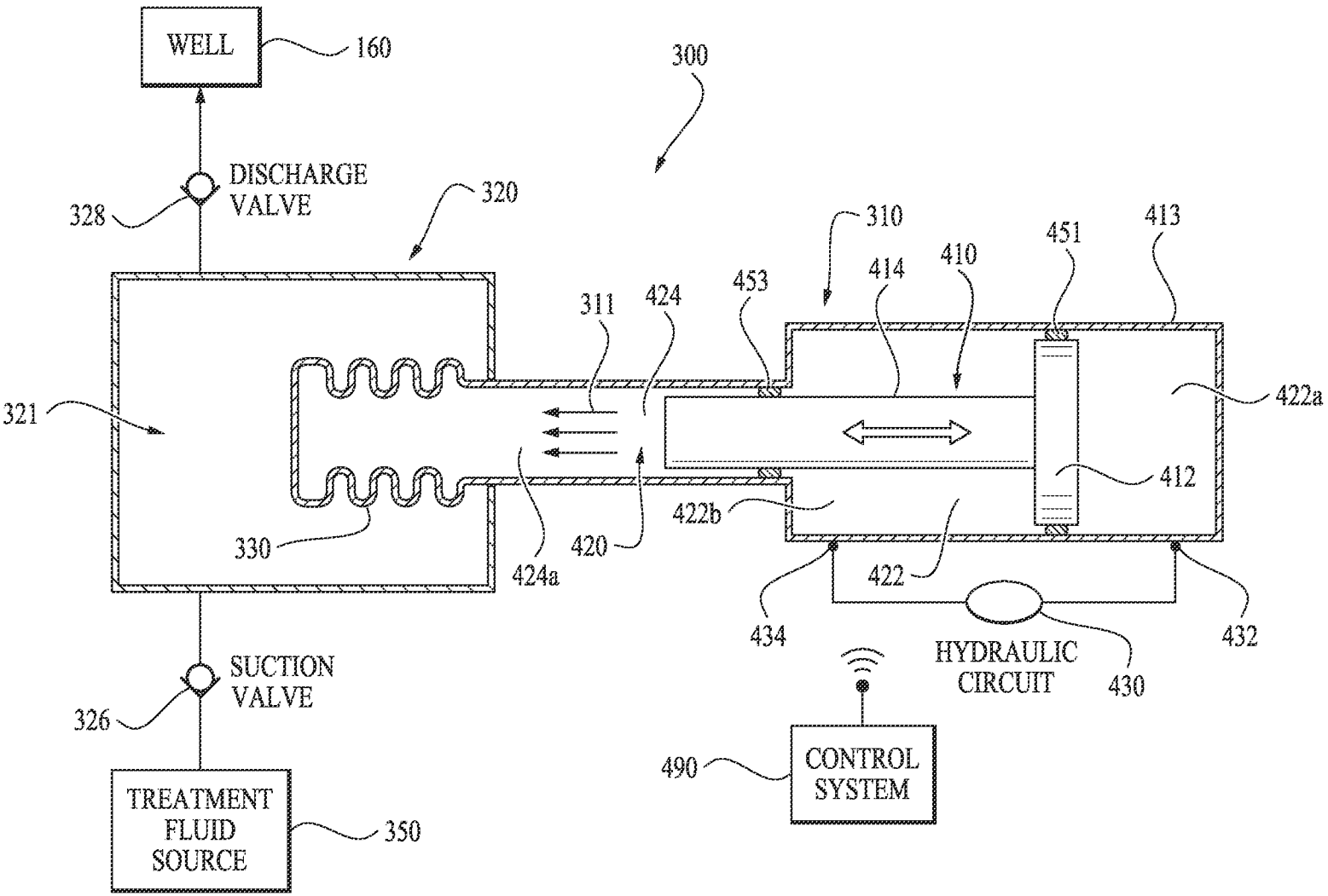
FIG. 4 is a schematic illustration of an exemplary bellows pump with piston/plunger, according to an embodiment of the disclosure.

In embodiments, the piston 410 may be configured to sealingly move within the bore 420, for example having one or more seal (configured to engage between the piston 410 and the bore 420) disposed on the piston 410 and/or on the inner wall of the bore 420. In some embodiments, one or more seal may comprise pump packing. In some embodiments, the bellows 330 may be configured to protect the piston 410 from wear, for example by separating the piston 410 from the treatment fluid in the fluid end 320. In some embodiments, the piston 410 may be configured so that, during its reciprocal movement in the bore 420, the piston 410 does not extend into the inner volume of the bellows 330; while in other embodiments, the piston 410 may be configured to extend partially into the bellows during a discharge stroke. Regardless, the piston 410 may be configured to not contact the bellows 330 (e.g. the end of the bellows) during its reciprocal movement. The piston 410 can be driven/powered by any suitable means, including various types of driver elements configured to induce reciprocal movement of the piston 410, such as a hydraulic circuit, a combustion engine, an electric motor, a linear actuator, rack and pinion, etc. In the example of FIG. 4, the piston 410 may be driven by a hydraulic circuit 430. In other exemplary embodiments, the pump 300 may be powered by natural gas (e.g. via a natural gas-fired engine or natural gas-fired electric generator) produced from the same area in which well treatment (e.g. fracturing) operations are being performed. In some embodiments, a control system 490 may control one or more aspect of the driver (e.g. to control the reciprocation of the piston 410 and thereby the bellows 330) and/or the valves (e.g. 326, 328).

In some embodiments, the piston 410 can comprise a head 412 and a rod 414 (e.g. with the rod 414 disposed between the head 412 and the bellows 330, and extending from the head 412 towards the fluid end 320). In some embodiments, the piston 410 can be driven by a hydraulic circuit 430. For example, the hydraulic circuit 430 of the power end 310 can include a first port 432, located such that the head 412 is disposed between the first port 432 and the rod 414, and a second port 434 located between the head 412 and the bellows 330 (e.g. more proximate the bellows 330 than the first port 432). In some embodiments, the hydraulic circuit 430 may include one or more source of drive fluid and/or one or more pump. For example, the first port 432 may be in fluid communication with a source of drive fluid and/or a pumping mechanism. In some embodiments, the second port 434 may be in fluid communication with a source of drive fluid and/or a pumping mechanism. In some embodiments, the source of drive fluid may be the same for the first port 432 and the second port 434. In some embodiments, the pumping mechanism may be the same for the first port 432 and the second port 434. In some embodiments, the hydraulic circuit 430 may include one or more valve. The hydraulic circuit 430 may be configured to produce pressure differential on either side of the piston 410 (e.g. the head 412), for example by introducing drive fluid (such as hydraulic oil) via the ports (432, 434), which may induce movement/displacement of the piston 410. For example, introducing drive fluid via the first port 432 and/or removing drive fluid via the second port 434 may urge extension of the piston 410 towards the fluid end 320, while introducing drive fluid via the second port 434 and/or removing drive fluid via the first port 432 may retract the piston 410, urging the piston 410 away from the fluid end 320.

While the rod 414 and head 412 may have a similar diameter in some embodiments, in some embodiments the rod 414 may have a smaller diameter than the head 412. The ratio of size differential between the rod 414 and the head 412 can provide an intensifying effect, in which pressure applied to the head 412 is multiplied/increased as applied to the bellows 330 (via the rod 414). For example, the piston 410 may be part of an intensifier configured to intensify applied pressure (e.g. from the driver) to the bellows 330 (e.g. with the rod 414 having a smaller diameter than the head 412). For example, the size difference/ratio between the diameter of the rod 414 and the head 412 may range from approximately 1:1.1 to 1:10 (e.g. from 1:1.5 to 1:10, from 1:2 to 1:10, from 1:3 to 1:10, from 1:5 to 1:10, from 1:7 to 1:10, from 1:1.5 to 1:8, from 1:1.5 to 1:5, from 1:1.5 to 1:3, from 1:2 to 1:8, from 1:2 to 1:5, from 1:2 to 1:3, from 1:3 to 1:10, from 1:3 to 1:8, or from 1:3 to 1:5).

As described above, the power end 310 may include a bore 420 (e.g. in a power end housing 413) in fluid communication with (e.g. fluidly coupled to) the bellows 330 (e.g. an internal volume of the bellows), and the piston 410 can be disposed within the bore 420. In embodiments (e.g. in which the piston 410 is not uniform in diameter along its length), the bore 420 may have a first portion 422 with an inner diameter configured for movement of the head 412 (axially) therethrough and a second portion 424 with an inner diameter configured for movement of the rod 414 (axially) therethrough. For example, the first portion 422 of the bore may have a diameter approximately equal to that of the head 412, while the second portion 424 of the bore may have a diameter approximately equal to that of the rod 414 (e.g. the first portion 422 of the bore may have a larger diameter than the second portion 424 of the bore). In embodiments, the head 412 may separate the first portion 422 of the bore 420 into two cavities (whose volumes may change based on the position of the head 412 within the bore 420), for example with a first cavity 422*a* distally away from the fluid end 320 and/or bellows 330 (e.g. with the head 412 disposed between the first cavity 422*a* and the bellows 330) and a second cavity 422*b* more proximal to the bellows 330 and/or fluid end 320 (e.g. with the second cavity 422*b* disposed between the head 412 and the bellows 330). Interaction of the rod 414 within the second portion 424 of the bore 420 may form a third cavity 424*a* in fluid communication with the bellows 330. In embodiments having a hydraulic circuit as the driver (e.g. as shown in FIG. 4), the first port 432 may be in fluid communication with the first cavity 422*a*, and the second port 434 may be in fluid communication with the second cavity 422*b*. The third cavity 424*a* may be in fluid communication with the bellows 330. Typically, the bore 420 may extend along the longitudinal axis of the power end 310 and/or parallel to the longitudinal axis (e.g. the axis of extension) of the bellows 330.

In operation, the head 412 of the piston 410 may be configured to sealingly move within the first portion 422 of the bore 410 (e.g. during pump strokes), and the rod 414 may be configured to sealingly move within the second portion 424 of the bore 420 (e.g. during pump strokes). In embodiments, the power end 310 may further comprise a first seal 451 configured to seal the head 412 with respect to the first portion 422 of the bore 420 (e.g. such that the head 412 and first seal 451 isolate the first cavity 422*a* from the second cavity 422*b*) and a second seal 453 configured to seal the rod 414 with respect to the second portion 424 of the bore 420 (e.g. such that the rod 414 and second seal 453 isolate the third cavity 424*a* from the second cavity 422*b*). For example, the first seal 451 may be disposed on the head 412 (e.g. a moving seal), such as within one or more groove configured to hold a gasket, or on the bore first portion 422 inner surface (e.g. a stationary seal) and/or the second seal 453 may be disposed on the rod 414 (e.g. a moving seal) or on the bore second portion 424 inner surface (a stationary seal). In some embodiments, the first seal 451 may be a moving seal (e.g. disposed on the head 412) and the second seal 453 may be a stationary seal (e.g. disposed on the inner surface/wall of the bore 420—e.g. within the bore second portion 424—which may in some embodiments comprises pump packing). In some embodiments, one or more stationary seal may be configured to prevent fluid flow between the second portion 424 of the bore and the first portion 422 of the bore and/or to provide a controlled volume of fluid for interaction with the inner volume of the bellows 330. While the discussion has been set forth with regard to a pump 300 having a single bellows 330, similar concepts apply for dual (e.g. double-acting) bellows pumps (e.g. in which a single piston interacts with two bellows, for example such that the discharge stroke for one bellows is the suction stroke for the other).

It can be important for the health of the bellows pump 300 (e.g. to protect the bellows 330 from excessive pressure differentials which could damage the bellows 330) to ensure that the bellows 330 and the piston 410 remain in sync (e.g. with the bellows 330 not exceeding its full permissible extension position when the piston 410 is at its maximum extension at the end of the discharge stroke, and the bellows 330 not exceeding its permissible contraction position when the piston 410 is at its most retracted position at the end of its suction stroke). To aid in maintaining such synchronization between the bellows 330 and the piston 410, the volume of fluid between the rod 414 and the bellows 330 may be maintained at approximately a constant volume. Leaks in the bellows 330 can prove problematic, affecting the amount of sync and potentially damaging the bellows 330. For example, a bellows 330 leak can cause a pressure imbalance between the drive fluid in the bellows 330 and the treatment fluid in the chamber 321, which may damage (e.g. crush) the bellows 330.

Figure 5:
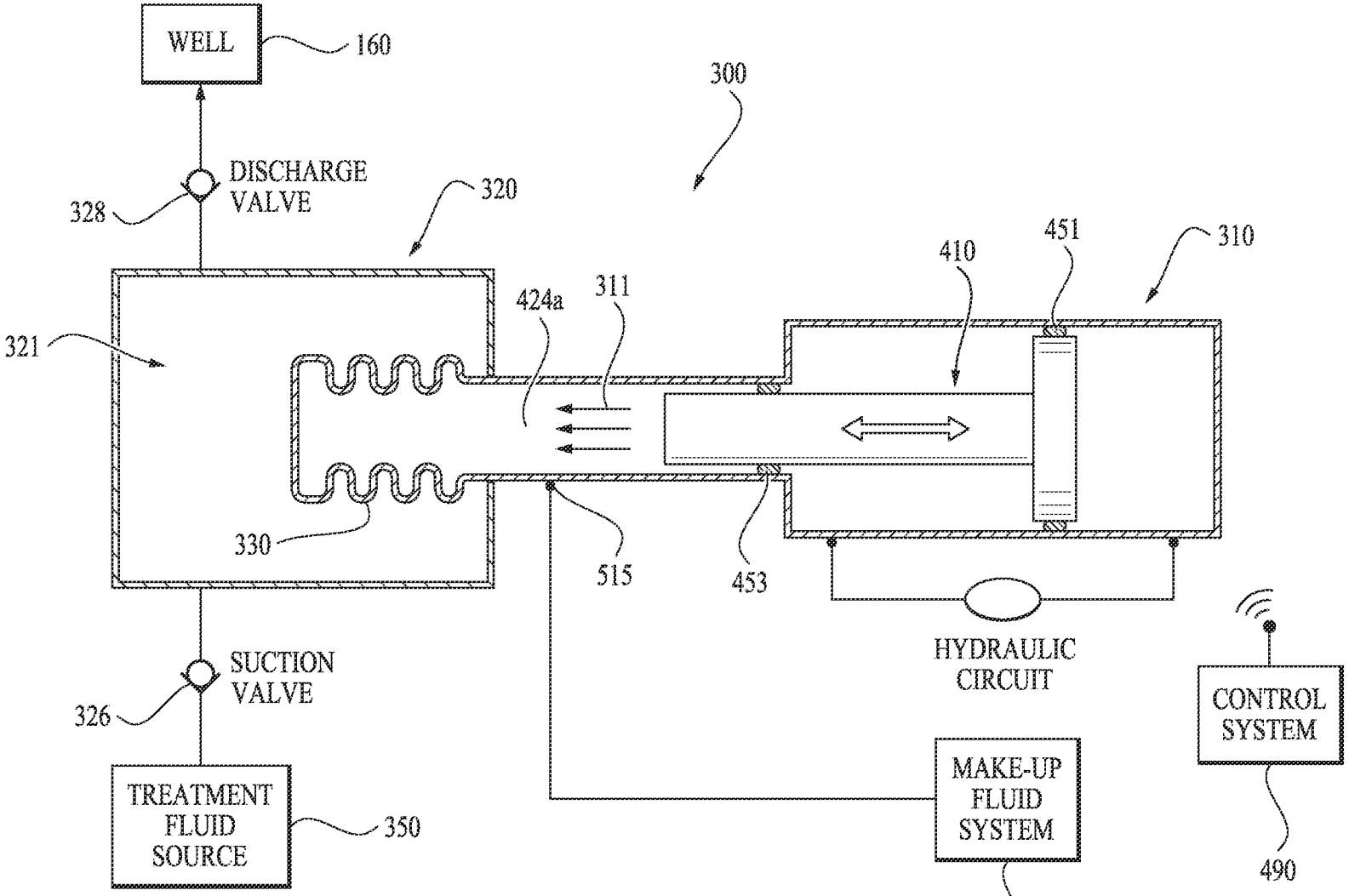
FIG. 5 is a schematic illustration of an exemplary system for providing make-up fluid to an exemplary bellows pump, according to an embodiment of the disclosure.

In order to address any such leak, a make-up system 510 (e.g. as shown schematically with an embodiment of pump 300 in FIG. 5) can be configured to correct/maintain a controlled volume of fluid in the space between the rod 414 and the bellows 330 (for example by injecting make-up fluid, which typically is drive fluid, into the space between the rod 414 and the bellows 330—e.g. into the sealed space formed by the rod seal 453, such as the third cavity 424*a*), in order to maintain synchronization between the bellows 330 and the piston 410. For example, the power end 310 may include a make-up port 515 (e.g. a third port), which may be in fluid communication with the second portion 424 of the bore 420 (e.g. the third cavity 424*a* between the rod 414 and/or rod seal 453 and the bellows 330). While the make-up port 515 is shown with respect to the power end 310 in FIG. 5, in other embodiments, the make-up port 515 may be disposed in the fluid end 320.

A source of make-up fluid may be in fluid communication with the make-up port 515, and the make-up system 510 may further comprise one or more make-up valve configured to open (to provide fluid communication therethrough) and close (to prevent fluid communication therethrough and/or isolate the make-up system 510 from the bellows 330). In some embodiments the make-up system 510 may include a make-up pump, which may be configured to pump make-up fluid from the make-up fluid source into the second portion 424 of the bore 420 through the make-up port 515. The control system 490 in some embodiments may be used to operate the make-up system 510, for example opening and closing the make-up valve and/or operating the make-up pump. In some embodiments, the control system 490 may comprise and/or communicate with one or more sensors, whose data the control system 490 can use to determine if the bellows 330 and piston 410 are out of sync and to operate the make-up system 510 to bring the bellows 330 and piston 410 back into sync. For example, the control system 490 may open the make-up valve and activate the make-up pump to inject make-up fluid into cavity 424*a* and/or to draw make-up fluid out of cavity 424*a* via make-up port 515, in order to bring the bellows 330 and the piston 410 back into sync.

In some embodiments, the pump 300 may be one of a plurality of similar pumps which may be configured to operate together/concurrently (e.g. configured to jointly pump fluid in the well 160 and/or which are jointly driven and/or which share a common drive fluid source and/or make-up fluid source and/or which are jointly controlled). For example, the plurality of pumps 330 may share a common source for treatment fluid, drive fluid, and/or make-up fluid. In some embodiments, the drive fluid and the make-up fluid may be drawn from a common fluid source (e.g. drive fluid and make-up fluid may be substantially the same). In some embodiments, the plurality of pumps 330 can share a common driver. In some embodiments, the plurality of pumps 330 may share a common control system 490. In some embodiments, one or more of the plurality of pumps 330 may be configured to be out-of-sync with one or more other of the plurality of pumps 330 (for example with a first pump undergoing a discharge stroke while a second pump undergoes a suction stroke). In some embodiments, having pumps of the plurality of pumps 330 out-of-sync with each other may allow for continuous pumping of treatment fluid (e.g. under approximately constant pressure). In some embodiments, a first half of the plurality of pumps may be in sync with each other, while a second half of the plurality of pumps may be in sync with each other but out of sync with the first half. In some embodiments, the plurality of pumps may comprise at least two dissimilar pumps.

Some embodiments may include a control system 490, which may be configured to monitor and/or control one or more aspects of the bellows pump 300 and/or related treatment system 100 (e.g. a system including at least one bellows pump 300). The control system 490 may include an information handling system (e.g. comprising one or more processor) and/or may be configured to receive data from one or more sensor configured to monitor/detect one or more parameters of the system. In some embodiments, the parameters monitored may include pressure, temperature, flow rate, viscosity, contamination/particle count, strain, valve position, piston position, bellows position, vibration and/or acoustics (which could be used to give a general idea something is wrong in the fluid chamber), and/or hydraulic gain (e.g. with hydraulic gain control also potentially picking up if something is wrong in the system). Data from the sensor(s) may be transmitted to and/or received by the information handling system, for example with the control system 490 using the data to monitor and/or control one or more aspect of the bellows pump 300 and/or system 100. In embodiments, the control system 490 may be configured to communicate with sensors and/or other components of the pump or system wirelessly and/or via wired connection.

Figure 6:
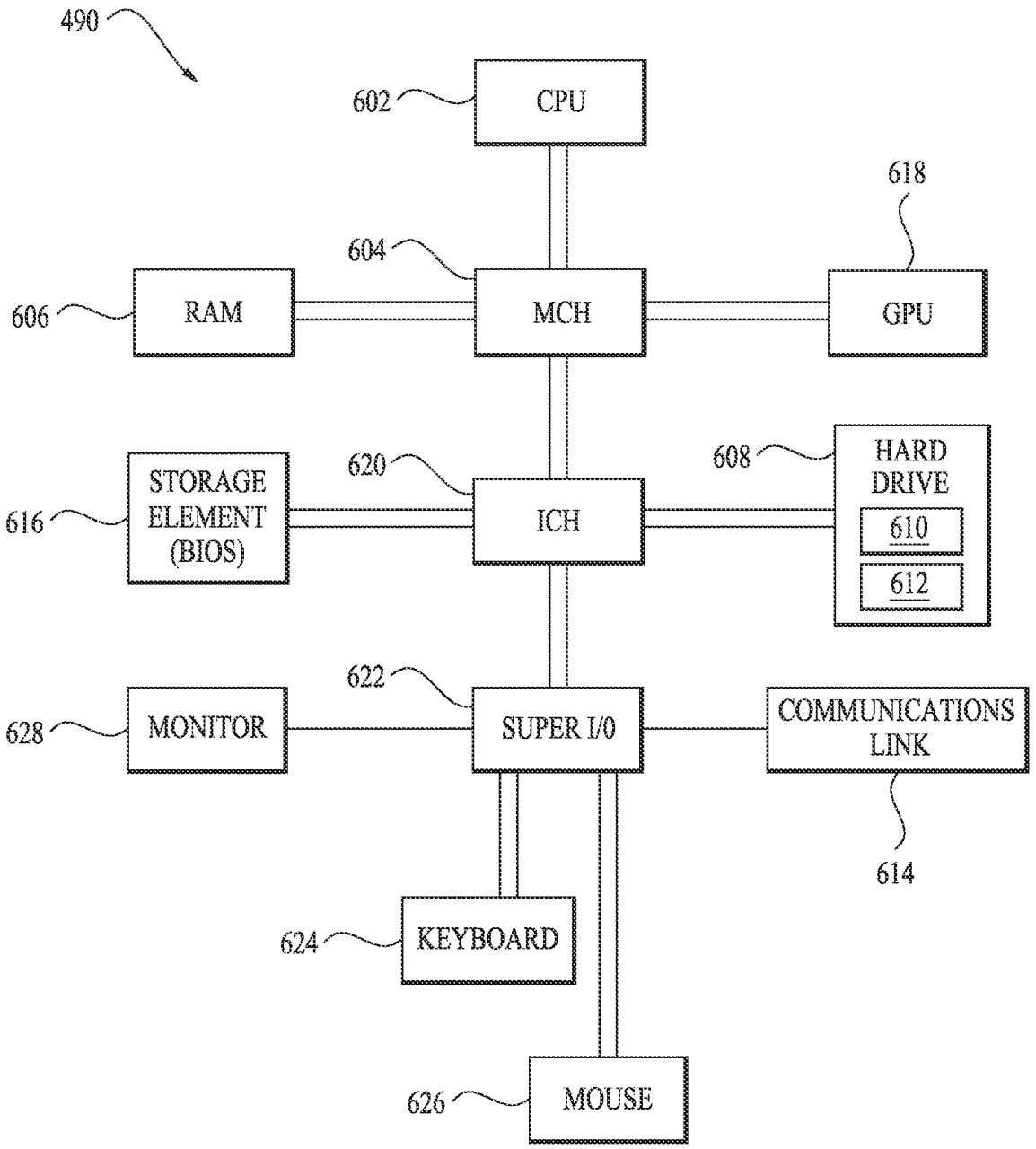
FIG. 6 is a schematic illustration of an exemplary control system, which may be used in conjunction with a bellows pump system, according to an embodiment of the disclosure.

FIG. 6 is a schematic diagram illustrating an exemplary information handling system/control system 490, for example for use with or by an associated treatment system 100 of FIG. 1, according to one or more aspects of the present disclosure. A processor or central processing unit (CPU) 602 of the control system 490 is communicatively coupled to a memory controller hub (MCH) or north bridge 604. The processor 602 may include, for example a microprocessor, microcontroller, digital signal processor (DSP), application specific integrated circuit (ASIC), or any other digital or analog circuitry configured to interpret and/or execute program instructions and/or process data. Processor 602 may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory 606 or hard drive 608. Program instructions or other data may constitute portions of a software or application, for example application 610 or data 612, for carrying out one or more methods described herein. Memory 606 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 610 or data 612 may be retrieved and stored in memory 606 for execution or use by processor 602. In one or more embodiments, the memory 606 or the hard drive 608 may include or comprise one or more non-transitory executable instructions that, when executed by the processor 602, cause the processor 602 to perform or initiate one or more operations or steps. The information handling system 600 may be pre-programmed or it may be programmed (and reprogrammed) by loading a program from another source (for example, from a CD-ROM, from another computer device through a data network, or in another manner).

The data 612 may include treatment data, geological data, fracture data, microseismic data, sensor data, or any other appropriate data. In one or more embodiments, the data 612 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 612 may include geological data relating to one or more geological properties of the subterranean formation 202 (referring to FIG. 2). For example, the geological data may include information on the wellbore 204 (referring to FIG. 2), completions, or information on other attributes of the subterranean formation 202. In one or more embodiments, the geological data may include information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 612 may include fracture data relating to fractures in the subterranean formation 202. The fracture data may identify the locations, sizes, shapes, and other properties of fractures in a model of a subterranean zone. The fracture data may include information on natural fractures, hydraulically-induced fractures, or any other type of discontinuity in the subterranean formation 202. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

In embodiments, the sensor data may include data measured/detected by one or more sensors, for example with relation to one or more aspect of the pump 300 and/or the system 100. For example, the sensor data may include pressure (e.g. at the fluid end 320 and/or the power end 310), temperature (e.g. at the fluid end 320 and/or power end 310 and/or make-up system 510), flow rate (e.g. within the fluid end 310 and/or hydraulic circuit 430 and/or the make-up system 510), viscosity (e.g. of treatment fluid in the fluid end 320 and/or drive fluid in the power end 310), contamination/particle count (e.g. at the fluid end 320 and/or power end 310 and/or in the make-up system 510), strain (e.g. at the fluid end 320 and/or power end 310), suction valve 326 and/or discharge valve 328 position, piston position, and/or bellows position. Data received by the control system 490 (e.g. from one or more sensors) may be used to carry out operations with respect to the pump 300 and/or system 100. For example, the control system 490 may evaluate the data and determine one or more action based on the evaluation. In some embodiments, the control system 490 may automatically take action based on the evaluation.

The one or more applications 610 may comprise one or more software applications, one or more scripts, one or more programs, one or more functions, one or more executables, or one or more other modules that are interpreted or executed by the processor 602. For example, the one or more applications 610 may include a fracture design module, a reservoir simulation tool, a hydraulic fracture simulation model, or any other appropriate function block. The one or more applications 610 may include machine-readable instructions for performing one or more of the operations related to any one or more embodiments of the present disclosure. The one or more applications 610 may include machine-readable instructions for generating a user interface or a plot, for example, illustrating fracture geometry (for example, length, width, spacing, orientation, etc.), pressure plot, hydrocarbon production performance, pump performance. The one or more applications 610 may obtain input data, such as treatment data, geological data, fracture data, or other types of input data, from the memory 606, from another local source, or from one or more remote sources (for example, via the one or more communication links 614). The one or more applications 610 may generate output data and store the output data in the memory 606, hard drive 608, in another local medium, or in one or more remote devices (for example, by sending the output data via the communication link 614).

Memory controller hub 604 may include a memory controller for directing information to or from various system memory components within the information handling system 600, such as memory 606, storage element 616, and hard drive 608. The memory controller hub 604 may be coupled to memory 606 and a graphics processing unit (GPU) 618. Memory controller hub 604 may also be coupled to an I/O controller hub (ICH) or south bridge 620. I/O controller hub 620 is coupled to storage elements of the information handling system 600, including a storage element 616, which may comprise a flash ROM that includes a basic input/output system (BIOS) of the computer system. I/O controller hub 620 is also coupled to the hard drive 608 of the information handling system 600. I/O controller hub 320 may also be coupled to an I/O chip or interface, for example, a Super I/O chip 622, which is itself coupled to several of the I/O ports of the computer system, including a keyboard 624, a mouse 626, a monitor (or other display) 628 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 6 without departing from the scope of the present disclosure. For example, FIG. 6 shows a particular configuration of components of control system 490. However, any suitable configurations of components may be used. For example, components of control system 490 may be implemented either as physical or logical components. Furthermore, in some embodiments, functionality associated with components of control system 490 may be implemented in special purpose circuits or components. In other embodiments, functionality associated with components of control system 490 may be implemented in configurable general-purpose circuit or components. For example, components of control system 490 may be implemented by configured computer program instructions.

In a bellows-style pump, detecting leakage with respect to the bellows can be important, for example for pump durability and life. Bellows-style pumps may be prone to fatigue failure or mechanical or hydraulic damage, for example due to high-pressure drive fluid that expands the bellows and which, over time, may result in damage or wear of the bellows in the bellows pump. Such damage or wear of the bellows may allow the high-pressure pumped treatment fluid to leak through the barrier provided by the bellows, potentially entering the bellows and thereby causing contamination of the drive fluid of the power end of the bellows pump (which could, in turn, cause further damage to the pump). Additionally, such damage or wear of the bellows may allow drive fluid to leak out of the bellows, escaping containment and potentially causing damage to the bellows during pumping operations due to resulting pressure imbalances in the pump. Early and effective leakage detection can prevent costly damage.

Disclosed embodiments may provide mechanisms for sensing, detecting, and/or monitoring this type of issue (e.g. leakage with respect to the bellows, which may be indicative of wear and/or damage to the bellows), which may be used to dynamically and/or in real time indicate the wearing of the bellows. Disclosed embodiments may relate to a bellows pump system in which the bellows is configured to form an annulus, such that fluid in the annulus may be monitored in order to detect leakage. For example, a double-walled bellows may include an annulus between the walls, and the annulus may be in fluid communication with a port. Detection of fluid at the port may be indicative of leakage (either into or out of the bellows), and one or more action may be taken in response to such fluid detection.

Figure 7:
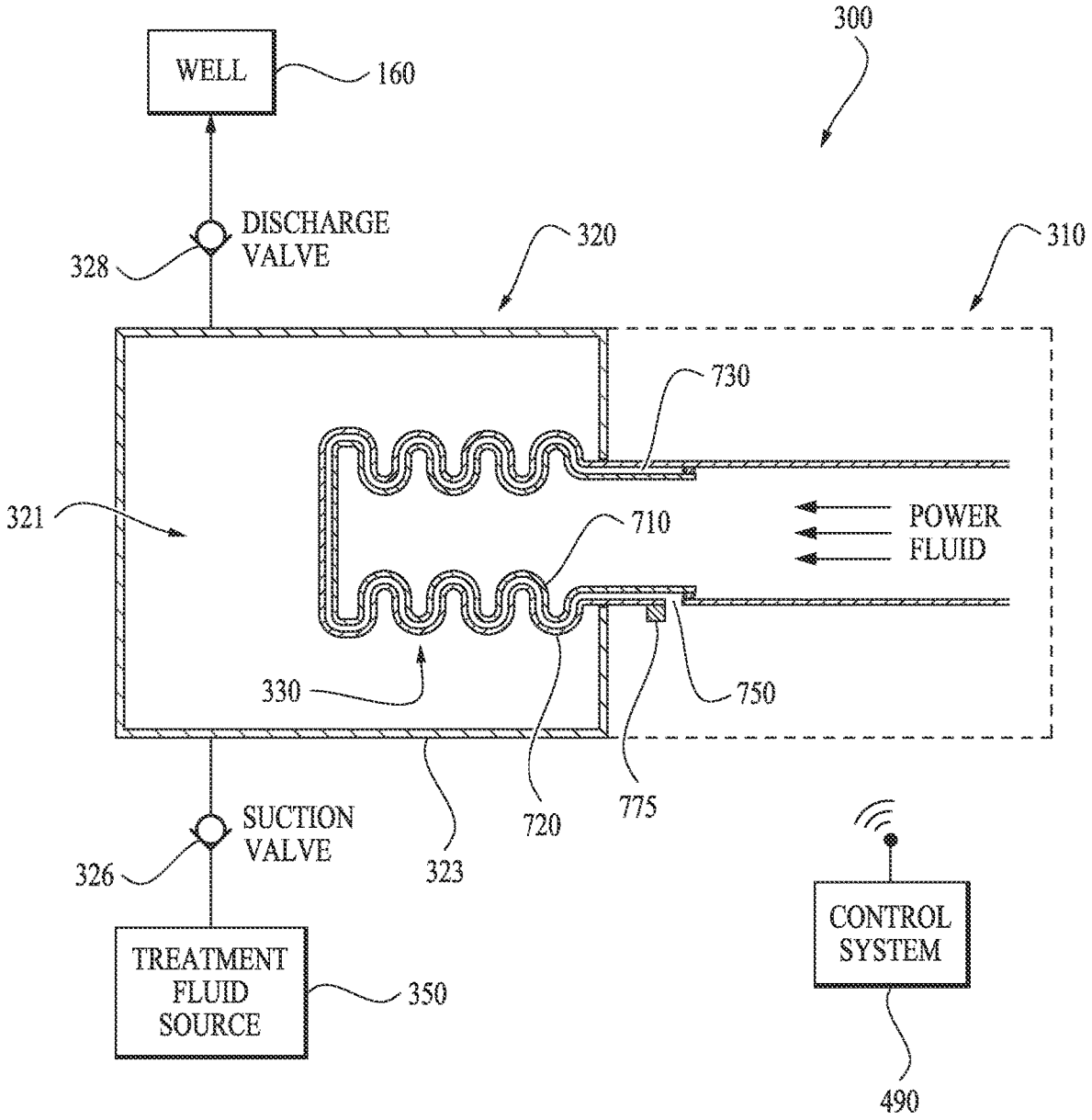
FIG. 7 is a schematic illustration of an exemplary bellows pump having a double-walled bellows, according to an embodiment of the disclosure.

FIG. 7 is a schematic illustration of an exemplary bellows pump 300 with double-walled bellows 330, according to one or more aspects of the present disclosure. The bellows pump 300 embodiment of FIG. 7 comprises an expandable double-walled bellows 330, which may be configured to extend into a chamber 321 of a fluid end 320 of the pump 300 based on application of drive fluid therein (e.g. from the power end 310 of the pump 300). In some embodiments, the double-walled bellows 330 may include an inner wall 710, enclosing an inner volume, and an outer wall 720 enclosing/surrounding/encompassing the inner wall 710. An annulus 730 (e.g. an annular space) is disposed/formed between the inner wall 710 and the outer wall 720 of the bellows 330, and the annulus 730 is in fluid communication with a port 750 (which in some embodiments may comprise a weep hole).

In embodiments, the annulus 730 may be configured to provide a sealed annular space between the inner wall 710 and the outer wall 720 of the bellows 330 with no fluid communication out (e.g. no fluid communication between the annulus 730 and an external environment) except via the port 750. In some embodiments, the annulus 730 is configured so that there is fluid connection between any portion of the annulus 730 and the port 750 (e.g. so that any fluid entering the annulus 730 (e.g. via leak) can move to the port 750. In some embodiments, the port 750 may be disposed in the housing of the power end 310 of the pump 300, while in other embodiments the port 750 may be disposed in the housing 323 for the fluid end 320 (e.g. external to the chamber 321).

In some embodiments, the inner wall 710 and outer wall 720 may be substantially uncoupled (e.g. not coupled together) within the chamber 321 (e.g. the portions of the inner wall 710 and the outer wall 720 disposed in the chamber 321 may be substantially uncoupled). In some embodiments, the annulus 730 may have an open space between the entirety (e.g. the entire portion) of the inner wall 710 and the outer wall 720 which is disposed in the chamber 321. In some embodiments, the inner wall 710 may be sealingly coupled to an interior surface of the outer wall 720, for example in proximity to the port 750 (e.g. with the port 750 disposed axially between the coupling of the inner wall 710 to the outer wall 720 and the chamber 321), in proximity to an opening in the bellows 330 configured to allow fluid flow between an inner volume of the bellows 330 and the power end 310 of the pump 300, and/or in proximity to or within the power end 310 (and in some embodiments, this may be the only coupling of the inner wall 710 to the outer wall 720). In other embodiments, the inner wall 710 may be coupled (e.g. at selective locations) to the outer wall 720 of the bellows 330 at other selective locations (e.g. within the chamber 321, in addition to coupling at their open ends), so long as one or more fluid pathways to the port 750 exist within the annulus 730 (e.g. so long as there is fluid connection between any portion of the annulus 730 and the port 750). In some embodiments, the majority (e.g. approximately 51-100%, 70-100%, 75-100%, 80-100%, 85-100%, 90-100%, 95-100%, 98-100%, 75-95%, 85-95%, 90-95%, 90-98%, or 95-98%) of the inner wall and the outer wall disposed in the chamber may be uncoupled (e.g. providing an inner wall 710 that is substantially uncoupled to the outer wall 720). In some embodiments, the open ends of the bag-like inner and outer walls 710, 720 may be sealingly coupled together in proximity to their open ends. In some embodiment, the outer wall 720 and/or the inner wall 710 may be coupled to the power end 310 (e.g. to a bore 420—see FIG. 4 for example—disposed in the power end 310). For example, some portion of the bellows 330 may extend into the power end 310 and be configured to receive drive fluid from the power end 310.

In some embodiments, the annulus 730 may be configured such that any fluid communication of drive fluid from the inner volume to the annulus 730 would be via a leak in the inner wall 710, and any leak of treatment fluid from the chamber 321 to the annulus 730 would be via leak in the outer wall 720. The annulus 730 may be configured so that any leak of fluid into the annulus 730 would be in fluid communication with the port 750. By having the port 750 in fluid communication with the annulus 730, the port 750 may be configured for leak detection. In some embodiments, leak detection may be via visual inspection (e.g. manual inspection by personnel at a weep hole). In some embodiments, one or more sensor 775 may be disposed in proximity to (e.g. proximate to, adjacent to, and/or abutting) the port 750, and the one or more sensor 775 may be configured to detect and/or monitor for leakage. For example, the one or more sensor 775 may be configured to detect/sense in the port (e.g. directed at or into the port, for example to detect with respect to any fluid leakage in the port and/or via the port).

In some embodiments, the annulus 730 may be configured to retain any leakage of drive fluid from the inner volume and/or to retain any leakage of treatment fluid (e.g. from the fluid end 320 of the pump 300, such as the chamber 321) into the bellows 330 (e.g. through the outer wall 720). In some pump 200 embodiments, the one or more sensor 775 may comprise a fluid sensor (e.g. in proximity to the port 750 and/or configured to detect the presence of fluid), such as a pressure sensor (e.g. a pressure transducer) and/or a contact (e.g. conduction) sensor. In some pump 300 embodiments, the one or more sensor 775 may comprise a contamination sensor (e.g. in proximity to the port 750 and/or configured to detect contaminants). In some embodiments, the contamination sensor may be configured to detect anything that is not drive fluid (e.g. detecting whether the fluid is or is not drive fluid or treatment fluid, thereby allowing for the type of leak to be identified). In some embodiments, the contamination sensor may be configured to detect the presence of particulates, solids, etc. in the fluid. In embodiments, the fluid sensor and/or contamination sensor may be included within the one or more sensor 775. In another embodiment, the annulus 730 may be filled with a fluid. For example, the fluid may be drive fluid or a third fluid with at least one property that is detectably different than the treatment fluid and the drive fluid (an example may be a fluid with a different conductivity). In such a case the detectable property would change when contaminated with either the treatment fluid or the drive fluid.

Typically, the inner wall 710 of the bellows 330 may be configured to be at least as expandable and contractible and/or at least as flexible as the outer wall 720. For example, the inner wall may be configured so that it will not restrain expansion and/or contraction of the expandable outer wall (e.g. during billows pumping movement). In some embodiments, the inner wall 710 and the outer wall 720 can be formed of the same/similar material. For example, in some embodiments both the inner wall 710 and the outer wall 720 may comprise a thin metal body (e.g. bag-like and/or formed of thin metal sheeting) having an accordion-like configuration (e.g. with pleats or convolutions configured to allow for expansion and/or contraction of the bellows 330). In some embodiments, both the inner wall 710 and the outer wall 720 may comprise an elastomer (e.g. configured to allow for expansion and/or contraction of the bellows 330). In some embodiments, both the inner wall 710 and the outer wall 710 may be formed of the same elastomeric material, while in other embodiments they may be formed of different elastomeric materials.

In some embodiments, the inner wall 710 and the outer wall 720 may be formed of different materials. For example, a first one of the inner wall 710 and the outer wall 720 may be formed of metal having an accordion-like configuration (e.g. similar to the discussion above), and a second one of the inner wall 710 and the outer wall 720 may be formed of an elastomeric material. For example, the outer wall 720 may be formed of metal having an accordion-like configuration, and the inner wall 710 may be formed of an elastomeric material. In some embodiments, the inner wall 710 may comprise an elastomeric liner (as discussed in more detail with respect to FIG. 8). In alternate embodiments, the outer wall 720 may be formed of an elastomeric material, and the inner wall 710 may be formed of metal having an accordion-like configuration. In embodiments, the elastomeric material of any walls of the bellows 330 (e.g. for the inner wall 710 and/or outer wall 720) may comprise one or more selected from the following: natural rubber, polyisoprene rubber, butyl rubber, chloroprene rubber, ethylene propylene diene rubber (EPDM), styrene butadiene rubber, silicone, urethanes, and combinations thereof.

In some embodiments, the inner wall 710 (e.g. the elastomeric liner) may be configured to be removable/replaceable (e.g. from within the outer wall 720 of the bellows 330). In some embodiments, the elastomeric material may be fatigue and/or abrasion resistant. In some embodiments, an interior surface of the outer wall 720 and/or an exterior surface of the inner wall 710 may include a low-friction material/coating (e.g. grease, PTFE, or other lubricant) and/or may be configured to minimize friction due to rubbing interaction of the inner and outer walls. 710, 720

Typically, the expandable bellows 330 may be configured to extend into the fluid end 320 of the pump 300, for example into the chamber 321 within the fluid end housing 323 having a suction valve 326 (in fluid communication with a treatment fluid source 350) and a discharge valve 328 (in fluid communication with a well). The pump 300 may also include a power end 310 in fluid communication with (e.g. fluidly coupled to) the bellows 330, which may be configured to apply (e.g. reciprocally) the drive fluid within the bellows 330. In some embodiments, the power end 310 may include a piston 410 (for example, as in FIG. 4) configured to reciprocally move fluid with respect to the bellows 330 (e.g. its inner volume), to expand/inflate the bellows 330 (e.g. on its discharge stroke) and to compress/deflate/retract the bellows 330 (e.g. on its suction stroke). For example, the piston 410 may translate axially within a bore 420 of the power end 310 which is in fluid communication with the inner volume within the bellows 330. In some embodiments, the piston 410 may be configured to not extend into the bellows 330 (e.g. during its discharge stroke, the piston 330 will not extend beyond the point of attachment of the inner wall 710 to the outer wall 720 of the bellows 330). In other embodiments, the piston 410 may be configured to (e.g. during its discharge stroke) partially extend into the bellows 330 (e.g. beyond the point of attachment of the inner wall 710 to the outer wall 720), but not to contact the bellows 330

(e.g. the piston 410 will not contact the inner wall 710 at the far end of the bellows 330 away from the power end 310). In some embodiments, the piston 410 may be part of or may be driven by an intensifier (e.g. configured to intensify applied pressure from the driver mechanism to the bellows 330, as discussed above in more detail-see for example FIG. 4). And as discussed above, different types of driver mechanisms may be used for the bellows pump 300.

As discussed above, the pump 300 may in some embodiments include a control system 490. For example, the control system 490 may be configured to receive data from the one or more sensor 775, compare the data to a corresponding threshold, and responsive to the data exceeding the threshold, initiate an action. In some embodiments, if any fluid is detected, action may be initiated (e.g. the threshold for fluid detection can be any measured fluid in the annulus). In some embodiments, there may be two or more different thresholds, and in some embodiments exceeding the different thresholds may result in different actions. For example, at a first/lower threshold, the control system 490 may send an alert, while at a second/higher threshold, the control system 490 may stop pumping (e.g. stopping movement of the piston and/or bellows and/or treatment fluid). In some embodiments, the action may comprise sending an alert and/or or stopping pumping (e.g. of treatment fluid into the well). In some embodiments, the control system 790 may be configured to evaluate the type of fluid detected by the one or more sensor 775 (e.g. at the port 750 and/or within the annulus 730). For example, data from the contamination sensor (e.g. a conductivity sensor) may be used to determine whether the leak (e.g. the fluid detected in the annulus 730) is drive fluid or treatment fluid. In some embodiments, the alert may indicate whether the fluid leak is drive fluid or treatment fluid. In some embodiments, different actions may be taken (e.g. automatically by the control system 490) depending on the type of fluid detected.

Figure 8:
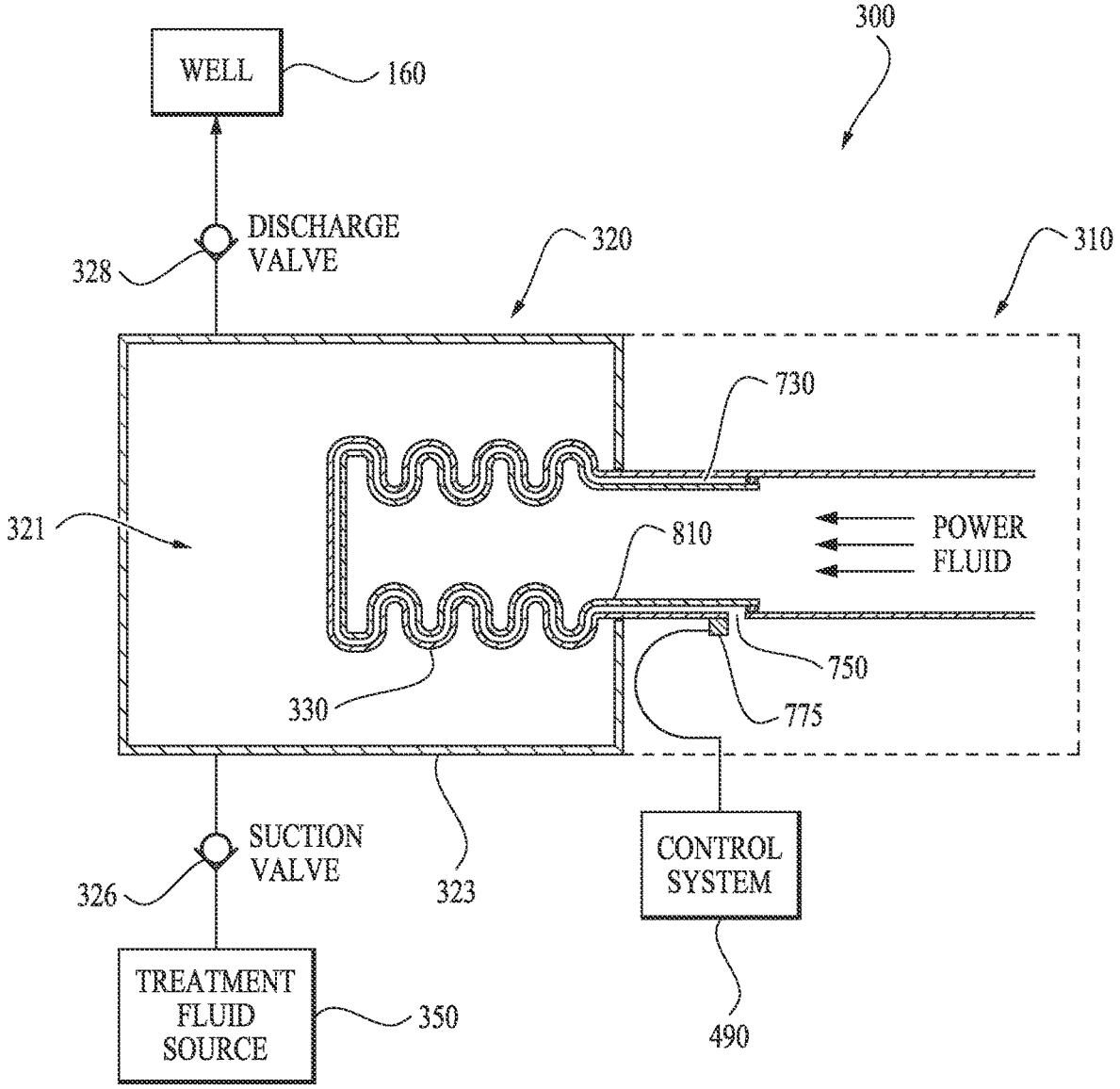
FIG. 8 is a schematic illustration of an exemplary bellows pump having a liner disposed within a bellows, according to an embodiment of the disclosure.

As mentioned above, in some embodiments, the double-walled bellows 330 (with annulus 730 between the walls) may be formed by having an elastomeric liner disposed within a bellows 330 (such as a single-walled bellows). FIG. 8 schematically illustrates an exemplary embodiment having an elastomeric liner 810 within a single-walled bellows 330. In some embodiments, the single-walled bellows 330 may be formed of a thin metal (e.g. a thin-sheeted hollow metal body) and/or have an accordion-like configuration. Generally, the embodiment depicted in FIG. 8 may function, operate, and/or be configured similarly to the exemplary embodiment shown in FIG. 7, for example with the inner wall 710 of FIG. 7 comprising (e.g. being formed by) the elastomeric liner 810 in FIG. 8, and the bellows 330 (e.g. single-walled bellows) shown in FIG. 8 forming the outer wall 720 discussed with respect to FIG. 7. The annulus 730 (e.g. annular space) can be disposed between the elastomeric liner 810 and the bellows 330 (and may be in fluid communication with the port 750, as discussed above). In embodiments, the elastomeric liner 810 may be loose or slip fit or unbonded within the bellows 330 (e.g. with the only coupling between the liner 810 and the bellows 330 being in proximity to their open ends and/or the port, and/or with the liner 810 being free to move within the bellows as the bellows reciprocally moves within the chamber).

In embodiments, the inner volume of the elastomeric liner 810 may be approximately the same (e.g. slightly less, due to the annulus) than that of the bellows 330. In embodiments, the elastomeric liner 810 may include or be formed of elastomeric material selected from the following: natural rubber, polyisoprene rubber, butyl rubber, chloroprene rubber, ethylene propylene diene rubber (EPDM), styrene butadiene rubber, silicone, urethanes, and combinations thereof. In embodiments, the elastomeric material may be fatigue and/or abrasion resistant. In some embodiments, the elastomeric liner 810 may be configured to be removable/replaceable. For example, the sealing coupling of the elastomeric liner 810 to the bellows 330 may be releasable. In some embodiments, the elastomeric liner 810 can extend out of the fluid end 320 (e.g. into the power end 310). In some embodiments, the elastomeric liner 810 may couple to the bellows 330 in proximity to or at the power end 310 (e.g. within the bore 420 of the power end 310). In some embodiment, in proximity to the port 750, the bellows 330 (e.g. outer wall 720) may couple to the power end 310 (e.g. the bore 420) and the elastomeric liner 810 (e.g. inner wall 710) may also couple to the power end 310 (e.g. the bore 420), with the points of attachment being axially displaced on either side of the port 750 (such that the annulus 730 is in fluid communication with the port 750). In some embodiments, the port 750 may be in fluid communication with the external environment (e.g. providing fluid communication therethrough between the annulus 730 and the external environment).

So in some embodiments (such as shown in FIG. 8), the elastomeric liner 810 may be added or placed within the inside of the bellows 330 (e.g. a conventional, single-walled bellows), to create the annulus 730 between the inner surface of the bellows 330 and the liner 810 (configured to contain drive fluid therein). In some embodiments, the elastomeric liner 810 may be loose, slip fit, or otherwise unbonded within the bellows 330 to create the annulus 730 structure. In certain embodiments, the elastomeric liner 810 may comprise multiple layers of the same material and/or different materials.

In some embodiments, the annulus 730 may be vented (e.g. at the port 750) in a manner that is visible from outside of the pump 300, e.g., by the operator. For example, the venting of the annulus 730 may be visible via a weep hole in the bellows 330. In some embodiments, the weep hole may be disposed in proximity to the bottom (e.g. downward with respect to gravitational orientation) of the bellows 330. In some embodiments, a vessel/container may be placed in proximity to the weep hole, for example to catch/collect any fluid exiting the annulus 730 through the weep hole. Any damage to the elastomeric liner 810 or the bellows 330 can cause the fluid presented at the weep hole (e.g. from the annulus 730) to leak out, which may indicate the failure of the bellows 330 and/or the liner 810. In some embodiments, the use of the elastomeric liner 810 within the inside of the bellows 330 may reduce or prevent contamination of the power end 310 drive fluid in the bellows 330 in the event of the failure of the bellows 330 or in the event of treatment fluid leakage. In some embodiments, the elastomeric liner 810 also may provide a layer of separation between the bellows 330 and the pressurized drive fluid in the pump 300, and early detection of any drive fluid leakage (e.g. in the annulus) may allow pumping to be stopped before there is damage to the bellows 330 and/or other pump 300 components (e.g. due to pressure imbalances).

In certain embodiments, the port 750 may be used as a slot for placing or coupling a sensor 775 (e.g. which may be directed into the port 750, for example towards any fluid coming from the annulus 730). As shown in FIG. 8, the port 750 may be located within the bellows 330 at or near an end (e.g. opening) of the elastomeric liner 810 (for example, in proximity to the coupling of the liner 810 to the bellows 330 and/or the power end housing/bore 420). However, in other embodiments the port 750 may be placed in other locations on the bellows 330. In some embodiments, the sensor 775 may include, but is not limited to, a pressure transducer or contact (conduction) type sensor. In certain embodiments, the sensor 775 may be configured to detect the presence and/or amount (e.g. including changes in the amount) of fluid or pressure near the annulus 730, which may be useful in assessing the health or wear and tear of the bellows 330. The detected information may be provided to the control system 490, which in some embodiments can display or provide the information to the operator or otherwise use the information to generate an alert, e.g., to the operator prompting the operator to take remedial measures with regard to the bellows pump 300. In some embodiments, the control system 490 may compare the detected information, e.g., information relating to the wear of the bellows 330, to a threshold value stored in the memory of the control system 490. This comparison may be used by the control system 490 to determine if the bellows 330 is sufficiently damaged to generate an alert and/or prompt other actions with regard to the system (some or all of which may be automated by the control system 490). In some embodiments, the alerts may automated pump 300 shutdown in the event of bellows 330 failure, among other reasons, to prevent additional failures of power end 310 components due to contamination of the power fluid in the bellows 330.

In certain embodiments, the port 750 may be given full visibility for monitoring visually or electronically. Any external leak point, such as a weep hole, may be monitored in real-time and alert the operator in the event of bellows 330 failure, for example to prevent catastrophic failure of power end 310 components due to contamination of the power fluid. In certain embodiments, one or more elastomeric liners 810 placed within the bellows 330 may help in preventing contamination of the power end fluid in the event of bellows 330 failure. Also, in certain embodiments of the present disclosure, a pressure transducer or fluid sensor may be placed at or near a weep hole or port 750 of the bellows-style pump 300 to detect a bellows 330 failure or potential failure (e.g. fluid leakage) and generate an electronic signal to an operator or automated operating system (e.g. control system 490) for indicating or alerting the bellows 330 failure or potential failure. Persons of skill will understand these and other bellows pump 300 embodiments based on the disclosure herein.

Disclosed embodiments also include exemplary methods for detecting leakage of a bellows pump 300, for example while the pump 300 is operating to pump treatment fluid into a well. For example, a method of detecting leakage in a bellows pump 300 may comprise: detecting fluid in an annulus 730 of an expandable double-walled bellows 330 (e.g. similar to the double-walled bellows pump embodiments disclosed herein). In some embodiments, detecting fluid in the annulus 730 may comprise visually inspecting a weep hole in fluid communication with the annulus 730. In other embodiments, detecting fluid in the annulus 730 may comprise detecting fluid via one or more sensor 775 in proximity to a port 750 in fluid communication with the annulus 730. In some embodiments, the one or more sensor 775 used for detection may include a fluid sensor and/or a contamination sensor.

Some method embodiments may further comprise comparing the detected fluid to a (e.g. corresponding) threshold, and taking action responsive to the detected fluid exceeding the threshold. For example, the control system 490 may receive data from the one or more sensor 775, compare the data to the threshold, and take action in response. In some embodiments, the method may further comprise using the bellows pump 300 to introduce/pump treatment fluid (e.g. fracturing fluid) into the well. In embodiments, the action taken (which may be performed, e.g. automatically, by a control system 490, for example receiving data from the one or more sensor) may be stopping introduction/pumping of treatment fluid and/or sending an alert (which may be visual or audio). In some embodiments, responsive to the detected fluid exceeding a first (e.g. lower) threshold, the action may be sending an alert; and responsive to the detected fluid exceeding a second (e.g. higher) threshold, the action may be automatically stopping movement of the bellows (e.g. stopping pumping of treatment fluid). In some embodiments, one or more action may be manual. In some embodiments, one or more action can be automatically taken by the control system 490 (e.g. configured to receive and/or analyze data from the one or more sensor 775).

Some method embodiments may also comprise placing the bellows pump 300 in fluid communication with the well (e.g. with the bellows pump 300 comprising the expandable double-walled bellows 330 having the annulus 730 between the walls 710, 720) and/or fluidly coupling a treatment fluid source 350 to the bellows pump 300 (e.g. such that pumping of the bellows pump 300 introduces treatment fluid from the treatment fluid source 350 into the well). In embodiments wherein the double-walled bellows at issue comprises an elastomeric liner 810 disposed within a single-walled bellows 330, then responsive to detecting fluid in excess of the threshold, the method can also comprise replacing the elastomeric liner 810 (e.g. removing the leaking liner from the single-walled bellows, placing a replacement liner within the bellows, and sealingly attaching the liner within the bellows).

In some embodiments, responsive to detecting a leak/fluid, the method may further comprise determining if the leak is or includes drive fluid or treatment fluid. In some embodiments, responsive to detecting a leak/fluid (e.g. and determining that the leak is drive fluid), the method may also include injecting drive fluid between the piston 410 and the bellows 330 (e.g. using a make-up system) to ensure that the bellows 330 and piston 410 are in sync. In some embodiments, responsive to detecting a leak/fluid (e.g. and determining that the leak is treatment fluid), the method may further include stopping pumping/introduction of fluid into the well. Such methods may be used in conjunction with any one of the double-walled bellows pumps 300 described herein.

Exemplary systems, including any one of the double-walled bellows pump 300 embodiments disclosed herein and/or implementing any one of the method embodiments herein, are also disclosed. For example, a system for pumping treatment fluid into a well may comprise: a bellows pump 300; a treatment fluid source 350; and a control system 490, wherein the pump 300 includes any one of the double-walled bellows pumps 300 disclosed herein. Some system embodiments may further comprise a driver for the power end 310 of the pump 300, which may be configured to induce reciprocating movement in the bellows 330 and/or the piston 410. The drive may include any type of driver mechanism configured to provide the reciprocal movement of the bellows 330, for example as discussed above. Some system embodiments may also comprise a make-up system 510 in fluid communication with the bellows 330 (e.g. the inner volume), as discussed generally above with more specific embodiments also discussed below.

In a bellows-style pump, detecting leakage with respect to the valves and/or bellows can also be important, for example for pump durability, reliability, maintenance, and life. Valve leakage may lead to less effective pumping of treatment fluid downhole in the well and/or may lead to damage to pump components (such as the bellows). For example, a pressure differential across the bellows (e.g. between the treatment fluid in the chamber of the fluid end and the drive fluid in the inner volume of the bellows) can result in damage to the bellows. Additionally, bellows-style pumps may be prone to fatigue failure or mechanical or hydraulic damage, for example due to high-pressure drive fluid that expands the bellows and which, over time, may result in damage or wear of the bellows in the bellows pump. Such damage or wear of the bellows may allow the high-pressure pumped treatment fluid to leak through the barrier provided by the bellows, potentially entering the bellows and thereby causing contamination of the drive fluid of the power end of the bellows pump (which could, in turn, cause further damage to the pump). Additionally, such damage or wear of the bellows may allow drive fluid to leak out of the bellows, escaping containment and potentially causing damage to the bellows during pumping operations due to resulting pressure imbalances in the pump (e.g. due to the bellows and the piston being out of sync). Early and effective leakage detection can prevent costly damage.

The disclosed embodiments may provide mechanisms for sensing, detecting, and/or monitoring this type of issue (e.g. leakage with respect to the valves of the fluid end and/or the bellows). Disclosed embodiments may relate to a bellows pump system in which one or more sensors disposed on one or more components of the pump can monitor for indications of valve leakage and/or bellows leakage (e.g. the bellows being out of sync with the piston). Analysis based on the sensor data may be used to determine valve and/or bellows leakage.

Figure 3:
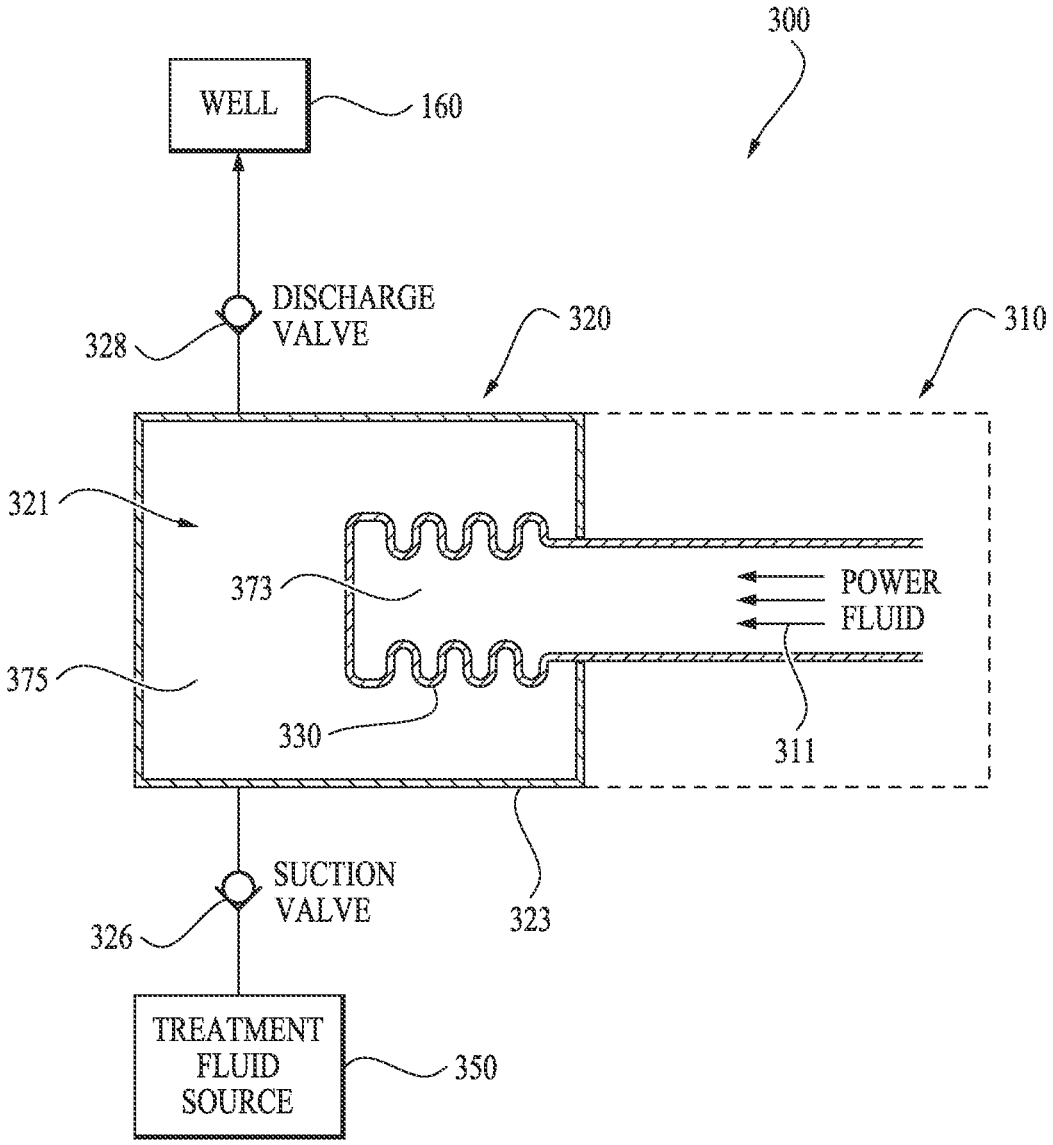
FIG. 3 is a schematic illustration of an exemplary bellows pump, according to an embodiment of the disclosure.
Figure 9:
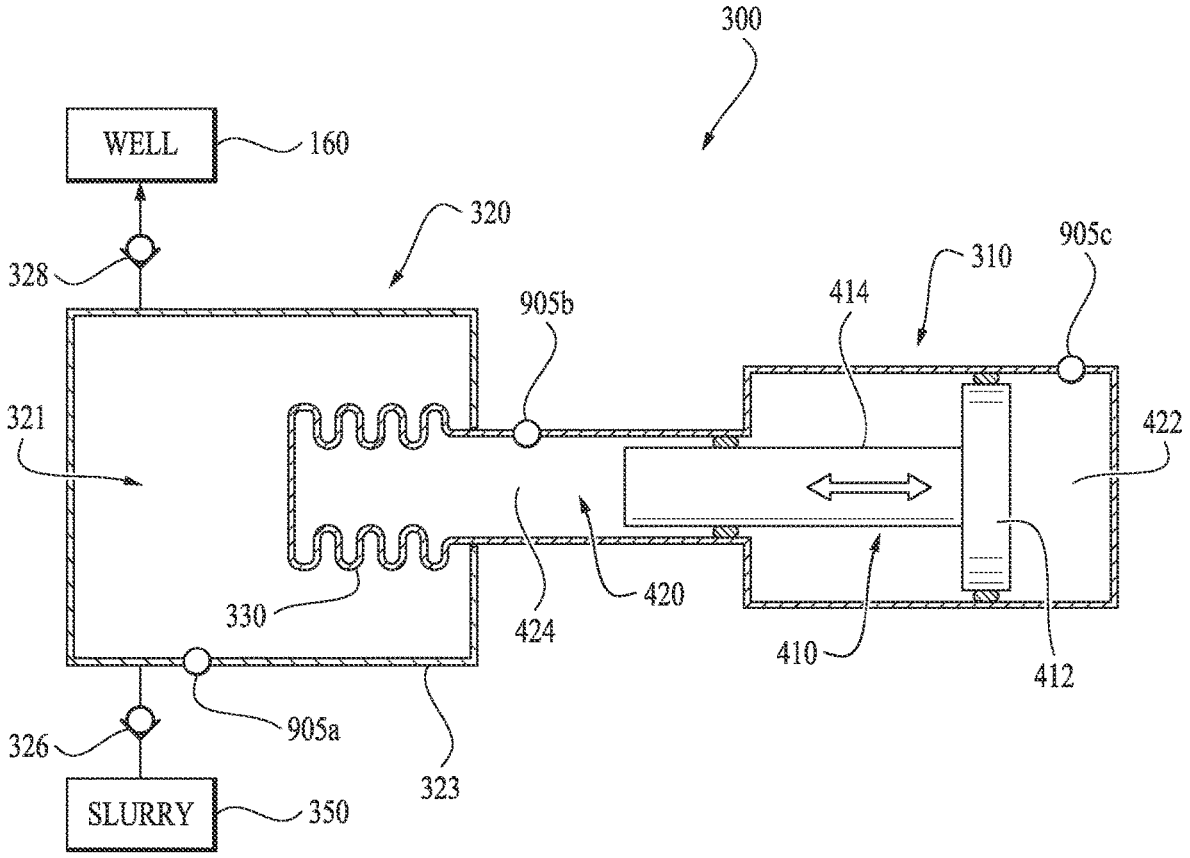
FIG. 9 is a schematic illustration of an exemplary bellows pump having one or more strain gauge, according to an embodiment of the disclosure.

FIG. 9 is a schematic illustration of an exemplary bellows pump 300 embodiment, similar to the pump embodiments shown in FIGS. 3-5, having one or more sensors configured to measure strain. For example, the pump 300 may have a power end 310, a fluid end 320, an expandable bellows 330, one or more sensors configured to measure strain (e.g. one or more strain gauge 905), and a control system 490 (e.g. similar to that discussed with respect to FIG. 4) which is configured to receive data from the one or more strain gauge 905 and to monitor for valve health. The fluid end 320 can have a fluid end housing 323 with a chamber 321, a suction valve 326 (e.g. in fluid communication with the chamber 321 and a source for the treatment fluid and/or configured for introduction of treatment fluid into the chamber 321), and a discharge valve 328 (e.g. in fluid communication with the chamber 321 and the well and/or configured for injection of treatment fluid from the chamber 321 into a well). The power end 310 in FIG. 9 is configured to reciprocally expand/inflate and contract/deflate the bellows 330 based on movement of drive fluid and/or the bellows 330 is configured to expand within the chamber 321 of the fluid end 320 based on movement of the drive fluid. Typically, the suction valve 326 may be a one-way check valve configured to allow treatment fluid from the treatment fluid source to enter the chamber 321 (e.g. during a suction stroke of the pump 300), while preventing treatment fluid from exiting the chamber 321 therethrough, and the discharge valve 328 may be a one-way check valve configured to allow treatment fluid to exit the chamber 321 (e.g. during a power stroke of the pump 300), while preventing treatment fluid from entering the chamber 321 therethrough.

In some embodiments, the power end 310 may include a piston 410 configured to reciprocally move drive fluid (e.g. in and out of the bellows 330), for example similar to that in FIG. 4. For example, the piston 410 may be disposed within a bore 420 in the power end 310, and the bore 420 may be in fluid communication with the bellows 330 (e.g. an internal volume of the bellows). In some embodiments, the piston 410 may have a head 412 and a rod 414 (e.g. with the rod 414 extending from the head 412 and being disposed between the head 412 and the bellows 330). In some embodiments, the rod 414 can have a smaller diameter than the head 412. In some embodiments, the bore 420 may include a first portion 422 with an inner diameter configured for movement of the head 412 (axially) therethrough and a second portion 424 with an inner diameter configured for movement of the rod 414 (axially) therethrough. For example, the head 412 may be configured to sealingly move within the first portion 422 of the bore 420 (e.g. during pump strokes), and the rod 414 may be configured to sealingly move within the second portion 424 of the bore 420 (e.g. during pump strokes). In some embodiments, a first seal disposed on the head 412 can be a moving seal, and a second seal disposed within the second portion of the bore 414 can be a stationary seal. It should be noted that the embodiment shown in FIG. 9 may include a hydraulic circuit as the driver mechanism for the piston 410 (e.g. similar to FIG. 4), but other embodiments may use a different driver mechanism for the piston 410 or may not use a piston at all (but instead may have another mechanism to reciprocally move fluid in and out of the bellows 330).

In some embodiments, the one or more strain gauge 905 can be disposed in the fluid end 320 and/or on (e.g. configured to measure strain in) the fluid end housing 323 (e.g. in the chamber wall, a slurry valve housing, a bellows housing, or a manifold member between the valve housing and the bellows) and/or in the power end 310 and/or on the power end housing (e.g. with respect to the first portion of the bore 420 and/or the second portion of the bore 420). For example, FIG. 9 illustrates several exemplary locations for one or more the strain gauge 905 to be located (see for example 905*a* illustrating a strain gauge 905 at an exemplary location on the chamber housing 323, 905*b* illustrating a strain gauge 905 at an exemplary location in the second portion 424 of the bore 420, and 905*c* illustrating a strain gauge 905 in the first portion 422 of the bore 420). In some embodiments, the one or more strain gauge 905 may be only one strain gauge (for example, located at one of the positions 905*a, b, c*). In other embodiments, the one or more strain gauge 905 may include a first strain gauge 905 on the fluid end 320 (e.g. similar to position 905*a*) and a second strain gauge 905 on the power end 310 (e.g. similar to 905*b* or 905*c*). In some embodiments, the one or more strain gauge 905 may be externally mounted (e.g. on the fluid end housing and/or the power end housing), which may provide easier access to the one or more strain gauge 905 and/or protect the one or more strain gauge 905 from exposure to pressure, contaminants, etc.

Figure 10A:
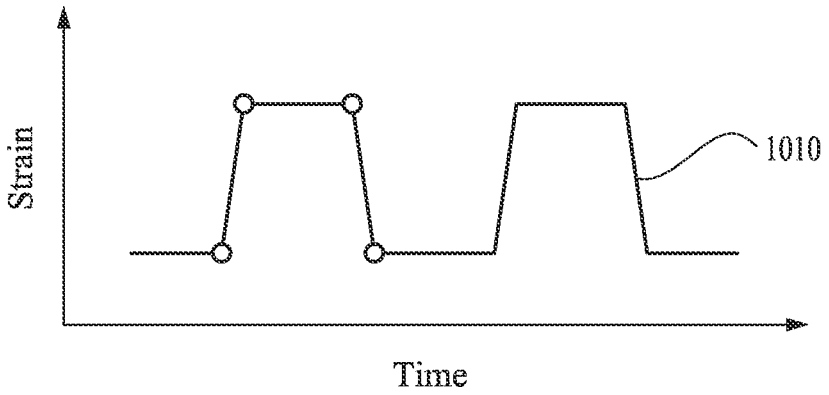
FIG. 10A is a chart illustrating exemplary strain gauge data from the one or more strain gauge of FIG. 9 (e.g. when the pump valves are healthy), according to an embodiment of the disclosure.
Figure 10B:
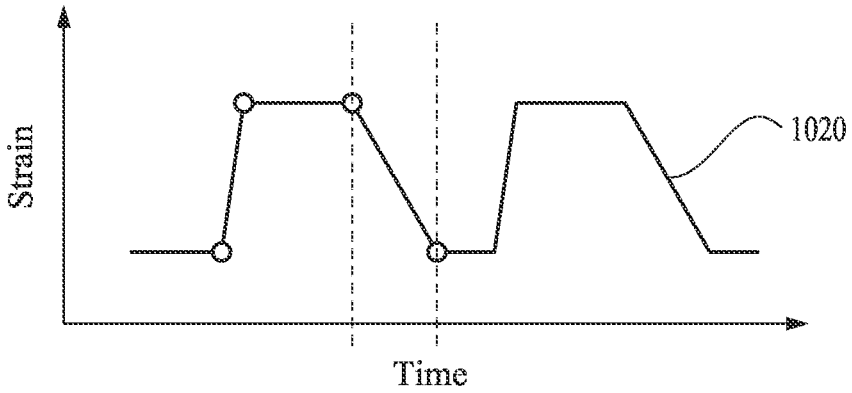
FIG. 10B is a chart illustrating exemplary strain gauge data from the one or more strain gauge of FIG. 9 (e.g. when the discharge valve is leaking), according to an embodiment of the disclosure.
Figure 10C:
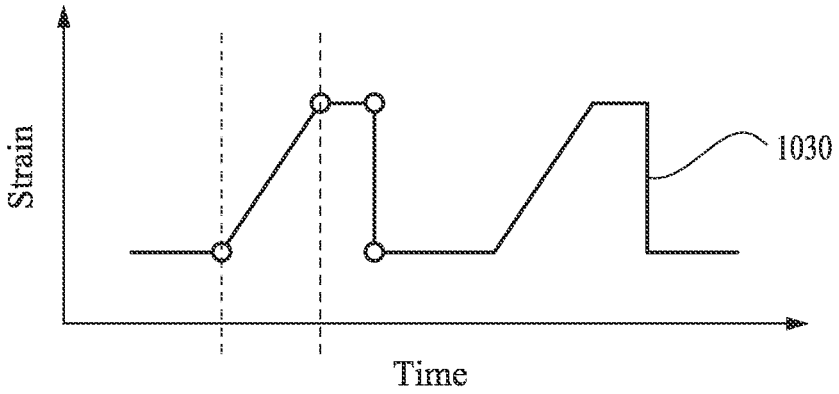
FIG. 10C is a chart illustrating exemplary strain gauge data from the one or more strain gauge of FIG. 9 (e.g. when the suction valve is leaking), according to an embodiment of the disclosure.

The one or more strain gauge 905 each measures strain, for example sending strain data to the control system 490. In some embodiments, the control system 490 may include a monitor configured to visually display the data from the one or more strain gauge 905. FIGS. 10A-C illustrate exemplary strain data charts, which may be useful in detecting valve leakage. For example, FIG. 10A illustrates an exemplary normal strain data chart with a strain signal 1010 for a healthy pump 300 in which the suction valve 326 and discharge valve 328 are operating properly. FIG. 10B illustrates an exemplary strain data chart with a strain signal 1020 in which the discharge valve 328 is leaking, creating a longer strain decay from peak over time (e.g. for each strain cycle). For example, in FIG. 10B, the strain decay from peak takes a longer period of time (for example, compared to FIG. 10A). FIG. 10C illustrates an exemplary strain data chart with a strain signal 1030 in which the suction valve 326 is leaking, creating a longer strain rise to peak over time (e.g. for each strain cycle). For example, in FIG. 10C, the strain rise to peak takes a longer period of time (for example, compared to FIG. 10A). An operator may be able to see valve issues when the strain sensor data is visually displayed.

Alternatively, the strain data may be similarly used, for example by the control system 490, to determine valve leakage. For example, strain decay from peak may be monitored, e.g. by the control system 490, as an indicator of discharge valve 328 health/leakage. In some embodiments, strain decay from peak (e.g. the amount of time it takes for strain to decay from peak level to valley/base level) exceeding a corresponding (e.g. strain decay from peak) threshold can be indicative of a discharge valve 328 leak. In some embodiments, the strain decay from peak threshold may be pre-set, for example based on historical data. In some embodiments, strain decay from peak analysis may be based on the slope of strain versus time (e.g. the steepness and/or the rate of change of the slope).

In some embodiments, strain rise to peak may be monitored, e.g. by the control system 490, as an indicator of suction valve 326 health/leakage. In some embodiments, strain rise to peak (e.g. the amount of time it takes for strain to rise from floor/valley/base/low level to peak level) exceeding a corresponding (e.g. strain rise to peak) threshold can be indicative of a suction valve 326 leak. In some embodiments, the strain rise to peak threshold may be pre-set, for example based on historical data. In some embodiments, strain rise to peak analysis may be based on the slope (e.g. the steepness and/or rate of change of the slope).

Some embodiments may include a plurality of strain gauges 905. For example, a first strain gauge 905*a* may be disposed on the fluid end 320 and a second strain gauge (e.g. either 905*b* or 905*c*) may be disposed on the power end 310. In embodiments, offset between the first strain gauge data and the second strain gauge data may be monitored by the control system 490. In some embodiments, the pump 300 can be one of a plurality of similar pumps (e.g. configured to jointly pump fluid downhole in the well and/or jointly driven-see for example FIG. 18), wherein the control system 490 (e.g. for all of the plurality of pumps) compares strain data from the plurality of pumps and initiates action only in the event that one of the plurality of pumps 300 is more than a pre-set percentage from the mean/average of the plurality of pumps (e.g. indicting too much drift). For example, the threshold(s) can be set based on comparative data from the plurality of pumps (e.g. rather than using pre-set threshold ranges).

In embodiments, the control system 490 can be configured to initiate an action in response to detecting a leak (e.g. either a discharge valve 328 leak or suction valve 326 leak). For example, the action can include sending an alert (e.g. with visual and/or audio display) and/or stopping pumping of treatment fluid into the well (e.g. shutting down the driver and/or preventing movement of the bellows and/or the piston/plunger).

Figure 11:
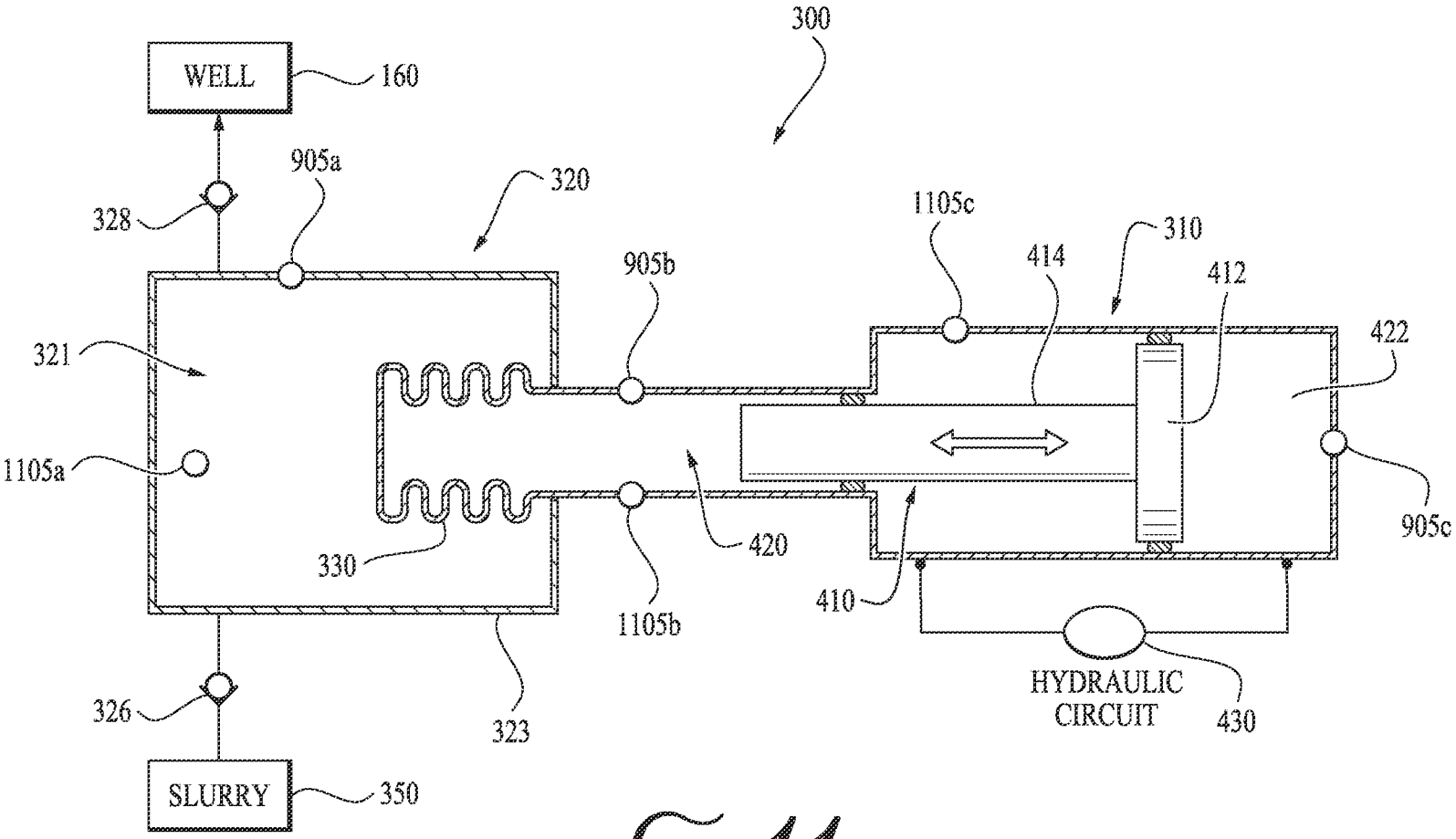
FIG. 11 is a schematic illustration of an exemplary bellows pump having one or more strain gauge and one or more position sensor, according to an embodiment of the disclosure.

FIG. 11 provides a schematic illustration of a pump 300 similar to that discussed with respect to FIG. 9, which also includes one or more position sensor 1105 (e.g. configured to monitor the position of one or more component of the pump 300). So for example, in addition to having one or more strain gauge 905 (e.g. which can be located at exemplary positions 905*a, b, c*), the pump 300 of FIG. 11 may also have one or more position sensor 1105. The one or more position sensor 1105 can be located at various positions on the pump 300 (e.g. see exemplary locations 1105*a, b, c*) and/or to monitor the position of various components of the pump 300. And while the embodiment shown in FIG. 11 includes a hydraulic circuit as the driver mechanism for the piston 410, other similar embodiments may use a different driver mechanism for the piston 410 or may not use a piston at all (but instead may have another mechanism to reciprocally move fluid in and out of the bellows 330). In embodiments, the controller 490 can be configured to correlate data from the one or more position sensor 1105 with data from the one or more strain gauge 905 (e.g. overlaying a position chart and the strain chart and/or use position data to check/match-up timing with the strain data).

Figure 12:
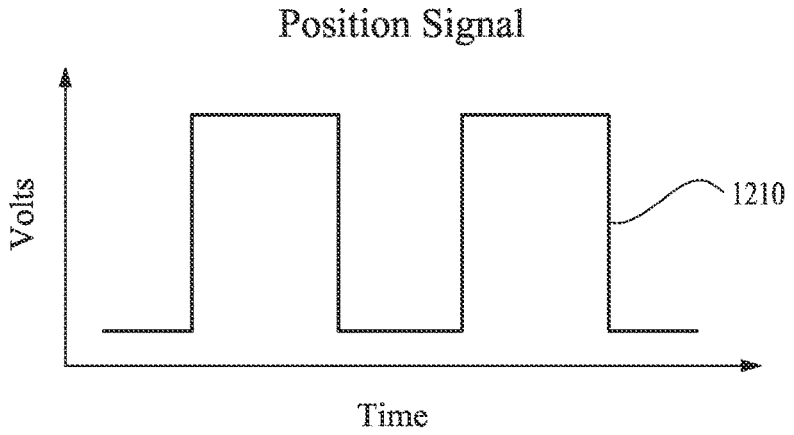
FIG. 12 is a chart illustrating exemplary position data from the one or more position sensor of FIG. 11, according to an embodiment of the disclosure.

FIG. 12 illustrates an exemplary chart of the position data from the one or more position sensor, with position signal 1210 showing position versus time. Such a chart may be visually displayed by the control system 490, for example on the monitor. In the example of FIG. 12, the position data from the one or more position sensor 1105 may be shown in volts (e.g. with voltage correlating to distance in a known way), with the voltage from the position sensor(s) 1105 being displayed versus time. In some embodiments, the control system 490 may use data from the one or more position sensor 1105 to interpret the data from the one or more strain gauge 905. For example, offset between the data/chart of the one or more position sensor 1105 and the one or more strain gauge 905 can be monitored. In some embodiments, the position data may help monitor the timing of the strain gauge data and/or may be used with respect to valve timing.

In some embodiments, the one or more position sensor 1105 can be disposed on the fluid end 310 (e.g. within the chamber 321 and/or configured to detect position of the bellows 330 in the chamber 321 and/or on the bellows 330) and/or the power end 310 (e.g. in the first portion 422 of the bore 420 and/or the second portion 424 of the bore 420 and/or configured to detect the position of the head 412 and/or the rod 414 of the piston 410). In some embodiments, the one or more position sensor 1105 may comprise two position sensors, for example with a first position sensor 1105*a* configured to detect the position of the bellows 330 and a second position sensor 1105*b* or 1105*c* configured to detect the position of the piston 410 (e.g. the head and/or rod). In some embodiments, the second position sensor may be a hydraulic motor head position sensor. For example, the first position sensor 1105*a* can be configured to detect the position of the bellows 330 (e.g. the amount of extension and/or the position of the far end of the bellows 330 away from the power end 310 and/or towards the opposite side of the chamber 321), and the second position sensor 1105*b* or 1105*c* configured to detect the position of the piston 410 (e.g. the amount of extension).

In some embodiments, the first position sensor 1105*a* can be disposed in the chamber 321 of the fluid end 320. For example, the first position sensor 1105*a* may be mounted opposite the bellows 330 in the chamber 321 and directed at the far end of the bellows 330 (e.g. measuring distance between the sensor 1105*a* and the bellows 330, for example using an optical eye). In some embodiments, the second position sensor 1105*b, c* can be disposed in the bore 420 of the power end 310 and/or in proximity to the piston 410. For example, the second position sensor 1105*b* can be disposed in the second portion 424 of the bore 420 and/or in proximity to the rod 414 of the piston 410. In some embodiments, the second position sensor 1105*c* can be disposed in proximity to the head 412 of the piston 410 and/or disposed in the first portion 422 of the bore 420 and/or disposed with the head 412 of the piston 410 between the second position sensor 1105*c* and the bellows 330. For example, the second position sensor 1105*c* may be mounted opposite the head 412 in the first portion 422 of the bore 420 and directed at the head 414 and/or in some embodiments may be mounted on or within the piston 410 itself.

In embodiments, the control system 490 may be configured to receive data from the first and second position sensors 1105 and to monitor for bellows health. In embodiments, a difference (e.g. offset) between the position of the bellows 330 (e.g. with respect to the chamber 321) and the position of the piston 410 (e.g. the rod and/or head) can be monitored (e.g. by the control system 490) as an indicator of bellows health (e.g. whether or not the bellows 330 and the piston 410 are in sync). For example, the position of the bellows 330 relative to the position of the piston 410 (e.g. during discharge and suction strokes) can be monitored. In some embodiments, the difference (e.g. offset) between the position of the bellows 330 and the position of the piston 410 extending beyond (e.g. +/−) a (e.g. position) threshold range can be indicative of potential leakage with respect to the bellows 330 (which could impact whether the bellows 330 is in sync with the piston 410). In some embodiments, the control system 490 may monitor whether the difference is constant or changing over time, with changes potentially being indicative of the bellows 330 and the piston 410 being out of sync.

In some embodiments, the position threshold may be pre-set (e.g. based on historical data). In some embodiments, the control system 490 may be configured to initiate an action in response to detecting a bellows 330 leak and/or out of sync (e.g. the offset extending beyond the threshold). For example, the action may comprise sending an alert (e.g. with visual and/or audio display) and/or stopping pumping of treatment fluid (e.g. shutting down the driver and/or preventing movement of the bellows and/or the piston/plunger) and/or operating a make-up system to restore sync (e.g. as discussed with respect to FIG. 5 for example). In some embodiments, the pump 300 can be one of a plurality of similar pumps (e.g. configured to jointly pump fluid downhole in the well and/or jointly driven), and the control system 490 (e.g. for all of the plurality of pumps) can compare position data from the plurality of pumps and initiate action only in the event that one of the plurality of pumps is more than a pre-set percentage from the mean/average of the plurality of pumps (e.g. too much position drift). See for example, FIG. 18. In some embodiments, the position threshold range may be based on comparative data from the plurality of pumps.

In some embodiments, the pump 300 can comprise both one or more strain sensor 905 and one or more position sensor 1105, and the controller 490 may monitor for incomplete fill based on both strain and position data. For example, if the piston 410 is extending (e.g. towards the bellows 330) and the strain level sensed is not rising to an expected level (e.g. based on comparison of multiple strain gauges, comparison of multiple pumps configured for joint pumping, and/or based on pre-set threshold (e.g. from historical data)), the controller 490 may take action. In some embodiments, one or more pressure sensor may be used in place of or in conjunction with the one or more strain gauge (e.g. with a first pressure sensor configured to detect pressure in the chamber 321 of the fluid end 320 and/or a second pressure sensor configured to detect pressure in the power end 310 (e.g. the first portion of the bore and/or the second portion of the bore)).

Figure 13:
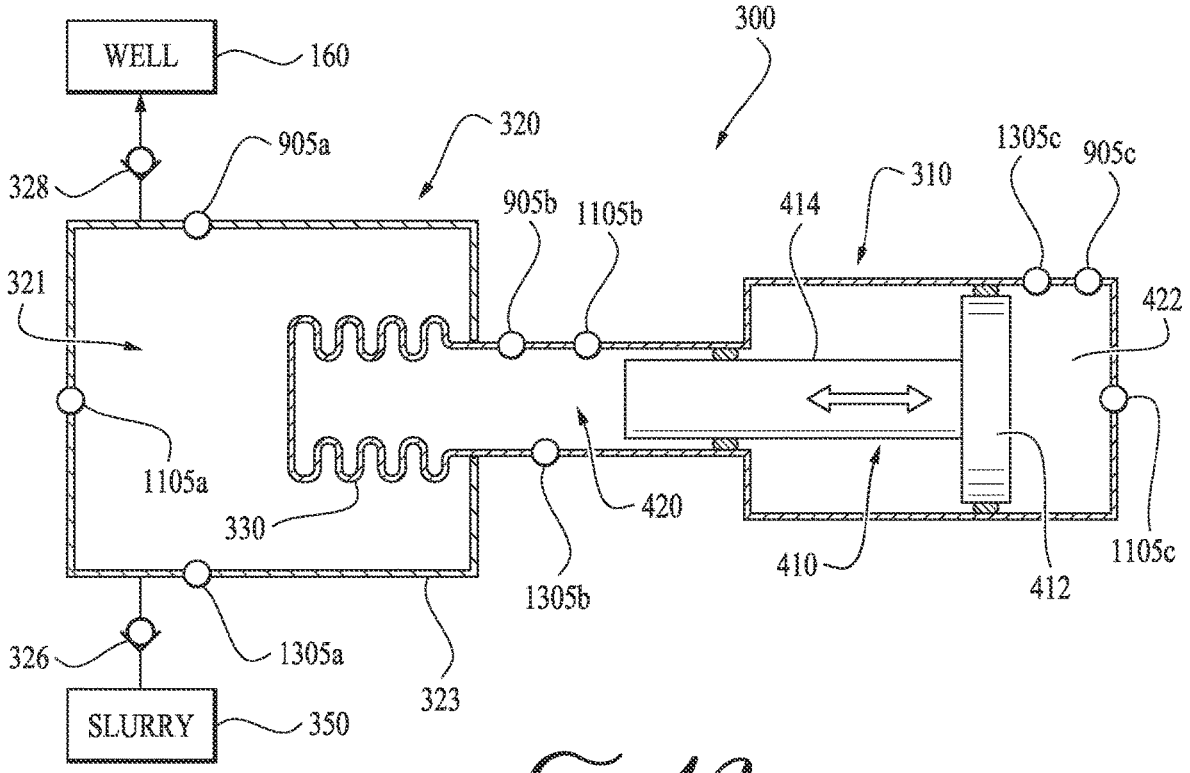
FIG. 13 is a schematic illustration of an exemplary bellows pump having one or more strain gauge, one or more position sensor, and one or more pressure sensor, according to an embodiment of the disclosure.

FIG. 13 provides a schematic illustration of a pump 300 similar to that discussed with respect to FIG. 11, which also includes one or more pressure sensor 1305 (e.g. configured to monitor the pressure at one or more location within the pump 300). So for example, in addition to having one or more strain gauge 905 (e.g. which can be located at exemplary positions 905*a, b, c*) and one or more position sensor 1105 (which can be located at exemplary positions 1105*a, b, c*), the pump 300 of FIG. 13 may also have one or more pressure sensor 1305. The one or more pressure sensor 1305 can be located at various positions on the pump 300 (e.g. see for example exemplary locations 1305*a, b, c*) and/or configured to monitor the pressure at the chamber 321 of the fluid end 320 and/or at one or more locations within the bore 420 of the power end 310.

In embodiments, the control system 490 may be configured to correlate data from the one or more pressure sensor 1305 and data from the one or more strain gauge 905 (e.g. using the one or more position sensor 1105). In some embodiments, pressure decay from peak may be monitored (e.g. by the control system 490) as an indicator of discharge valve health/leakage, and in some instances may be compared to the strain decay from peak over the same time. For example, the pressure decay from peak (e.g. the amount of time it takes for pressure data to decay from the peak value to a floor value in a pressure cycle) exceeding a corresponding (e.g. pressure decay from peak) threshold can be indicative of a discharge valve 328 leak (e.g. similar to FIG. 10B, but with pressure data taking the place of strain data). In some embodiments, pressure decay from peak may be based on slope of pressure versus time (e.g. steepness and/or the rate of change of the slope). In some embodiments, the decay from peak threshold can be pre-set, while in other embodiments, the threshold may be based on comparative data from a plurality of similar pumps working together to pump fluids downhole.

In some embodiments, the pressure rise to peak can be monitored (e.g. by the control system 490) as an indicator of suction valve 326 health/leakage. For example, the pressure rise to peak (e.g. the amount of time it takes for pressure data to rise from the floor value to the peak value in a cycle) exceeding a corresponding (e.g. pressure rise to peak) threshold can be indicative of a suction valve 326 leak (similar to FIG. 10C, but with pressure data taking the place of strain data). In some embodiments, pressure rise to peak may be based on slope of pressure versus time (e.g. steepness and/or rate of change of the slope). In some embodiments, the rise to peak threshold can be pre-set, while in other embodiments, the threshold may be based on comparative data from a plurality of similar pumps working together to pump fluids downhole.

Figure 14:
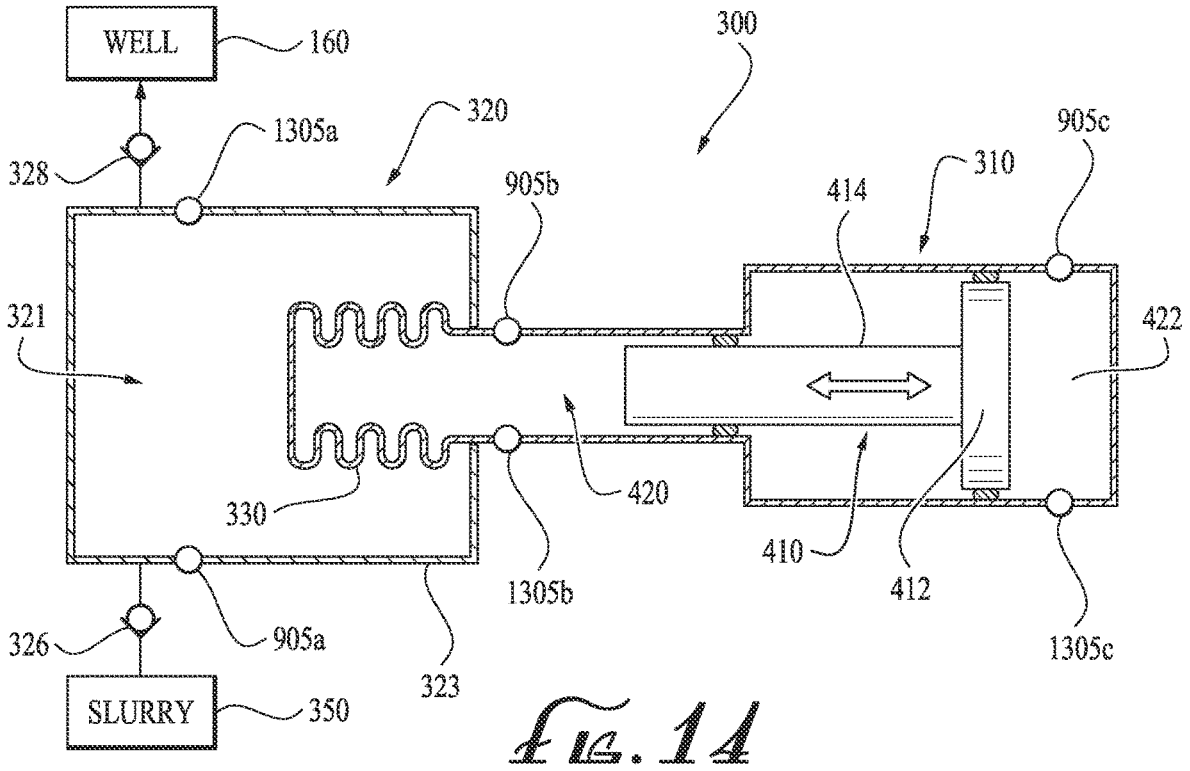
FIG. 14 is a schematic illustration of an exemplary bellows pump having one or more strain gauge and one or more pressure sensor, according to an embodiment of the disclosure.

FIG. 14 provides a schematic illustration of a pump 300 similar to that discussed with respect to FIG. 13, but without the one or more position sensors. The pump 300 embodiment of FIG. 14 may have sensors detecting strain and pressure at one or more locations. So for example, in addition to having one or more strain gauge 905 (e.g. which can be located at exemplary positions 905*a, b, c*), the pump 300 of FIG. 14 may also have one or more pressure sensor 1305 (e.g. which can be located at exemplary positions 1305*a, b, c*). In embodiments, the pump 300 may be configured to measure strain and pressure, and to correlate the data readings (for example with the control system 490 analyzing the data to monitor for valve health, similar to the discussion with respect to FIG. 13).

Figure 15:
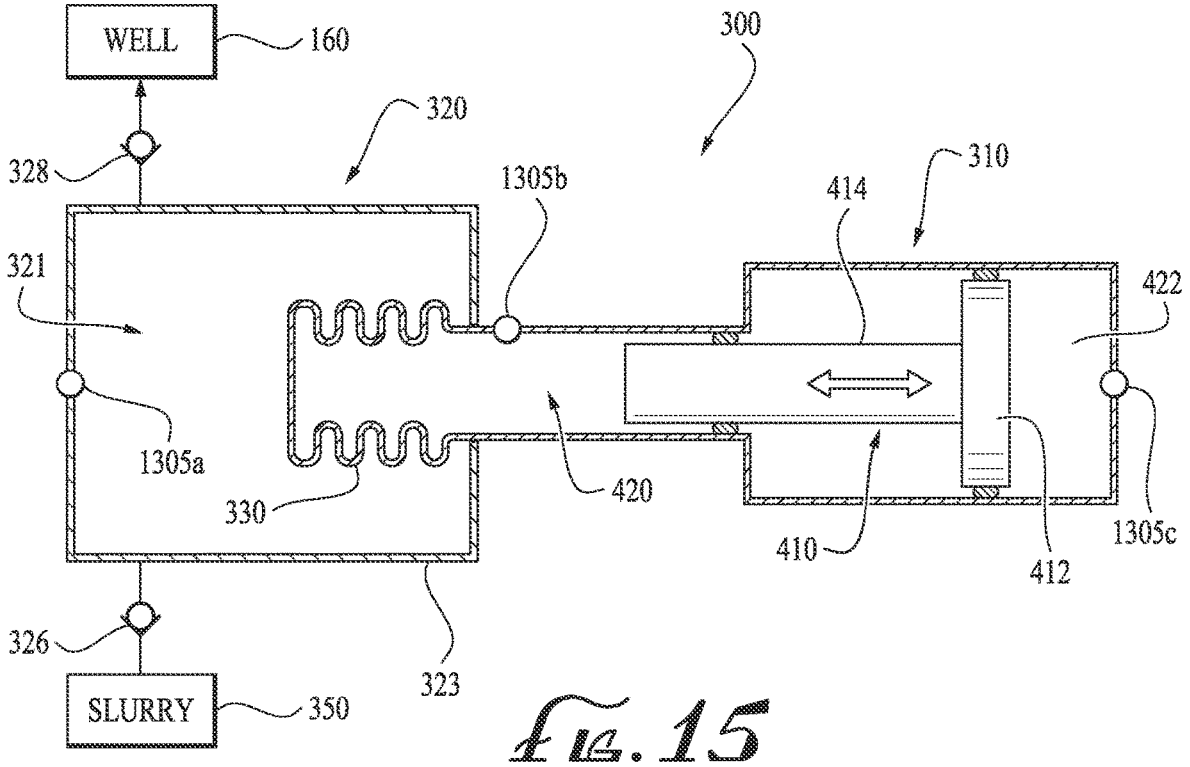
FIG. 15 is a schematic illustration of an exemplary bellows pump having one or more pressure sensor, according to an embodiment of the disclosure.

FIG. 15 provides a schematic illustration of a pump 300 similar to that discussed with respect to FIG. 13, but without the one or more position sensors and without the one or more strain sensor. Stated another way, the pump 300 of FIG. 15 may be similar to that of FIG. 14, but without the one or more strain sensor. Thus, the pump 300 embodiment shown in FIG. 15 may be configured with one or more sensor 1305 detecting pressure at one or more locations. The control system 490 may use the pressure data similar to the discussion with respect to FIG. 13 (e.g. to detect valve leakage). For example, the one or more pressure sensor 1305 (e.g. which can be located at exemplary positions 1305*a, b, c*) can be disposed on (e.g. configured to measure pressure in) the chamber 321 of the fluid end 320 and/or the bore 420 of the power end 310 (e.g. with respect to the first portion 422 of the bore 420 and/or the second portion 424 of the bore 420). In embodiments, pressure decay from peak can be monitored (e.g. by the control system 490) as an indicator of discharge valve 328 health/leakage and/or pressure rise to peak can be monitored (e.g. by the control system 490) as an indicator of suction valve 326 health/leakage. Some pump 300 embodiments may include a plurality of pressure sensors 1305. For example, a first pressure sensor 1305*a* can be disposed on the fluid end 320 (e.g. in the chamber 321) and a second pressure sensor (e.g. 1305 *b* or 1305*c*) can be disposed on the power end 310 (e.g. in the bore 410). In some embodiments, offset between the first pressure sensor data and the second pressure sensor data can be monitored (e.g. by the control system 490).

Figure 16:
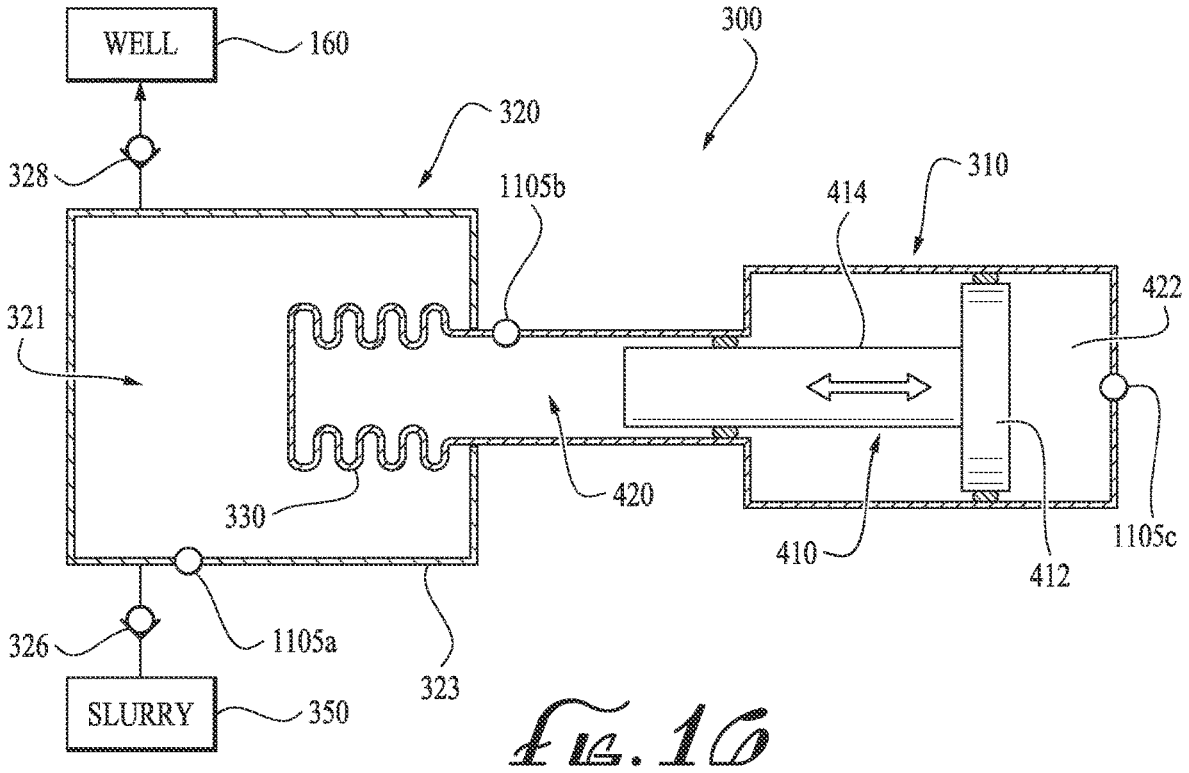
FIG. 16 is a schematic illustration of an exemplary bellows pump having one or more position sensor, according to an embodiment of the disclosure.

FIG. 16 provides a schematic illustration of a pump 300 similar to that discussed with respect to FIG. 13, but without the one or more pressure sensor and without the one or more strain sensor. Stated another way, the pump 300 of FIG. 16 may be similar to that of FIG. 11, but without the one or more strain sensor. Thus, the pump 300 embodiment shown in FIG. 16 may be configured with one or more sensor 1105 detecting position (e.g. of one or more component of the pump 300) at one or more locations (e.g. at one or more of exemplary locations 1305*a, b, c*). The control system 490 may use the position data similar to the discussion with respect to FIG. 13 (e.g. to detect valve leakage, bellows leakage and/or out-of-sync). For example, a first position sensor 1105*a* can be configured to detect the position of the bellows 330 (e.g. the amount of extension and/or the position of the far end of the bellows 330 away from the power end 310) and a second position sensor (e.g. 1105*b* or 1105*c*) can be configured to detect the position of the piston 40 (e.g. the amount of extension). By monitoring the difference (e.g. offset) between the position of the bellows 330 (e.g. with respect to the chamber 321) and the position of the piston 410 (e.g. the rod and/or head), e.g. by the control system 490, bellows health can be determined. For example, if the difference (e.g. offset) between the position of the bellows 330 and the position of the piston 410 (e.g. the rod/head) exceeds a corresponding threshold range, then there is potential leakage with respect to the bellows 330 (which could impact whether the bellows 330 is in sync with the piston 410).

Figure 17:
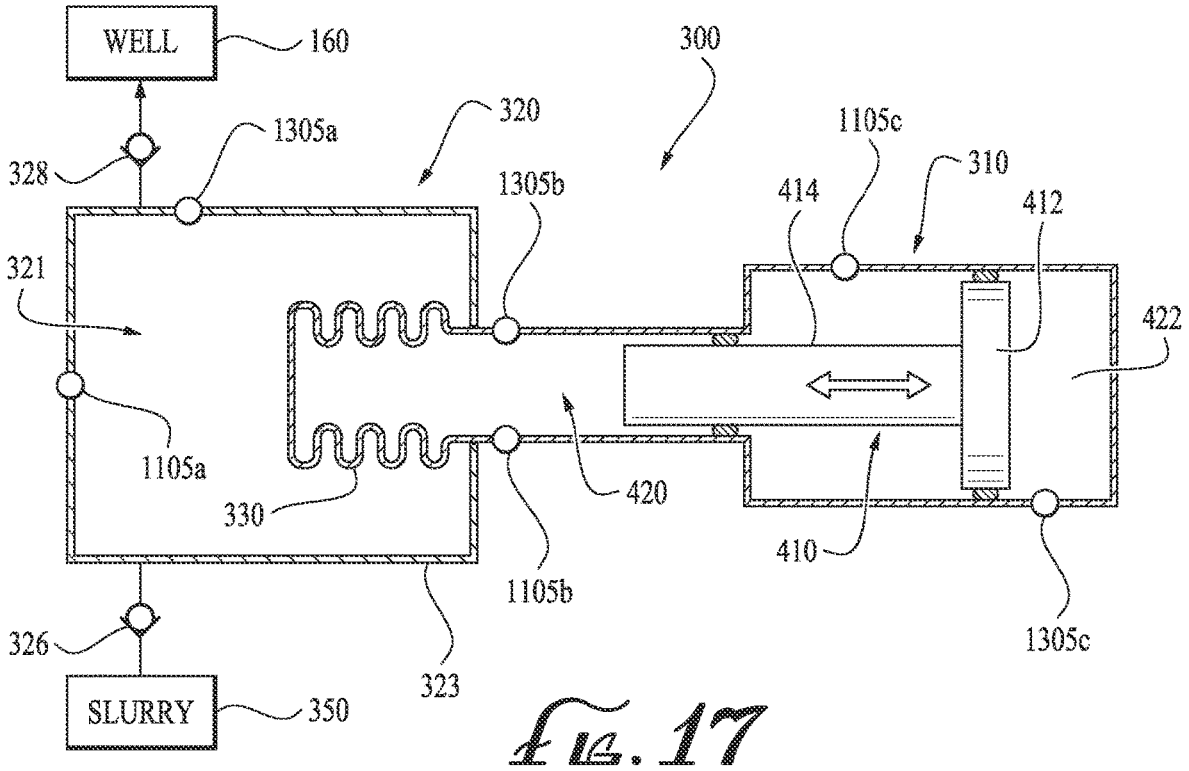
FIG. 17 is a schematic illustration of an exemplary bellows pump having one or more position sensor and one or more pressure sensor, according to an embodiment of the disclosure.

FIG. 17 provides a schematic illustration of a pump 300 similar to that discussed with respect to FIG. 13, but without the one or more strain sensor. Stated another way, the pump 300 of FIG. 17 may be similar to that of FIG. 16, but may also include one or more pressure sensor 1305. Thus, the pump 300 embodiment shown in FIG. 17 may be configured with one or more sensor 1105 detecting position (e.g. of one or more component of the pump 300) at one or more locations (e.g. one or more of exemplary locations 1105*a, b, c*) and one or more sensor 1305 detecting pressure at one or more locations (e.g. one or more of exemplary locations 1305*a, b, c*). The control system 490 may use the pressure data similar to the discussion with respect to FIG. 13 (e.g. to detect valve leakage). For example, the one or more pressure sensor 1305 can be disposed on (e.g. configured to measure pressure in) the chamber 321 of the fluid end 320 and/or the bore 420 of the power end 310 (e.g. with respect to the first portion 422 of the bore 420 and/or the second portion 424 of the bore 420). In embodiments, pressure decay from peak can be monitored (e.g. by the control system 490) as an indicator of discharge valve 328 health/leakage and/or pressure rise to peak can be monitored (e.g. by the control system 490) as an indicator of suction valve 326 health/leakage. Some pump 300 embodiments may include a plurality of pressure sensors 1305. For example, a first pressure sensor 1305*a* can be disposed on the fluid end 320 (e.g. in the chamber) 321 and a second pressure sensor (for example 1305*b* or 1305*c*) can be disposed on the power end 310 (e.g. in the bore 420). In some embodiments, offset between the first pressure sensor data and the second pressure sensor data can be monitored (e.g. by the control system 490).

Similarly, the control system 490 may use the position data similar to the discussion with respect to FIG. 13 (e.g. to detect valve or bellows leakage and/or out-of-sync). For example, a first position sensor 1105*a* can be configured to detect the position of the bellows 330 (e.g. the amount of extension and/or the position of the far end of the bellows 330 away from the power end 310) and a second position sensor (e.g. 1105*b* or 1105*c*) can be configured to detect the position of the piston 410 (e.g. the amount of extension). By monitoring the difference (e.g. offset) between the position of the bellows 330 (e.g. with respect to the chamber 321) and the position of the piston 410 (e.g. the rod and/or head), e.g. by the control system 490, bellows health can be determined. For example, if the difference (e.g. offset) between the position of the bellows 330 and the position of the piston 410 (e.g. the rod/head) exceeds a corresponding threshold range, then there is potential leakage with respect to the bellows 330 (which could impact whether the bellows 330 is in sync with the piston 410).

Figure 18:
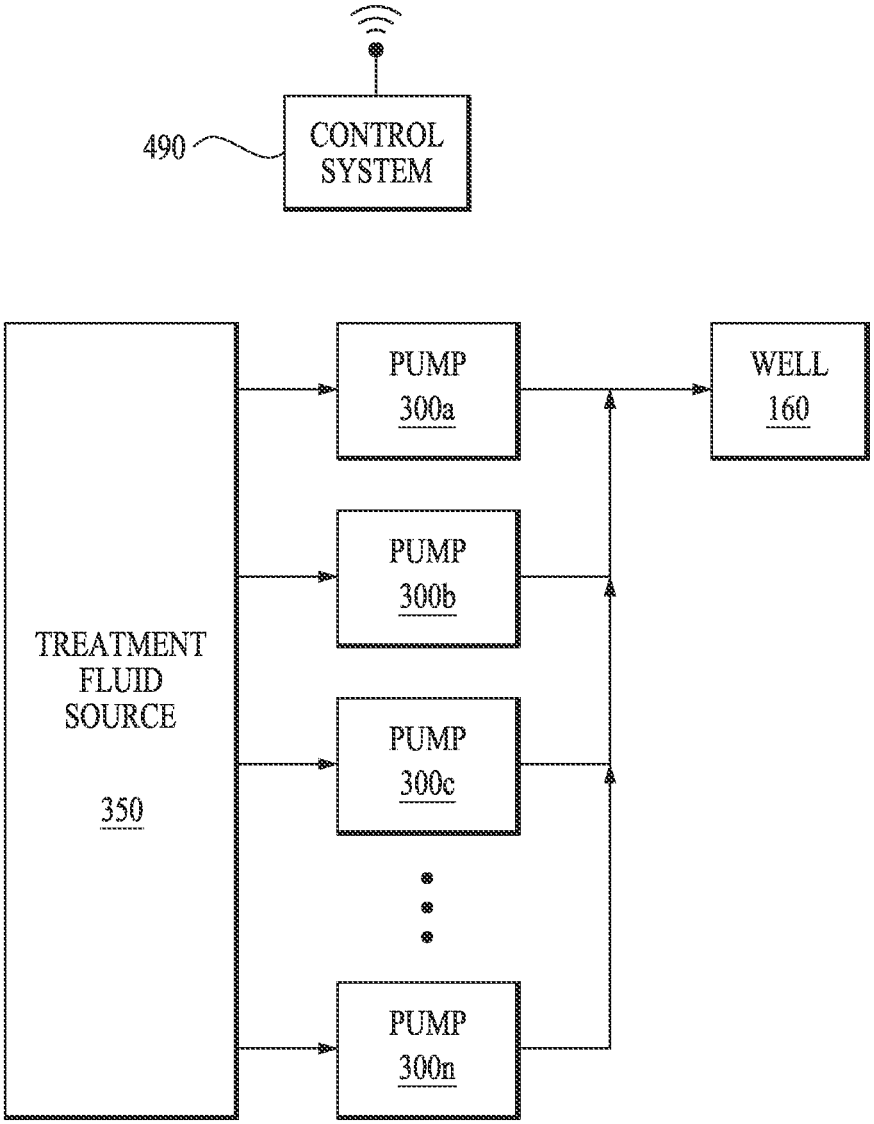
FIG. 18 is a schematic illustration of an exemplary system having a plurality of pumps configured to jointly pump fluid into a well, according to an embodiment of the disclosure.

FIG. 18 provides a schematic illustration of a system having multiple pumps (e.g. 300*a*-300*n*) configured to jointly pump treatment fluid into a well 160. In some embodiments, the plurality of pumps may be configured to provide constant pumping at approximately constant pressure. For example, one or more pump (e.g. 300*a*) may be configured so that its power stroke is out of sync with the power stroke of one or more other of the pumps (e.g. 300*b*). In some embodiments, half of the pumps may be configured to have their power/discharge strokes in sync, for example when the other half of the pumps are having their suction stroke. While FIG. 18 illustrates an embodiment in which all of the pumps draw from the same treatment fluid source 350, in other embodiments one or more of the pumps may draw from an independent fluid source.

Disclosed embodiments may provide a way to monitor valve and/or bellows health in real-time. The bellows pump 300 may comprise a fluid end housing/bellows housing 323 having a chamber 321 configured to contain the bellows 330, wherein the bellows 330 is used to provide fluid flow (e.g. through the chamber 321). For example, the suction valve 326 may be disposed upstream of the chamber 321 to allow incoming fluid flow, and the discharge valve 328 may be disposed downstream of the chamber 321 to discharge pressurized (e.g. treatment) fluid flow. While the suction valve 326 and the discharge valve 328 may each be one-way check valves, in alternate embodiments, any other suitable valve may be used as either the suction valve 326 and/or discharge valve 328. Although not required, as illustrated in FIGS. 9, 11, and 13-17, the bellows pump 300 may be coupled to a pressure intensifier (e.g. having a piston with head 412 larger than rod 414), which may be configured to increase the hydraulic pressure produced by the bellows pump 300. In embodiments, the pressure intensifier may be integrated into the bellows pump 300. It should be understood that various pump 300 embodiments discussed with respect to a piston and/or intensifier may be used without the piston and/or intensifier in other embodiments (e.g. with alternate means or mechanisms for reciprocally expanding and contracting the bellows), all of which are specifically included herein. For example, the one or more strain sensor, one or more position sensor, and/or one or more pressure sensor may be similarly used in exemplary bellows pump 300 embodiments which do not have a piston and/or intensifier, for example providing data to the control system 490 to monitor valve and/or bellows health. Additionally, any driver mechanism capable of reciprocally expanding and contracting the bellows may be used, and are included within the scope of this disclosure.

As discussed above, FIG. 11 illustrates suitable positions (905*a, b, c*) for the one or more strain gauges 905 and suitable positions (1105*a, b, c*) for the one or more position sensors 1105. As illustrated, there may be one or more strain gauges 905 disposed on the bellows housing/fluid end housing 323, on the portion of the housing for the power end 310 with the second portion of the bore 420 (e.g. associated with the rod 414 of the piston 410), on the pressure intensifier portion of the power end housing (e.g. with the first portion 422 of the bore 420 and/or associated with the head 412 of the piston 410), and any other suitable location. Likewise, there may be one or more position sensors 1105 disposed on the bellows housing/fluid end housing 323 (e.g. within the chamber 321), on the portion of the housing for the power end 310 with the second portion 424 of the bore 420 (e.g. associated with the rod 414 of the piston 410) (e.g. within the second portion 424 of the bore 420), on the pressure intensifier portion of the power end 310 housing (e.g. in the first portion 422 of the bore 420), and any other suitable location. In embodiments, there may be a position sensor 1105 disposed on the bellows 330 contained within the bellows housing/fluid end housing 323. The one or more strain gauges 905 and one or more position sensors 1105 may measure parameters related to operation of the bellows pump 300 with reference to corresponding operation of associated valves (such as suction valve 326 and discharge valve 328). The position of the bellows 330 within the bellows housing/fluid end housing 323 in relation to the position of the piston 410 of the pressure intensifier may be correlated and monitored. The valve monitoring system (e.g. control system 490) may compare the position of the bellows 330 and piston 410 and create alerts and/or make physical adjustment (by way of actuated valves, such as suction valve 326, discharge valve 328, or other suitable valves) to the volume of power fluid providing the (e.g. fluid) coupling between the two in order to adjust the timing.

The relation of position of the bellows 330 and pressure intensifier (e.g. piston 410) may be used to determine leak of the bellows 330 by comparing expected position with actual position. For example, actual position may be determined based on the position sensor 1105*a* associated with the fluid end 320, chamber 321, and/or bellows 330, while expected position may be determined based on the position sensor 1105*b* or 1105*c* associated with the power end 310, the bore, 420 and/or the piston 410. In certain embodiments, head position of a hydraulic motor(s) used to drive the pressure intensifier may be used to correlate its position. If the actual position does not follow the expected position, a determination may be made that there is leakage in the fluid coupling between the two.

FIG. 12 illustrates a graph showing a position signal 1210 generated by one of the position sensors 1105 (for example, of FIG. 11) during operation of the bellows pump 300. In certain embodiments, the position signal 1210 may be shown on a display unit of the valve monitoring system. FIG. 12 shows a position signal 1210 displayed in volts over time (in seconds). The position signal 1210 may be generated by one of the position sensors 1105 positioned on or with respect to the piston 410 of the pressure intensifier and/or positioned on or with respect to the bellows 330 contained within the bellows housing/fluid end housing 323. The position signal 1210 may represent the timing for opening and closing of a valve (such as suction valve 326, discharge valve 328, or other suitable valves) over the indicated time as the bellows 330 operate.

FIGS. 10A, 10B, and 10C each illustrates a graph of strain over time. FIG. 10A illustrates a strain signal 1010 during ordinary operations as received by the valve monitoring system (e.g. the control system 490) for a healthy pump. FIG. 10B illustrates a strain signal 1020 of an example of a discharge valve 328 leak which creates a longer strain decay over time for each strain cycle. FIG. 10C illustrates a strain signal 1030 of an example of a suction valve 326 leak which creates a longer strain rise to peak. Referring to each of FIGS. 10A-10C, the example notations each represent key timing in valve opening/closing position. In one or more embodiments, the valve monitoring system (e.g. the control system 490) may receive and process signals from the one or more strain gauges 905 and one or more position sensors 1105 to determine the opening and closing of the slurry valves (i.e., suction valve 326 and discharge valve 328), determine the position of the pressure intensifier (e.g., piston 410), and/or determine the position of the bellows 330 in the bellows housing/fluid end housing 323.

Using this information, the valve monitoring system (e.g. the control system 490) may determine the health of the slurry valves 326, 328 and/or bellows 330 and may relay the status to a display. In one or more embodiments, the valve monitoring system may display the processed signals in a graphical representation, such as strain signals 1010, 1020, and 1030, generate and transmit an alert to a user or operator if there is leakage, actuate one or more valves, terminate operation of the bellows pump 300, or any combination thereof based on the received signals. In further embodiments, the received strain measurements and position measurements may be used to monitor other aspects of pump 300 performance beyond valve leakage. For example, and without limitation, such measurements may monitor for cavitation of the bellows pump 300, incomplete fill with the corresponding fluid at the fluid end 320, driver fluid leakage within the pressure intensifier (e.g. bore 420), and any combination thereof. As the valve monitoring system (e.g. the control system 490) may continuously monitor both strain and positions with respect to the bellows pump 300, the rate-of-change of either the strain, positions, or both may further be instructive of pump performance throughout both suction and discharge strokes.

Disclosed embodiments also comprise methods for monitoring valve and/or bellows health and/or for introducing treatment fluid into a well. Such methods may use any of the disclosed pump embodiments, such as the examples illustrated in FIGS. 9, 11, and 13-18. For example, a method embodiment may comprise: receiving (e.g. at a control system) strain data associate with the bellows pump (e.g. strain data for the fluid end housing and/or strain data for the power end housing); detecting valve leakage in the bellows pump based on the strain data; and responsive to detecting valve leakage, initiating action (e.g. by a controller), wherein leakage in a discharge valve of the bellows pump is detected based on (time for) strain decay from peak exceeding a first threshold, and leakage in a suction valve of the bellows pump is detected based on (time for) strain rise to peak exceeding a second threshold. Some embodiments may further comprise detecting strain in the bellows pump (e.g. at the fluid end and/or at the power end) (e.g. using one or more sensor—e.g. strain gauge) and sending strain data to the control system.

Some embodiments may further comprise pumping treatment fluid downhole in a well using the bellows pump. In some embodiments, the action may comprise sending an alert (e.g. with visual and/or audio display) and/or stopping pumping of treatment fluid (e.g. shutting down the driver and/or preventing movement of the bellows and/or the piston). In some embodiments, the action may include replacing the leaking valve which was detected. In some embodiments, the bellows pump may be one of a plurality of similar bellows pumps, and pumping treatment fluid may further comprise pumping with the plurality of bellows pumps. In some embodiments, the threshold(s) may be based on comparison of the strain data for the plurality of bellows pumps (e.g. if a pump is too far from the average). Some embodiments may further comprise (e.g. dynamically) setting the threshold(s) based on comparison of the strain data for the plurality of bellows pumps. Some embodiments may further comprise receiving (e.g. at the control system) position data associate with the bellows pump (e.g. position data for the bellows and/or position data for the piston), and correlating the position data and the strain data. For example, the position data may include data for both the bellows and the piston, and exemplary method embodiments may further comprise monitoring bellows health based on the amount of sync between the position of the bellows and the position of the piston (e.g, wherein out-of-sync movement is detected based on difference between the position of the bellows and the position of the piston (e.g. rod and/or head) extending beyond (e.g. +/−) a threshold range). Some embodiments may further comprise receiving (e.g. at the control system) pressure data associated with the bellows pump (e.g. pressure data for the chamber of the fluid end of the pump and/or pressure data for the bore of the power end of the pump), and correlating the pressure data with the strain data.

Disclosed embodiments may also include a method comprising: receiving position data (e.g. from at least two position sensors and/or at a control system) associate with the bellows pump (e.g. position data for the fluid end (e.g. the bellows in the chamber) and position data for the power end (e.g. the piston—the head and/or rod)); detecting (e.g. by the control system) out-of-sync movement in the bellows pump (e.g. based on the position data from the at least two position sensors in the pump and/or based on comparison of position data to similar pumps configured to jointly pump treatment fluid downhole in the well); and responsive to detecting out-of-sync movement, initiating action (e.g. by a controller), wherein out-of-sync movement is detected based on difference between the position of the bellows and the position of the piston (e.g. rod and/or head) extending beyond (e.g. +/−) a threshold range. In some embodiments, the threshold range is pre-set, while in other embodiments the threshold range can be based on comparison to (e.g. an average from) the plurality of pumps (e.g. action only initiated in the event that one of the plurality of pumps is more than a pre-set percentage from the mean of the plurality of pumps (e.g. too much position drift)). Some embodiments further comprise pumping treatment fluid downhole in a well using the bellows pump.

In some embodiments, the action may comprise sending an alert (e.g. with visual and/or audio display) and/or stopping pumping (e.g. shutting down the driver and/or preventing movement of the bellows and/or the piston) and/or using a make-up system to introduce or remove drive fluid between the piston and the bellows to provide synchronous movement of the bellows with the piston. In some embodiments, the action can be automated (e.g. by the control system). In some embodiments, the action may include replacing the bellows. Some embodiments may further comprise receiving (e.g. at the control system) pressure data associated with the bellows pump (e.g. pressure data for the chamber of the fluid end of the pump and/or pressure data for the bore of the power end of the pump), and correlating the pressure data with the position data.

Disclosed embodiments may also include a method comprising: receiving (e.g. at a control system) pressure data associate with the bellows pump (e.g. data for a chamber of a fluid end of the pump and/or pressure data for a bore of a power end of the pump); detecting valve leakage in the bellows pump based on the pressure data; and responsive to detecting valve leakage, initiating action (e.g. by a controller), wherein leakage in a discharge valve of the bellows pump is detected based on (time for) pressure decay from peak exceeding a first threshold, and leakage in a suction valve of the bellows pump is detected based on (time for) pressure rise to peak exceeding a second threshold. Some embodiments may further comprise detecting pressure in the bellows pump (e.g. at the fluid end and/or at the power end) (e.g. using one or more sensor—e.g. one or more pressure sensor) and sending pressure data to the control system. Some embodiments may further comprise pumping treatment fluid downhole in a well using the bellows pump.

In embodiments, the action may comprise sending an alert (e.g. with visual and/or audio display) and/or stopping pumping of treatment fluid (e.g. shutting down the driver and/or preventing movement of the bellows and/or the piston/plunger). In some embodiments, the action may include replacing the leaking valve. In embodiments, the bellows pump may be one of a plurality of similar bellows pumps, and pumping treatment fluid may further comprise pumping with the plurality of bellows pumps. In some embodiments, the threshold(s) may be based on comparison of the pressure data for the plurality of bellows pumps (e.g. if a pump is too far from the average). Some embodiments may further comprise (e.g. dynamically) setting the threshold(s) based on comparison of the pressure data for the plurality of bellows pumps.

Some embodiments may further comprise receiving (e.g. at the control system) position data associate with the bellows pump (e.g. position data for the bellows and/or position data for the piston), and correlating the position data and the pressure data. In some embodiments, the position data may comprise data for both the bellows and the piston, further comprising monitoring bellows health based on the amount of sync between the position of the bellows and the position of the piston. For example, out-of-sync movement may be detected based on difference between the position of the bellows and the position of the piston extending beyond a threshold range. Some embodiments may further comprise receiving (e.g. at the control system) strain data associated with the bellows pump (e.g. strain data for the fluid end of the pump and/or strain data for the power end of the pump), and correlating the pressure data with the strain data.

It should be noted that in bellows-style pumps, for example pumps configured to introduce treatment fluid into a well, various components of the pump may experience harsh operating conditions. For example, the discharge valve may experience high pressures and/or abrasive and/or corrosive treatment fluid, which can degrade the discharge valve. Such degradation can, over time, negatively impact the sealing capabilities of the discharge valve, which may lead to leakage of treatment fluid back into the chamber of the pump through the discharge valve. For example, a leaking discharge valve can potential cause a problem when the bellows pump is stopped (e.g. for maintenance or for reduction of overall flow rate into the well, when a plurality of pumps are jointly used to pump treatment fluid). Discharge valve leakage can allow pressurized treatment fluid to flow backward into the chamber of the pump, and while the pump is stopped, this leakage of fluid can cause a pressure build-up/accumulation in the chamber.

Oftentimes, the bellows of a bellows pump can be a fairly fragile element, for example due to its need to be expandable. For example, sufficient leakage of treatment fluid through the discharge valve back into the chamber can cause a pressure imbalance (e.g. between the external pressure in the chamber and the internal pressure within the bellows), with the pressure imbalance of fluids being separated only by the thin bellows material. Such a pressure imbalance may damage the bellows, for example crushing the bellows (e.g. beyond its minimum desired length). Besides damage to the bellows itself, a damaged bellows may lead to additional system damage and/or extended maintenance and/or pump downtime. Disclosed embodiments may address one or more such concerns, for example preventing and/or reducing pressure build-up due to discharge valve leakage, thereby improving pump functionality and reducing maintenance issues (for example, allowing the leaking discharge valve to be replaced without the need to replace the bellows or other system components which might otherwise have been damaged).

Figure 19:
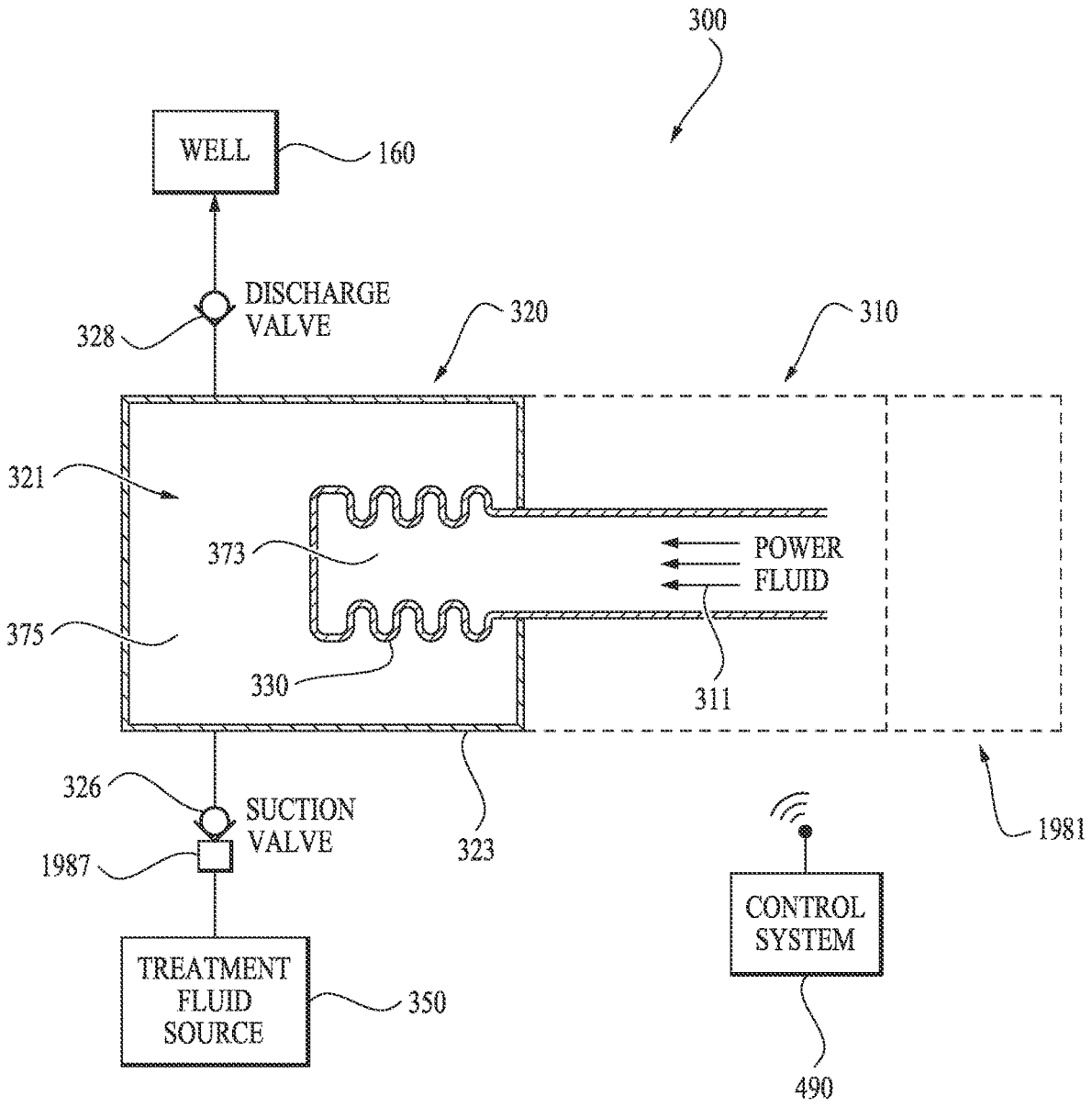
FIG. 19 is a schematic illustration of an exemplary bellows pump system, according to an embodiment of the disclosure.

FIG. 19 is a schematic illustration of an exemplary bellows pump system, according to an embodiment of the disclosure. For example, the system of FIG. 19 may include a source of treatment fluid 350; a bellows pump 300 having a power end 310, a fluid end 320 having a chamber 321, and an expandable bellows 330 disposed in the chamber 321 and in fluid communication with the power end 310; a suction valve 326 in fluid communication with the chamber 321 and the source of treatment fluid 350; a discharge valve 328 in fluid communication with the chamber 321 and the well 160; and a venting mechanism 1987 configured to vent the chamber 321 of treatment fluid. In embodiments, the power end 310 can be configured to reciprocally expand and contract the bellows 330 within the chamber 321 based on movement of drive fluid. In embodiments, the bellows 330 can be configured to separate the drive fluid of the power end 310 from the treatment fluid in the chamber 321. In some embodiments, the power end 310 can have a piston disposed in a bore, for example configured to reciprocate within the bore (see FIG. 4 for example). For example, the power end 310 can be configured to reciprocally provide discharge and suction strokes, with a discharge stroke by the power end 310 expanding the bellows 330 within the chamber 321 (e.g. thereby driving treatment fluid in the chamber 321 out through the discharge valve 328) and a suction stroke by the power end 310 contracting the bellows 330 within the chamber 321 (e.g. thereby introducing treatment fluid into the chamber 321 through the suction valve 326). In embodiments, the suction valve 326 is closed and the discharge valve 328 is open during a discharge stroke, and the discharge valve 328 is closed and the suction valve 326 is open during a suction stroke.

The venting mechanism 1987 may be configured to vent the chamber 321 in the event of stoppage of the pump 300 (e.g. responsive to pump stoppage). For example, pump stoppage may be based on a stop command (e.g. issued by the control system 490 and/or by a user) or on one or more sensor detecting one or more parameter of the system to determine that the pump 300 has stopped (e.g. no movement of the bellows 330 and/or the power end 310 for a plurality of cycles or for a given timeframe). In embodiments, venting the chamber 321 may comprise draining any fluid out of the chamber 321 until the pump is restarted (e.g. venting the chamber 321 for the duration of pump stoppage).

Figure 22:
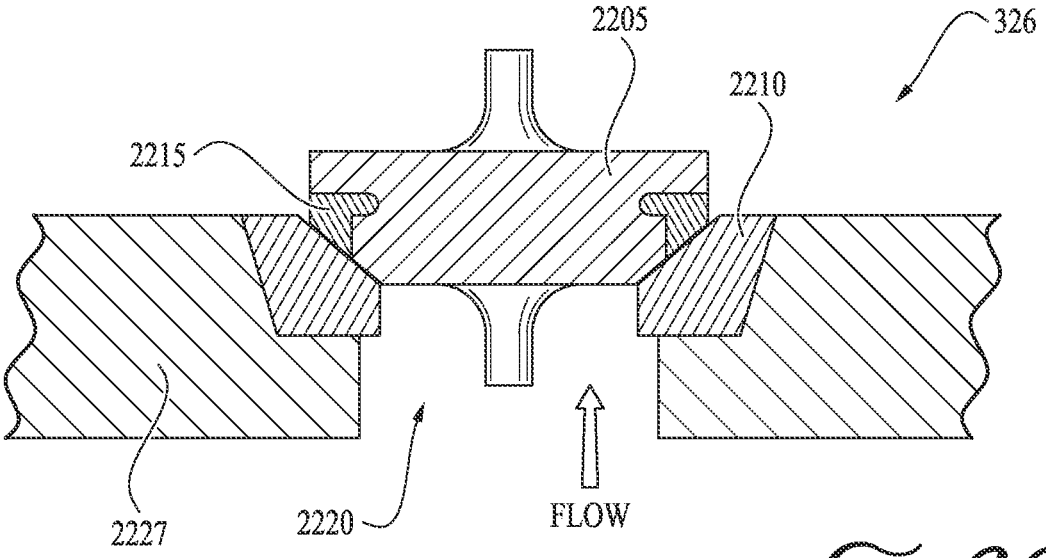
FIG. 22 is a schematic cross-sectional view an exemplary suction valve (or other one-way check valve), according to an embodiment of the disclosure.

In some embodiments, the suction valve 326 and the discharge valve 326 may each be one-way valves (e.g. one-way check valves). The venting mechanism 1987 may be configured to open the suction valve 326 to allow treatment fluid to flow out of the chamber 321 through the open suction valve 326 (e.g. towards the source of treatment fluid 350). In some embodiments, venting through the suction valve 326 may be assisted by gravity (e.g. due to orientation of the suction valve 326, for example below the chamber 321). In embodiments, for example as illustrated in FIG. 22, the suction valve 326 may comprise a one-way check valve having a poppet 2205 and a seat 2210 (e.g. with the seat 2210 extending around a passage 2220 through the suction valve body 2227). The poppet 2205 may be biased against the seat 2210 to a closed position (e.g. preventing/restricting fluid flow through the suction valve 326, e.g. from the opposite direction) but be configured so that, when the biasing force is overcome (e.g. by pressure differential between the two sides of the poppet 2205—such as a pressure differential between the chamber 321 and the treatment fluid source 350), the poppet 2205 lifts off the seat 2210 to an open position (e.g. allowing fluid flow through the suction valve 326—e.g. between the seat 2210 and the poppet 2205 and/or into the chamber 321). In some embodiments, the venting mechanism 1987 can be configured to force the suction valve 326 to the open position, responsive to pump stoppage, and to hold the suction valve 326 in the open position for the duration of pump stoppage (e.g. until the pump is restarted).

Figure 23:
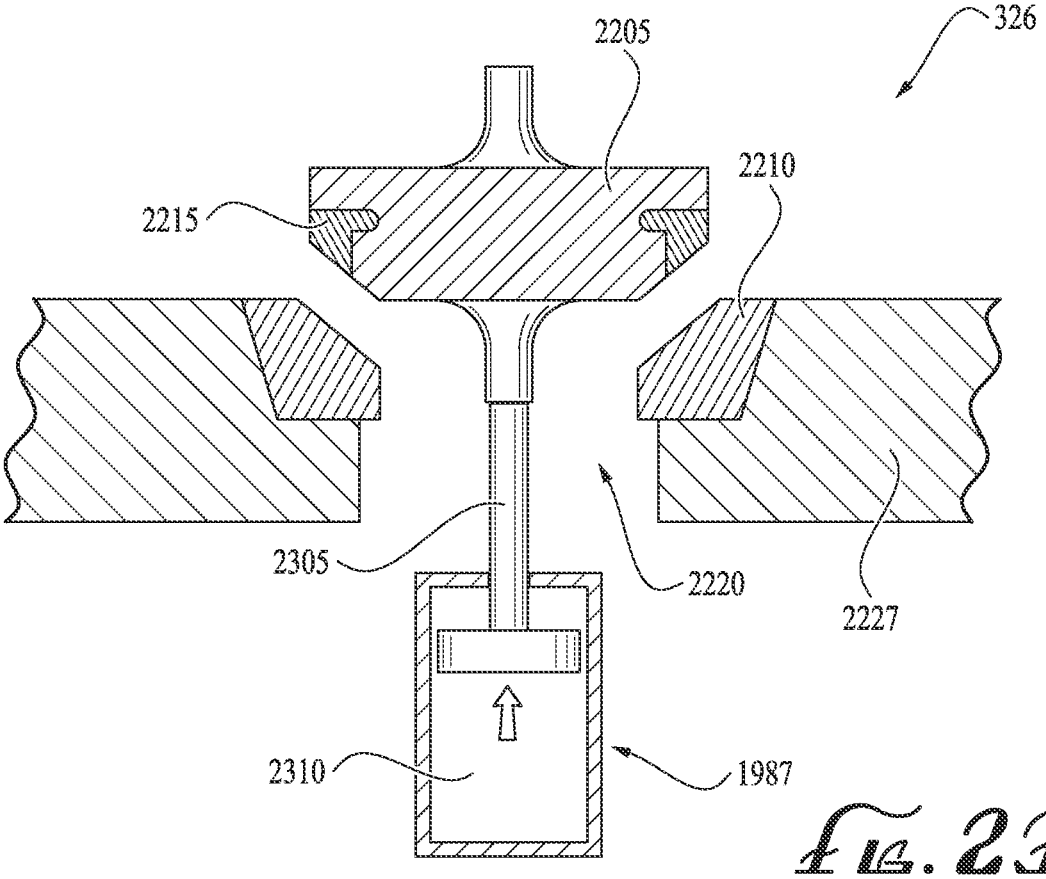
FIG. 23 is a schematic cross-sectional view of the exemplary suction valve of FIG. 22 forced to an open position by an exemplary venting mechanism, according to an embodiment of the disclosure.

In some embodiments, for example as illustrated in FIG. 23, the venting mechanism 1987 may have an extended position and retracted position. For example, in the extended position (shown in in FIG. 23), the poppet 2205 can be in the open position (e.g. lifted from the seat 2210). In the extended position, the venting mechanism 1987 may overcome biasing to force open the suction valve 326, thereby allowing leakage of treatment fluid in the chamber 321 to flow out through the suction valve 326. In the retracted position (similar to FIG. 22), the poppet 2205 can be in the closed position (e.g. contacting/seated on the seat 2210). In the retracted position, the venting mechanism 1987 may release the poppet 2205, allowing the biasing force/element to close the suction valve 326. Once released, the suction valve 326 can operate as a one-way check valve again, thereby preventing treatment fluid in the chamber 321 from exiting through the suction valve 326. In the extended position (e.g. shown in FIG. 23), the venting mechanism 1987 may contact the poppet 2205 on a proximate surface (e.g. in proximity to the seat/opposite the chamber and/or distal to the chamber) and may hold the poppet 2205 off the seat 2210 (e.g. in the open position). In the retracted position, the venting mechanism 1987 may not apply sufficient force (e.g. to the poppet 2205) to overcome the biasing, allowing the poppet 2205 to retract and/or to contact the seat 2210 (e.g. in a closed position). In some embodiments, in the retracted position, the venting mechanism 1987 may not contact the poppet 2205 at all.

In some embodiments, the venting mechanism 1987 can be external to the chamber 321. For example, in the extended position, the venting mechanism 1987 may extend through the seat 2210 of the suction valve 326 (e.g. through the passage 2220) to contact the poppet 2205. The venting mechanism 1987 can be disposed opposite the poppet 2205 with respect to the valve seat 2210 (e.g. with the valve seat 2210 being disposed axially between the poppet 2205 and the venting mechanism 1987 in the closed position). In some embodiments, the venting mechanism 1987 can include an actuator 2310 and a vent rod 2305, with the actuator 2310 configured to move the vent rod 2305 between the extended and retracted positions. In the extended position, the vent rod 2305 may contact the poppet 2205 on a proximate surface (e.g. in proximity to the seat/opposite the chamber) and may hold the poppet 2205 off the seat 2210 (e.g. in the open position). In the retracted position, the vent rod 2305 may not apply sufficient force to overcome the biasing and/or may not contact the poppet 2205 at all (e.g. allowing the poppet 2205 to remain in contact with the seat 2210). In the extended position, the vent rod 2305 may extend through the seat 2210 (e.g. passage) of the suction valve 326 to contact the poppet 2205. In some embodiments, in the open position, fluid from the source of treatment fluid 350 may flow around the vent rod 2305 and the poppet 2205 and into the chamber 321, for example during pumping of treatment fluid using the pump 300. By way of example, the suction valve 326 and venting mechanism 1987 can be configured so that, during pumping, fluid may flow around the vent rod 2305 and the poppet 2205 and into the chamber 321. Alternatively, fluid from the source of treatment fluid 350 may flow past the vent rod 2305, around the poppet 2205, and into the chamber 321, for example depending on the position of the venting mechanism 1987 with respect to the suction valve 326 and/or the fluid flow path between the source of treatment fluid 350 and the suction valve 326 during pumping.

Typically, the suction valve 326 can also include a seal 2215 configured to prevent fluid flow through the suction valve 326 in the closed position. For example, the seal 2215 can be disposed on the poppet 2205 and/or the seat 2210. In embodiments, the seal 2215 may be configured for use with/contact with treatment fluid (e.g. resistant to treatment fluid, so as not to readily degrade due to exposure to treatment fluid). For example, the seal 2215 may be abrasive and/or corrosive (e.g. acid) resistant. In embodiments, the vent rod 2305 can be configured to extend axially through the suction valve 326 (e.g. the seat/passage), for example along the centerline axis of the suction valve/seat/passage. Some poppet 2205 embodiments may have a contact element configured for contact with the vent rod 1987 when the vent rod 1987 is in the extended position. In some embodiments, the contact element may extend from the surface of the poppet 2205 distal to the chamber 321 (e.g. extending through the passage/opening 2220 in the seat 2210). In some embodiments, the poppet 2205 and the seat 2210 may have corresponding contact surfaces (e.g. corresponding angled surfaces), and the seal 2215 may be disposed on one or both contact surfaces.

Figure 20:
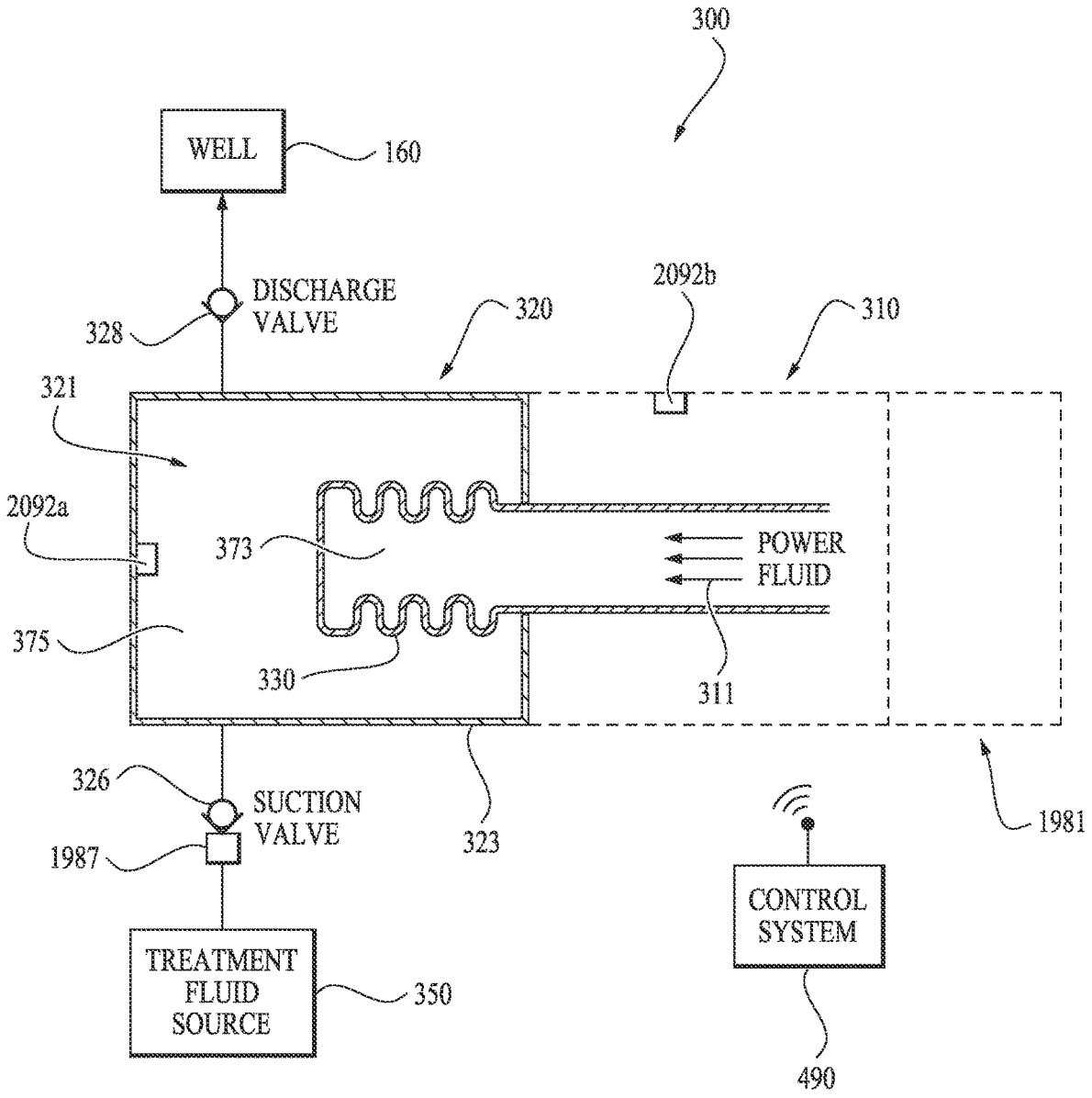
FIG. 20 is a schematic illustration of another exemplary bellows pump system, according to an embodiment of the disclosure.

Some bellows pump systems may additionally include a control system 490. In some embodiments, the control system 490 may be configured to stop the pump 300 (e.g. issue a stoppage command to the pump/driver), responsive to receiving a stop command. See for example, FIG. 19. The stop command can be a normal stop command (for example stoppage based on maintenance or on reducing pumping volume into the well) or an emergency stop command. The stop command can be issued by a user/personnel, or maybe automated in some embodiments. In some embodiments, the control system 490 may include one or more sensor configured to detect one or more parameter of the system at one or more location in the system, and the control system 490 may be configured to receive data from the one or more sensor (for example, the types of data which might be used to evaluate the need for an emergency stop, such as a synchronization error, a prime mover fault, flowrate, undesirable well response, pressure, temperature, electrical fault, sensor fault, detectable bad valve condition, and/or bellows damage detection), to evaluate the sensor data to detect an emergency stop condition, and responsive to detecting an emergency stop condition, to stop the pump 300 (e.g. issuing a stoppage command to the pump/driver). In some embodiments, responsive to pump stoppage, the control system 490 may be configured to instruct the venting mechanism 1987 to vent the chamber 321 (e.g. with the venting mechanism 1987 in the extended position). In some embodiments, the control system 490 may have one or more sensor 2092*a*, 2092*b* configured to detect one or more parameter of the system at one or more location in the system, wherein the control system 490 is configured to receive data from the one or more sensor 2092*a*, 2092*b* (e.g. position data for the bellows 330 and/or piston, hydraulic system performance data, such as flow and/or pressure, and/or data indicating that a prime mover (e.g. a driver) has stopped), to evaluate the sensor data to detect pump 300 stoppage (e.g. no movement of the bellows 330 or power end 310, for example compared to a pre-set threshold), and responsive to detecting pump 300 stoppage, to instruct the venting mechanism 1987 to vent the chamber 321 (e.g. with the venting mechanism 1987 in the extended position). See for example, FIG. 20, illustrating an exemplary system. In some system embodiments, responsive to restarting of the pump 300, the control system 490 may be configured to instruct the venting mechanism 1987 to stop venting the chamber 321 (e.g. with the venting mechanism 1987 in the retracted position (e.g. releasing the suction valve 326, so that the suction valve 326 may again operate as a one-way check valve).

Figure 21:
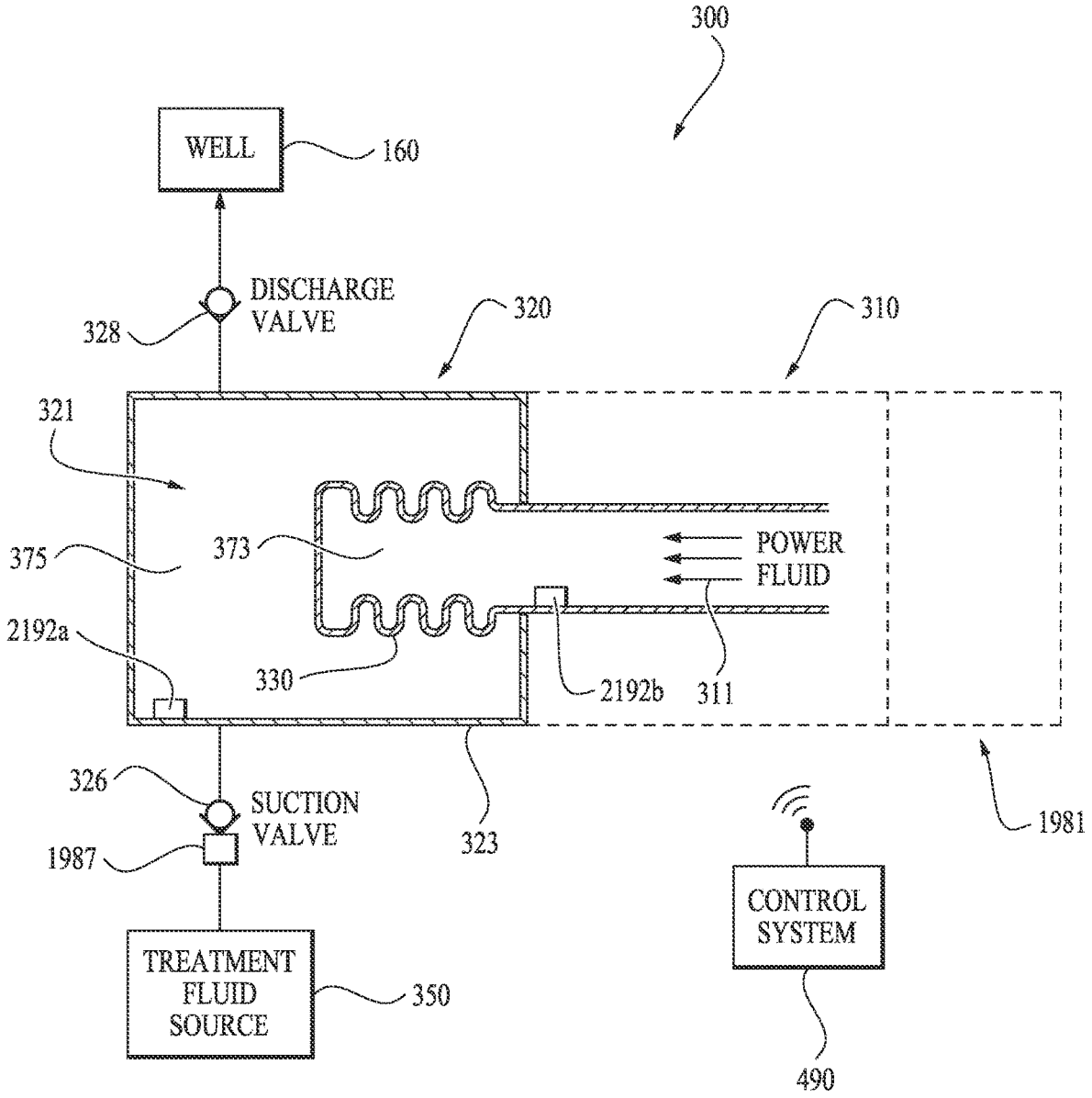
FIG. 21 is a schematic illustration of yet another exemplary bellows pump system, according to an embodiment of the disclosure.

While some embodiments may be configured to vent the chamber 321 upon pump stoppage, other embodiments may be configured to vent the chamber 321 based on detection of a leak. For example, in FIG. 21 the venting mechanism 1987 may be configured to vent the chamber 321 in the event that leakage is detected (e.g. responsive to detection of leakage of treatment fluid into the chamber 321 through the discharge valve 328). For example, the control system 490 may have one or more sensor 2192*a*, 2192*b* configured to detect one or more parameter of the system at one or more location in the system, and the control system 490 may be configured to receive data from the one or more sensor 2192*a*, 2192*b* (e.g. configured to detect one or more parameter of the system indicative of a discharge leak-such as pressure in the chamber 321, pressure in the bellows 330, flow rate, and/or detection of poor valve performance), to evaluate the sensor data to detect a leak (e.g. of treatment fluid into the chamber 321 through the discharge valve 328), and responsive to detecting a leak, to open the suction valve 326 (e.g. instruct the venting mechanism 1987 to vent the chamber 321).

In some embodiments, responsive to opening the suction valve, the control system 490 may be configured to stop the pump 300 (e.g. issue a stoppage command to the pump/driver). In other embodiments, the suction valve 326 may be held open (e.g. by the venting mechanism 1987) even while the pump 300 runs. For example, the suction valve 326 may be held open even as the bellows 330 reciprocates in the chamber 321 and/or as the driver element 1981 continues to operate. Holding the suction valve 326 open even as the pump 300 runs may protect the bellows 330 from damage due to excessive pressure in the chamber 321. This approach may be particularly useful in system embodiments in which more than one bellows and/or more than one pump is commonly driven.

Figure 24:
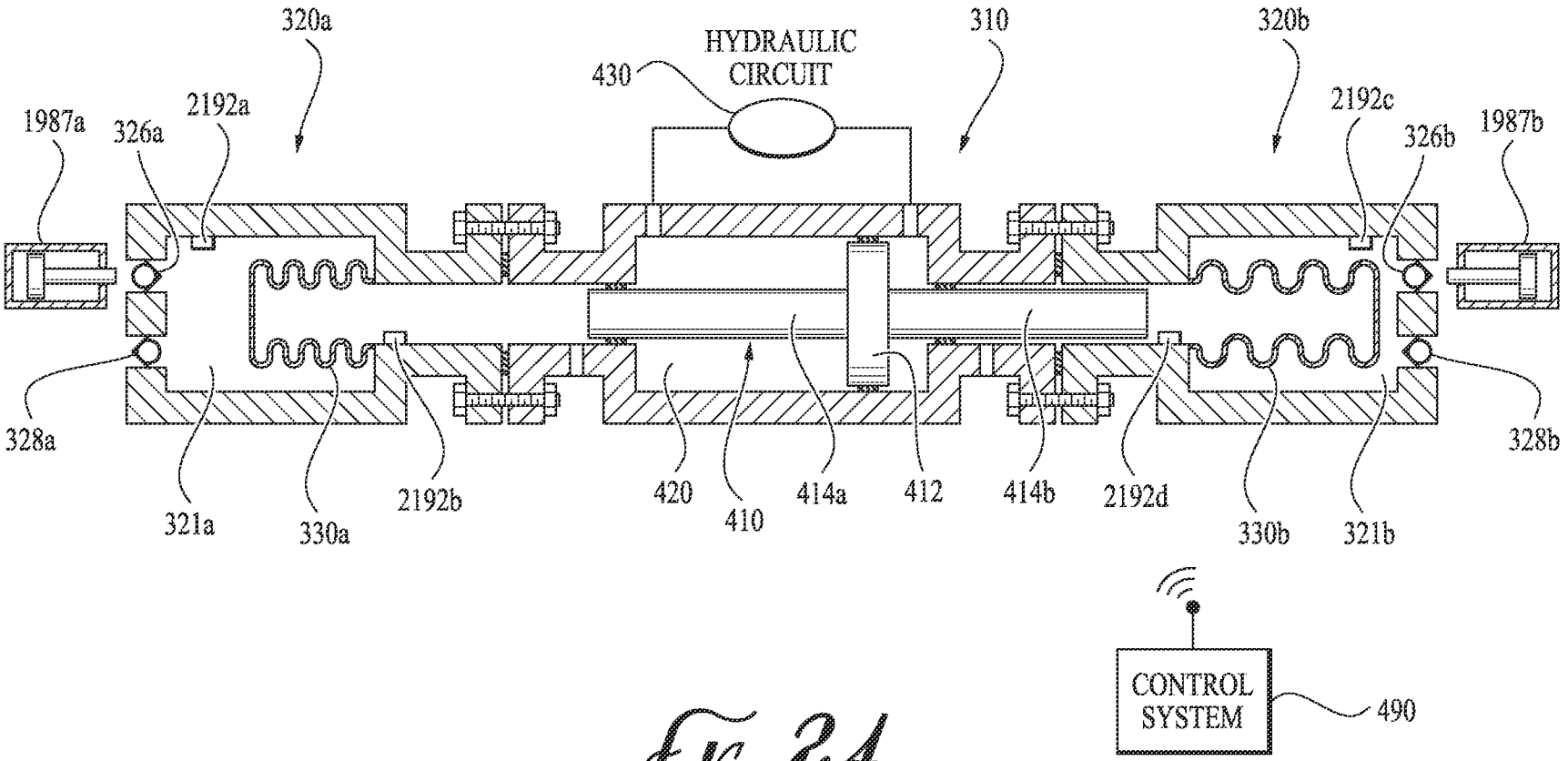
FIG. 24 is a schematic illustration of an exemplary dual bellows pump system, according to an embodiment of the disclosure.

For example, in some embodiments the pump 300 may be a dual bellows pump (see for example, FIG. 24) further having a second fluid end (e.g. having a first fluid end 320*a* and a second fluid end 320*b*). The first fluid end 320*a* may be similar to the embodiments described above with respect to FIGS. 19-23. The second fluid end 320*b* may include a second chamber 321*b*, a second suction valve 326*b* in fluid communication with the second chamber 321*b* and the source of treatment fluid 350 (or another/second source of treatment fluid—e.g. the source of treatment fluid can include multiple sources of treatment fluid), a second discharge valve 328*b* in fluid communication with the second chamber 321*b* and the well 160, and a second expandable bellows 330*b* disposed in the second chamber 321*b* and in fluid communication with the power end 310. In some embodiments, the second fluid end 320*b* may be substantially the same as the first fluid end 320*a* (e.g. which may be substantially the same as the fluid end embodiments described herein). The power end 310 can be configured to reciprocally expand and contract the both the first bellows 330*a* and the second bellows 330*b* based on movement of drive fluid. In embodiments, the bore 420 of the power end 310 can be fluidly coupled to (e.g. in fluid communication with) both the first fluid end 320*a* and second fluid end 320*b* (e.g. the first bellows 330*a* and second bellows 330*b*). The bore 420 may extend out of two (e.g. opposite) sides of the power end 310, for example with two second portions of the bore 420 (e.g. configured for the rod, as discussed above) extending from a single first portion of the bore 420 (e.g. configured for the head, as discussed above).

The power end 310 can be configured to reciprocally expand and contract both the first and second bellows 330*a*, 330*b* based on movement of drive fluid by the piston 410. For example, the piston 410 may have a head 412 and two rods 414*a*, 414*b*, with the rods 414*a*, 414*b* extending from opposite sides of the head 412 (e.g. with the first rod 414*a* extending towards the first fluid end 320*a*/bellows 330*a* and the second rod 414*b* extending towards the second fluid end 320*b*/bellows 330*b*). In some embodiments, the two rods 414*a*, 414*b* may be aligned (e.g. having the same longitudinal centerline axis) and/or may extend outward along the centerline axis of the head 412 and/or first portion 422 of the bore 420. The driver, such as a hydraulic circuit 430 (see FIG. 4), may be configured to reciprocate the piston 410 based on pressure differential across the head 412 of the piston 410, thereby reciprocating the rods 414*a*, 414*b* (and thereby the bellows 330*a*, 330*b*).

In embodiments, the venting mechanism 1987*a* can be configured to vent the first chamber 321*a* in the event that leakage is detected in the first chamber 321*a* (e.g. responsive to detection of leakage of fluid into the first chamber 321*a* through the first discharge valve 328*b*). For example, the control system 490 may have one or more sensor 2192*a*, 2192*b* configured to detect one or more parameter of the system at one or more location in the system, and the control system 490 may be configured to receive data from the one or more sensor 2192*a*, 2192*b*, to evaluate the sensor data to detect a leak (e.g. of treatment fluid into the first chamber 321*a* through the first discharge valve 328*a*), and responsive to detecting a leak (e.g. in the first chamber 321*a* and/or through the first discharge valve 328*a*), to vent the first chamber 321*a*. In embodiments, the first suction valve 326*a* may be held open (e.g. by the first venting mechanism 1987*a*) even while the dual bellows pump 300 continues to run. For example, the first suction valve 326*a* may be held open while the second bellows 330*b* continues to pump treatment fluid through the second chamber 321*b* to the well and/or while the piston 410/driver (e.g. hydraulic circuit 430 in FIG. 24) continues to provide reciprocation. In some embodiments, despite the pump 300 continuing the run, holding the first suction valve 326*a* open may protect the first bellows 330*a* from damage due to leakage through the first discharge valve 326*b*. This may allow the pump 300 to continue operating using one side (e.g. the second fluid end 320*b*) of the dual bellows pump, even when there is a detected leak causing the other side (e.g. the first fluid end 320*a*) of the dual bellows pump to be disabled/protected (e.g. to protect the bellows on the leaking side from damage).

Some system embodiments can further comprise a second venting mechanism 1987*b* (e.g. which may be similar to the first venting mechanism 1987*a*) configured to vent the second chamber 321*b* of treatment fluid. The first and second venting mechanisms 1987*a*, 789*b* may be configured to vent their corresponding chamber in the event that leakage is detected in the corresponding chamber 321*a*, 321*b* (e.g. responsive to detection of leakage of fluid into the corresponding chamber 321*a*, 321*b* through the corresponding discharge valve 328*a*, 328*b*). In embodiments, the control system 490 may have one or more sensor 2192*a*-2192*d* configured to detect one or more parameter of the system at one or more location in the system, and the control system 490 may be configured to receive data from the one or more sensor 2192*a*-2192*d*, to evaluate the sensor data to detect a leak (e.g. of treatment fluid into the first or second chamber 321*a*, 321*b* and/or through the first or second discharge valve 328*a*, 328*b*), and responsive to detecting a leak, to vent the corresponding chamber 321*a*, 321*b* (e.g. to open the corresponding suction valve 326*a*, 326*b*, for example by instructing the corresponding venting mechanism 1987*a*, 1987*b*). The corresponding suction valve may be held open even while the dual bellows pump 300 continues to runs (e.g. while the bellows of the non-leaking chamber pumps treatment fluid through the correspond chamber to the well and/or while the piston/driver continues to reciprocate).

In other examples, the bellows pump 300 (which may be a single or dual bellows pump) may be just one of a plurality of pumps jointly operating to pump treatment fluid into the well. For example, in addition to the bellows pump 300 embodiments described above (for example with respect to FIGS. 19-24), the system can also include one or more additional pump 300*a*-300*n* and a common driver element

Figure 25:
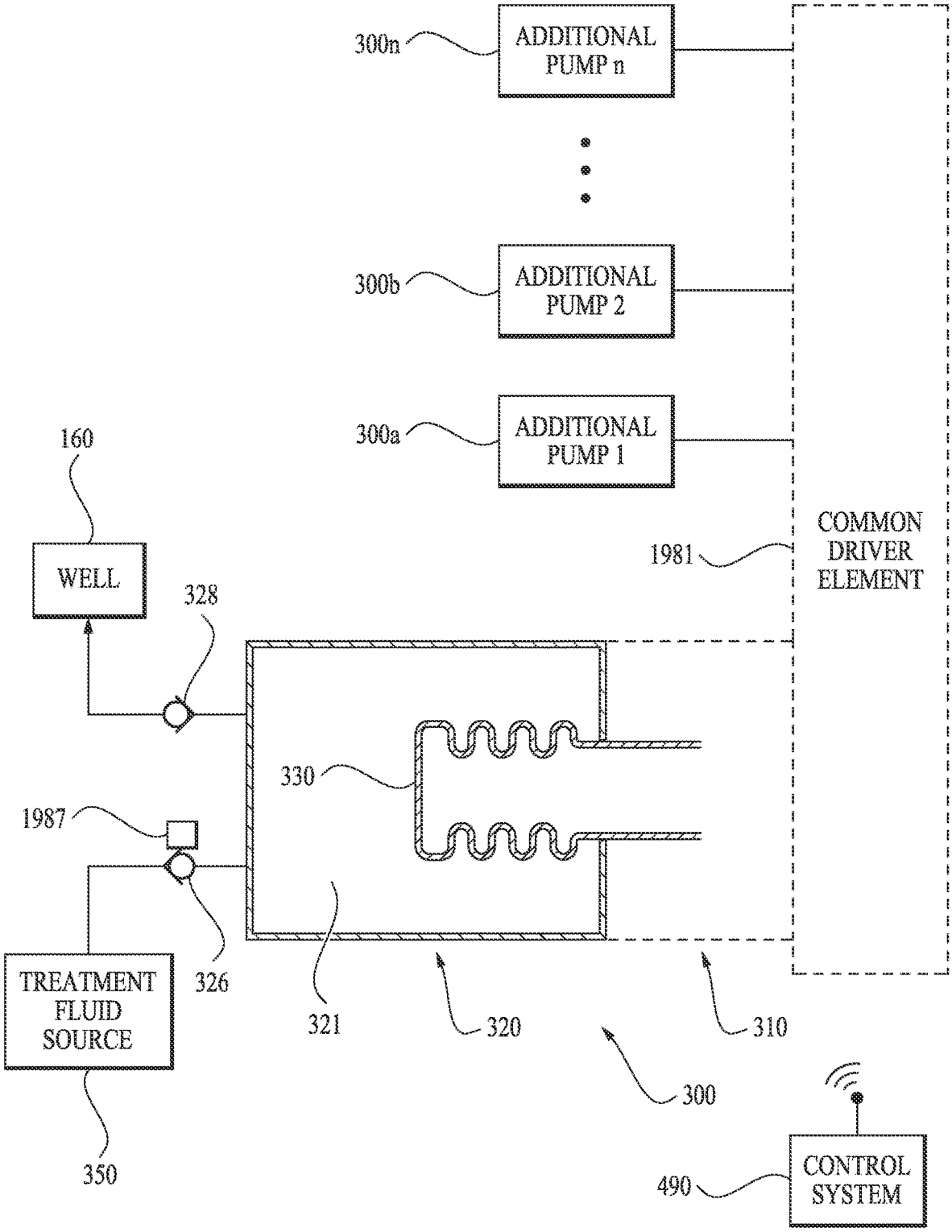
FIG. 25 is a schematic illustration of still another exemplary bellows pump system, according to an embodiment of the disclosure.

1981. The common driver element 1981 can be configured to drive the power end 310 of the bellows pump 300 and the one or more additional pumps 300*a*-300*n* (e.g. simultaneously). The bellows pump 300 and the one or more additional pumps 300*a*-300*n* can be configured to jointly pump treatment fluid to the well 160. FIG. 25 provides a schematic illustration of a system having a bellows pump 300 and multiple additional pumps (e.g. 300*a*-300*n*) configured to jointly pump treatment fluid into a well 160. In some embodiments, the plurality of pumps may be configured to provide constant pumping at approximately constant pressure. For example, one or more pump (e.g. 300*a*) may be configured so that its power stroke is out of sync with the power stroke of one or more other of the pumps (e.g. 300*b*). In some embodiments, half of the pumps may be configured to have their power/discharge strokes in sync, for example when the other half of the pumps are having their suction stroke. In some embodiments, all of the pumps may draw from the same treatment fluid source 350, while in other embodiments, one or more of the pumps may draw from an independent fluid source.

As discussed above, the venting mechanism 1987 can be configured to vent the chamber 321 of the bellows pump 300 in the event that leakage is detected in the chamber 321 (e.g. responsive to detection of leakage of fluid into the chamber 321 through the discharge valve 328). For example, the control system 490 may have one or more sensor (as previously discussed) configured to detect one or more parameter of the system at one or more location in the system, and the control system 490 may be configured to receive data from the one or more sensor, to evaluate the sensor data to detect a leak (e.g. of treatment fluid into the chamber 321 and/or through the discharge valve 328), and responsive to detecting a leak (e.g. in the chamber 321 of the bellows pump 300 and/or through the discharge valve 328), to vent the chamber 321 (e.g. instructing the venting mechanism 1987 to vent the chamber 321, for example by opening the suction valve 326). In embodiments, the suction valve 326 of the bellows pump 300 can be held open even while the one or more additional pump 300*a*-300*n* continues to run (e.g. while the one or more additional pump 300*a*-300*n* introduces treatment fluid into the well and/or while the common driver 1981 continues to reciprocate). This may allow the system to continue operating using the one or more additional pump 300*a*-300*n*, even when there is a detected leak causing the bellows pump 300 to be disabled (e.g. configured so as to not pump treatment fluid, to protect the bellows 330 from damage). In some embodiments, the one or more additional pumps 300*a*-300*n* (e.g. of a multi-pump system, for example with the multiple pumps driven by a common driver element 1981) may also be similarly configured to the bellows pump 300 and/or to each other, for example with a venting mechanism 1987 for holding open the suction valve in the event of a discharge valve leak.

Figure 26:
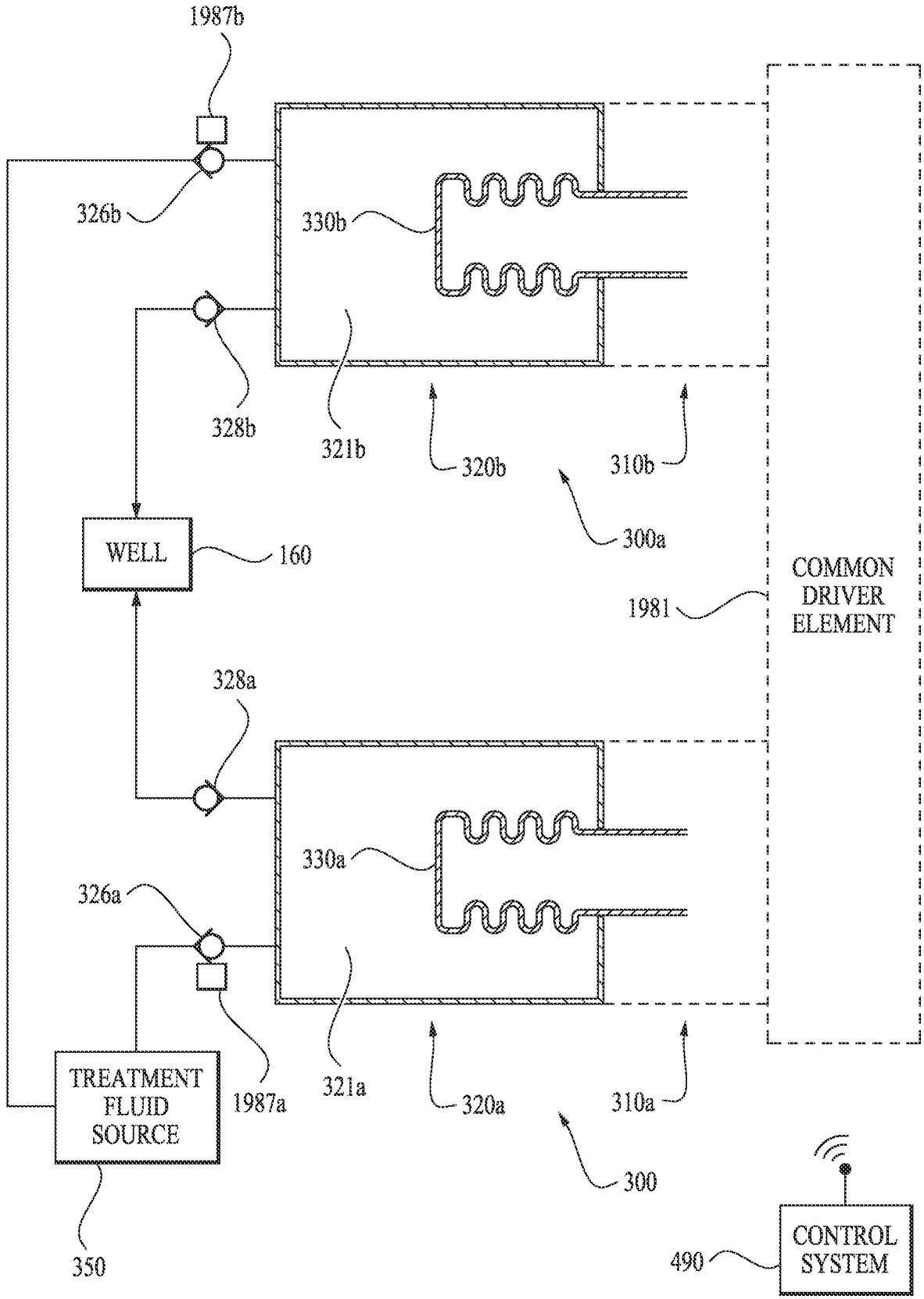
FIG. 26 is a schematic illustration of yet another exemplary bellows pump system, according to an embodiment of the disclosure.

FIG. 26 illustrates a similar exemplary system, in which two bellows pumps 300*a*, 300*b* (which may be similar) are driven by a common driver element 1981. If a leak is detected in either chamber 330*a* or 330*b*, the corresponding venting mechanism 1987*a*, 1987*b* may operate to vent the corresponding chamber 321*a*, 321*b* (for example holding the corresponding suction valve 326*a*, 326*b* open). The other pump may continue to operate (e.g. continuing to introduce treatment fluid into the well via the non-leaking pump) and/or the common driver element 1981 may continue operating. This may allow the system to continue operating, even when there is a detected leak causing one of the bellows pump to be disabled/vented.

While many embodiments may vent the chamber by holding open the suction valve, in alternate embodiments, the venting mechanism can include a separate vent valve configured to allow venting of the chamber. For example, the vent valve may be an active valve, and the venting mechanism can be configured to open the vent valve to allow treatment fluid to flow out of the chamber through the vent valve (e.g. either due to pump stoppage or due to detection of a leak). In some embodiments, the fluid flowing out of the chamber through the venting valve may be directed to the source of treatment fluid. In some embodiments, the fluid flowing out of the chamber during venting may be recirculated back into the chamber once pump operation resumes.

Variations of all disclosed embodiments, for example having and/or deleting one or more aspects of various disclosed embodiments illustrated in the figures, are included herein. As persons of skill will appreciate, various aspects illustrated in one or more of the disclosed embodiments may be combined and/or deleted, thereby illustrating still further disclosed embodiments included within the scope of this disclosure.

While the suction valve 326 and the discharge valve 328 may each be one-way check valves, in alternate embodiments, any other suitable valve may be used as either the suction valve 326 and/or discharge valve 328. For example, the suction valve 326 could be an active valve, and the control system 490 could use an actuator/venting mechanism to operate the valve (in standard pumping operation and/or for venting to protect the bellows). Although not required, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver element/mechanism 1981 capable of reciprocally expanding and contracting the bellows 330 may be used, and are included within the scope of this disclosure.

So, the bellows pump according to certain embodiments of the present disclosure may comprise a valve management system that includes one or more check valves that allow the treatment fluid to flow in a selected direction within the bellows pump. For example, the bellows pump may include at least a discharge valve and a suction valve, and the discharge valve and/or the suction valve may comprise a one-way check valve that only allows the treatment fluid to flow downstream of the fluid treatment source (e.g. with the suction valve between the fluid treatment source and the chamber/bellows, and the discharge valve between the chamber/bellows and the well). In some embodiments, the suction valve may comprise a check valve that includes an actuator that is configured open the suction valve when the operation of the bellows pump is stopped, inter alia, to allow treatment fluid to flow upstream of the fluid end and the bellows out of the bellows pump and/or to a treatment fluid source or collection vessel. This may, in some instances, prevent amounts of treatment fluid from flowing back into the fluid end and thereby prevent that treatment fluid from damaging the bellows and/or otherwise hindering operation of the pump.

Returning now to FIG. 19, a bellows pump 300 may have a fluid end body 320 with an internal cavity (e.g. chamber 321). In the operation of the bellows pump 300, the driving fluid can be separated from the treatment fluid by the bellows 330, which may be comprised of a thin flexible material that separates the internal cavity of the fluid end 320 into at least a first volume within the bellows 330 and a second volume in the chamber 321 outside the bellows 330. In some embodiments, the bellows 330 may not be designed to withstand significant pressure differentials between the first volume and the second volume. Instead, the bellows 330 serves as a fluid separating barrier between the first volume for driving fluid (e.g. within the bellows 330) and the second volume for treatment fluid (e.g. in the chamber 321). During operation of the bellows pump 300, the bellows 330 can flex axially to keep pressure balanced between first volume and the second volume during operation. On a discharge stroke, as driving fluid enters first volume, the bellows 330 inflates and treatment fluid is expelled from the second volume (e.g. the chamber 321) through discharge valve 328. Once the discharge stroke is complete, a suction stroke begins. During the suction stroke, the bellows 330 deflates, and treatment fluid is drawn through suction valve 336 into the chamber 321. Once the bellows 330 is compressed to its minimum desired length, another discharge stroke begins. In some embodiments, one or both of discharge valve 328 and suction valve 326 may comprise a check valve system, as shown for example in FIGS. 22-23 and described in further detail below.

Referring back to FIG. 19, when the operation of the bellows pump 300 is stopped, the treatment fluid may leak through discharge valve 328 (opposite the direction of flow shown), allowing pressurized treatment fluid to flow backward into the chamber 321 inside fluid end 320. In some instances, this leakage of pressurized fluid could cause the bellows 330 to be crushed or compressed beyond the desired minimum length, which can cause damage to the bellows 330 or otherwise interfere with the proper operation of the bellows pump 300. Therefore, in some embodiments, it may be advantageous to use a discharge valve 328 that is less prone to allow leakage.

In some embodiments, a check valve system that may be used in such applications (e.g., as the discharge valve 328 or the suction valve 326) is illustrated in FIG. 22. When the check valve is in the closed position as shown in FIG. 22, poppet 2205 is seated against seat 2210 on the outlet (e.g. passage 2220) of the valve. The poppet 2205 can be urged off seat 2210 by fluid flow through passage 2220 only in one direction (i.e., as indicated by the flow arrow), and thus only allows fluid to pass between seat 2210 and poppet 2205 when flowing in the indicated direction. Fluid flow through outlet/passage 2220 in the reverse direction is prevented by the poppet 2205 being forced against the seat 2210 by the fluid and sealed against the seat by an elastomeric insert/seal 2215 on poppet 2205. In some embodiments, an elastomeric insert may be installed on seat 2210 instead of or in addition to the elastomeric insert on poppet 2205, among other reasons, to improve the integrity of the seal between the poppet 2205 and the seat 2210. Such check valve systems may be used for one or both of the suction valve 326 and discharge valve 328. In some embodiments, the check valve systems may be passive and urged to their closed positions by springs, which may provide the biasing force urging the valves towards their closed positions.

In some instances, it may be desirable to temporarily stop the operation of the bellows pump 300 during the treatment operation for a number of different reasons. For example, in the case of a fracturing operation, it may be desirable to stop the operation of the pump 300 for a short period of time to create pressure pulses in the subterranean formation, which may enhance the nature of the fractures formed therein. In other instances, operation of the pump 300 may be stopped when the total flow rate required from a plurality of pumps is reduced, or if the pump 300 is stopped for maintenance activities or remedial measures. In cases where the bellows pump 300 is stopped, it may be desirable to prevent accumulation of reverse-leaking treatment fluid from accumulating in the fluid end body (e.g. chamber 321). One method to accomplish this is to force open the suction valve 326 of the bellows pump 300 to allow treatment fluid leakage to return to the treatment fluid source 350 upstream of the suction valve.

FIG. 23 shows a check valve system similar to that of FIG. 22, but modified to include a mechanism (e.g. venting mechanism 1987) for forcing the suction valve 326 open, e.g., to allow treatment fluid leakage to return to the treatment fluid source 350 upstream of the suction valve 326. When used as the suction valve (e.g., valve 326 in FIG. 19), the check valve system can be used to prevent treatment fluid from accumulating inside the chamber 321 and causing damage to the bellows 330 or otherwise hindering operation of the bellows pump 300. In this embodiment, an actuator 2310 can be used to hold poppet 2205 off its seat 2210 by extending a rod 2305 against poppet 2205 and thus opening a flow passage between the poppet 2205 and the seat 2210 which can allow for reverse flow. In some embodiments, the rod 2305 may be attached to the poppet 2205. Actuator 2310 may comprise any type of mechanism that can cause the poppet 2205 to travel axially (i.e., in the upward direction in FIG. 11, towards the poppet 2205). In some embodiments, the actuator 2310 may comprise an electric actuator, a hydraulically-driven actuator, a mechanically-driven actuator, a pneumatically-driven actuator, a magnetically-driven actuator, a spring-loaded actuator, a solenoid, a linear actuator, or any combination or variation thereof. As a person of skill in the art would understand, the present disclosure may utilize any actuator of any suitable design and configuration in the check valve system of FIG. 23, and may configure that actuator to engage the poppet 2205 in any suitable manner.

When the bellows pump 300 of FIG. 19 is stopped, actuator 2310 lifts poppet 2205 off of seat 2210 thus creating the flow passage through which any treatment fluid that might leak into the fluid end body (e.g. chamber 321) may instead flow through the suction valve 326 (e.g., through valve 326 in the reverse direction of the flow indicated by the arrow). In some embodiments, the fluid may be recovered to a treatment fluid source 350 for recirculation into the bellows pump 300, another pumping system, or other system for conditioning of the treatment fluid. When operation of bellows pump 300 resumes, actuator 2310 retracts downward, allowing poppet 2205 to return to seat 2210 and function again as a one-way check valve.

One or more bellows pumps with a valve management system according to the present disclosure may be used in conjunction with any type of fracturing or other treatment fluid operation and in any suitable capacity in the treatment system. In some embodiments, one or more bellows pumps may be used as the primary fracturing pumps in a fracturing system or operation. In some embodiments, one or more bellows pumps may be used in combination with other fracturing pumps, e.g., as an intensifier or booster to increase the pressure of the fracturing fluid.

Disclosed embodiments also comprise exemplary methods for pumping treatment fluid into a well. Such methods may use any of the disclosed pump or system embodiments, such as the examples illustrated in FIGS. 19-26. For example, an exemplary method embodiment may comprise: pumping treatment fluid into the well using a bellows pump having a chamber with a bellows disposed therein (e.g. using any of the pump system embodiments disclosed herein); and responsive to pump stoppage, venting fluid from the chamber. In embodiments, venting fluid from the chamber may further comprise venting the chamber for the duration of pump stoppage (e.g. until the pump is restarted, and treatment fluid is again introduced into the well). In embodiments, venting fluid may comprise opening a suction valve in fluid communication with the chamber, and holding the suction valve open for the duration of pump stoppage (e.g. until the pump is restarted, and treatment fluid is again introduced into the well). In embodiments, opening the suction valve may involve moving a venting mechanism to an extended position. Opening a suction valve and holding it open may act to temporarily reconfigure the suction valve from a one-way check-valve to an open port (e.g. for the duration of the suction valve being held open).

Embodiments may further comprise releasing the suction valve, for example responsive to re-starting the pump. In embodiments, releasing the suction valve may include moving the venting mechanism to a retracted position. Method embodiments may also include, responsive to opening the suction valve, draining/venting/reversing flow of treatment fluid from the chamber (e.g. through the suction valve to the source of treatment fluid). Some embodiments also comprise recovering treatment fluid (e.g. at the source of treatment fluid) for recirculation upon pump restart.

Some method embodiments may further comprise, responsive to receiving (e.g. at the control system) sensor data from one or more sensor configured to detect one or more parameter of the bellows pump system (e.g. one or more sensor disposed on the bellows pump—for example one or more position sensor), detecting (e.g. using the control system) pump stoppage based on the sensor data. And in some embodiments, responsive to detecting pump stoppage, the method may include venting fluid from the chamber. For example, embodiments may include opening a suction valve in fluid communication with the chamber, and holding the suction valve open for the duration of pump stoppage (e.g. until the pump is restarted, and treatment fluid is again introduced into the well). Other method embodiments may further comprise, responsive to receiving (e.g. at the control system) a stop command (which may be an emergency stop command in some instances), venting fluid from the chamber (e.g. opening a suction valve in fluid communication with the chamber, and holding the suction valve open for the duration of pump stoppage (e.g. until the pump is restarted, and treatment fluid is again introduced into the well).

While the method embodiments described above relate to venting the chamber in the event of pump stoppage, in other embodiments, venting may be based on detection of leakage. For example, another exemplary method may comprise pumping treatment fluid into the well using a bellows pump having a chamber with a bellows disposed therein (e.g. using any of the pump system embodiments disclosed herein); responsive to receiving (e.g. at the control system) sensor data from one or more sensor configured to detect one or more parameter of the bellows pump system (e.g. one or more sensor disposed on the bellows pump and configured to detect one or more parameter indicative of leakage, such as pressure in the chamber and/or bellows), detecting (e.g. using the control system) a leak (e.g. in the chamber and/or through the discharge valve) based on the sensor data; and responsive to detecting a leak, venting fluid from the chamber (e.g. opening a suction valve in fluid communication with the chamber, and holding the suction valve open). In some embodiments, the pump may be stopped in response to venting the fluid and/or detecting leakage. In other embodiments, venting the fluid can occur/continue even while the pump is running (e.g. while the bellows and/or power end/driver element is reciprocating). For example, some embodiments may include continuing to reciprocate the bellows and/or piston and/or drive element, even while the suction valve is held open.

For example, in some embodiments the pump may be a dual bellows pump, and the suction valve (e.g. the suction valve corresponding to the chamber having a leak) may be held open even while the dual bellows pump continues to run (e.g. while the second bellows pumps treatment fluid through a second chamber to the well and/or while the piston continues to reciprocate). This may allow continued pumping of treatment fluid into the well (e.g. pumping via the second bellows of the dual bellows pump), even while the suction valve is held open (e.g. in relation to the chamber with a leak).

In another example, pumping treatment fluid may occur using one or more additional pump (as well as the bellows pump, e.g. jointly working to pump treatment fluid). For example, the bellows pump and the one or more additional pump can be driven by a common driver element. In such system embodiments, the method may include continuing to pump treatment fluid into the well (e.g. using the one or more additional pump), even while the suction valve is held open in the bellows pump. For example, the suction valve may be held open, even while the common driver continues to reciprocate and/or the one or more additional pumps continue to introduce treatment fluid into the well.

One or more of the pump embodiments disclosed herein (e.g. relating to FIGS. 19-26) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments or aspects thereof, and/or a non-transitory computer-readable medium can have program instructions stored thereon configured to cause a control system (e.g. of the bellows pump system) to perform any of the disclosed method embodiments or aspects thereof. Such instructions may be used by the control system of the disclosed bellows pump system embodiments, for example to operate the bellows pump system (which may include disclosed pump embodiments).

As previously mentioned, in certain piston-driven bellows-style pumps, keeping the piston and bellows in sync can be important (as discussed above). Accordingly, some embodiments of a bellows pump system may include a make-up system configured to maintain synchronous movement (for example, by maintaining a controlled volume of fluid between the piston and the bellows). In some embodiments, the make-up fluid of the make-up system may be shared by (e.g. in fluid communication with) one or more other/additional components of the bellows pump system, since the same fluid may be used for the make-up system as is used for operations of the pump itself or operations of other components of the system (for example using the fluid in hydraulic operations and/or as lubricant). This may lead to heat accumulation in the make-up system, which should be dissipated to keep the system operating effectively and to prevent damage to the system. Additionally, it may be advantageous to eliminate or to minimize the size/amount of external cooling systems needed to address heat issues for the system, since there is often a lack of space in proximity to well sites and/or since this may reduce cost, maintenance, size, supply issues, etc. Thus, there is a need for improved bellows pump systems configured to better handle heat build-up, for example in and/or using the make-up system.

FIGS. 27-31 provide schematic illustration of exemplary bellows pump system embodiments having a bellows pump 300 similar to the pump embodiments shown in FIGS. 3-5, and having a make-up system 510 which can be configured to cool additional/other components of the system which may be in fluid communication with the make-up system 510. For example, disclosed embodiments may comprise a bellows pump 300 and a make-up system 510. In disclosed embodiments, the make-up system 510 can be configured to both keep the piston and bellows in sync (e.g. by maintaining a controlled volume of fluid (e.g. make-up/drive fluid) between the piston and the bellows) and to cool fluid (e.g. make-up/drive fluid) from at least one additional component of the system (e.g. simultaneously and/or concurrently performing both operations). In some embodiments, the make-up system 510 may be configured as the sole cooling system for the overall bellows pump system (having the pump and the at least one additional component), while in other embodiments the make-up system 510 may work with one or more external/additional/independent cooler system to jointly cool the overall bellows pump system (for example, allowing for use of a smaller external cooler, while still effectively cooling the system). In embodiments, a control system may be configured to determine and control appropriate circulation of fluid, for example to optimize cooling as well as to maintain synchronous movement of the bellows and the piston.

Figure 27:
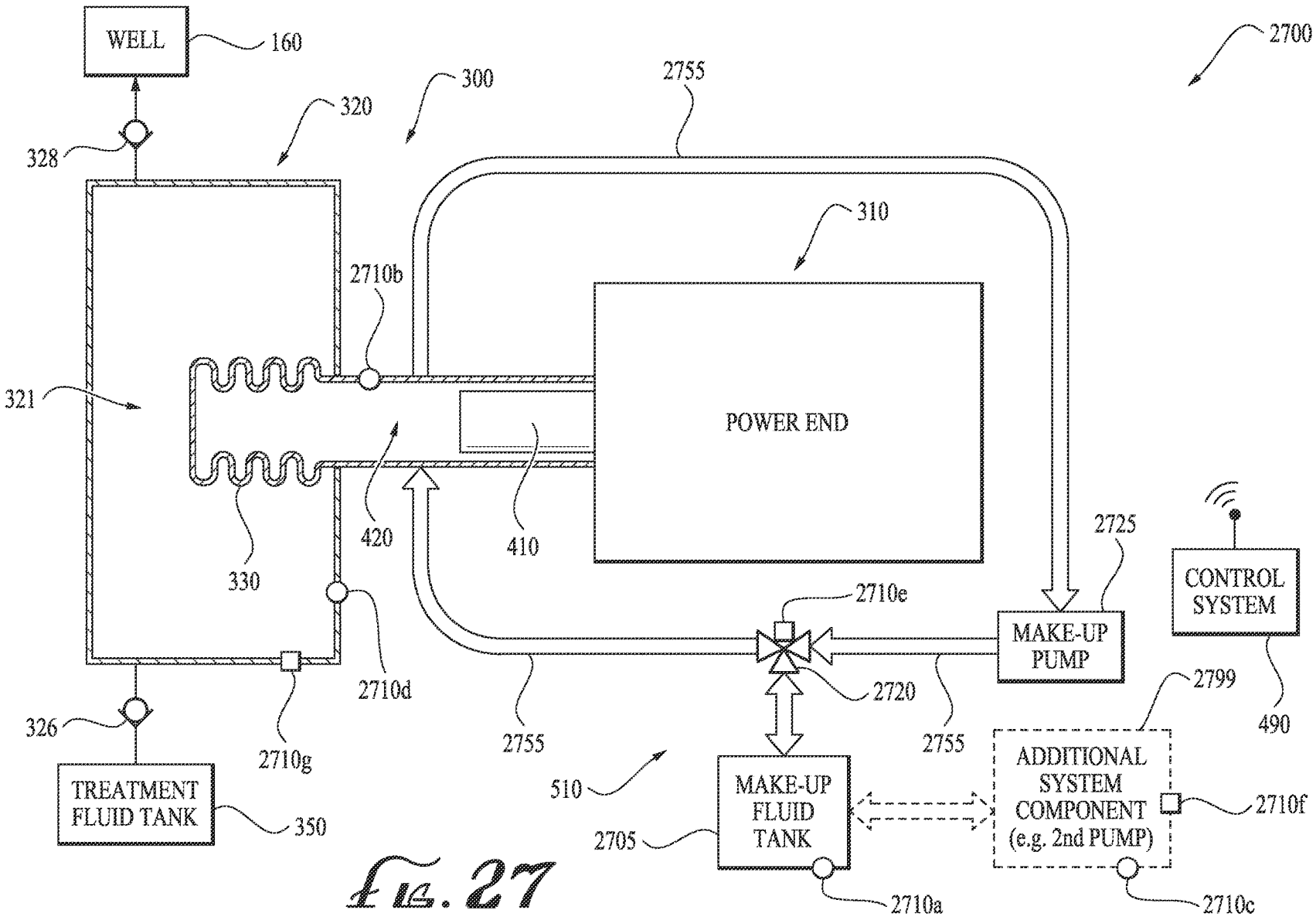
FIG. 27 is a schematic illustration of an exemplary bellows pump system having a make-up system, according to an embodiment of the disclosure.

FIG. 27 schematically illustrates a system 2700 having a bellows pump 300, configured to pump treatment fluid into a well 160, and a make-up system 510. As previously discussed, the pump 300 can include a power end 310 having a piston 410 (e.g. disposed in a bore 420 of the power end 310, with the bore 420 in fluid communication with the bellows 330 and the piston 410 configured to reciprocally move fluid with respect to the bellows 330), a fluid end 320 having a chamber 321 (e.g. with a suction valve 326 and a discharge valve 328 in fluid communication therewith), and an expandable bellows 330. The power end 310 can be configured to reciprocally expand and contract the bellows 330 within the chamber 321 based on movement of fluid (e.g. make-up/drive fluid) by the piston 410, thereby pumping treatment fluid through the chamber 321 towards the well 160. As treatment fluid passes through the chamber 321, it may pass across/contact the bellows 330. In many embodiments, the treatment fluid may be cooler than the bellows 330 (e.g. with the treatment fluid having a lower temperature that the fluid in the bellows 330), which may allow for the bellows 330 to vent heat (e.g. via conductive heat exchange) into the treatment fluid.

The make-up system 510 may be configured to maintain a controlled volume of fluid (e.g. make-up/drive fluid) between the piston 410 and the bellows 330 and/or to keep the piston 410 and bellows 330 in sync. In embodiments, the make-up system 510 may include a make-up fluid source 2705 (e.g. a tank of make-up/drive fluid) fluidly coupled to the bellows 330 and to at least one additional component 2799 of the system 2700. In embodiments, the make-up system 510 can be configured to receive heat via circulation of fluid (e.g. make-up/drive fluid) with the at least one additional component 2799 of the system 2700 (e.g. with the fluid of make-up system 510 being used as coolant for the at least one additional component 2799), and to discharge heat via circulation of the fluid with the bellows 330 (e.g. in addition to performing its make-up syncing function). For example, the make-up system 510 can be configured to cool fluid (e.g. make-up/drive fluid) from the at least one additional component 2799, in addition to and/or simultaneously with and/or concurrently with maintaining the controlled volume of fluid between the piston 410 and the bellows 330 and/or keeping the bellows 330 and the piston 410 in sync.

Some system 2700 embodiments can also comprise a control system 490, for example having one or more sensor 2710 configured to detect one or more parameter of the system 2700. In embodiments, the control system 490 can be configured to receive data from the one or more sensor 2710, to evaluate the sensor data to determine a circulation protocol/plan for circulating fluid between the make-up system 510 and bellows 330 (e.g. between the make-up fluid source 2705, the bellows 330, and/or the at least one additional component 2799), and responsive to determining a circulation protocol, to circulate fluid between the make-up system 510 and the bellows 330 (e.g. in accordance with/based on the circulation protocol). In some embodiments, the control system 490 can further be configured to evaluate the sensor data to determine whether the bellows 330 and piston 410 are out of sync (e.g. whether the amount of fluid between the piston 410 and the bellows 330 is no longer approximately equal to the controlled volume (e.g. beyond a threshold for the controlled volume of fluid)), and responsive to determining that the bellows 330 and piston 410 are out of sync, to use the make-up system 510 to adjust the amount of fluid between the piston 410 and the bellows 330 to return the piston 410 and bellows 330 to sync (e.g. to return the amount of fluid between the piston 410 and the bellows 330 to the controlled volume), thereby maintaining the controlled volume of fluid between the piston 410 and the bellows 330.

In embodiments, the one or more sensor 2710 may be configured to detect one or more of the following parameters at one or more location within the system 2700: temperature, flow rate, pressure, viscosity, contamination, strain, and/or position of one or more component of the system 2700. For example, in FIG. 27, a first temperature sensor 2710*a* may be disposed on and/or configured to measure the temperature of fluid in the make-up fluid source 2705, a second temperature sensor 2710*b* may be disposed on and/or configured to measure the temperature of fluid in the bellows 330, a third temperature sensor 2710*c* may be disposed on and/or configured to measure the temperature of fluid in the at least one additional component 2799 of the system 2700, and/or a fourth temperature sensor 2710*d* may be disposed on and/or configured to measure the temperature of fluid in the chamber 321 (e.g. the treatment fluid). In some embodiments, a first flow rate sensor 2710*e* may be disposed on and/or configured to measure the flow of fluid in the make-up system 510 (e.g. flowing into and/or out of the bellows 330 and/or into or out of the make-up fluid source 2705 and/or through the make-up pump 2725), a second flow rate sensor 2710*f* may be disposed on and/or configured to measure the flow of fluid in the at least one additional component of the system 2799 (e.g. into, out of, and/or through the at least one additional component 2799), and a third flow rate sensor 2710*g* may be disposed on and/or configured to measure the flow of fluid in the chamber 321 (e.g. the flow of treatment fluid).

In embodiments, the make-up system 510 can further include at least one make-up valve 2720 configured to control fluid flow between the make-up system 510 and the bellows 330 and/or at least one make-up pump 2725 configured to pump fluid between the make-up system 510 and the bellows 330. The make-up system 510 may also include at least one make-up port 515 (see FIG. 5 for example) in fluid communication with the bellows 330 and the make-up fluid source 2705. In FIG. 27, the make-up valve 2720 can be disposed between the make-up fluid source 2705 and the bellows 330, between the make-up fluid source 2705 and the make-up pump 2725, and/or between the bellows 330 and the make-up pump 2725. In some embodiments, the make-up system 510 may further comprise one or more fluid conduit 2755 (e.g. piping or tubing) configured to fluidly couple various portions of the system 2700. For example, fluid conduit 2755 may fluidly couple the make-up fluid source 2705 to the make-up valve 2720, the make-up valve 2720 to the bellows 330, the make-up valve 2720 to the make-up pump 2725, the bellows 330 to the make-up pump 2725, the bellows 330 to the at least one additional component 2799, and/or the at least one additional component 2799 to the make-up pump 2725 or make-up valve 2720 or make-up fluid source 2705. The control system 490 can be configured to operate the make-up pump 2725 and/or make-up valve 2720 to control circulation of fluid between the make-up system 510 and the bellows 330 (e.g. by sending instructions to the make-up valve 2720 and/or make-up pump 2725, which may have actuators responsive to such instructive signals). FIG. 27 illustrates an embodiment in which the control system 490 communicates wirelessly.

By way of example, the at least one additional component 2799 of the system 2700 may include: one or more additional pump, an intensifier, the power end 310 of the pump 300 (e.g. a head of the piston 410 of the power end 310 of the pump 300—e.g. a first portion of a bore 420 of the power end 310 configured for reciprocal movement of the head of the piston 410), a hydraulic circuit configured to reciprocally move the piston 410 within a bore 420 of the power end 310, hydraulics, lube pumps, cylinders, bellows, pistons/plungers, packing, and combinations thereof. In some embodiments, the at least one additional component 2799 may comprise any component of the system 2700 which can use the same fluid as the make-up system 510 and/or which may need fluid cooling.

In embodiments, the control system 490 may determine (e.g. via the circulation protocol) an amount of time to hold fluid in the bellows 330, a source of fluid to circulate to the bellows 330 (e.g. from the make-up fluid source 2705 and/or the at least one additional component 2799), and/or an amount of fluid to circulate to optimize heat transfer/cooling of the fluid. For example, cooling may be optimized based on the amount of time that fluid is held in the bellows 330 and/or the source and amount of fluid circulated. In some embodiments, the amount of fluid to circulate can be approximately equal to the controlled volume of fluid (e.g. being maintained between the piston 410 and the bellows 330). In some embodiments, the control system 490 may use temperature of the bellows 330 and temperature of the make-up fluid source 2705 to determine the circulation protocol. Some embodiments may further use temperature of the at least one additional component 2799 when determining the circulation protocol. In some embodiments, the control system 490 may use flow rate to determine the circulation protocol (e.g. the flow rate of fluid into and/or out of the bellows, the flow rate of treatment fluid, and/or the flow rate of fluid through the make-up system 510). In some embodiments, the control system 490 may (e.g. additionally) use one or more of the following to determine the circulation protocol: temperature of the treatment fluid/chamber 321, pressure (e.g. in the bellows 330 and/or the chamber 321), viscosity, contamination, and/or position of one or more component of the system 2700 (e.g. the position of the piston 410 and/or the bellows 330).

Typically, the bellows 330 (e.g. the fluid in the bellows 330) may have a temperature greater than that of the treatment fluid/chamber 321 (e.g. the bellows 330 is typically hotter than the treatment fluid/chamber 321). Thus, the treatment fluid flowing though the chamber 321 and contacting the bellows 330 can serve as a heat sink, using its relatively cooler temperature (e.g. relative to the bellows 330) to draw heat from the bellows 330 (which may thereby cool the fluid in the bellows 330). It should be understood that hot, cold, hotter, cooler, colder, and other such terms are relative terms and do not denote any specific temperature. Rather, reference to a hot fluid means that the fluid is hotter than a cool fluid of the system and/or has been heated, while reference to a cool fluid means a fluid that is colder than a hot fluid of the system and/or has not been heated or has been heated less than the fluid of another portion of the system (for example another portion of the system with which the fluid is interacting).

In embodiments, circulation of fluid between the make-up system 510 and the bellows 330 may comprise introducing/injecting (e.g. heated/hot) fluid from the make-up fluid source 2705 into the bellows 330. In FIG. 27 for example, the make-up fluid source 2705 may be heated by its interaction with the at least one additional component 2799 of the system 2700 (for example, with the fluid of the make-up system 510 being used to cool the at least one additional component 2799), and this heated fluid from the make-up fluid source 2705 may be circulated to the bellows 330 for cooling (e.g. via conduction with the cooler treatment fluid). In embodiments, the circulation may further comprise introducing/injecting (e.g. cool) fluid from the bellows 330 into the make-up fluid source 2705. Such an approach may cool the make-up fluid source 2705 by withdrawing hotter fluid and inserting cooler fluid (and may also allow for maintenance of the controlled volume of fluid between the piston 410 and the bellows 330). In some embodiments, circulation of fluid may further comprise introducing/injecting (e.g. cool) fluid from the bellows 330 into the at least one additional component 2799, and introducing/injecting fluid from the at least one additional component 2799 into the make-up fluid source 2705.

Figure 29:
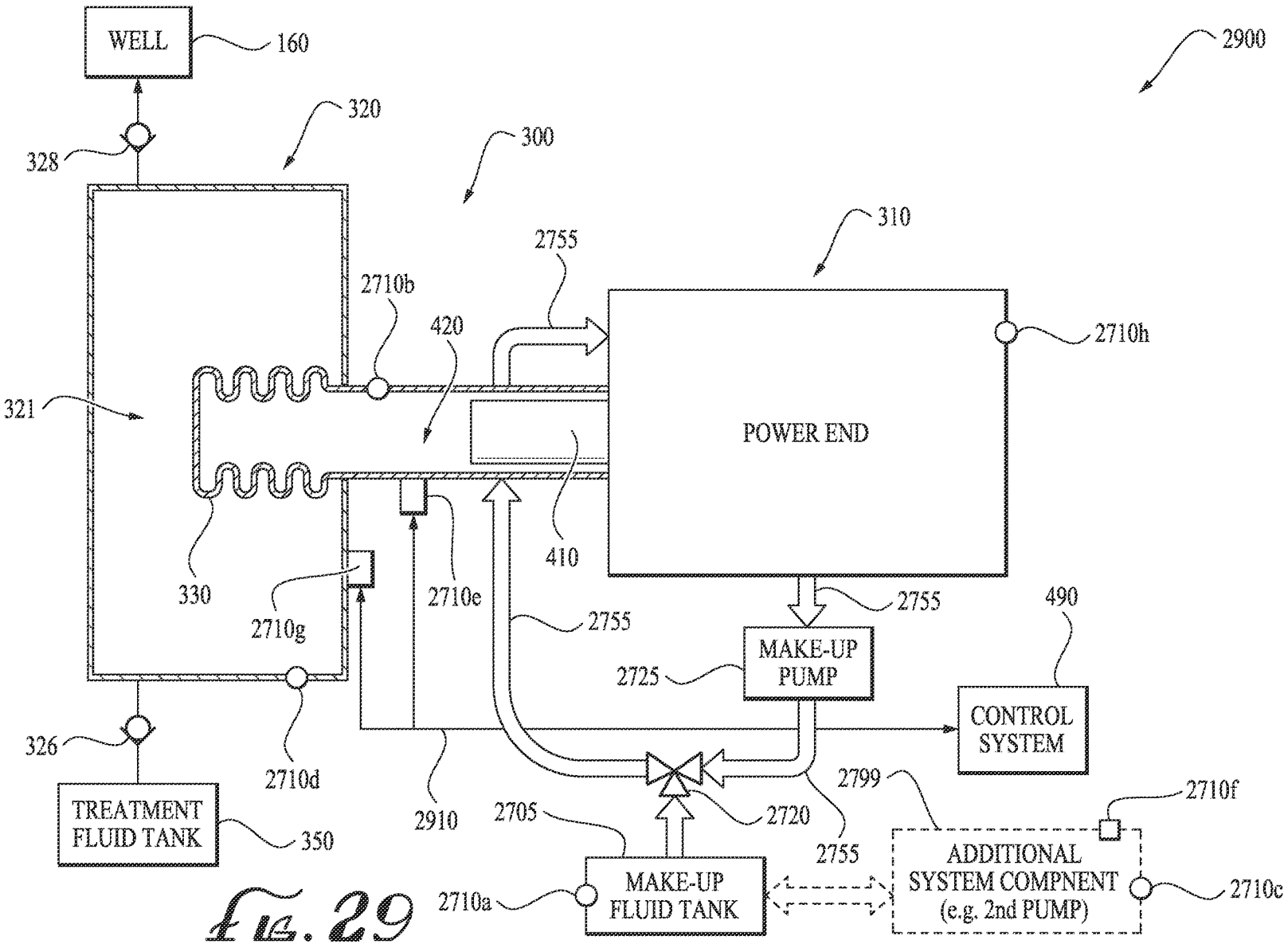
FIG. 29 is a schematic illustration of another exemplary bellows pump system, according to an embodiment of the disclosure.

FIG. 29 schematically illustrates a system 2900 similar to the system 2700 of FIG. 27, in which the at least one additional component of the system 2900 may include the power end 310 of the pump 300 (e.g. the pump 300 having the bellows 330). So, in FIG. 29 the make-up system 510 is fluidly coupled to (e.g. in fluid communication with) the power end 310 of the pump 300. For example, the make-up system 510 may be in fluid communication with the first portion of the bore 420 of the pump 330/intensifier, and the same fluid used in the make-up system 510 (e.g. make-up fluid) may be drive fluid and/or lubricant for the power end 310. In FIG. 29, the make-up fluid source 2705 may be fluidly coupled to the make-up valve 2720 (e.g. via fluid conduit 2755), for example with the make-up valve 2720 disposed between the bellows 330 and the make-up fluid source 2705. The power end 310 of the pump 399 may be fluidly coupled to the make-up pump 2725 (e.g. via fluid conduit 2755), which may be fluidly coupled to the make-up valve 2720 (e.g. via fluid conduit 2755). The bellows 330 may be fluidly coupled (e.g. via fluid conduit 2755) with the power end 310 of the pump 300. In some embodiments, the make-up fluid source 2705 may additionally be in fluid communication with one or more additional system components 2799 (e.g. in addition to the power end 310 of the pump 300), although in the embodiment of FIG. 29 this is merely optional. For example, the make-up fluid source 2705 may be fluidly coupled both to the power end 310 of the pump 300 and to at least one additional system component 2799 (which for example could be external to pump 300). FIG. 29 illustrates an embodiment in which the control system 490 communicates via wired connection.

In some embodiments, the control system 490 may determine the circulation protocol based on temperature, for example prioritizing flow from whichever of the make-up fluid source 2705 or the at least one additional component 2799 (e.g. the power end 310 of the pump 300) has hotter fluid to the bellows 330. For example, circulation may comprise introducing/injecting (e.g. heated/hot) fluid from the hotter of the make-up fluid source 2705 or the at least one additional component 2799 (e.g. the power end 310 of the pump 300) to the bellows 330 for cooling (e.g. with the hotter of the make-up fluid source 2705 or the at least one additional component 2799, such as the power end 310, being prioritized for circulation of fluid with the bellows 330). In some embodiments, temperature/heat considerations may be based on absolute temperature (e.g. the measured temperature), while in other embodiments temperature/heat considerations may be based on relative temperature (e.g. the difference between the measured temperature and the corresponding safe operating temperature limit for the portion of the system in question). Both embodiments are included in this disclosure, and any reference to temperature (e.g. hotter, cooler, etc.) can include both absolute and relative considerations (unless for example one is specifically required).

In some embodiments (e.g. in instances when the power end 310 is hotter than the make-up fluid source 2705), circulation of fluid between the make-up system 510 and the bellows 330 may comprise injecting (e.g. heated/hot) fluid from the at least one additional component (e.g. the power end 310, as shown in FIG. 29) into the bellows 330, and injecting (e.g. cool) fluid from the bellows 330 into the at least one additional component (e.g. the power end 310 of the pump 300, as shown in FIG. 29). In some embodiments, (e.g. in instances when the make-up fluid source 2705 is hotter than the power end 310), circulation of fluid between the make-up system 510 and the bellows 330 may comprise introducing/injecting (e.g. heated/hot) fluid from the make-up fluid source 2705 into the bellows 330. In some embodiments, circulation may further comprise introducing/injecting (e.g. cool) fluid from the bellows 330 into the make-up fluid source 2705, while in other embodiments, circulation may further comprise introducing/injecting (e.g. cool) fluid from the bellows 330 into the at least one additional component (e.g. the power end 310 of pump 300, as shown in FIG. 29), and introducing/injecting fluid from the at least one additional component (e.g. the power end 310, as shown in FIG. 29) into the make-up fluid source 2705.

In embodiments, the control system 490 (e.g. with the circulation protocol) can be configured to hold fluid in the bellows 330 (e.g. for heat exchange with the treatment fluid in the chamber 321 of the fluid end 320, for example via conduction) until the fluid in the bellows 330 is cooler (e.g. has a lower temperature) than the make-up fluid source 2705 or the at least one additional component (for example, the power end 310 as shown in FIG. 29), and then to circulate fluid. For example, once the fluid in the bellows 330 cools sufficiently, fluid may be circulated based on the circulation protocol and/or may be circulated to whichever of the make-up fluid source 2705 or the at least one additional component (e.g. the power end 310 as shown in FIG. 29) is now hotter than the bellows 330. In some embodiments, the control system 490 may circulate fluid out of the bellows 330 when the fluid in the bellows 330 cools below the temperature of either the make-up fluid source 2705 or the at least one additional component (e.g. the power end 310 as shown in FIG. 9), for example circulating to the hotter of the make-up fluid source 2705 or the at least one additional component (e.g. the power end 310).

Figure 28:
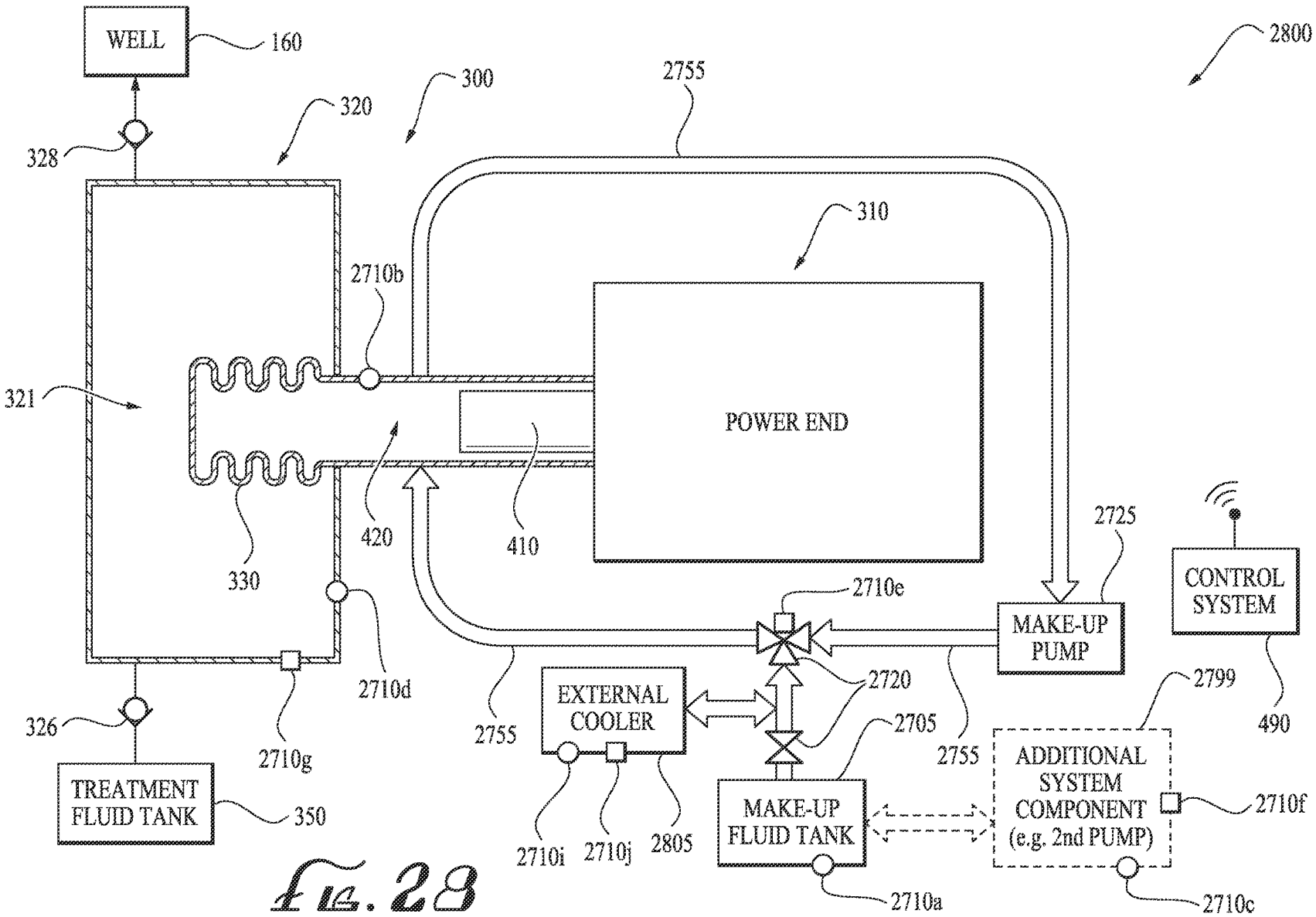
FIG. 28 is a schematic illustration of the exemplary bellows pump system of FIG. 27, further including an external cooler, according to an embodiment of the disclosure.
Figure 30:
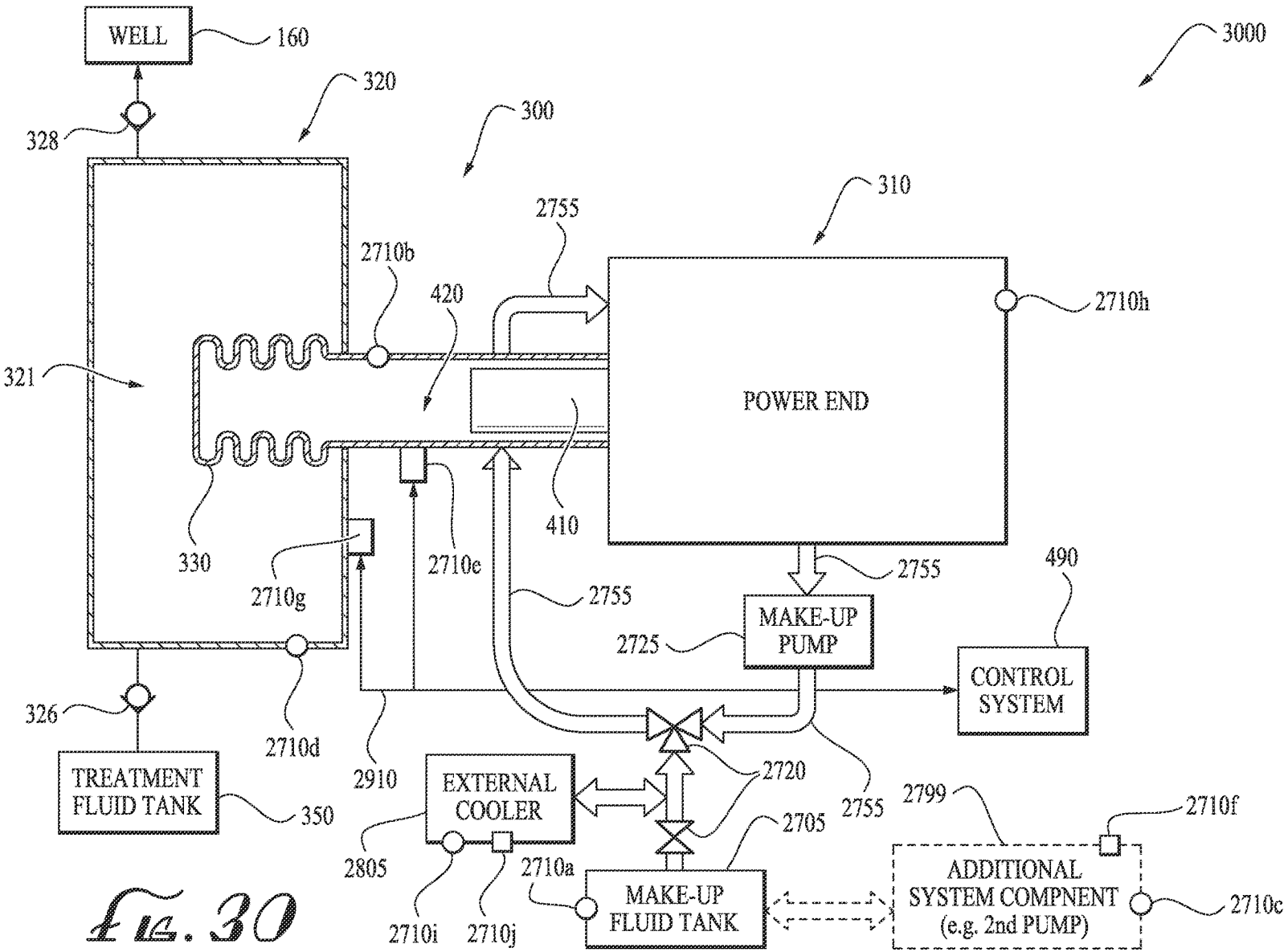
FIG. 30 is a schematic illustration of the exemplary bellows pump system of FIG. 29, further including an external cooler, according to an embodiment of the disclosure.
Figure 31:
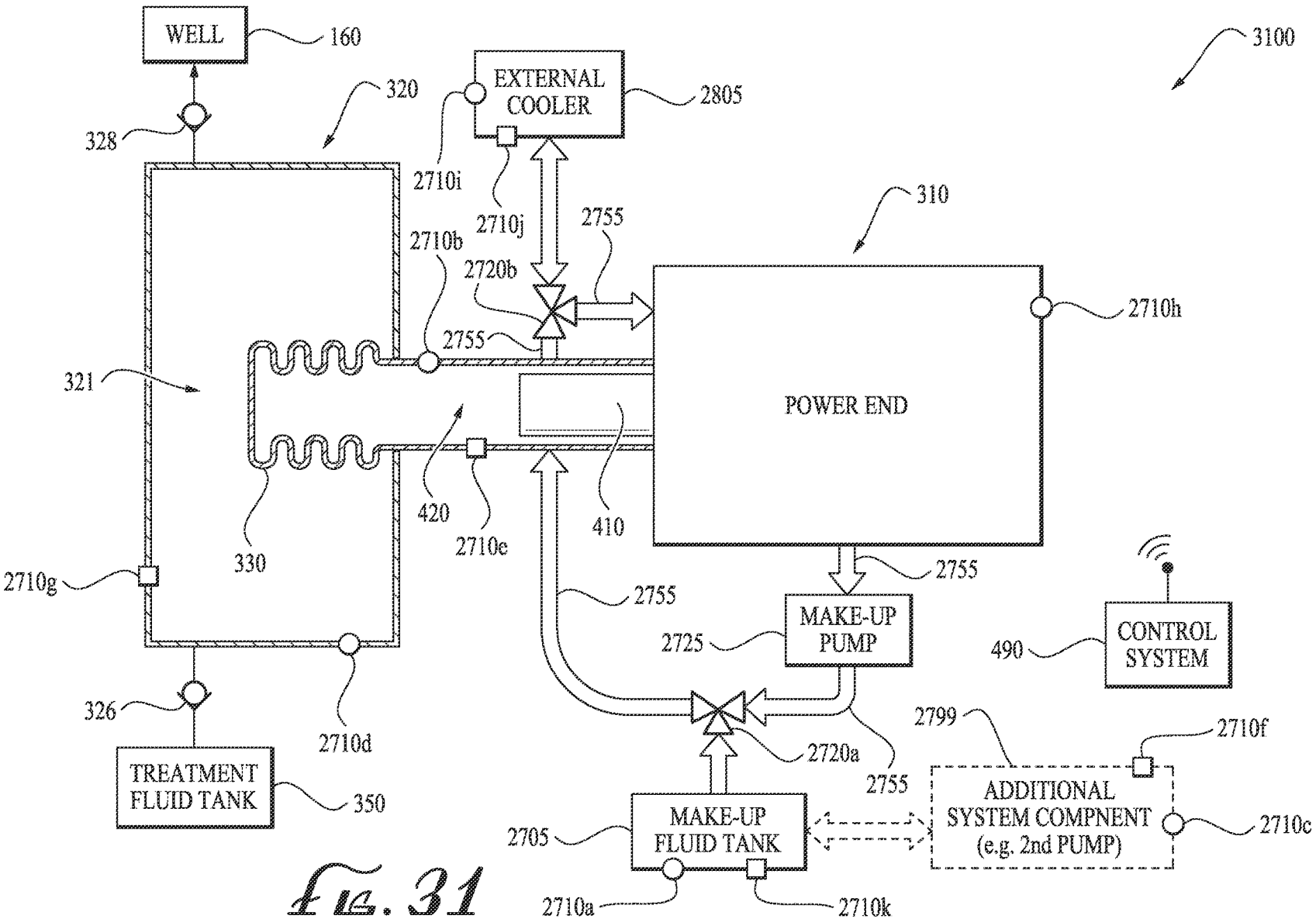
FIG. 31 is a schematic illustration of an exemplary bellows pump, illustrating another potential location for the external cooler, according to an embodiment of the disclosure.

As shown in FIG. 28 (which may be similar to FIG. 27) and FIG. 30 (which may be similar to FIG. 29), some system embodiments may additionally include an external cooler 2805. The external cooler 2805 can be any mechanism or device configured to cool fluid, for example using conduction, convection, radiant, or other forms of heat transfer. In some embodiments, the external cooler 2805 may be used if the system is expected to generate more heat than can be effectively dissipated through the bellows 330 via circulation with the make-up system 510. In some embodiments, the external cooler 2805 may be fluidly coupled to the make-up system 510 (e.g. to the make-up fluid source 2705 and/or the bellows 330). In FIG. 28, the external cooler 2805 may be fluidly coupled to the make-up fluid source 2705. For example, two make-up valves 2720 may be used, with the first make-up valve 2720*a* disposed between the make-up fluid source 2705 and the bellows 330, and the second make-up valve 2720*b* disposed between the first make-up valve 2720*a* and the make-up fluid source 2705. The external cooler 2805 may be fluidly coupled between the two make-up valves 2720, as shown in FIG. 30. The external cooler 2805 is not limited to one particular location within the system, but can be fluidly coupled in various locations throughout the system (so long as it has the fluid communication needed to allow cooling operation). For example, FIG. 31 illustrates another location for the external cooler 2805, for example fluidly coupled to the bellows 330. For example, the second make-up valve 2720*b* may be disposed between the bellows and the at least one additional component (e.g. the power end 310 of the pump 300).

In embodiments, the external cooler 2805 may be sized smaller than otherwise might be needed for the system due to the operation and/or configuration of the make-up system 510 for cooling. In some embodiments, the control system 490 may circulate fluid (e.g. from the bellows 330) to the external cooler 2805 only if the bellows 330 cannot handle more heat (e.g. if the bellows 330 temperature is approaching its safe operating temperature limit). For example, when the control system 490 determines that fluid in the bellows 330 is at (e.g. a threshold for) safe operating temperature limit, fluid may be circulated from the bellows 330 to the external cooler 2805. And responsive to circulating fluid from the bellows 330 to the external cooler 2805, fluid may be circulated from the hotter of the make-up fluid source 2705 or the at least one additional component (e.g. the power end 310 as shown in FIG. 30) to the bellows 330. Alternatively, the control system 490 may circulate fluid to the external cooler 2805 from the hotter of the make-up fluid system 510 (e.g. the make-up fluid source 2705), the at least one additional component (e.g. the power end 310 as shown in FIG. 30), or the bellows 330. For example, the control system 490 may circulate fluid to optimize cooling of fluid in the system using both the bellows 330 and the external cooler 2805 (e.g. circulating to either or both at any time). While typically the treatment fluid may be cooler than the bellows 330, in some embodiments and/or at other times, the treatment fluid/chamber 321 may be hotter than the bellows 330. In the event that the treatment fluid/chamber 321 is hotter than the bellows 330, fluid may be circulated from the hottest of the bellows 330, the make-up fluid source 2705, or the at least one additional component (e.g. power end 310 as shown in FIG. 30) to the external cooler 2805.

In some embodiments, the at least one additional component 2799 of the system may include one or more additional pumps. In some embodiments, such multiple pumps may be configured to jointly introduce treatment fluid into the well 160. In some embodiments, the plurality of pumps may be configured to provide constant pumping at approximately constant pressure. For example, one or more pump of the system may be configured so that its power/discharge stroke is out of sync with the power/discharge stroke of one or more other of the pumps of the system. In some embodiments, half of the pumps in the system may be configured to have their power/discharge strokes in sync, for example when the other half of the pumps are having their suction stroke.

Furthermore, while the suction valve 326 and the discharge valve 328 may each be one-way check valves, in alternate embodiments, any other suitable valve may be used as either the suction valve 326 and/or discharge valve 328. Although not required, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver mechanism capable of reciprocally expanding and contracting the bellows may be used, and are included within the scope of this disclosure.

So, in embodiments, the systems and methods described herein may be used in controlling an injection treatment (e.g. of treatment fluid into a well). For example, the injection treatment may be done using intensifier-type pumping systems that utilize one or more bellows 330 for pumping the treatment fluid. The control system 490 of the pump 300 may monitor the pumping systems, determine whether an issue, such as lack of sync and/or heat build-up, occurs, and automatically address the issue(s), for example by using the make-up system 510 to bring the piston 410 and bellows 330 back into sync and/or by circulating fluid to dissipate heat build-up. The present disclosure may provide systems and methods for improved cooling operations, which may use the make-up system 510 to aid in overall system cooling as well as to supplement/adjust the fluid to keep the bellows 330 and the piston 410 properly in sync. The provided systems and methods may be used to monitor bellows 330 position and to determine when to add the fluid (e.g. when there is not adequate amount of fluid in the high-pressure system between the piston 410 and the bellows 330). The provided systems may also use the make-up system 510 for system-wide cooling, for example with the make-up fluid being configured to flow between components of the system to receive heat and move the heat away for dissipation/cooling. In embodiments, the heated fluid may be circulated to the bellows 330 for heat transfer with the treatment fluid (e.g. which is typically cooler).

Returning to FIG. 29, an exemplary cooling infrastructure (e.g. system 2900) with a make-up system 510 for the high-pressure system is illustrated. The system 2900 of FIG. 29 includes a pump body (e.g. for power end 310), a bellows 330, a piston 410, a plurality of sensors 2710, a make-up pump 2725, a control system 490, one or more make-up valves 2720, and a make-up fluid source (e.g. tank) 2705. The pump body (e.g. power end 310) can be associated with a particular pump from an array of pumps. In particular, the pump body/power end 310 can be connected to a reciprocating, intensifier, or linear actuated pump 300 which uses the bellows 330 and the piston 410 in sync to inject treatment fluid into a particular geological formation, such as shale. The system 2900 can circulate the make-up fluid from the pump body (e.g. power end 310) to other pump system components via pipelines 2755 to cool the pump 300 and other pump system components such as hydraulics, lube pumps, cylinders, bellows 330, pistons 410, packing, etc.

In an embodiment, the system 2900 can be configured to include a plurality of sensors 2710 coupled to various pump system components, for example via electric lines 2910, to detect position of the various pump system components, such as the bellows 330 and the piston 410. The control system 490 can be configured to evaluate measurement data acquired by the plurality of sensors 2710. For example, the control system 490 can access input data from the plurality of sensors 2710. The input data can include pressure, temperature, bellow position, treatment fluid flow/rate, and other critical parameters from the plurality of sensors 2710. As another example, the control system 490 can utilize the one or more make-up valves 2720 to regulate the make-up fluid moving through the cooling infrastructure (e.g. the make-up system 510) to optimize heat rejection using treatment fluid and/or to reduce the size of or eliminate the need for external heat exchanges/coolers. The control system 490 can monitor temperature of the make-up fluid and keep a steady or regulated flow of the make-up fluid in the cooling infrastructure. As another example, the control system 490 can transmit a command to the one or more make-up valves 2720 to regulate circulation of fluid from the make-up pump 2725 or a make-up fluid source 2705. In embodiments, the cooling infrastructure (e.g. the control system 490) can be configured to determine the amount of time to keep the make-up fluid in the bellows 330. The amount time to keep the make-up fluid in the bellows 330 can determine how much heat is rejected from the make-up fluid to treatment fluid in the chamber 321.

In an embodiment, the control system 490 can be configured to include a self-learn mode to read the measurement data from the plurality of sensors 2710 and adjust the make-up fluid on the fly. In particular, the control system 490 can monitor fluid temperature and flow to regulate the make-up fluid pump 2725, the one or more make-up valves 2720, and make-up fluid source 2705 to improve cooling efficiency of make-up fluid passing through the system 2900. For example, the control system 490 can regulate the make-up fluid passing through the bellows 330 that is pumping a treatment fluid in the system 2900. The control system 490 can allow the one or more make-up valves 2720 to regulate flow through the bellows 330 and keep the make-up fluid in contact with the bellows 330 for an optimal amount of time to reject heat through the bellows 330 into the high-pressure system (e.g. into the treatment fluid in chamber 321).

In an embodiment, the control system 490 can be configured to use a machine learning model to determine the make-up fluid circulation based on the input data, such as pressure, temperature, bellow position, treatment fluid flow/ rate, and other critical parameters from the plurality of sensors 2710. The machine learning model can be trained using a decision tree based algorithm, such as decision tree, random forest, etc. In an embodiment, the control system 490 can apply the decision tree algorithm to determine a tree-like model to classify one or more subjects into a map of possible outcomes of multiple related choices in which each internal node represents a test on an attribute, each branch represents an outcome of the test, and each leaf node represents a class label. A path from root to leaf is determined based on a decision tree classification rule. In particular, a decision tree typically starts with a single node, which branches into possible outcomes. Each of those outcomes leads to additional nodes, which branch off into other possible outcomes. The accuracy of a decision tree model is controlled by a depth and a node splitting function of the decision tree model at the cost of increasing computation time. A decision tree model may be evaluated using one or more metrics, such as accuracy, sensitivity, specificity, precision, miss rate, false discovery rate, and false omission rate, etc., using the measurements classified by the decision tree model.

In an embodiment, the control system 490 can apply the random forest algorithm to determine a random forest model consisting of multiple decision trees. A decision tree model is a block of a random forest model and multiple decision tree models are combined to make a random forest model. For example, each individual tree in the random forest model splits out a class prediction and the class with the most votes becomes our model's winning prediction. Compared to a decision tree algorithm, a random forest tree uses a large number of relatively uncorrelated decision tree models to operate as a committee to determine a winner class which usually outperforms any of individual constituent decision tree models.

In an embodiment, the control system 490 can be configured to include a heuristic mode to read the measurement data from the plurality of sensors 2710 and adjust the make-up fluid based on predetermined set points or maps of parameters such as temperature, flow, bellows position, treatment fluid rate, and other critical parameters. The predetermined set points or maps can be determined from prior experience or user input, for example.

In an embodiment, the cooling infrastructure (e.g. the make-up system 510 configured for cooling) can be used on other fluid systems capable of passing fluid through the bellows 330. These fluid systems can include fluid used to cool the pump 300, engine, motor, variable frequency drives or even fluid used for lubrication. The cooling infrastructure can also be configured to direct fluid to external coolers 2805, besides the bellows 330 which are positioned in the fluid stream.

FIG. 30 illustrates an example system 3000 with a make-up system 510 and an external cooler 2805 for the high-pressure system. The control system 490 can be configured to regulate the make-up fluid passing through an external cooler 2805. The control system 490 can allow the make-up system 510 to regulate the make-up flow through the external cooler 2805 for an optimal amount of time to reject heat from the high pressure system.

In various embodiments, the inputs to the control system 490 via the wired or wireless communications include sensor data from one or more sensors 2710 positioned in the system that represent respective pressure, temperature, flow/rate, viscosity, contamination/particle count, and/or bellows position. In some embodiments, the outputs of the control system 490 via one or more wired or wireless communications include data that controls the make-up valve(s) 2725 and/or the make-up pump(s) 2720 (e.g. to control make-up fluid regarding synchronizing the bellows 330 and piston 410 and/or to control circulation of fluid to cool the system).

Disclosed embodiments also comprise exemplary methods for cooling a bellows pump during introduction of treatment fluid into a well. Such methods may use any of the disclosed pump or system embodiments, such as the examples illustrated in FIGS. 27-31. For example, an exemplary method embodiment may comprise: pumping treatment fluid into the well using the bellows pump system (e.g. wherein the bellows pump system comprises a pump having a bellows and a piston, and a make-up system configured to maintain a controlled volume of drive fluid between the piston and the bellows and/or to keep the piston and bellows in sync, with the make-up system fluidly coupled to the bellows and to at least one additional component of the system), and cooling fluid (e.g. make-up/drive fluid from the at least one additional component) using the make-up system. In embodiments, cooling fluid (e.g. from the at least one additional component) may comprise circulating fluid between the make-up system and the bellows. Some embodiments may further comprise determining that the bellows and piston are out of sync, and using the make-up system to adjust the amount of fluid (e.g. injecting or removing make-up/drive fluid) between the piston and the bellows to return the piston and bellows to sync. In some embodiments, the system may further comprise a control system. In embodiments, responsive to receiving (e.g. at the control system) sensor data from one or more sensor configured to detect one or more parameter of the bellows pump system, the method may further include determining a circulation protocol (e.g. based on the sensor data), and responsive to determining a circulation protocol, circulating fluid between the make-up system and the bellows (e.g. based on the circulation protocol).

In some embodiments, circulating fluid may comprise operating (e.g. by the control system sending instructions) a make-up pump and/or a make-up valve to control fluid flow. In some embodiments, pumping treatment fluid into the well may comprise pumping treatment fluid through a chamber of a fluid end of the pump into the well, wherein the treatment fluid contacts the bellows in the chamber (e.g. allowing for conduction heat transfer therebetween). Some embodiments may further comprise receiving/absorbing heat from the at least one additional component into the make-up fluid system (e.g. into the fluid of the make-up fluid system), and circulating fluid may comprise circulating heated fluid into the bellows and/or shedding/dissipating heat from the fluid in the bellows into the treatment fluid (e.g. via conduction).

In some embodiments, determining a circulation protocol may comprise determining an amount of time to hold fluid in the bellows, a source of fluid to circulate to the bellows, and/or an amount of fluid to circulate to optimize heat transfer/cooling of the fluid (e.g, wherein cooling is optimized based on the amount of time that fluid is held in the bellows and/or the source and amount of fluid circulated). In embodiments, the amount of fluid to circulate may be approximately equal to the controlled volume of fluid (e.g. being maintained between the piston and the bellows). In some embodiments, the control system may use temperature of the bellows and temperature of the make-up fluid source to determine the circulation protocol. In some embodiments, the control system may further use the temperature of the at least one additional component to determine the circulation protocol. In some embodiments, the control system may use flow rate to determine the circulation protocol. In some embodiments, the control system may use one or more of the following to determine the circulation protocol: temperature of the chamber/treatment fluid, pressure, viscosity, contamination, and/or position of one or more component of the system. In some embodiments, the control system may determine the circulation protocol based on temperature, for example with the circulation protocol prioritizing flow from whichever of the make-up fluid source or the at least one additional component (e.g. the power end of the pump) has hotter fluid to the bellows.

In some embodiments, the make-up source may be heated by the at least one additional component of the system, and circulating fluid may comprise circulating the heated fluid from the make-up fluid source into the bellows. In some embodiments, circulating heated fluid into the bellows further comprises circulating (e.g. cool) fluid from the bellows into the make-up fluid source. Some embodiments may further comprise holding the circulated fluid in the bellows until the fluid cools to a temperature below that of the make-up fluid source. In some embodiments, circulating fluid into the bellows may further comprise circulating fluid from the bellows into the at least one additional component.

In some method embodiments, the at least one additional component may include a power end of the pump fluidly coupled to the make-up system (e.g. to the make-up fluid source). In some embodiments, determining a circulation protocol may further comprise determining which of the power end and the make-up fluid source contains hotter fluid, and circulating the hotter fluid (e.g. the fluid from the hotter source) to the bellows. For example, determining a circulation protocol may further comprise determining which of the power end and the make-up fluid source contains hotter fluid, and responsive to determining that the power end fluid is hotter, circulating the (e.g. hotter) power end fluid to the bellows. In some embodiments, the method may further comprise circulating the (e.g. cool) fluid from the bellows to the power end. In another example, determining a circulation protocol may further comprise determining which of the power end and the make-up fluid source contains hotter fluid, and responsive to determining that the make-up fluid source is hotter, circulating the (e.g. hotter) fluid from the make-up fluid source to the bellows. In some embodiments, the method may further comprise circulating the power end fluid to the make-up fluid source and the (e.g. cool) bellows fluid to the power end. In other embodiments, the method may further comprise circulating the bellows fluid to the make-up fluid source.

Once heated fluid is circulated to the bellows, it may be held in the bellows for heat transfer (e.g. with the treatment fluid in the chamber of the fluid end of the pump, for example by conduction). In some embodiments, the control system may determine how long to hold the heated fluid in the bellows, for example to optimize heat transfer (e.g. and further circulation may not occur until the circulation protocol specifies). Some embodiments further comprise holding fluid in the bellows until the fluid is cooler than either the fluid in the make-up fluid source or the fluid in the power end. In embodiments, the fluid may then be circulated from the hotter of the make-up fluid source or the power end into the bellows.

Some method embodiments may further comprise circulating fluid with an external cooler. In some embodiments, circulating fluid with an external cooler may comprise only circulating to the external cooler in the event that the bellows cannot handle more heat (e.g. the bellows is near its safe operating temperature limit or the temperature of the bellows is at or above the temperature of the treatment fluid in the chamber). So in some examples, the bellows may be exclusively used for cooling of the system as long as the bellows can handle it, and only when the bellows cannot handle the heat of the system, then using the external cooler. In other embodiments, circulating fluid with an external cooler may comprise cooling the fluid (e.g. of the make-up system) using both the bellows and the external cooler (e.g. simultaneously and/or working together), for example with circulation configured to optimize heat dissipation for the system.

One or more of the system embodiments disclosed herein (e.g. relating to FIGS. 27-31) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments, and/or a non-transitory computer-readable medium can have program instructions stored thereon configured to cause a control system (e.g. of the bellows pump system) to perform any of the disclosed method embodiments. Such instructions may be used by the control system of the disclosed bellows pump system embodiments, for example to operate the bellows pump system.

As has been discussed, in a bellows-style pump, effectively addressing leakage of treatment fluid into the bellows can be important, for example for pump durability, reliability, maintenance, and life. When operating correctly, the bellows of the pump will segregate the treatment fluid being pumped by the pump (e.g. through the chamber of the fluid end) from the drive fluid used by the power end of the pump (e.g. to provide pumping operation of the bellows and/or piston). However, damage and/or wear of the bellows may occur over time, given the difficult operating conditions for such pumps (e.g. the abrasive and/or acidic/corrosive nature of treatment fluid and/or the high pressures experienced by the pump). Such damage and/or wear of the bellows may allow the high-pressure pumped treatment fluid to leak through the barrier provided by the bellows, potentially entering the bellows and thereby causing contamination of the drive fluid of the power end of the bellows pump (which could, in turn, cause further damage to the pump, including one or more seal in the power end).

Concerns about such pump damage may be even greater in bellows pump systems having a make-up system. It can be important to prevent any leakage of treatment fluid into the bellows from spreading to the make-up system, since introduction of treatment fluid into the make-up system may damage the make-up system, requiring still further costly repairs. This issue may be even more critical in bellows pump systems in which the make-up fluid is shared by (e.g. in fluid communication with) one or more other/additional components of the bellows pump system (e.g. similar to the discussion above regarding FIGS. 27-31), since those other components would also be prone to damage from introduction of treatment fluid. Thus, there may be a need for improved bellows pump systems which can minimize potential damage due to leakage of treatment fluid into the bellows.

Figure 32:
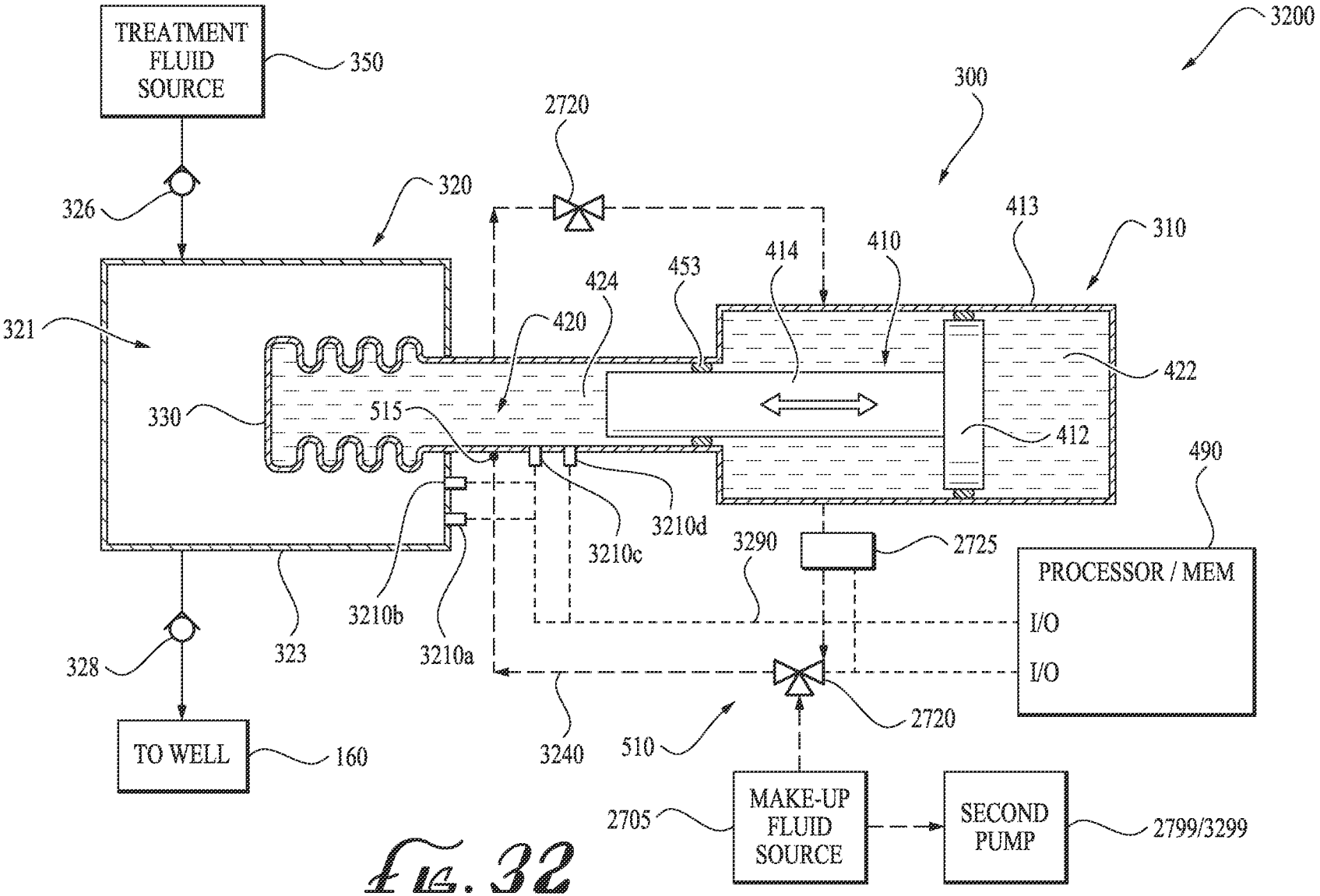
FIG. 32 is a schematic illustration of an exemplary bellows pump system having a make-up system, according to an embodiment of the disclosure.
Figure 33:
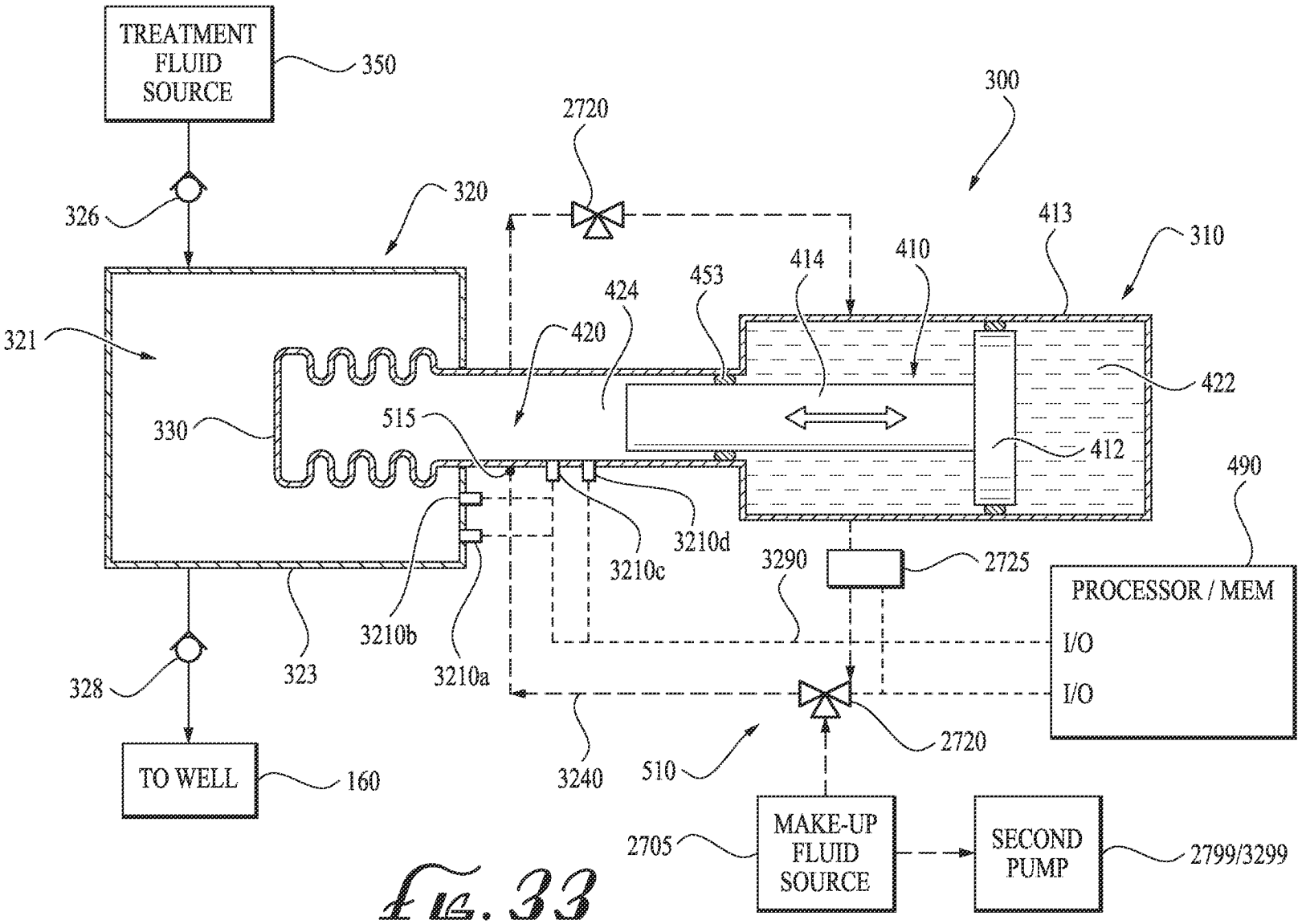
FIG. 33 is a schematic illustration of the exemplary bellows pump system of FIG. 32, illustrating a leak in the bellows, according to an embodiment of the disclosure.

FIGS. 32-33 provide schematic illustration of an exemplary bellows pump system 3200 embodiment having a bellows pump 300 similar to the pump embodiments shown in FIGS. 3-5, and having a make-up system 510 which can be configured to prevent or minimize any contamination within the bellows 330 (e.g. of treatment fluid entering the bellows) from spreading to, compromising, and/or damaging other components of the system 3200 which may be in fluid communication with the make-up system 510. FIG. 32 illustrates the bellow pump 300 while it is in good health (e.g. when there is no leakage of treatment fluid into the bellows 330 from the chamber 321) and/or is configured for pumping operation (e.g. with make-up and/or drive fluid disposed between the bellows 330 and the piston 410). Typically, the make-up and/or drive fluid disposed between the bellows 330 and the piston 410 may be the same fluid as the drive fluid disposed in the intensifier (e.g. between the seal 453 and the head 412 of the piston 410 and/or behind the head 412 of the piston). FIG. 33 illustrates the bellows pump 300 after there has been leakage of treatment fluid into the bellows 330 (e.g. such that the fluid between the bellows 330 and the piston 410 is contaminated with treatment fluid). In FIG. 33, the seal (e.g. second 453) may separate the contaminated fluid (e.g. having treatment fluid therein) from the clean drive fluid. In FIG. 33, the seal 453 has not yet been compromised by the treatment fluid (despite exposure due to bellows failure/leakage), such that the fluid in the intensifier (e.g. the fluid surrounding the head 412 of the piston 410) is still clean drive fluid, while the fluid between the bellows 330 and the seal 453 is dirty fluid (e.g. contaminated with treatment fluid).

In FIGS. 32-33, the system 3200 may comprise a source of treatment fluid 350, a bellows pump 300 in fluid communication with the source of treatment fluid 350 and/or configured to pump treatment fluid into the well, a make-up system 510, and a control system 490 having one or more sensor 3210 (e.g. configured to detect one or more parameters of the system 3200). In embodiments, the bellows pump 300 may include a power end 310 comprising a piston 410 (e.g. of an intensifier) configured to reciprocally move make-up/drive fluid (e.g. in and out of the bellows 330); a fluid end 320 having a fluid end housing 323 with a chamber 321, a suction valve 326 (e.g. in fluid communication with (e.g. fluidly coupled to) the chamber 321 and a source for the treatment fluid 350 and/or configured for introduction of treatment fluid into the chamber 321), and a discharge valve 328 (e.g. in fluid communication with (e.g. fluidly coupled to) the chamber 321 and the well and/or configured for injection of treatment fluid from the chamber 321 into a well); and an expandable bellows 330. In embodiments, the power end 310 can be (e.g. fluidly connected to and) configured to reciprocally expand/inflate and contract/deflate the bellows 330 based on movement of make-up/drive fluid, and the bellows 330 can be configured to expand within the chamber 321 of the fluid end 320 based on movement of the make-up/drive fluid.

In embodiments, the make-up system 510 may be configured to maintain a controlled volume of fluid (e.g. make-up and/or drive fluid) between the piston 410 and the 330 bellows (e.g. to keep the bellows 330 and piston 410 in sync). The make-up system 510 may comprise a make-up fluid source 2705 fluidly coupled to the bellows 330 and at least one other/additional component of the system 3200. The control system 490 may be configured to receive data from the one or more sensor 3210, to evaluate the sensor data to detect a leak (e.g. of treatment fluid into the bellows 330, which could contaminate the make-up fluid source 2705), and responsive to detecting a leak, to fluidly isolate the make-up system 510 (e.g. the make-up fluid source 2705) from the bellows 330. In embodiments, fluidly isolating the make-up system 510 from the bellows 330 may act to simultaneously fluidly uncouple the at least one additional component 2799 of the system 3200 from the bellows, thereby preventing the spread of any contamination (e.g. treatment fluid) entering the bellows 330 to any additional component 2799 (e.g. a second pump 3299) of the system 3200. In embodiments, the control system 490 may also be configured to evaluate the sensor data to determine whether the bellows 330 and piston 410 are out of sync, and responsive to determining that the bellows 330 and piston 410 are out of sync, using the make-up system 510 to adjust the amount of fluid (e.g. injecting and/or removing make-up/drive fluid) between the piston 410 and the bellows 330 to return the piston 410 and bellows 330 to sync.

In embodiments, the one or more sensor 3210 can be configured to detect one or more of the following parameters at one or more location within the system 3200: pressure, temperature, flow rate, viscosity, contamination (e.g. particle count), and/or position of one or more component of the system. For example, the one or more sensor 3210 may detect position of the bellows 330 relative to position of the piston 410, pressure in the chamber 321 relative to pressure in the bellows 330, flow rate of treatment fluid through the suction valve 326 relative to flow rate if treatment fluid through the discharge valve 328, flow rate of make-up/drive fluid through the (e.g. one or more) make-up port 515 (e.g. in and out) of the bellows 330, flow rate of make-up fluid/drive fluid (e.g. configured to drive the piston 410) into and out of the intensifier (e.g. the first portion 422 of the bore 420 of the power end 310), flow rate of make-up/drive fluid into and out of the make-up fluid source 2705, viscosity of fluid in the bellows 330, contamination (e.g. particle count) within the bellows 330, and/or temperature of make-up/drive fluid within the bellows 330 (e.g. compared to expected temperature and/or compared to temperature in the chamber 321). In embodiments, the one or more sensor may comprise a first sensor 3210*a* configured to monitor one or more parameter within the chamber 321, a second sensor 3210*b* configured to monitor one or more parameter in the bellows 330, a third sensor 3210*c* configured to monitor one or more parameter of the make-up fluid system 510 (e.g. one or more parameter of the make-up/drive fluid entering and/or leaving the bellows 330 (e.g. through the make-up port 515)), and/or a fourth sensor 3210*d* configured to monitor one or more parameter relating to the piston 410, intensifier, and/or power end 310.

In embodiments, the control system 490 may detect a leak based on the sensor data by comparing sensor data to a corresponding threshold. In some embodiments, the corresponding threshold can be pre-set and/or pre-selected. In some embodiments, the corresponding threshold can be based on historical data. In some embodiments, the corresponding threshold can be dynamically determined. For example, the corresponding threshold may be based on statistical deviation from sensor data across a plurality of cycles of the pump 300 (e.g. a pre-set timeframe, such as one minute, or cumulative data for the life (or some portion of the life) of the pump 300).

The suction valve 326 in some embodiments can be a one-way check valve configured to allow treatment fluid from the treatment fluid source to enter the chamber 321 (e.g. during a suction stroke of the pump 300) (e.g. while preventing treatment fluid from exiting the chamber 321 therethrough), and the discharge valve 328 can be a one-way check valve configured to allow treatment fluid to exit the chamber 321 (e.g. towards the well) (e.g. during a power stroke of the pump 300) (e.g. while preventing treatment fluid from entering the chamber 321 therethrough). In FIG. 32, the power end 310 further comprises a bore 420 (e.g. in a power end housing 413) in fluid communication with the bellows 330 (e.g. an internal volume of the bellows 330), and the piston 410 is disposed within the bore 420. In some embodiments, the piston 410 can be driven by a hydraulic circuit 430 (see FIG. 4 for example). In some embodiments, the hydraulic circuit 430 can be fluidly coupled to the make-up fluid source 2705, for example drawing make-up/drive fluid from the make-up fluid source 2705.

Typically, the piston 410 may have a head 412 and a rod 414, with the rod 414 extending from the head 412 and being disposed between the head 412 and the bellows 330. While the rod 414 and the head 412 may be similarly sized in some embodiments, in other embodiments the rod 414 may have a smaller diameter than the head 412. For example, the rod 414 may have a smaller diameter than the head 412 when the piston 410 is part of an intensifier configured to intensify applied pressure (e.g. from a driver) to the bellows 330. In embodiments, the bore 420 can include a first portion 422 with an inner diameter configured for movement of the head 412 (axially) therethrough and a second portion 424 with an inner diameter configured for movement of the rod 414 (axially) therethrough. For example, the head 412 may be configured to sealingly move within the first portion 422 of the bore (e.g. during pump strokes) and the rod 414 may be configured to sealingly move within the second portion 424 of the bore (e.g. during pump strokes). In embodiments, the power end 310 can include a first seal 451 (see for example FIG. 4) configured to seal the head 412 with respect to the first portion 422 of the bore and a second seal 453 configured to seal the rod 414 with respect to the second portion 424 of the bore 420. For example, the first seal 451 may be a moving seal (e.g. disposed on the head 412) and the second seal 453 may be a stationary seal (e.g. disposed on the inner surface/wall of the bore 420—e.g. within the second portion 424 of the bore-which may in some embodiments comprises pump packing).

In embodiments, the second seal 453 may be configured to provide the controlled volume of fluid (e.g. make-up/drive fluid) between the piston 410 and the bellows 330. For example, the second seal 453 may be disposed in the power end 310 with make-up/drive fluid on both sides (e.g. pressurized on both sides). The second seal 453 may be configured to separate the controlled volume of make-up/drive fluid disposed between the bellows 330 and the piston 410 from the first portion 422 of the bore 420 (e.g. with the head 412 of the piston 410 therein). In some embodiments, the second seal 453 may be configured for use in an abrasive and/or corrosive environment (e.g. for exposure to treatment fluid), despite being shielded from the treatment fluid in the chamber 321 by the bellows 330. By unconventionally using a seal 453 that can resist an abrasive and/or corrosive environment (e.g. treatment fluid), the intensifier portion of the pump 300 can be protected from bellows 330 leakage (see for example, FIG. 33, showing the second seal 453 separating contaminated fluid in the bellows 330 from the clean drive fluid in the first portion 422 of the bore 420), and in some instances this may allow the pump 300 to continue to function for some time and at some capacity even after there is a leak. The resistant seal 453 can also help prevent spread of contamination from the bellows 330 into the make-up system 510. In some embodiments, the first seal 451 may be configured for use with clean fluid (e.g. drive fluid) and/or may not be configured for use in an abrasive and/or corrosive environment and/or for use with treatment fluid. In other words, the first seal 451 may differ from the second seal 453, with the first seal 451 being more vulnerable to damage from exposure to an abrasive and/or corrosive environment and/or exposure to treatment fluid.

In embodiments, the make-up fluid source 2705 can comprise make-up fluid. While the make-up fluid could be any fluid compatible with the function of the fluid between the bellows 330 and the piston 410, typically the make-up fluid may be drive fluid (e.g. hydraulic fluid, such as hydraulic oil), which may be the same drive fluid used for pump operations. For example, in FIG. 32, the same drive fluid is used between the bellows 330 and the piston 410 and/or second seal 453 (e.g. in the second portion 424 of the bore 420) as is used to power the piston head 412 (e.g. in the first portion 422 of the bore 420). In FIG. 32, the pump 300 comprises an intensifier (e.g. having a head 412 that is larger than its rod 414). In some embodiments, the intensifier may be fluidly coupled to and/or in fluid communication with the make-up fluid source 480. For example, the first portion 422 of the bore (e.g. the piston head 412) can be fluidly coupled to the make-up fluid source 480. FIGS. 32-22 illustrate such an embodiment, in which the intensifier may be in fluid communication with the make-up fluid source 2705 via the make-up fluid circuit 3240 (e.g. which may include one or more fluid conduit 2755, similar to FIG. 27 for example).

In some embodiments, the make-up system 510 can include at least one make-up port 515 in fluid communication with the bellows 330 (e.g. the second portion 424 of the bore) and the make-up fluid source 2705, at least one make-up valve 2720 configured to control (e.g. open or close or partially close—e.g. to control speed of flow) fluid flow between the make-up port 515/bellows 330 and the make-up fluid source 2705, and/or at least one make-up pump 2725 configured to pump fluid between the bellows 330 and the make-up fluid source 2705. For example, the make-up fluid source 2705 can be in fluid communication with the bellows 330 when the make-up valve 2720 is open, and the make-up fluid source 2705 can be fluidly isolated from the bellows 330 when the make-up valve 2720 is closed. In embodiments, the make-up valve 2720 and/or make-up pump 2725 may be disposed anywhere in the fluid flow circuit 3240 for the make-up system 510. For example, the make-up valve 2720 can be disposed between the make-up fluid source 2705 and the make-up port 515 (e.g. which can be disposed in the power end housing or fluid end housing), between the make-up port 515 and the first portion 422 of the bore, between the make-up fluid source 2705 and the make-up pump 2725, and/or between the make-up port 515 and the make-up pump 2725. Similarly, the make-up pump 2725 can be disposed between the make-up fluid source 2705 and the make-up port 515 (e.g. which is disposed in the power end housing or fluid end housing), between the make-up port 515 and the first portion 422 of the bore, between the make-up fluid source 2705 and the first portion 422 of the bore, and/or between the make-up port 515 and the make-up valve 2720. In embodiments, fluidly isolating the make-up system 510 from the bellows 330 may comprise closing the make-up valve 2720 and/or shutting off/deactivating the make-up pump 2725. In some embodiments, fluidly isolating the make-up system 510 form the bellows 330 may occur automatically, for example with the control system 490 instructing a valve mechanism/actuator to close the make-up valve 2720 and/or to shut off the make-up pump 2725).

In some embodiments, there may be two or more make-up valves. For example, the two or more make-up valves can be disposed between the make-up fluid source and the make-up port (e.g. which is disposed in the power end housing or fluid end housing), between the make-up port and the first portion of the bore, between the make-up fluid source and the make-up pump, and/or between the make-up port and the make-up pump. Some embodiments may include two or more make-up pumps. For example, the two or more make-up pumps can be disposed between the make-up fluid source and the make-up port (e.g. which is disposed in the power end housing or fluid end housing), between the make-up port and the first portion of the bore, between the make-up fluid source and the first portion of the bore, and/or between the make-up port and the make-up valve. While any sort of bellows pump 300 may be used within the system of FIG. 32, in embodiments the bellows pump 300 (and in some embodiments, any additional pumps of the system) can be a high-pressure pump (e.g. configured to pump treatment fluid into the well at high pressures, such as up to 20000 psi).

As noted above, the make-up system 510 may be fluidly coupled to one or more additional component (e.g. 2799) of the system 3200, in addition to the bellows 330. For example and depending on the configuration of the system 3200, the at least one other component of the system 3200 can include: one or more additional bellows (e.g. 3430 for of a dual bellows pump-see FIG. 34 for example—and/or 3530 for another independent (e.g. similar) pump 3299 configured to draw fluid from the make-up fluid source 2705 and/or to jointly pump fluid into the well-see FIG. 35 for example), one or more additional (e.g. similar) pump 3299 configured to draw fluid from the fluid source 2705 and/or to jointly pump fluid into the well, an intensifier (e.g. for this pump 300 and/or for one or more additional pump 3299), the head 412 of the piston 420 of the pump 300 (e.g. via fluid coupling of the bellows 330 with the first portion 422 of the bore 420), and/or a hydraulic circuit (see for example 430 of FIG. 4) configured as the driver of the piston 410 (e.g. configured to reciprocally move the piston 410 within the bore 420). These additional components of the system 3200 are merely exemplary, and it should be understood that there can be other types of components fluidly coupled to the fluid source 2705 of the make-up system 510 in various embodiments.

Figure 34:
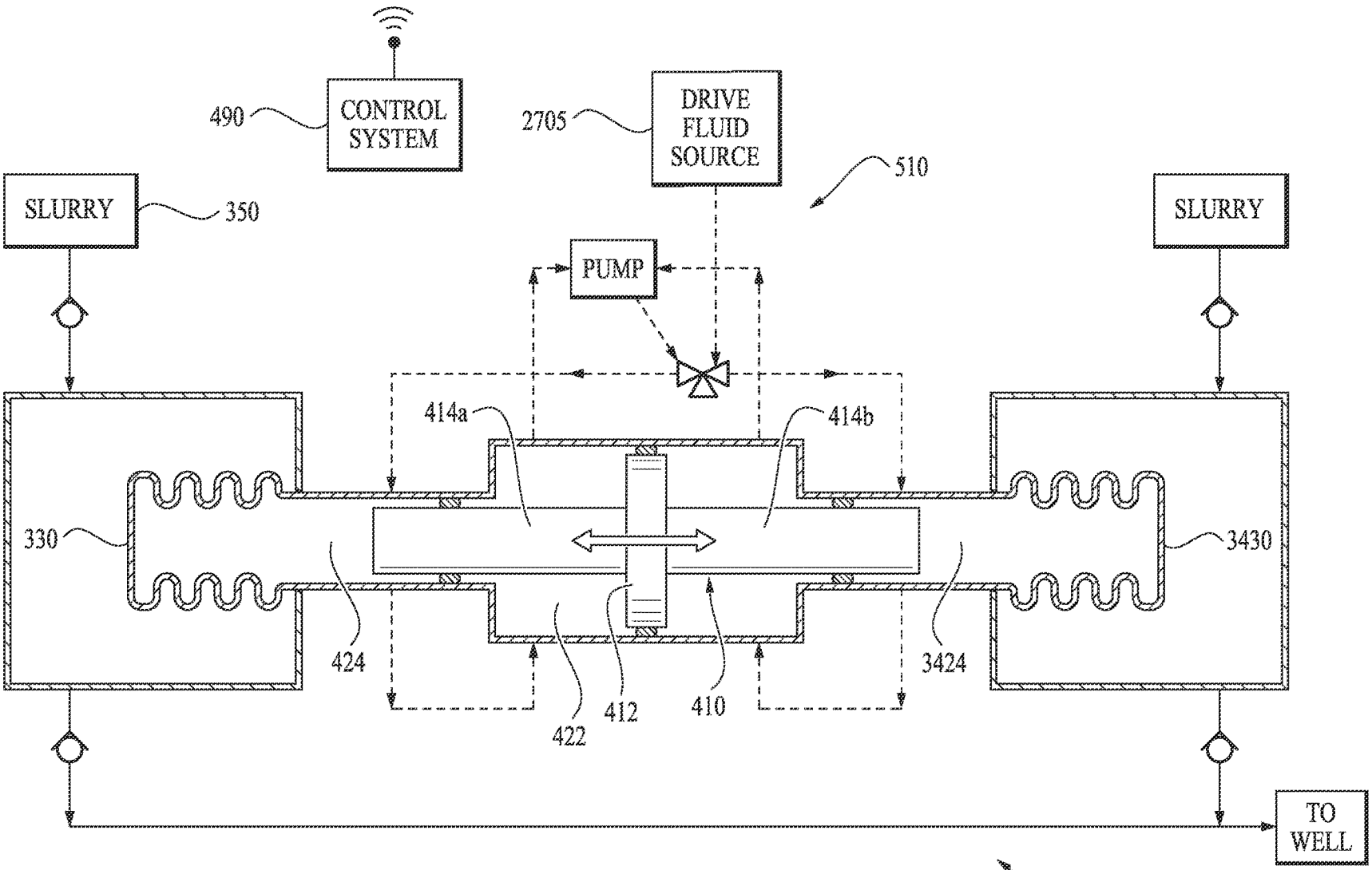
FIG. 34 is a schematic illustration of an exemplary dual-bellows pump system, according to an embodiment of the disclosure.

FIG. 34 schematically illustrates an exemplary system having a dual-bellows pump 3401 (which may be similar to the single bellows pump embodiments 300 in most respects). For example, the pump 3401 may include a second bellows 3430 (e.g. in addition to the first bellows 330), and the piston 410 may be configured to reciprocally expand and contract both the first bellows 330 and second bellows 3430. For example, the piston 410 may have two rods 414*a, b* extending from opposite sides of the head 412, with one of the rods extending towards each of the two bellows of the dual bellows pump 3401. The bore 420 in FIG. 34 may have a third portion 3424 configured for axial movement of the second rod 414*b* towards the second bellows 3430, and the third portion 3424 of the bore 420 may be in fluid communication with the second bellows 3430. In some embodiments, the two rods 414*a, b* may be substantially similar, and the second portion 424 and third portion 3424 of the bore 420 may be substantially similar (but extending for example in opposite directions). As shown in FIG. 34, the expansion/discharge stroke for the first bellows 330 can simultaneously serve as the contraction/suction stroke for the second bellows 3430, and vice versa. In some embodiments, both the first bellows 330 and the second bellows 3430 can be fluidly coupled to the make-up system 510. For example, the make-up fluid source 2705 can be fluidly coupled to the second bellows 3430 (e.g. via a second make-up port), in addition to being coupled to the first bellows 330. In embodiments, the make-up system 510 can be configured to maintain a second controlled volume of fluid between the piston 410 and the second bellows 3430 (e.g. in addition to maintaining a first controlled volume of fluid between the piston 410 and the first bellows 330). In some embodiments, a single make-up system 510 may be used for both controlled volumes, while in other embodiments separate make-up systems could be used for each. In embodiments, if either the first bellows 330 or the second bellows 3430 leaks and becomes contaminated (e.g. by treatment fluid), upon detecting the leak/contamination, the controller 490 may isolate the leaking bellows from the make-up system 510. This may in turn simultaneously fluidly uncouple the two bellows 330, 3430 from one another (e.g. fluidly isolating the bellows form one another), for example protecting the uncontaminated bellows from being contaminated by the leaking bellows. In some embodiments, the second bellows 3430 may be one of the additional components fluidly coupled to the make-up system 510. In embodiments, fluidly isolating the first bellows 330 from the make-up system 510 (e.g. by closing the make-up valve) can fluidly isolate the first bellows 330 from the second bellows 3430 (e.g. fluidly uncouple the second bellows 3430 from the first bellows 330) and/or can protect the second bellows 3430 from contamination via the make-up system 510.

In some embodiments, multiple pumps may be configured to jointly introduce treatment fluid into the well. In some embodiments, the plurality of pumps may be configured to provide constant pumping at approximately constant pressure. For example, one or more pump of the system 3500 may be configured so that its power/discharge stroke is out of sync with the power/discharge stroke of one or more other of the pumps of the system 3500. In some embodiments, half of the pumps in the system 3500 may be configured to have their power/discharge strokes in sync, for example when the other half of the pumps are having their suction stroke.

Figure 35:
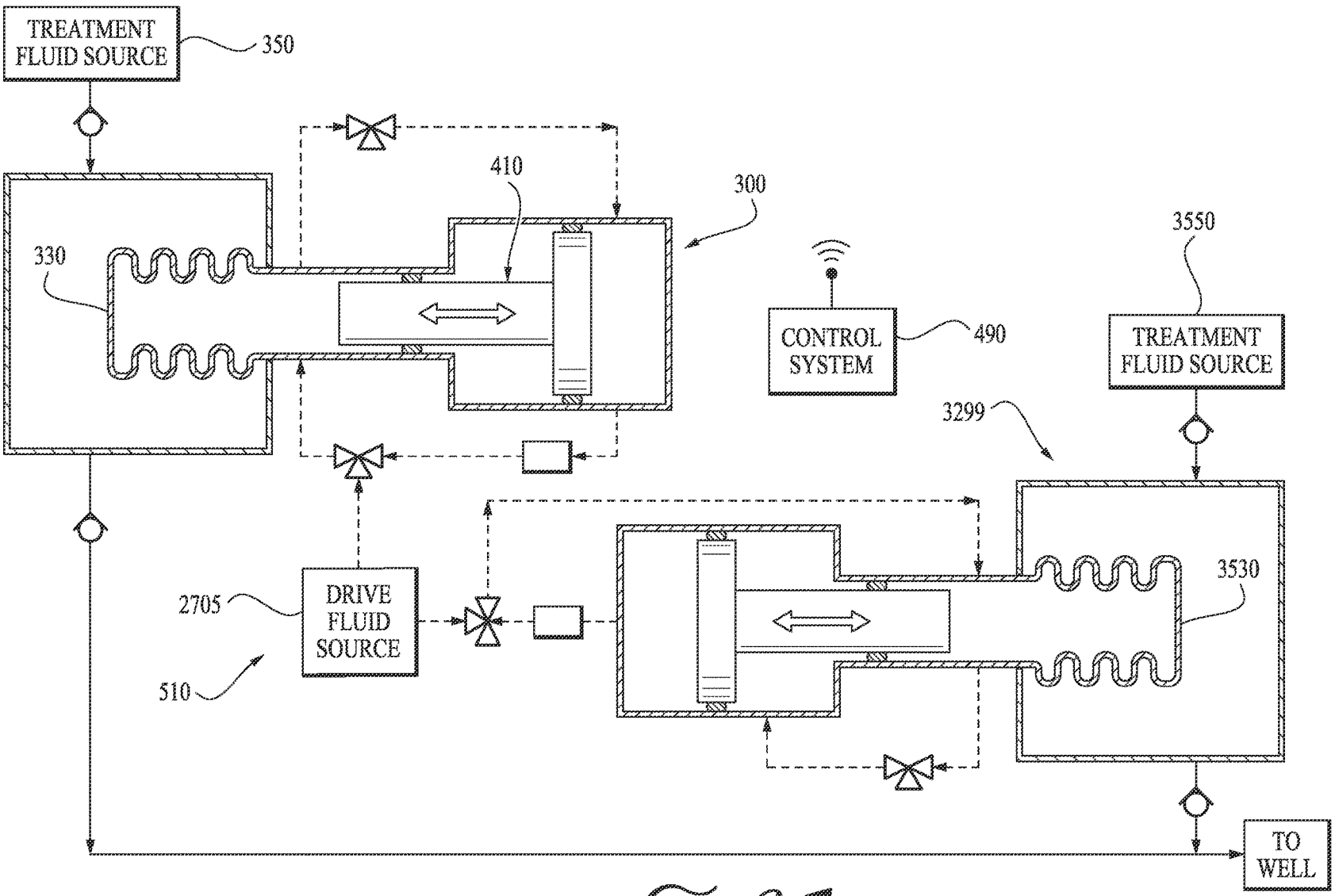
FIG. 35 is a schematic illustration of an exemplary system having two bellows pumps, according to an embodiment of the disclosure.
Figure 30:
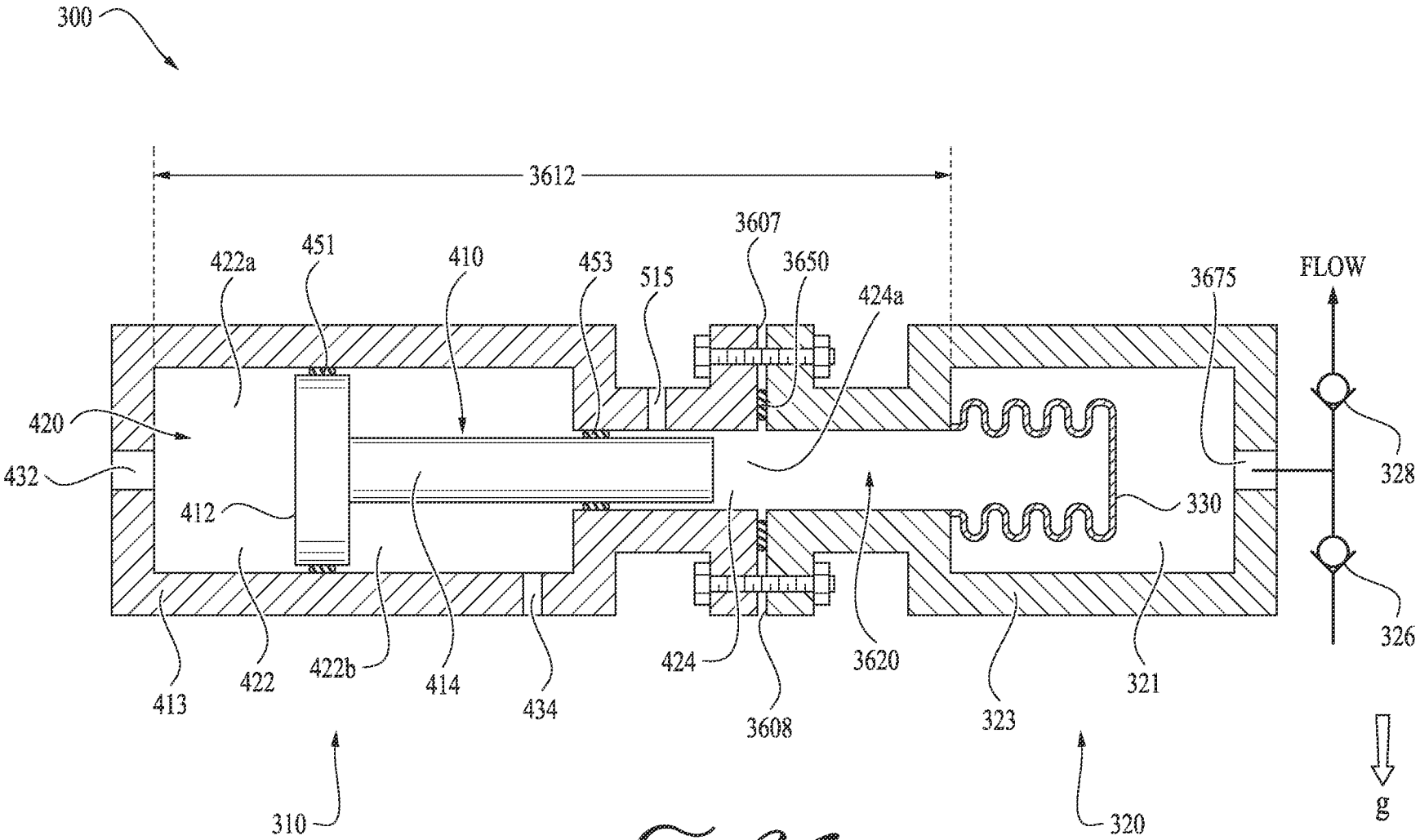

FIG. 35 schematically illustrates an exemplary system 3500 having two pumps 300, 3299 fluidly coupled to a common make-up system 510. While both pumps 300, 3299 are shown as being bellows pumps, in some embodiments, one of the pumps may not be a bellows pump (e.g. only one of the pumps may be a bellows pump). In the embodiment shown in FIG. 35, both of the pumps 300, 3299 may be similar bellows pumps, and may be fluidly coupled to the make-up fluid source 2705. For example, the system 3500 can comprise one or more additional (e.g. similar) pump (e.g. the first bellows pump 300 and the second bellows pump 3299 as shown in FIG. 35). In embodiments, the pumps (e.g. the first bellows pump 300 and the one or more additional pump, e.g. 3299) can be configured to jointly pump treatment fluid into the well and/or can be fluidly coupled to the make-up fluid source 2705. In some embodiments, a common control system 490 may be used to control the entire system 3200. The control system 490 may detect a leak/contamination in any of the bellows pumps of the system 3500 (e.g. either the first or second bellows pump 300, 3299 of FIG. 35), and may fluidly isolate the leaking bellows from the one or more non-leaking bellows. In some embodiments, the one or more additional pump (e.g. the second bellows pump 3299 of FIG. 35) may be one of the additional components fluidly coupled to the make-up system 510. In embodiments, the corresponding threshold (e.g. to which the sensor data is compared to determine if there is a leak/contamination in one of the bellows) can be based on statistical deviation compared across the pumps of the system. For example, sensor data from all of the similar pumps of the system (e.g. configured to jointly pump fluid into the well) can be used to determine a threshold, for example with the threshold based on being more than a certain deviation (e.g. percentage) from the mean/average data from all system pumps.

While the two pumps 300, 3299 of FIG. 35 are shown as drawing treatment fluid from separate sources 350, 3550, in other embodiments two or more pumps of the system may draw treatment fluid from a common source. So in some embodiments, two or more bellows pumps may draw treatment fluid from a common source, and they may also be fluidly coupled to a common make-up fluid source. And while the pumps in FIG. 35 are illustrated as being operated by a common control system 490, in other embodiments each pump could have its own control system, for example with the control systems communicating with each other in some embodiments. While FIG. 35 illustrates a system having two bellows pumps 300, 3299, in other embodiments any number of additional bellows pumps may be configured to jointly pump treatment fluid into the well and/or to draw from (e.g. be fluidly coupled to) the same make-up fluid source 510.

Furthermore, while the suction valve 326 and the discharge valve 328 may each be one-way check valves, in alternate embodiments, any other suitable valve may be used as either the suction valve 326 and/or discharge valve 328. Although not required, as illustrated in FIGS. 32-35, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver mechanism capable of reciprocally expanding and contracting the bellows may be used, and are included within the scope of this disclosure.

So, in embodiments, the systems and methods described herein may be used in controlling an injection treatment (e.g. of treatment fluid into a well). For example, the injection treatment may be done using intensifier-type pumping systems that utilize one or more bellows for pumping the treatment fluid. The control system of the pump may monitor the pumping systems, determine whether an issue, such as failure and/or contamination, occurs in the bellows, and automatically stop the pump, take mitigating actions, and/or warn an operator before the treatment fluid spreads to undesirable places.

FIGS. 32 and 33 illustrate an exemplary improved intensifier-type pumping system 3200. In an embodiment, the intensifier-type pumping system may include designed components that allow for the automatic prevention of contamination from a damaged billows causing additional damage to the system (e.g. to other components of the system). In embodiments, the pumping system may include a pressure intensifier and one or more fluid ends and bellows.

In hydraulic fracturing and other well treatment operations, high pressure pumps are often used to pump treatment fluid into a well, for example pumping a slurry mixture of proppant or sand mixed with water or processed water into a shale formation. These operations can use of a variety of pump types, including hydraulic intensifier and positive displacement pumps, to pump pressurized fluid. Both hydraulic intensifiers and positive displacement pumps can use a piston to move fluid. Some of these pumps may use a bellows to separate the piston from the treatment fluid to reduce wear on the piston (e.g. with the bellows acting as a physical barrier between the treatment fluid and the piston, to physically separate the piston from the treatment fluid). The piston commonly can be surrounded by a fluid that allows the piston to move or reciprocate with minimal mechanical damage or wear due. In embodiments, this fluid or barrier may be drive fluid such as hydraulic oil or grease. This fluid generally creates the fluid (e.g., hydraulic) connection between the bellows and the piston such that they can move in synchrony. However, in some embodiments, the fluid or barrier may also support other systems on the pump or related pumps. For example, a reservoir of hydraulic fluid may be used by the system for the fluid that fluidly connects the end of piston to the bellows, and also may be used by the system for driving the pump. In some cases, there may be multiple pumps, pistons, and/or bellows that share a common fluid reservoir (e.g. of drive fluid).

The drive fluid can be critical for keeping the bellows and piston in sync and preventing damage to the piston and/or bellows. In particular, the amount of fluid between the end of the piston and the bellows must be calibrated and/or controlled such that the piston and the bellows are in proper sync. For example, one or more ports (e.g. make-up ports) may be incorporated into the system between the end of the piston and the bellows, such that make-up fluid (which can be drive fluid in some embodiments and/or hydraulic fluid) can be moved in and/or out of the bore therebetween. In some embodiments, this may be done using the make-up system. For example, the control system can monitor bellows position (e.g. in relation to piston position) and determine when to add fluid via the make-up system to keep the piston and bellows in sync. This system can have a make-up valve which can be opened to add fluid when the system does not have adequate amount or remove fluid when the system has an excess amount of fluid between the bellows and the piston. However, in the event of a break, perforation, or other damaged to the bellows, the make-up system may not be able to effectively perform its job and/or may accidentally spread contaminated fluid throughout additional components of the system (thereby causing more damage to the system and/or necessitating additional maintenance work).

For example, if an intensifier pump that had the fluid make-up system tied to the main hydraulic circuit has a bellows failure (e.g., due to fatigue or other sealing issues) then the make-up fluid (e.g., the hydraulic fluid) would be contaminated with treatment fluid (e.g., the slurry containing sand, water, and/or other chemicals). That is, the reservoir of hydraulic fluid (e.g. the make-up fluid source) could be contaminated with the abrasive and/or corrosive treatment fluid and then inadvertently pumped to other components connected to the reservoir, thereby placing each contaminated system in danger of failure. Such contamination would result in all hydraulic pumps, motors, lines, valves, and tanks needing to be repaired, replaced, or flushed to resume work, which would cause a high amount of non-productive time and/or high costs.

Advantageously, this disclosure provides examples of improved systems for detecting such failures of the bellows and reducing the chance of contamination within the hydraulic circuit. This disclosure provides systems and methods that can detect failure of a bellows and automatically respond to protect pumping system or any additional system(s)/component(s) that are connected to the make-up fluid system. In various embodiments, the detection could have selectable level of sensitivity to allow the operator to be cautious as they may like. As a result, this technology may prevent costly repairs and non-productive time for pumps which use a bellows.

Returning to FIGS. 32-33 for additional discussion, an exemplary intensifier system 3200 that uses a bellows 330 to protect the moving components and seals from the abrasive and/or corrosive treatment fluid is illustrated. FIG. 32 depicts a single acting intensifier pump 300 for illustrative purposes. However, it is to be appreciated that similar techniques and arrangement may be applied on a dual acting intensifier pump (see for example 3401 of FIG. 34).

The pump 300 includes an intensifier portion (e.g. power end 310) and a fluid end 320. The power end 310 includes a pump body 413 and a piston element 410. The piston element 410 is at least partially disposed within the pump body 413 (e.g. within a bore 420). The piston 410 includes a head 412 and a rod 414 portion. A pressure differential on either side of the head 412 can cause the piston element 410 to move. The rod 414 typically extends from the head 412 into a channel (e.g. the second portion 424 of the bore 420). The rod portion 414 may have a seal (e.g. second seal 453) that allows for the piston 410 to move but defines an interior volume (e.g. a controlled volume of fluid) between the distal end of the rod portion 414 of the piston element 410 and the bellows 330. The interior volume can be filled with a make-up fluid (e.g., drive fluid, such as hydraulic oil) such that the bellows 330 moves (e.g., expands or contracts) when the piston element 410 is driven.

In some embodiments, the pump 300 may include one or more seals 453 that are structured to provide a fluid seal between the rod portion 414 and walls of the bore 420 (e.g. the second portion 424 of the bore) or power end housing 413. In some embodiments, the seal 453 may be a seal that could be used in an abrasive and/or corrosive environment. In other embodiments, the seal 453 could be a seal that is rated for or designed for a clean environment (e.g., an environment that only includes non-contaminated hydraulic oil), although such embodiments may be less resilient and/or may not allow for operation of the pump after contamination. In embodiments, it may be important for maintenance personnel to update the second seal 453 to a seal that could be used in abrasive and/or corrosive environment. In this example, this may prevent the seal 453 from failing immediately when the bellows 330 fails. This is particularly advantageous in the system described herein. For example, as described herein, the system 3200 can be able to detect failures of a bellows 330 before enough mechanical damages is done to render the pump 300 non-functional. Thus, without the system 3200 described herein, even using a seal 453 that can operate in a contaminated environment may not help, because the issue may not be detected until there is a mechanical failure requiring re-building or replacing of the one or more components of the system. However, in this system 3200, the use of a seal 453 that has been rated to be operated within a contaminated environment allows for the pump 300 to have additional resilience during the short amount of time between a failure occurrence in the bellows 104 and when that failure is detected by the control system 490 and mitigation responses are taken. Thus, the unconventional use of a specialized seal in combination with the prevention system may extend the useful life of the pump 300 by a significant amount. Moreover, if there is a failure that is not an extreme failure, a pump 300 with such a specialized and unconventional seal 453 may be operated even if other responses are being taken by the control system 490 (e.g., the pump 300 may be operated at reduced rate or speed to limit further damage to the bellows 330, but may allow operations to complete the job before shutting off the pump 300 for repairs). Such a response may be set within the control system 490 as an automatic response if one or more compared sensor values are within a particular range (e.g. as discussed in greater detail below).

The fluid end 320 of FIG. 32 has the bellows 330 disposed within a chamber 321 of the fluid end housing 323. The bellows 330 separates the inner volume (e.g. within the bellows 330 and/or having make-up/drive fluid therein) from the chamber 321 of the fluid end 320 (e.g. having treatment fluid therein). A discharge valve 328 may have a first end fluidly connected to the chamber 321, and a suction valve 326 may have a first end connected to the chamber 321. A second side of the suction valve 326 may be coupled to a reservoir/source of treatment fluid 350 (e.g., the fluid intended to be pumped, such as a slurry). A second side of the discharge valve 328 may be connected to any place to which the treatment fluid is intended to be pumped. For example, the second side of the discharge valve 328 may be coupled to an oil and gas well. In some embodiments, the valves 326 and 328 are positioned within respective openings within the fluid end housing 323. In various embodiments, the valves 326 and 328 may be located within other components or devices, such as piping, that has a fluid connection with the chamber 321. In this way, the chamber 321 can be filled with treatment fluid as the bellows pump 300 operates.

The system 3200 typically also includes a control system 490. The control system 490 may include one or more processors coupled to one or more non-volatile computer readable medium (e.g., memory devices) that comprise instructions that, when executed by the processor, cause the control system 490 to implement or perform the various operations described herein. The control system 490 and/or processors thereof may be communicably coupled to the various components for either receiving data or sending data via communication lines 3290. The communication connections may be either wired or wireless. The control system 490 may, in some embodiments, be communicably coupled to other control systems or information handling systems via one or more network connections or direct connections. Additional discussion of various embodiments of the control system 490 are described with reference to FIG. 6.

The control system 490 may include one or more sensors 3210 designed and arranged to measure one or more parameters of the system 3200. The parameters that may be monitored include pressure, temperature, flow rate, viscosity, contamination/particle count, and/or bellows position. For example, one or more sensors 3210 may be deployed to monitor the position of the bellows 330, position of the piston element 410, pressure in the chamber 321, pressure within the bellows 330 (e.g. its inner volume), and/or the amount of fluid passing through the suction valve 326, the discharge valve 328, into a port (e.g. make-up port 515) leading to the inner volume of the bellows 330, and/or into and out of ports (see for example 432 and 434 in FIG. 4) designed to allow the driving of the piston element 410 (e.g. via hydraulic circuit). For example, the control system 490 may include a first sensor **3210*a* designed and arranged to monitor one or more parameters (e.g., pressure) within the chamber 321. The control system 490 may also include a second sensor 3210*b* that is positioned to monitor one or more parameters (e.g., temperature, pressure, and/or position) of the bellows 330. As another example, the control system 490 may include a third sensor 3210*c* that is positioned and arranged to monitor one or more parameters (e.g., temperature, pressure, viscosity, contamination, and/or flow rate) of the make-up fluid entering, within, or exiting the bellows 330 via a make-up system loop 3240 (e.g. which may be at least partially located between the valve 2720 and the bellows 330 (e.g. the inner volume). In a further example, the control system 490 may also include a fourth sensor 3210***d* that is positioned to monitor one or more parameters (e.g., temperature, pressure, and/or position) of the piston element 410. The sensors 3210 typically would be communicably coupled to the control system 490 (e.g., to the one or more processors of the control system) such that data is transferred therebetween. In some embodiments, the communication and/or connection may be done via direct wiring, wiring over a network, wireless connections such as Bluetooth, or wireless network connections.

The control system 490 may also be communicably coupled to a make-up system 510, for example communicatively coupled to a make-up valve 2720, a make-up pump 2725, and/or a make-up fluid source 2705 (e.g. a reservoir of make-up fluid). That is, the control system 490 may be coupled to various sensors which are positioned on or part of the make-up fluid pump 2725 and/or a make-up fluid source 2705 in order to monitor their respective states and/or the properties of the make-up fluid therein. In various embodiments, the control system 490 is also coupled to a control system of the make-up fluid pump 2725 such that the control system 490 is able to turn on or off the make-up pump 2725 and/or control its speed. In some embodiments, the control system 490 is also coupled to one or more make-up valves 2720 such that the control system 490 is able to issue commands that cause the one or more make-up valves 2720 to actuate (e.g., open or close) in order to control the flow of the make-up fluid in the system. In various embodiments, the inputs to the control system 490 via the wired or wireless communications include sensor data from one or more sensors 3210 positioned in the system that represent respective pressure, temperature, flow/rate, viscosity, contamination/particle count, and/or bellows position. In some embodiments, the outputs of the control system 490 via one or more wired or wireless communications include data that controls the make-up valve(s) 2720 and/or the make-up pump(s) 2725 (e.g. to control make-up fluid regarding synchronizing the bellows and piston and/or to isolate the bellows in case of leakage).

FIG. 32 depicts the system 3200 having a bellows 330 that is not damaged. In this example, the controls system 490 may continue to monitor the system 3200, including by way of example bellows 330 and piston element 410 or intensifier position, treatment pressure and rate, make-up fluid pressure, rate, temperature and/or may also monitor particle count or contamination via monitoring the data outputs of the sensors 3210. FIG. 33 depicts the system 3200 having a bellows 330 that is damaged. That is, the bellows 330 may have a leak or perforation that can allow the make-up fluid in the inner volume of the bellows 330 to be contaminated with the treatment fluid in the chamber 321.

As indicated above, the controls system 490 can be configured to monitor the bellows 330 position to identify when a bellow 330 has failed by comparing its position to the piston element 410 position. For example, the control system 490 may compare a position of the bellows 330 to a position of the piston element 410 over time and determine if the differences in relative position are abnormal. For example, the relative position differences may be compared to a threshold and/or compared to mapped data that is stored within the control system 490. The mapped data for example may include expected relative position over time for one or more cycles. A statistical deviation from the mapped data to the monitored data (e.g., taken over one or more cycles) may then be compared to a threshold (or via another analysis) to allow the control system 490 to determine whether an issue exists within the bellows 330. In some embodiments, the control system 490 may continuously monitor the relative positions. In various embodiments, the control system 490 may monitor the relative positions of the bellows 330 and the piston element 410 at particular times or intervals (e.g., set by a user based on preferences) for only a cycle or a pre-set number of cycles. In some embodiments, the monitoring by the control system 490 may be manually triggered by a user such as a maintenance personnel. In response to determining that an issue does exist (e.g., that the bellows 330 are likely compromised), the control system 490 may initiate a response automatically as discussed in greater detail below.

In the event the bellows position is not recorded (or in addition to using positional data), the control system 490 could monitor for pressure changes between make-up fluid in the inner volume of the bellows 330 and treatment fluid in the chamber 321. That is, the control system 490 may receive data representing the pressure in the bellows 330 and data representing the pressure in the chamber 321. In healthy operation, the two pressures would typically be aligned. Thus, if the two pressures are roughly equal (e.g., within a threshold value that may be set manually or adjusted over time), the control system 490 may determine that there is not an issue or concern (e.g. no leak and/or contamination). However, with a crack or other failure in the bellows 330, the two pressures would typically deviate as the piston 410 moves, and this may indicate a bellows 330 failure. In this way, the control system 490 may be configured to monitor the two pressures over multiple cycles, one cycle at a preset time, or continuously monitor and compare the two pressures and determine whether there is an issue or a deviation over a threshold value (e.g. which may be determined at one or more times during the monitoring). In some embodiments, the control system 490 may determine that there was an error or issue only if the deviation between the two pressures exceeds the threshold more than one time during multiple cycles (e.g. repeatedly, for certain pre-set number of times within a given timeframe). In response to determining an issue (e.g., that the bellows 330 are likely broken), the control system 490 can initiate a response automatically as discussed in greater detail below.

In some embodiments, the controls system 490 could also or alternatively monitor treatment fluid rate or make-up fluid for a quick change in contamination, viscosity, rate or temperature, which could indicate that treatment fluid can entered the make-up fluid system 510 (e.g. indicating a bellows failure). Such data could be used either alone or in conjunction with other sensor data. That is, the control system 490 may receive data from sensors regarding the properties of the treatment fluid within the chamber 321 and also receive data from sensors regarding one or more properties of the make-up fluid in the inner volume of the bellows 330 (or elsewhere within the make-up fluid loop 3240). Certain values/thresholds of the properties or qualities may be pre-set within the control system 490, such that the control system 490 receives the sensor data and compares it to the pre-set values stored in the memory. In some embodiments, the pre-set values/thresholds may be statically set by a user or dynamically calculated based on the time of operation, the time of day, the known qualities of the treatment fluid, and/or a monitored age of the make-up fluid. If the control system 490 determines that the data representing one of the pre-set properties exceeds the respective pre-set threshold value, the control system 490 may automatically initiate a response.

In embodiments, the response may be pre-set by a user and programmed into the control system 490. In some embodiments, the response can be dependent on the particular property that was determined to be out of a range or threshold. For example, the response may include closing the make-up valve, shutting off the make-up fluid pump, sending a notification to a user device of an operator, or a combination thereof. As one example, if any of the conditions described above are met, the controls system 490 may automatically issue data commands that would close the make-up valve 2720 and/or shut off the make-up fluid pump 2725 to prevent contamination of the make-up fluid system. In this way, the system 3200 may be able to intelligently isolate an issue before it causes a potentially catastrophic issue. Maintenance personnel may then be able to repair the system 3200 before contamination spreads.

It is to be appreciated that the response and threshold values may be selectable, pre-programmed, or dynamically calculated. For example, if an operator selected (e.g., pre-programmed into the control system 490) a less sensitive setting (e.g., a high threshold value) or if the position sensors of the bellows 330 or piston element 410 were not reading properly, the controls system 490 could warn the operator (e.g., via an automatically sent notification on a graphical user interface or human-machine interface at the well location or a remote location) of a possible failure and continue to monitor for a change in make-up fluid pressure, temperature, contamination, and/or viscosity to also detect a failure that may cause the system 3200 to automatically turn off as described above. That is, in some embodiments, an anomaly (e.g., a deviation) in the sensed and received data may first cause a first response (e.g., a notification or alarm to be sent or triggered) and a second anomaly (e.g., deviation) in the same or different parameter of the sensed and received data may cause a second response (e.g., closing of valves and/or turning off one or more portions of the system 3200). In this example, some parameters could be used, but are not required, to indicate a failure while others may provide reassurance to the control system 490 that a failure has occurred.

As indicated above, additional benefits include improved system efficiency/performance, maintenance, Health/Safety/Environmental (HSE) impact, reliability, and packaging opportunities. Additionally or alternatively, performance may be improved via the prevention of contaminated make-up material floating through the make-up (e.g., clean) oil.

Disclosed embodiments also comprise exemplary methods for protecting a bellows pump system (e.g. from damage due to contamination of the fluid in the bellows) during introduction of treatment fluid into a well. Such methods may use any of the disclosed pump embodiments, such as the examples illustrated in FIGS. 32-35. For example, an exemplary method embodiment may comprise: pumping treatment fluid into the well using a bellows pump system, wherein the bellows pump system includes a pump having a bellows and a piston, a control system, and a make-up system configured to maintain a controlled volume of drive fluid between the piston and the bellows, wherein the make-up system is fluidly coupled to the bellows; responsive to receiving (e.g. at the control system) sensor data from one or more sensor configured to detect one or more parameter of the bellows pump system (e.g. one or more sensor disposed on the bellows pump), detecting (e.g. using the control system) a leak in the bellows using/based on the sensor data; and responsive to detecting a leak, fluidly isolating the bellows from a fluid source of the make-up system. In embodiments, the make-up system (e.g. the make-up fluid source) can be fluidly coupled to both the bellows and to at least one additional component of the system. For example, the method may further include fluidly coupling one or more additional component of the system to the fluid source for the make-up system (which is already fluidly coupled to the bellows, for example). In embodiments, fluidly isolating the bellows from the fluid source may thereby fluidly uncoupling the at least one additional component of the system from the bellows. For example, disclosed embodiments may further comprise fluidly uncoupling the at least one additional component of the system from the bellows, for example in response to fluidly isolating the bellows from the fluid source.

In embodiments, fluidly isolating the bellows from the fluid source can occur automatically and/or via the control system. In embodiments, the one or more sensor can be configured to detect one or more of the following parameters at one or more location within the system: pressure, temperature, flow rate, viscosity, contamination (e.g. particle count), and/or position of one or more component of the system. For example, the sensor data can comprise position of the bellows relative to position of the piston, pressure in the chamber relative to pressure in the bellows, flow rate of treatment fluid through the suction valve relative to flow rate if treatment fluid through the discharge valve, flow rate of make-up/drive fluid through the (e.g. one or more) make-up port (e.g. in and out) of the bellows, flow rate of make-up fluid/drive fluid (e.g. configured to drive the piston) into and out of the intensifier (e.g. the first portion of the bore of the power end), flow rate of make-up/drive fluid into and out of the make-up fluid source, viscosity of fluid in the bellows, contamination (e.g. particle count) within the bellows, and/or temperature of make-up/drive fluid within the bellows (e.g. compared to expected temperature and/or compared to temperature in the chamber). In embodiments, the one or more sensor can comprise a first sensor configured to monitor one or more parameter within the chamber, a second sensor configured to monitor one or more parameter in the bellows, a third sensor configured to monitor one or more parameter of the make-up fluid system (e.g. one or more parameter of the make-up/drive fluid entering and/or leaving the bellows (e.g. through the make-up port)), and/or a fourth sensor configured to monitor one or more parameter relating to the piston, intensifier, and/or power end.

In embodiments, detecting a leak may comprise comparing (e.g. using the control system) the sensor data to a corresponding (e.g. pre-set, pre-selected, or dynamically determined) threshold. In some embodiments, the threshold can be based on historical data. In some embodiments, the threshold can be based on statistical deviation from sensor data across a plurality of cycles of the pump (e.g. a pre-set timeframe, such as one minute, or cumulative data for the life (or some portion of the life) of the pump). In some embodiments, the bellows pump system can include one or more additional (e.g. similar) pump (e.g. having a plurality of bellows pumps), which may be configured to jointly pump treatment fluid into the well, and the corresponding threshold can be based on statistical deviation compared across the pumps of the system (e.g. deviation from the average of the plurality of pumps of the system).

In embodiments, fluidly isolating the bellows may comprise closing a make-up valve of the make-up system and/or shutting off a make-up pump of the make-up system. Some embodiments of the make-up system comprise a fluid source (e.g. of make-up/drive fluid) fluidly coupled to the bellows (e.g. via a make-up port) and at least one other component of the system. In some embodiments, fluidly isolating the bellows from the fluid source of the make-up system may include fluidly isolating the bellows from an intensifier/head of the piston, a first portion of the bore, a second bellows (e.g. in a dual bellows system and/or in one or more additional pump), and/or a second pump. Some method embodiments may further include evaluating (e.g. using the control system) the sensor data to determine whether the bellows and piston are out of sync, and responsive to determining that the bellows and piston are out of sync, using the make-up system to adjust the amount of fluid (e.g. injecting or removing make-up/drive fluid) between the piston and the bellows to return the piston and bellows to sync. For example, using the make-up system may include controlling (e.g. opening and/or closing) the make-up valve and/or the make-up pump (e.g. activating or shutting off the make-up pump).

Disclosed embodiments may have the pump include a seal disposed between the piston and a bore in which the piston is disposed (e.g. configured to maintain a controlled volume of fluid between the piston and the bellows), and the seal can be configured for an abrasive and/or corrosive environment and/or exposure to treatment fluid (e.g. even though shielded from exposure to treatment fluid by the bellows). For example, the seal may be resistant to abrasive and/or corrosive environments and/or treatment fluid. In embodiments, the method may include continuing to pump treatment fluid into the well using the bellows pump while the bellows pump is isolated and/or while there is a detected leak (for example, due to the protection offered by the resistant seal). Some embodiments may further comprise sealing between the piston and a bore of the power end in which the piston is disposed (e.g. with the seal configured to maintain a controlled volume of fluid between the piston and the bellows) using a seal that is resistant to abrasive and/or corrosive environments and/or treatment fluid. In some embodiments, the rate of pumping treatment fluid into the well may be reduced while the bellows is isolated from the fluid source of the make-up system (e.g. reducing the rate of pumping of treatment fluid into the well), for example due to contamination being contained somewhat by the resistant seal.

In some embodiments, the pump can include a hydraulic circuit configured to reciprocally drive the piston in the bore of the power end, and the hydraulic circuit can be fluidly coupled to the fluid source of the make-up system (e.g. with the drive fluid used by the hydraulic circuit coming from the fluid source). In embodiments, closing the make-up fluid valve can isolate the bellows from the hydraulic circuit. Some embodiments can further comprise pumping treatment fluid into the well using a second bellows (e.g. of a dual bellows pump) or a second (e.g. one or more additional separate) bellows pump fluidly connected to the fluid source of the make-up system and/or configured to jointly pump treatment fluid into the well. For example, the second bellows or second pump may be configured to pump treatment fluid into the well at the same time that (e.g. simultaneously with) the first bellows pump is pumping treatment fluid into the well. In embodiments, closing the make-up valve can isolate the bellows from the second bellows (e.g. fluidly uncouple the second bellows from the first bellows) and/or protects the second bellows from contamination via the make-up system. In embodiments, the second bellows may still be in fluid communication with the make-up system while pumping (even when the first bellows has been isolated). In some embodiments, the second bellows may continue pumping even after the first bellows has been isolated from the make-up system and/or has been stopped.

Some method embodiments may further comprise taking action (e.g. using the control system and/or automatically) responsive to detecting the leak and/or fluidly isolating the bellows. For example, the action can include sending an alert/notice, isolating the bellows, and/or shutting down the pump (and/or in some embodiments and in some circumstances, continuing to pump treatment fluid, for example at a lower rate). In some embodiments, sending an alert may occur before isolating the bellows from the fluid source and/or before shutting down the pump. For example, upon sensor data exceeding a first threshold, the action may be sending an alert; upon sensor data exceeding a second threshold, the action may be shutting down the pump and/or using the output to shut down the suction fluid supply.

Some embodiments may further include using a second sensor (e.g. of the one or more sensor) (e.g. to detect contamination, viscosity, etc.) to confirm whether the detected leak relates to (e.g. involves) treatment fluid (e.g. entering the bellows). For example, responsive to confirming that the detected leak involves treatment fluid, operation of the isolated pump may be stopped (e.g. ceasing to pump treatment fluid into the well). Responsive to confirming that the leak does not involve treatment fluid, operation of the pump that is isolated may continue (e.g. continuing to pump treatment fluid into the well with the isolated pump), drive/make-up fluid (e.g. from the make-up fluid source) may be injected or removed using the make-up system, and/or fluid connection between the make-up system and the bellows may be restored.

In some embodiments, after a leak has been detected, the controlled volume of drive fluid between the piston and the bellows may be drained. For example, this may allow for repairing and/or replacing the bellows and/or the seal and/or otherwise performing maintenance on the pump. For example, the pump and/or make-up system may be flushed (e.g. the make-up valve, make-up pump, and/or fluid communication lines (e.g. piping) of the make-up system). After repairing and/or replacing the bellows and/or seal and/or performing maintenance, the make-up system may be used to inject make-up/drive fluid between the bellows and the piston (e.g. to provide the controlled volume of fluid and/or to return the piston and the bellows to sync).

One or more of the system embodiments disclosed herein (e.g. relating to FIGS. 32-35) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments, and/or a non-transitory computer-readable medium can have program instructions stored thereon configured to cause a control system (e.g. of the bellows pump system) to perform any of the disclosed method embodiments. Such instructions may be used by the control system of the disclosed bellows pump system embodiments, for example to operate the bellows pump system.

It should also be noted that certain piston-driven bellows-style pumps may have one or more issues and/or limitations. Conventionally, separate intensifiers, pump fluid ends (with bellows), and suction/discharge valving have been interconnected using piping, for example with hookup of such separate components occurring at the well site. The use of such interconnecting piping within the pump system can introduce one or more undesirable effects, however. For example, such piping may be subjected to significant cyclical pressure-induced fatigue. Such piping may also be subject to stress during transportation. These sorts of stresses can lead to reduced lifespan, increased failure rates (which may be a safety and/or environmental concern), and/or increased maintenance (which may lead to more unproductive downtime, thereby affecting overall productivity of a well). Further, since the piping (and particularly the piping connection) is often a weak point in the system, and since making and breaking such piping connections may cause still further leaks, a number of leak points may exist in such a system, which can be an environmental and/or safety concern. Interconnecting piping may also lead to the system having a larger footprint at the well site, which can be a concern due to space limitations.

Additionally or alternatively, the interconnecting piping may cause significant unswept volume between the intensifier and the fluid end. This unswept volume of fluid between the intensifier and the fluid end must be compressed before the fluid end can begin working (e.g. to pump treatment fluid into the well), which may reduce system efficiency and/or performance. Due to these and other issues relating to existing pumping systems, improvements to the pump structure, configuration, and approach may be useful, for example addressing one or more of these issues. Disclosed embodiments relate to improved piston-driven bellows pump embodiments, for example which may be redesigned and reconfigured for direct connection of the power end (e.g. intensifier) to the fluid end and/or for optimization of pump performance and/or efficiency.

FIG. 36 illustrates a cross-sectional view of an exemplary pump 300 according to an embodiment of this disclosure. In one or more aspect, the pump 300 of FIG. 36 may be similar to the embodiments discussed with respect to FIGS. 3-5. Specifically, the pump 300 of FIG. 36 may comprise: a power end 310, having a piston 410 disposed (at least partially) in a power end bore 420; a fluid end 320, typically having a fluid end bore 3620 and a chamber 321 which is configured to be in fluid communication with a suction valve 326 and a discharge valve 328; and an expandable bellows 330 disposed in the chamber 321 and in fluid communication with the fluid end bore 3620 and/or the power end bore 420. For example, in embodiments (such as shown in FIG. 36) having a fluid end bore 3620, the bellows 330 can be in fluid communication with the power end bore 420 through the fluid end bore 3620, while in any similar embodiments without a fluid end bore 3620 (e.g. in which the bellows is directly coupled to the power end bore 420), the bellows 330 may be in direct fluid communication with the power end bore 420. In embodiments, the power end 310 can be configured to reciprocally expand and contract the bellows 330 within the chamber 321 based on movement of fluid by the piston 410.

In some embodiments, the power end bore 420 and the fluid end bore 3620 can be fluidly coupled (e.g. in fluid communication) to form a unitary, continuous, and/or unbroken pump bore 3612 without external piping therebetween. In some embodiments, the power end bore 420 and the fluid end bore 3620 may be fluidly coupled without unswept volume therebetween, thereby minimizing any unswept volume between the piston 410 and the bellows 330. As shown in FIG. 36, the power end 310 can further comprise a power end housing 413 (e.g. with the power end bore 420 disposed therein), and the fluid end 320 can further comprise a fluid end housing 323 (e.g. with the chamber 321 and fluid end bore 3620 disposed therein). In embodiments, the power end housing 413 and the fluid end housing 323 can be configured to be directly coupled together (e.g. with no piping and/or unswept volume therebetween), and the unitary, continuous, and/or unbroken pump bore 3612 (e.g. the bore for the pump 300 as a whole) which is formed by the coupling may be entirely disposed within the power end housing 413 and the fluid end housing 323 (e.g. due to direct contact and coupling of the power end housing 413 to the fluid end housing 323, which may jointly form an overall pump housing, having the single, continuous pump bore 3612 extending therethrough). In embodiments, the pump bore 3612 may consist essentially of the power end bore 420 and the fluid end bore 3620, for example contacting with open ends aligning to form a continuous channel/bore in fluid communication with the bellows 330. In embodiments, all fluid communication between the piston 410 and the bellows 330 may occur via the pump bore 3612, which may be entirely disposed within the overall pump housing.

As persons of skill will appreciate, unswept volume can be thought of as the volume of drive fluid in the pump 300 which is not moved/swept by the piston 410. For example, unswept volume in a bellows pump 300 may be the volume between the distal end of the piston 410 at the end of its discharge stroke and the bellows 330 (e.g. the distal end of the bellows). This is as opposed to swept volume, which is the volume of drive fluid swept by the piston 410 as it moves between suction and discharge strokes. For a pump embodiment having external piping between the power end and the distal end (e.g. fluidly coupling the power end bore to the fluid end bore), such piping would represent upswept volume therebetween. By direct coupling of the power end 310 to the fluid end 320, the embodiment of FIG. 36 may eliminate or minimize unswept volume.

Typically, the pump housing may comprise a strong, fairly rigid, solid material and be configured to be capable of withstanding pump pressures and stresses. For example, the pump housing (e.g. the power end housing 413 and/or the fluid end housing 323) may comprise steel, cast iron, bronze alloys, nickel alloys, or composites and/or may have walls which are approximately 0.5" to 3" thick, for example depending on pressures within the relevant housing and strength of chosen material for the relevant housing. In embodiments, the walls of the pump housing (e.g. the power end housing 413 and the fluid end housing 323) may be approximately uniformly thick, although in some embodiments, the power end housing 413 may have walls that are thinner than the fluid end housing 323 walls, for example with each of the power end housing 413 and the fluid end housing 323 having uniformly thick walls. In embodiments, the contacting open ends of the power end bore 420 and the fluid end bore 3620 may have approximately the same diameter/cross-section. For example, the narrower second portion 424 of the bore 420 in the power end 310 may have approximately the same diameter/cross-section as the fluid end bore 3620 (or at least the portion of the fluid end bore 3620 proximate to the power end bore 420 upon coupling of the power end housing 413 to the fluid end housing 323).

As shown in FIG. 36, the power end housing 413 and the fluid end housing 323 each may have corresponding faces 3607, 3608 (e.g. flanges) configured for physical coupling of the power end housing 413 directly to the fluid end housing 323. For example, the corresponding faces 3607, 3608 can be configured for mechanical coupling (e.g. configured to be bolted together). In embodiments, the mechanical coupling may be a removable/releasable coupling, which may allow for the power end housing 413 and the fluid end housing 323 to be coupled for joint operation (e.g. pumping of treatment fluid), but also to be uncoupled, for example for maintenance. The physical coupling may be sufficiently strong to withstand pumping pressures and/or stresses, for example so that when coupled the power end housing 413 and the fluid end housing 323 act in the same manner as a single, unitary housing (e.g. formed without any joint). In embodiments, the corresponding faces 3607, 3608 can be configured for parallel mating contact. For example, each face 3607, 3608 may extend outward (e.g. perpendicularly or orthogonally) from the main portion of the housing, such that corresponding faces 3607, 3608 on the power end housing 413 and the fluid end housing 323 may extend approximately in parallel when the power end housing 413 and the fluid end housing 323 are in contact (e.g. with corresponding flanges/face 3607, 3608 abutting). In some embodiments, the faces/flanges 3607, 3608 may extend in all directions around the housing. And while FIG. 36 illustrates an embodiment having two bolts (e.g. on opposing sides of the housing), additional bolts may be used in other embodiments. While bolts are shown in FIG. 36, various sorts of mechanical coupling devices may be used, all of which are included herein.

Some embodiments may further comprise a housing (e.g. joint) seal 3650 disposed between the power end housing 413 and the fluid end housing 323 (e.g. at the joint between the corresponding faces 3607, 3608). The housing seal 3650 may be configured to seal the joint therebetween, for example providing a sealed coupling of the power end housing 413 to the fluid end housing 323 and/or of the power end bore 420 to the fluid end bore 3620. In embodiments, the housing seal 3650 can be configured to seal the fluid connection/coupling between the power end bore 420 and the fluid end bore 3620, for example to form the unitary sealed pump bore 3612 (e.g. preventing leakage from escaping at the joint between the power end housing 413 and the fluid end housing 323). For example, the housing seal 3650 may include one or more o-ring seal, metallic seal ring, and/or gasket, which may encircle the pump bore (e.g. at the intersection of the faces 3607, 3608). In some embodiments, there may be an inset in one or both corresponding faces/flanges 3607, 3608 at the joint, and the housing seal 3650 may be disposed therein.

In embodiments, the power end bore 420 and the fluid end bore 3620 may have contacting open ends aligning (e.g. when the corresponding faces 3607, 3608 are coupled in contact/abutting). In FIG. 36, the power end bore 420 and the fluid end bore 3620 align (e.g. have longitudinal centerline axes which align). In embodiments, the bellows 330 can be configured to extend/expand parallel to the power end bore 420 and/or fluid end bore 3620 (e.g. the bellows 330 may have a longitudinal centerline axis which aligns with the longitudinal centerline axis of the power end bore 420 and/or the fluid end bore 3620). For example, in FIG. 36, the pump 300 has a linear configuration, in which the longitudinal centerline axis of the power end bore 420, the fluid end bore 3620, the bellows 330, and the chamber 321 are all aligned. In the embodiment of FIG. 36, the chamber 321 and/or fluid end housing 323 may also include a valve port 3675 (e.g. a single point of fluid connection) configured to be in fluid communication with both the suction valve 326 and the discharge valve 328 (e.g. providing fluid communication between the suction and discharge valves 326, 328 and the chamber 323). In FIG. 36, the single valve port 3675 is aligned with the longitudinal centerline of the chamber 321 and/or bellows 330 and/or fluid end bore 3620 and/or power end bore 420.

As previously discussed, the power end 310 can be configured with two drive ports (e.g. a first port 432 and a second port 434), for example with the first port 432 configured to inject fluid in order to drive the piston 410 towards the bellows 330 (e.g. towards the fluid end bore 3620), and the second port 434 configured to inject fluid in order to drive the piston 410 away from the bellows 330 (e.g. away from the fluid end bore 3620). In embodiments, the first port 432 and the second port 434 may be operated in conjunction to induce reciprocal movement of the piston 410 in the bore 420, for example with one port injecting fluid while the other port removes fluid. In embodiments, the first port 432 can be in fluid communication with the first cavity 422*a* of the bore 420, and the second port 434 can be in fluid communication with the second cavity 422*b* of the bore 420. Some pump embodiments may further include a hydraulic circuit fluidly coupled to the two drive ports (e.g. the first port 432 and the second port 434), which may be configured to inject and remove fluid therethrough to drive the piston 410.

As also discussed above, the piston 410 may have a head 412 and a rod 414, for example with the rod 414 extending away from the head 412 towards the bellows 330 (e.g. the fluid end 320). In embodiments, the rod 414 and the head 412 may have longitudinal centerline axes which are aligned (and which may also be aligned with the axis for the power end bore 420). In embodiments, the head 412 can be disposed between the first port 432 and the fluid end 320, and the second port 434 can be disposed between the head 412 and the fluid end 320 (e.g. such that the head 412 may move between the two ports based on fluid movement therethrough, which may generate pressure differentials on the head 412). Embodiments may further comprise a first seal 451 (e.g. a moving seal, for example disposed on the head 412) configured to allow the head 412 to sealingly move (e.g. reciprocate) within the power end bore 420 (e.g. within the first portion 422 of the power end bore 420), and a second seal 453 (e.g. a stationary seal/packing, for example disposed in either the power end bore 420 or the fluid end bore 3620) configured to allow the rod 414 to sealingly move (e.g. reciprocate) within the bore.

In embodiments, the head 412 can have a larger diameter/cross-section than the rod 414, for example providing an intensifying effect configured to apply more pressure to the bellows 330. For example, the piston 410 may be part of an intensifier (e.g. the power end 310 may be configured as an intensifier). In exemplary embodiments, the rod-to-head size may range from approximately 1:1.1 to 1:10, for example. And as previously discussed, the bore 420 can include a first portion 422 configured for movement of the head 412 (e.g. axially) therethrough (e.g. having a diameter sized for the head 412) and a second portion 424 configured for movement of the rod 414 (e.g. axially) therethrough (e.g. having a diameter sized for the rod 414).

Some embodiments may further comprise a make-up port 515, which may be in fluid communication with the power end bore 420 and/or the fluid end bore 3620. The make-up port 515 may be configured to be fluidly coupled to a make-up system which is configured to keep the piston 410 and bellows 330 in sync and/or to maintain a controlled volume of fluid between the piston 410 (e.g. rod 414) and the bellows 3330 (e.g. in the third cavity of the bore), for example by allowing for injection of fluid into or removal of fluid from between the piston rod 414 and the bellows 330. In embodiments, the make-up port 515 can extend (e.g. radially) from either the power end bore 420 or the fluid end bore 3620 to the exterior of the housing. In embodiments, the make-up port 515 can be disposed between the second seal 453 and the bellows 330 (e.g. in either the power end bore 420 or the fluid end bore 3620), for example providing fluid communication between the bellows 330 and the make-up system for maintaining the controlled volume of fluid between the second seal 453 and the bellows 330.

Figure 37:
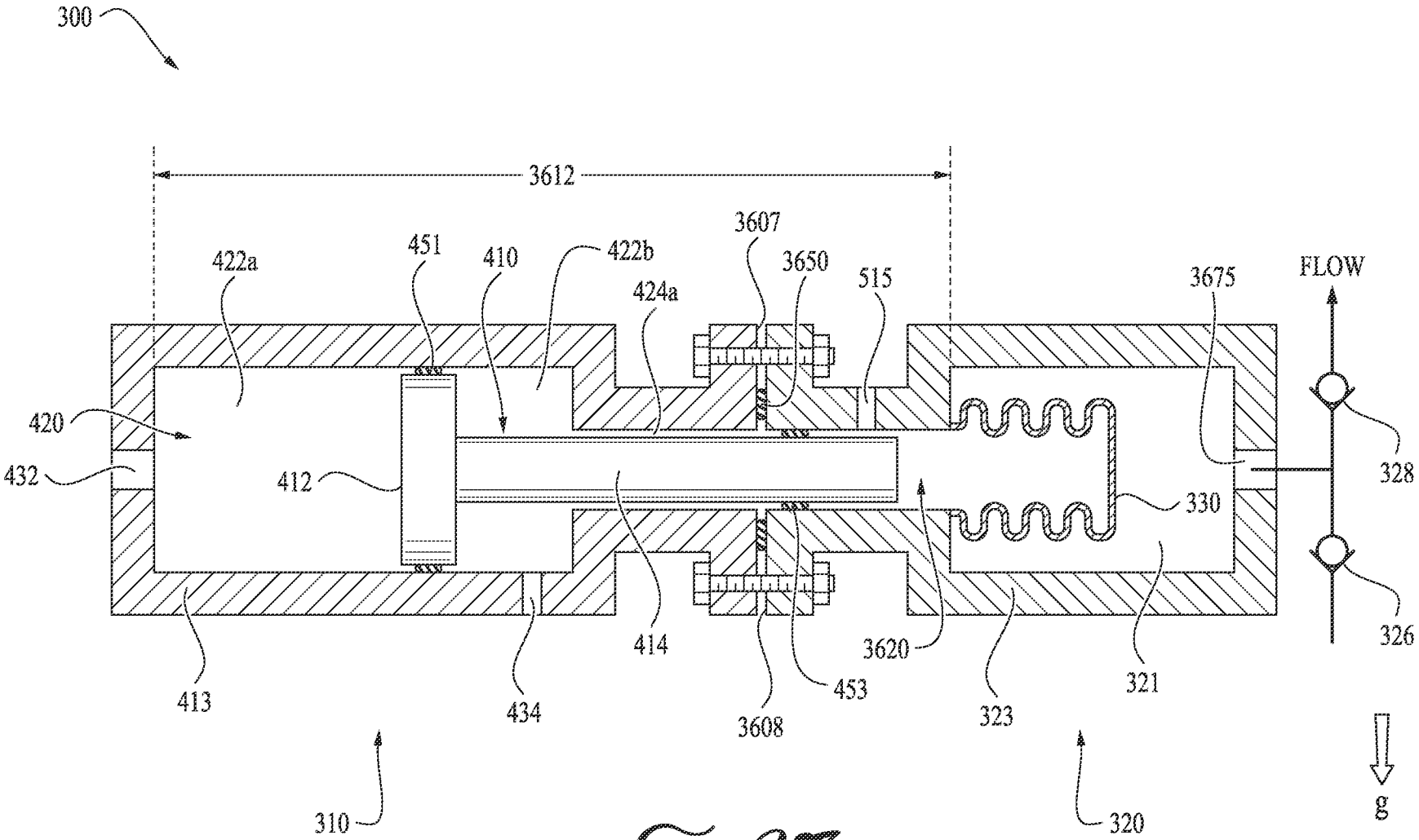
FIG. 37 is a cross-sectional view of another exemplary piston-driven bellows pump, according to an embodiment of the disclosure.

In the embodiment of FIG. 36, the make-up port 515 is disposed in the power end 310 (e.g. extending through the power end housing 413 and in fluid communication with the power end bore 420), and the make-up port 515 is disposed between the second seal 453 and the bellows 330 (e.g. with the second seal 453 disposed in the second portion 424 of the power end bore 420 and/or in proximity to the first portion 422 of the power end bore 420). FIG. 37 illustrates an exemplary embodiment similar to FIG. 36, having the make-up port 515 disposed in the fluid end 320 (e.g. extending through the fluid end housing 323 and in fluid communication with the fluid end bore 3620). While the second seal 453 could still be located in the power end bore 420, in FIG. 37 the second seal 453 is disposed in the fluid end 320 (e.g. in the fluid end bore 3620). For example, the second seal 453 can be disposed between the make-up port 515 and the joint between the fluid end housing 323 and the power end housing 413 (e.g. between the make-up port 515 and the housing seal 3650 and/or between the make-up port 515 and the face/flange 3608 of the fluid end 320). In embodiments, the make-up port 515 can be disposed between the second seal 453 and the bellows 330. Advantageously, in the configuration shown in FIG. 37 (e.g. with the make-up port 515 in the fluid end 320 and the second seal 453 in the fluid end bore 3620, between the make-up port 515 and the joint), the housing seal 3650 and/or the joint may be shielded from high pressure (e.g. the higher pressure within the bellows 330) by the second seal 453 (e.g. such that the housing seal 3650 may only be exposed to the lower pressure from the first portion 422 of the bore 420, and may not be exposed to the higher pressure of the bellows 330). This shielding effect may improve the lifespan and/or reliability of the housing seal 3650 and/or may allow for use of a housing seal 3650 which is not rated for higher pressures (such as bellows 330 pressures). Furthermore, locating the second seal 453 in the fluid end bore 3620 may minimize unswept volume between the rod 414 and the bellows 330, improving efficiency. In some embodiments, the second seal 453 may be disposed as close to the bellows 330 as possible (e.g. proximate the bellows 330), while still having the make-up valve 515 disposed between the second seal 453 and the bellows 330.

In some embodiments, low pressure for the treatment fluid may range up to about 1000 psi (e.g. about 0-1000 psi, about 100-1000 psi, about 300-1000 psi, about 500-1000 psi, about 3650-1000 psi, about 0-3650 psi, about 100-3650 psi, about 300-3650 psi, about 0-500 psi, about 100-500 psi, or about 500-3650 psi). In some embodiments, high pressure for the treatment fluid may range from about 1000 psi to about 15,000 psi, from about 1000 psi to about 20,000 psi, from about 15,000 psi to about 20,000 psi, from about 3000 psi to about 15,000 psi, from about 3000 psi to about 20,000 psi, from about 5000 psi to about 15,000 psi, or from about 5000 psi to about 20,000 psi. In embodiments, the hydraulic driver fluid pressure may range up to about 5000 psi (e.g. about 0-5000 psi, about 100-5000 psi, about 500-5000 psi, or about 1000-5000 psi), or in some embodiments up to about 10,000 psi (e.g. about 0-10,000 psi, about 100-10,000 psi, about 500-10,000, or about 1000-10,000 psi).

Figure 38:
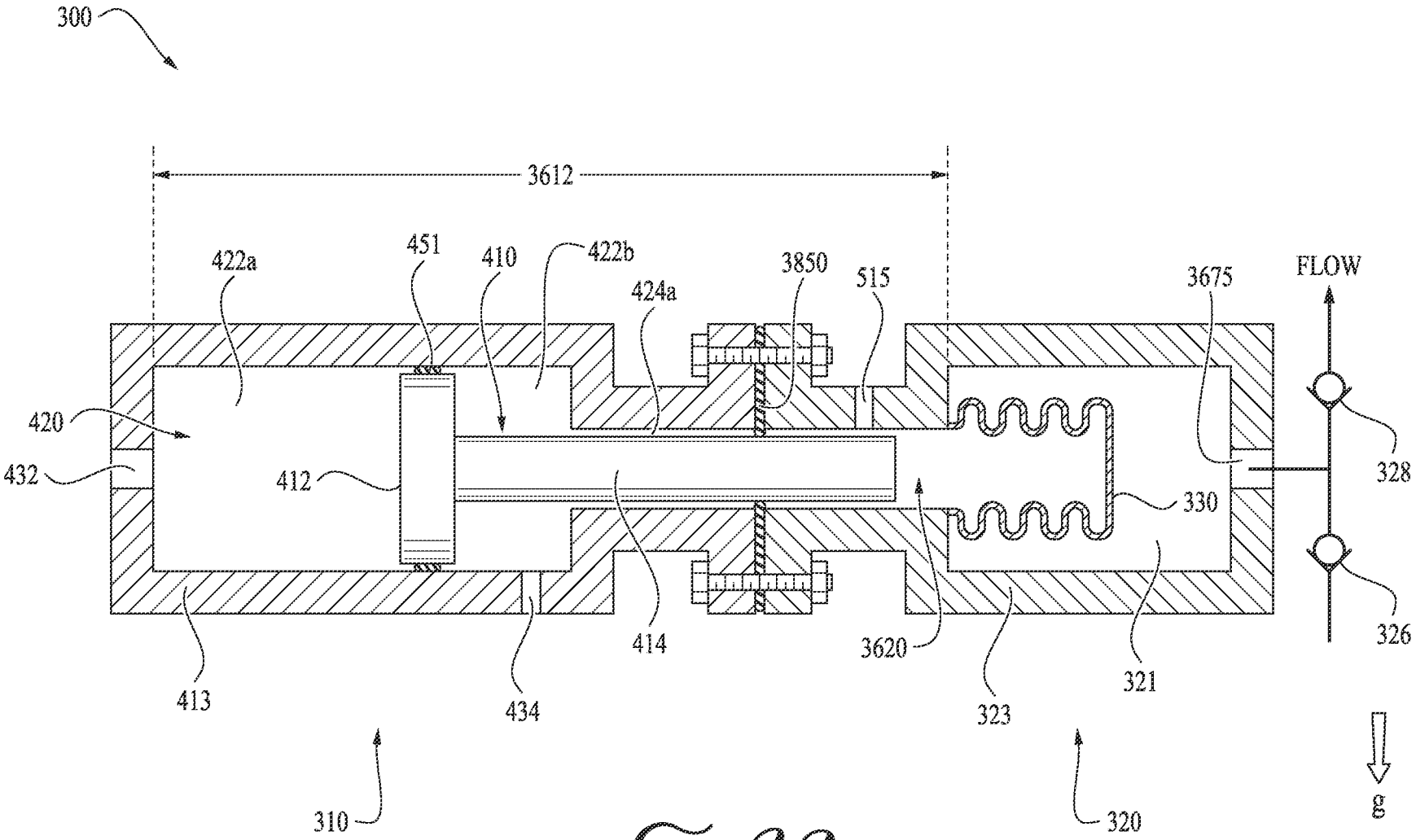
FIG. 38 is a cross-sectional view of yet another exemplary piston-driven bellows pump, according to an embodiment of the disclosure.

In some embodiments, the second seal 453 can be disposed proximate to the housing seal, 3650 for example within the fluid end bore 3620 or the power end bore 420. Proximity to the joint may allow for easier inspection and/or maintenance. In some embodiments, the second seal 453 can be axially aligned with the housing seal 3650 and/or can be disposed at the joint (e.g. at faces 3607, 3608). For example, the housing seal 3650 and the second seal 453 may be jointly formed (e.g. a unitary seal 3850 can be configured for both functions, sealing the joint and allowing for sealing movement of the rod 414). FIG. 38 illustrates an embodiment which may be similar to FIGS. 36-37, having a single unitary seal 3850 (e.g. disposed between the power end 310 and the fluid end 320 and/or between faces 3607, 3608) configured to perform both the sealing function of the housing seal and the sealing function of the second seal. The unitary seal 3850 may extend into the bore and at least partially between the faces 3607, 3608.

Figure 39:
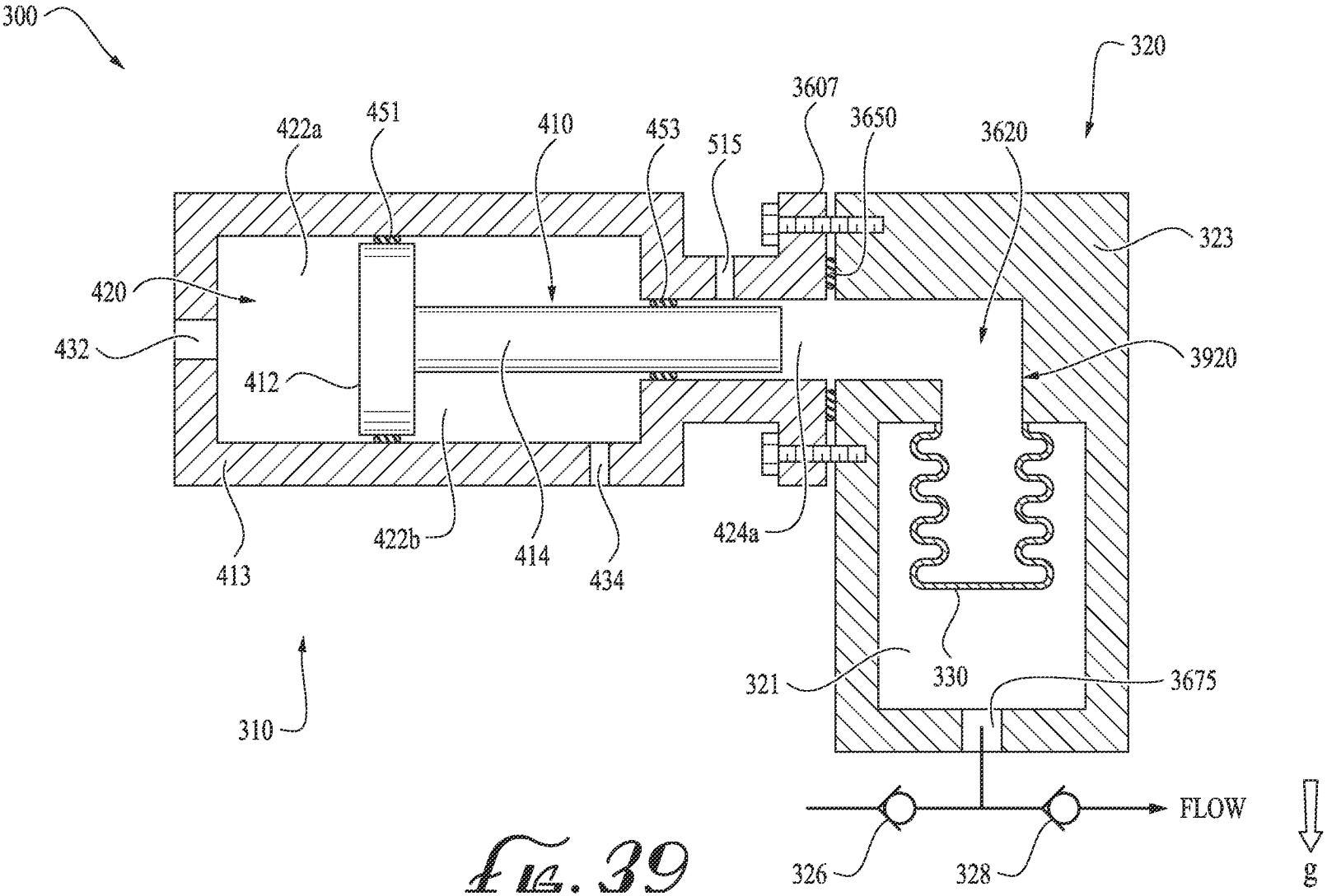
FIG. 39 is a cross-sectional view of still another exemplary piston-driven bellows pump, according to an embodiment of the disclosure.
Figure 10:
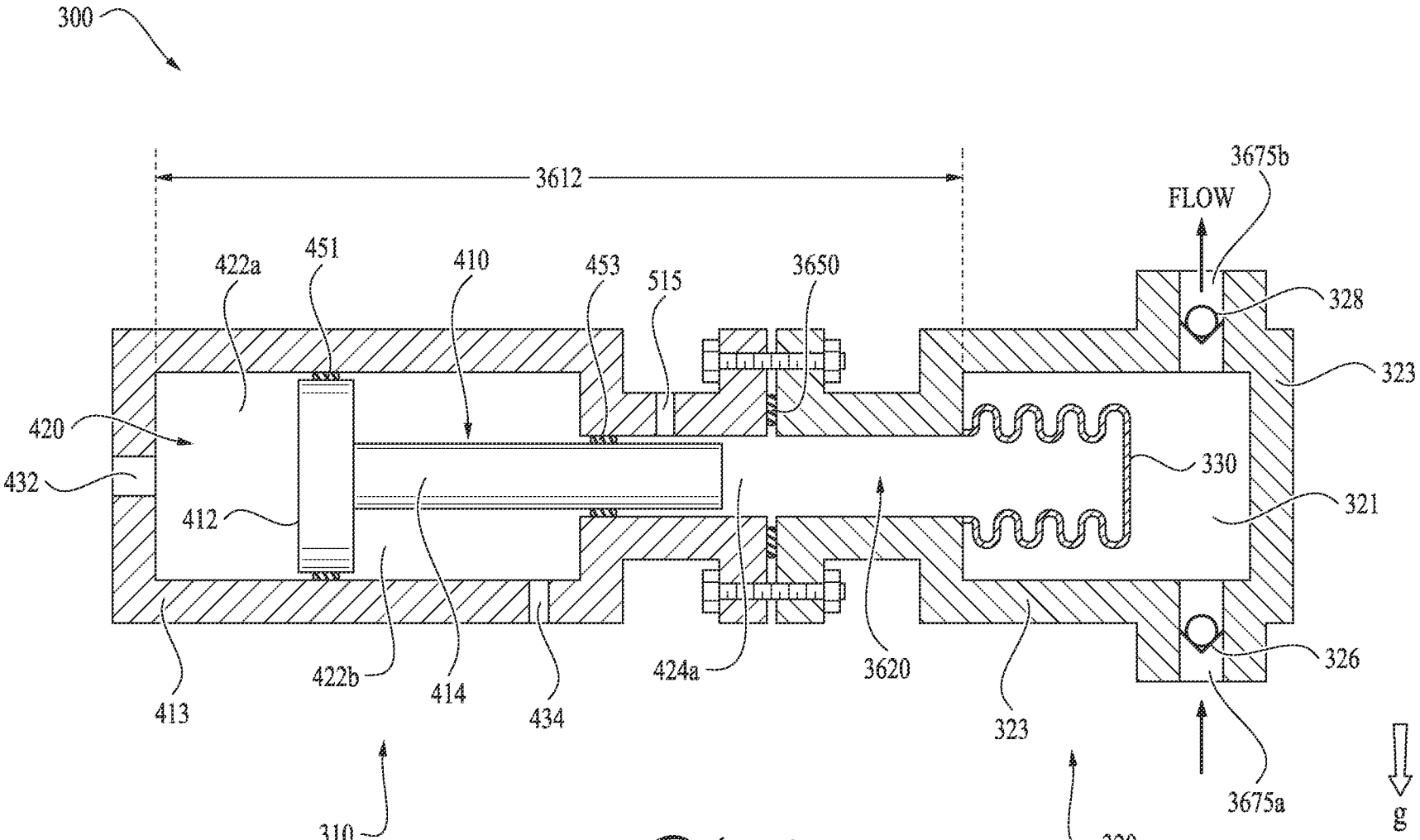

In some embodiments, the fluid end bore 3620 can include an angled portion 3920 (which could in some embodiments be the entire fluid end bore 3620), which is in fluid communication with the power end bore 420 but not aligned with the power end bore 420 (e.g. extends in a direction angled from the longitudinal centerline axis of the power end bore 420, with the longitudinal centerline axis of the angled portion 3920 of the fluid end bore 3620 extending at an angle from (e.g. not parallel to) the longitudinal centerline axis of the power end bore 420). FIG. 39 illustrates an embodiment similar to FIGS. 36-38, in which a portion 3920 of the fluid end bore 3620 is not parallel to the power end bore 420. In embodiments, the bellows 330 may be configured to expand in a direction angled from the power end bore 420 (e.g. from the longitudinal centerline axis of the power end bore 420). For example, the longitudinal centerline axis of the bellows 330 may be angled from (e.g. not parallel with) the longitudinal centerline axis of the power end bore 420 (for example, with the bellows 330 axis being parallel with and/or aligned with the longitudinal centerline axis of the angled portion 3920 of the fluid end bore 3620).

In embodiments, the chamber 321 may be configured with its longitudinal centerline axis angled from (e.g. not parallel with) the longitudinal centerline axis of the power end bore 420. In embodiments, the bellows 330 may be configured to expand at an angle to the power end bore 420 (e.g. with the direction of expansion angled from the longitudinal centerline axis of the power end bore 420) and/or the longitudinal centerline axis of the bellows 330 may be angled from the longitudinal centerline axis of the power end bore 420. In FIG. 39, the angle (e.g. of the angled portion 3920 of the fluid end bore 3620 and/or bellows 330 expansion and/or the chamber 321) is approximately 90 degrees from (e.g. orthogonal and/or perpendicular to) the power end bore 420 (e.g. the longitudinal centerline of the power end bore 420). In other embodiments, any angle could be used.

As shown in FIG. 39, the bellows 330 may be configured to expand downward (e.g. with respect to gravity (g)). For example, the power end bore 420 may be approximately horizontal, while the chamber 321 may extend and the bellows 330 may be configured to expand approximately vertically with respect to gravity (e.g. downward). In embodiments, fluid communication between the suction and discharge valves 326, 328 and the chamber 321 (e.g. the one or more valve port 3675) may be disposed below (e.g. with respect to gravity) the bellows 330. Locating the suction and discharge valves 326, 328 below the bellows 330 may reduce accumulation of solids (e.g. sand) from the treatment fluid on the convolutions (e.g. pleats or folds) of the bellows 330, which may improve bellows 330 function and/or durability.

Figure 41:
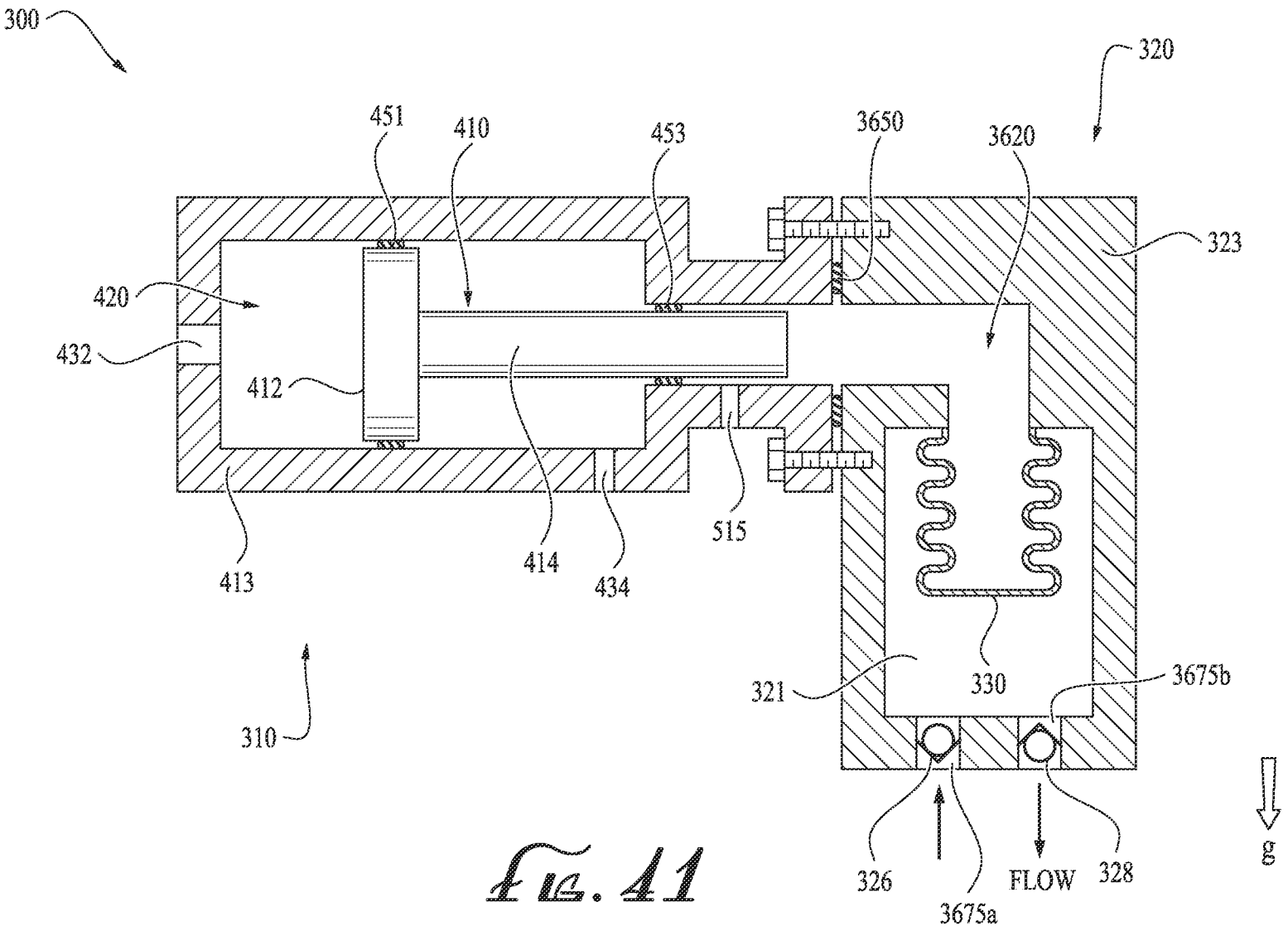
FIG. 41 is a cross-sectional view of still another exemplary piston-driven bellows pump, according to an embodiment of the disclosure.
Figure 40A:
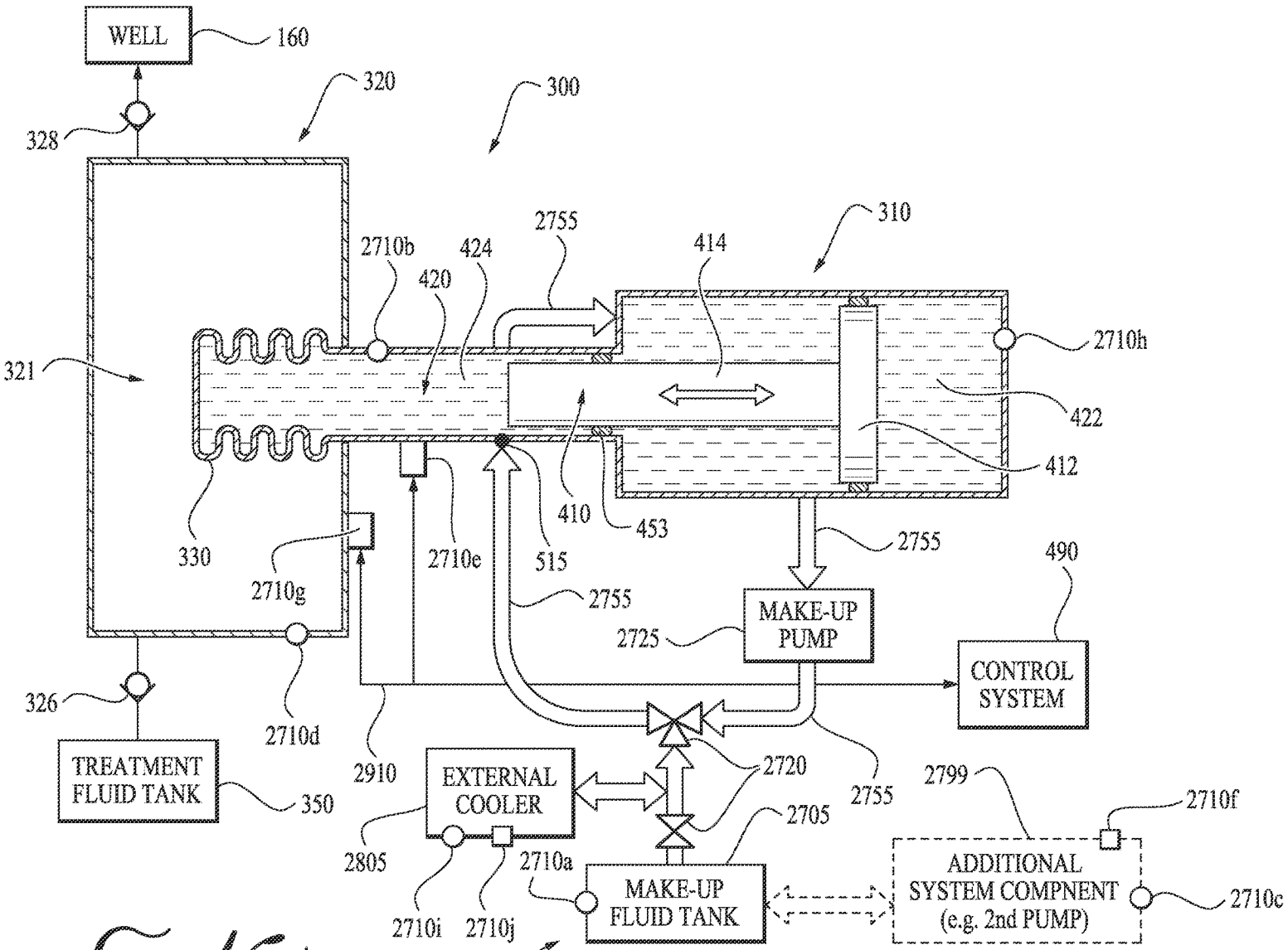
FIG. 40 is a cross-sectional view of yet another exemplary piston-driven bellows pump, according to an embodiment of the disclosure.
Figure 40B:
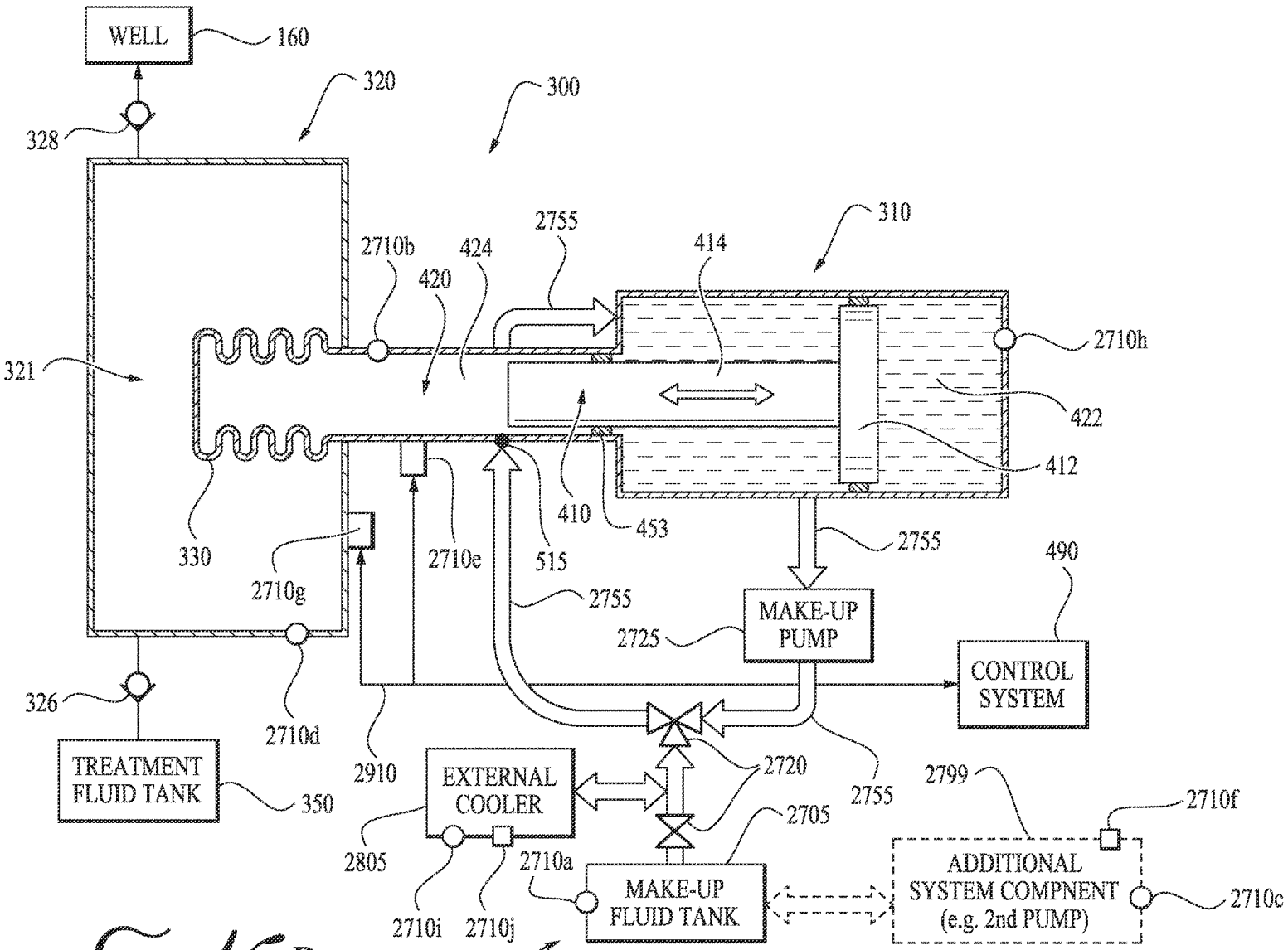

In embodiments, the suction valve 326 and/or the discharge valve 328 can be integrated into the fluid end housing 323. For example, the fluid end housing 323 can include two valve ports 3675*a*, 3675*b*, which can be in fluid communication with the chamber 321, and which may have the suction valve 326 and discharge valve 328 disposed therein. As shown in FIG. 40 (which may be similar to the embodiments shown in FIGS. 36-38), the suction valve 326 can be disposed opposite the discharge valve 328 in the chamber 321, in some embodiments. For example, the valve ports 3675*a*, 3675*b* can be disposed on opposite sides of the chamber 321. As shown in FIG. 41 (which may be similar to the embodiment shown in FIG. 39), the suction valve 326 and the discharge valve 328 can be disposed on the same side of the chamber 321/fluid end housing 323, in some embodiments. For example, the two valve ports 3675*a*, 3675*b* can be disposed on the same side of the chamber 321. In embodiments, the suction valve 326 and the discharge valve 328 can both be disposed below (e.g. with respect to gravity (g)) the bellows 330. For example as shown in FIG. 41, both valve ports 3675*a*, 3675*b* can be disposed below the bellows 330. In embodiments, as the bellows 330 extends/expands (e.g. during a discharge stroke), it can extend/expand downward towards the suction and discharge valves 326, 328.

Figure 42:
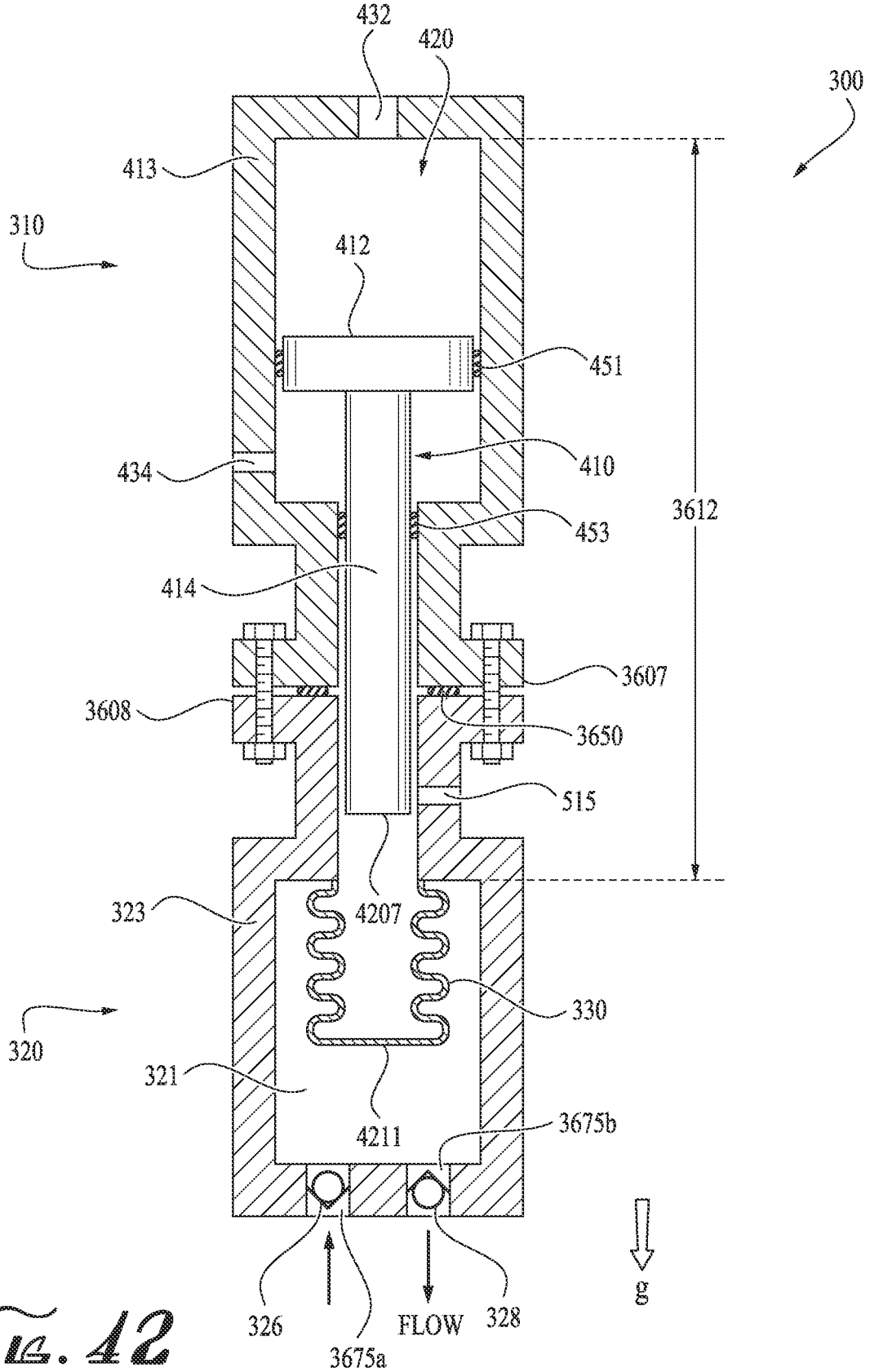
FIG. 42 is a cross-sectional view of yet another exemplary piston-driven bellows pump, according to an embodiment of the disclosure.

In some embodiments, the bellows 330 may be configured to expand downward (e.g. with respect to gravity), for example during a discharge stroke of the pump 300. As shown in FIG. 42, this can be because of the orientation of the pump 300 (e.g. with the pump 300 oriented so that the bellows 330 expands downward with respect to gravity (g)), and/or it may be because of the orientation of the bellows 330 with respect to the power end 310 (e.g. as shown in FIG. 41, with the fluid end bore 3620 having an angled portion 3920). In some embodiments, the chamber 321 can be configured so that fluid connection to the suction and discharge valves 326, 328 is located below the bellows 330 (with respect to gravity).

In some embodiments, the piston 410 (e.g. the rod 414) may be configured to only extend in the power end bore 420 (e.g. with the second seal 453 disposed in the power end bore 420). For example, the rod 414 may not extend into the fluid end bore 3620, even on the discharge stroke. In other embodiments, the piston 410 can extend through both the power end bore 420 and the fluid end bore 3620. For example, the rod 414 can be configured to extend into the fluid end bore 3620 (e.g. at least during the discharge stroke). While in some embodiments, the rod 414 may extend into the fluid end bore 3620 during discharge strokes and retract out of the fluid end bore 3620 during suction strokes, in other embodiments a distal end 4207 of the rod 414 (e.g. the end of the rod 414 closest to the bellows 330) can be configured to remain in the fluid end bore 3620 throughout reciprocal movement of the piston 410 (e.g. during both discharge and suction strokes). In some embodiments, the distal end 4207 of the rod 414 never exits/retracts out of the fluid end bore 3620, for example with the distal end 4207 of the rod 414 reciprocally moving within the fluid end bore 3620 alone. In such embodiments, the second seal 453 can be disposed in the fluid end bore 3620. In some embodiments, the distal end 4207 of the rod 414 may not extend into the bellows 330 (e.g. on a discharge stroke). In other embodiments, the distal end 4207 of the rod 414 may partially extend into the bellows 330. For example, the distal end 4207 of the rod 414 may extend into the bellows 330 during the discharge stroke, but may be configured to not contact a distal end 4211 of the bellows 330 (e.g. the end of the bellows 330 extending furthest into the chamber 321 and/or away from the rod 414). For example, the controlled volume of fluid can be configured to prevent the distal end 4207 of the rod 414 from contacting the distal end 4211 of the bellows 330.

Figure 43:
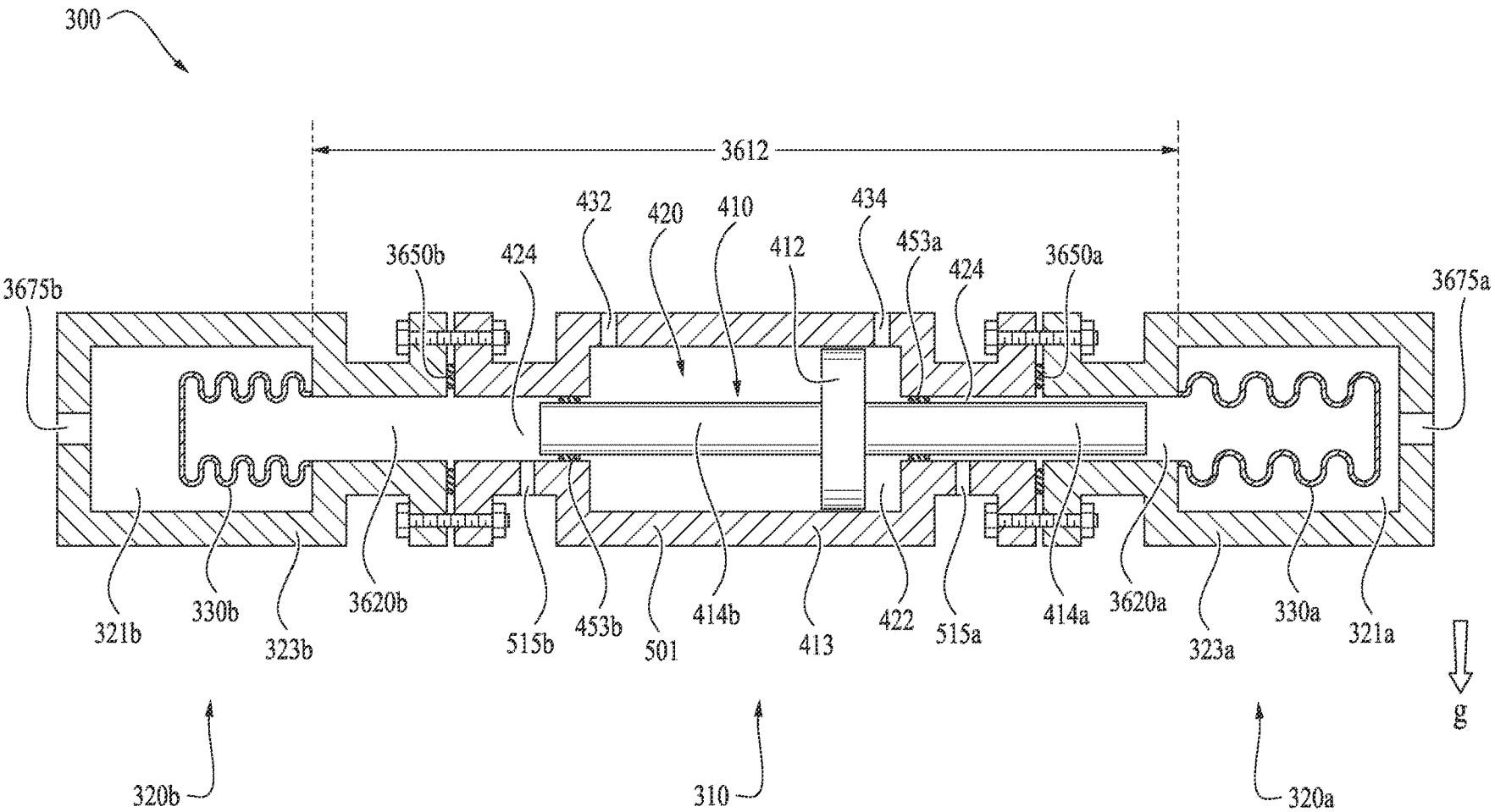
FIG. 43 is a cross-sectional view of an exemplary dual bellows (e.g. double-acting) pump, according to an embodiment of the disclosure.

While the embodiments described above illustrate single bellows pumps, aspects may also apply to dual bellows pump embodiments. For example, FIG. 43 illustrates an exemplary dual bellows pump embodiment, which may be similar to FIGS. 36-38, 40, and 42, and further comprising a second fluid end 320*b*. For example, the second fluid end 320*b* may have a second fluid end bore 3620*b* and a second chamber 321*b* (e.g. both in the second fluid end housing 323*b*) in fluid communication with a second suction valve 326*b* and a second discharge valve 328*b*. In some embodiments, the second fluid end 320*b* may be substantially the same as the first fluid end 320*a* (e.g. which may be substantially the same as the fluid end embodiments 320 described herein). A second expandable bellows 330*b* may be disposed in the second chamber 321*b*. A second make-up port 515*b* may be disposed in the second fluid end housing 323*b* or in the power end housing 413. The power end bore 420 can be fluidly coupled to (e.g. in fluid communication with) both the first and second fluid end bores 3620*a*, 3620*b* (e.g. with the power end bore 420 extending out of two sides of the power end housing 413, for example with two second portions (e.g. configured for the rod) of the power end bore 420 extending from a single first portion (e.g. configured for the head) of the power end bore 420), for example forming the unitary pump bore 3612 without external piping therebetween. The unitary pump bore 3612 may be entirely disposed within the power end housing 413 and the two fluid end housings 323*a*, 323*b* due to direct contact of the housings and/or may consisting essentially of the power end bore 420 and the two fluid end bores 3620*a*, 3620*b*. In some embodiments, there may be no unswept volume between the power end bore 420 and the two fluid end bores 3620*a*, 3620*b* (e.g. minimizing unswept volume between the piston 410 and the two bellows 330*a*, 330*b*).

The power end 310 can be configured to reciprocally expand and contract both the first and second bellows 330*a*, 330*b* based on movement of fluid by the piston 410. For example, the piston 410 may have a head 412 and two rods 414*a*, 414*b*, with the rods 414*a*, 414*b* extending from opposite sides of the head 412 (e.g. with the first rod 414*a* extending towards the first fluid end 320*a*/bellows 330*a* and the second rod 414*b* extending towards the second fluid end 320*b*/bellows 330*b*). In some embodiments, the two rods 414*a*, 414*b* may be aligned (e.g. having the same longitudinal centerline axis) and/or may extend outward along the centerline axis of the head 412 and/or first portion 422 of the power end bore 420. Embodiments may further include a second housing (e.g. joint) seal 3650*b* disposed between the power end housing 413 and the second fluid end housing 323*b* (e.g. such that the pump 300 has two housing seals (3650*a*, 3650*b*), with a housing seal disposed between the power end housing 413 and each of the two fluid end housings 323*a*, 323*b*). The second housing seal 3650*b* may be configured to seal the joint between the power end housing 413 and the second fluid end housing 323*b* and/or to seal the fluid connection/coupling between the power end bore 420 and the second fluid end bore 3620*b* (e.g. preventing leakage from escaping at the joint between the housings).

Figure 44:
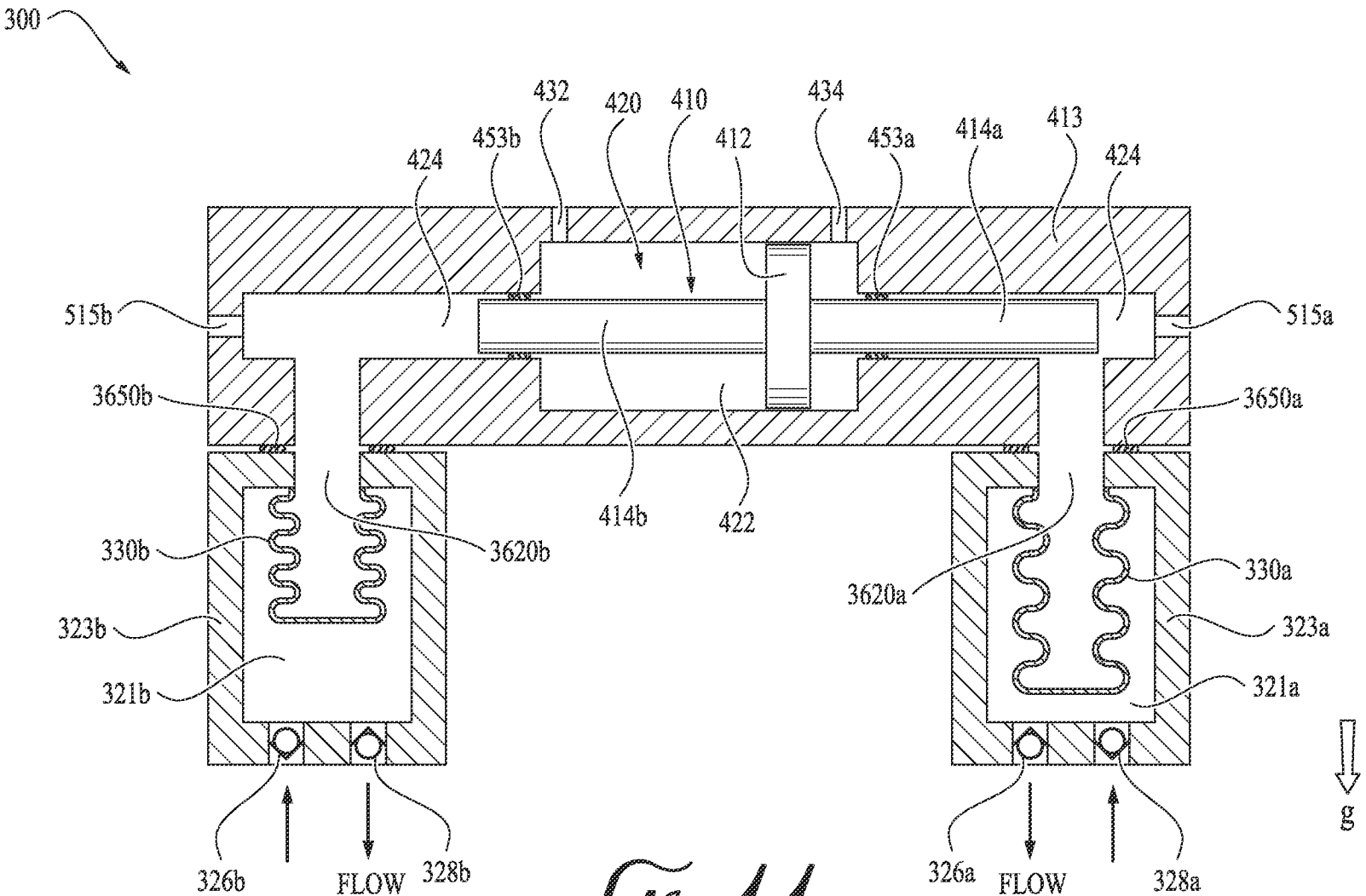
FIG. 44 is a cross-sectional view of another exemplary dual bellows (e.g. double-acting) pump, according to an embodiment of the disclosure.

FIG. 44 illustrates a similar dual bellows pump embodiment which is not linear. In some embodiments, one or both of the first and second fluid end bore 3620*a*, 3620*b* can include an angled portion (which could in some embodiments be the entire fluid end bore), which is in fluid communication with the power end bore 420 but not aligned with the power end bore 420 (e.g. extends in a direction angled from the longitudinal centerline axis of the power end bore 420—with the longitudinal centerline axis of the angled portion of the fluid end bore(s) 3620*a*, 3620*b* extending at an angle from (e.g. not parallel to) the longitudinal centerline axis of the power end bore 420). In some embodiments, one or more of the bellows 330*a*, 330*b* may be configured to expand in a direction angled from the power end bore 420 (e.g. from the longitudinal centerline axis of the power end bore). In some embodiments, one or more of the bellows 330*a*, 330*b* may be configured to expand in a direction angled from the longitudinal centerline axis of the piston 410. In some embodiments, one or more of the power end bore 420 may include an angled portion (e.g. angled from the longitudinal centerline axis of the piston 410), and the corresponding fluid end bore 3620*a, b* may be configured to extend parallel to (e.g. in the same direction as) the angled portion of the power end bore 420 and/or the corresponding bellows 330*a, b* may be configured to expand in the same direction as (e.g. along the centerline axis of) the angled portion of the power end bore 420. In other aspects, the embodiment of FIG. 44 may be similar to FIG. 39 and/or FIG. 41 (e.g. but applied to a dual bellows pump).

Figure 45:
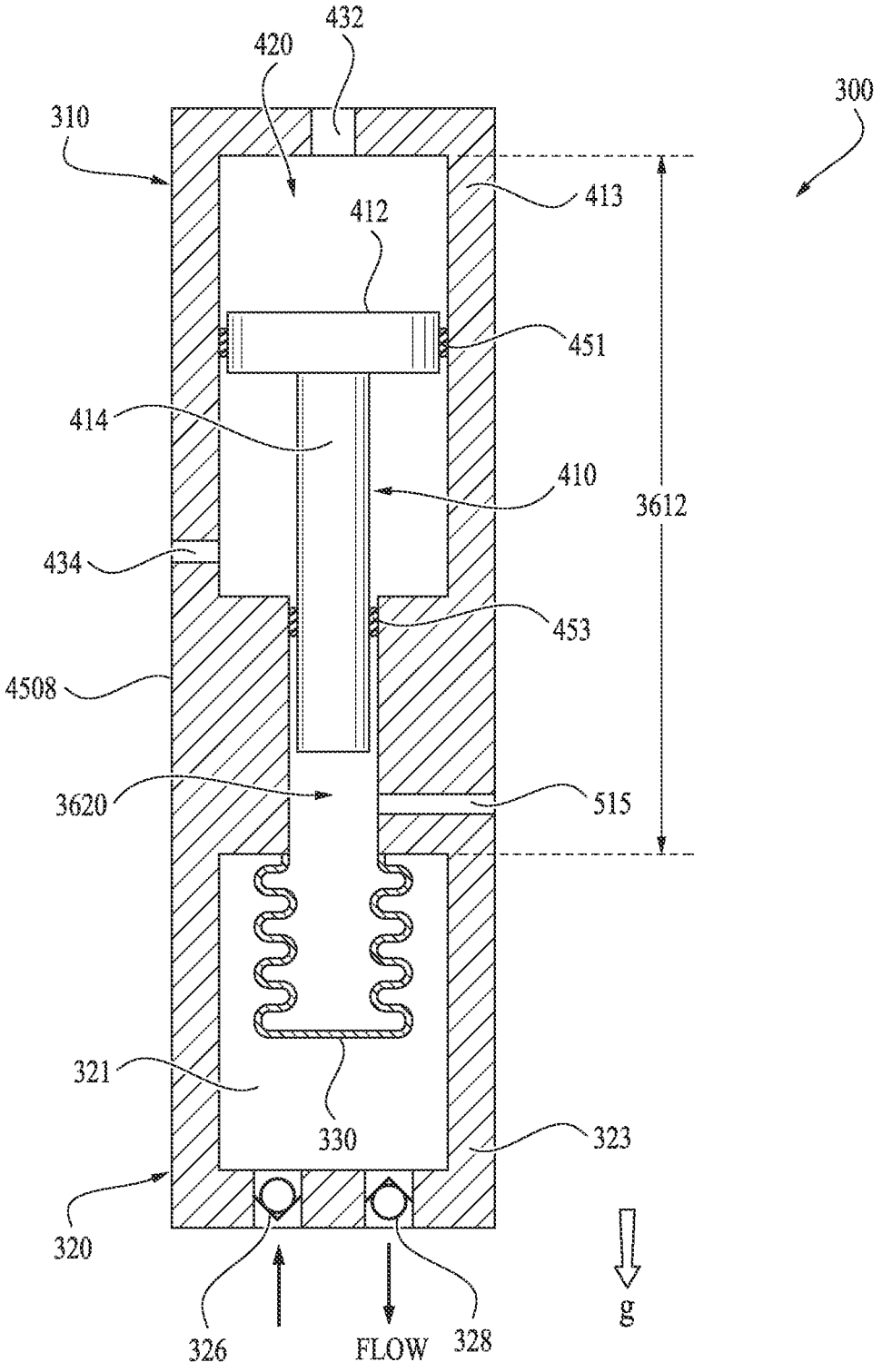
FIG. 45 is a cross-sectional view of another exemplary piston-driven bellows pump, according to an embodiment of the disclosure.

In some embodiments, the pump housing may not be formed by coupling a separate power end housing 413 to one or more fluid end housing(s) 320, but may be a unitary/monolithic housing 4508 (e.g. a single, solid piece) configure to include both the power end 310 and fluid end(s) 320. FIG. 45 illustrates an exemplary embodiment having a unitary/monolithic housing 4508. In embodiments, the power end bore 420 and the fluid end bore 3620 can be fluidly coupled without external piping therebetween by the power end bore 420 and the fluid end bore 3620 contacting (e.g. with open ends aligning and/or as part of a continuous bore) to form the continuous, unbroken, and/or unitary pump bore 3612 (which consists essentially of the power end bore 420 and the fluid end bore 3620). In other words, there may be only a single housing 4508 (e.g. a single piece) and a single bore 3612 in some embodiments. In embodiments, the power end 310 and the fluid end(s) 320 may both be disposed within a common housing (e.g. within a unitary housing 4508, which may be machined from a single piece of metal, for example). For example, the power end housing 413 and the one or more fluid end housing 323 may be portions of the unitary/common housing 4508. Since there is no joint between separate housing elements, there may be no (e.g. housing) seal between the power end 310 and the fluid end 320 necessary to form the unitary, sealed pump bore 3612, which is entirely disposed within the common/unitary housing 4508. This unitary housing approach may be used for dual bellows pumps as well, and the embodiment of FIG. 45 may be similar to any of FIGS. 36-44 in one or more aspects. In some embodiments, there may not be a fluid bore (e.g. the fluid bore may be considered a portion of the power end bore). For example, the bellows 330 may directly couple to the power end bore 420 in some embodiments. In embodiments, the bellows 330 may be disposed at the open end/corresponding face of the fluid end 320. Variations of all disclosed embodiments with no fluid bore and with the bellows 330 directly coupled to the power end bore 420 are included herein. As persons of skill will appreciate, various aspects illustrated in one or more of the disclosed embodiments may be combined and/or deleted, thereby illustrating still further disclosed embodiments included within the scope of this disclosure.

While the suction valve 326 and the discharge valve 328 may each be one-way check valves, in alternate embodiments, any other suitable valve may be used as either the suction valve 326 and/or discharge valve 328. Although not required, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver mechanism capable of reciprocally expanding and contracting the bellows 330 may be used, and are included within the scope of this disclosure.

The systems and methods described herein may be used in controlling an injection treatment (e.g. of treatment fluid into a well). For example, the injection treatment may be modified by utilizing a new intensifying-type pump that does not have piping between the main components. For example, this disclosure includes improved intensifier-type pumping system embodiments. In an embodiment, the intensifier-type pumping system may provide designed components that allow for directly coupling of various major components of an intensifier-type pumping system. Such arrangements may help improve fatigue characteristics. The pumping system can include a pressure intensifier and one or more fluid ends and corresponding bellows. Advantageously, such an intensifier-type pumping system may reduce the need for piping to interconnect a pressure intensifier, fluid end, and/or suction/discharge valving. That is, since such piping can be subjected to significant cyclical pressure-induced fatigue, it may wear faster and become a hazard (e.g. prone to leaks and/or other failures). The piping may also be subject to stress during transportation of such systems, which may cause unseen or unknown weaknesses within the piping (therefore elevating the potential for hazards during operation). In contrast, the disclosed embodiments may eliminate as much of the interconnecting piping as possible and achieve fluid-connectivity by directly joining system components together or incorporating them in a reduced number of housings. In doing so, stress from transportation and cyclical pressure can be better reduced, managed, or eliminated.

As indicated above, additional benefits can include improved system efficiency/performance, maintenance, Health/Safety/Environmental (HSE) impact, reliability, and packaging opportunities. Additionally or alternatively, performance may be improved via the reduction of the unswept volume between the intensifier and fluid end because of the elimination of connecting piping and its related volume. For example, any un-swept volume in the volume of the piping must be compressed before the fluid end can begin working (and the compressibility of typical fluids is approximately 3% at 10,000 psi), so reducing the volume within piping connections can be a direct factor of system efficiency.

Additional benefits may include the improvements in maintenance, environmental benefits, safety, and reliability of the system. For example, maintenance may be enhanced by elimination of piping/fittings/adapters and associated connections, and through incorporation of unitized components. Environmental benefits can be realized by fewer potential leak points. Safety aspects can be enhanced by reducing connections to be made/broken during repairs, as well as reduced potential for high-pressure-injection type injuries from leaks. Moreover, elimination of piping and fittings may also increase system reliability, for example by reduction of fatigue-failure related downtime and related repairs.

Direct connection of the system or apparatus components can enable more compact packaging of such systems, which may be especially beneficial in applications that require system and device mobility. For example, such intensifier-type pumps may be utilized in applications such as oil and gas retrieval. That is, the pumps may be deployed at various well locations and utilized for pumping fluids such as slurry or sludge into or around the well in order to retrieve the oil or gas.

Returning to FIG. 36, a two-dimensional diagram illustrates an example of a pump 300 apparatus, according to one or more aspects of the present disclosure. More particularly, FIG. 36 shows a cross-sectional diagram of a pump 300 comprising a single-acting intensifier driving a single fluid end 320 (e.g. with a single bellows 330 therein). The pump 300 of FIG. 36 includes a pressure intensifier (or intensifier section, which may serve as the power end 310 in FIG. 36) and a fluid end 320. The power end 310 can include an intensifier body (e.g. power end housing 413) and piston element 410. The power end housing 413 may include a first opening (e.g. the distal end of the second portion of the power end bore 420, e.g. at the face/joint). In some embodiments, the first opening may extend from an exterior surface of the power end housing 413 (e.g. at face 3607) to an internal cavity of the power end housing 413 (e.g. the first portion 422 of the power end bore 420), thereby defining a channel (e.g. the second portion 424 of the power end bore 420) between the first portion 422 of the power end bore 420 and the exterior of the power end housing 413. In some embodiments, the second portion 424 of the power end bore 420 may be round, for example having a constant diameter. In alternative embodiments, the second portion 424 of the power end bore 420 may be different shapes.

In some embodiments, the first opening may extend from a face 3607 of the power end housing 413. The face 3607 of FIG. 36 is shaped such that the power end housing 413 is able to mate with a corresponding face 3608 of a fluid end 320, which is described below. In some embodiments, the face 3607 may be flat and have a plurality of holes that allow for fasteners (such as bolts) to mechanically secure the power end housing 413 to the corresponding fluid end 320. Additionally or alternatively, the face 3607 may have grooves or other features that allow for a gasket (e.g. housing seal 3650) to be disposed between the face 3607 and the corresponding fluid end 320, thereby allowing for a hermetic seal to be formed therebetween. In some embodiments, the face 3607 may be of any shape or size that allows for a seal to be formed between the power end housing 413 and the corresponding fluid end 320. In an embodiment, a separate member containing port (e.g. a unified seal) may be placed between faces 3607, 3608 with seals to both faces. In embodiments, this member may be a spool and include flanges to facilitate fastening power end housing 413 to fluid end housing 323.

In some embodiments, the power end housing 413 may be formed of a single component such as a metal, alloy, plastic, or a combination thereof. In some embodiments, the fluid end housing 323 may be formed of a single component such as a metal, alloy, plastic, or a combination thereof. In some embodiments, the power end housing 413 may be formed by two or more components that are able to be mechanically secured together to form the power end housing 413. For example, a multi-component power end housing 413 may allow for easier maintenance. In some embodiments, the fluid end housing 323 may be formed by two or more components that are able to be mechanically secured together to form the fluid end housing 323. As another example, a single component power end housing 413 may provide improved strength. In some embodiments, the overall pump housing may be formed of a single component such as a metal, alloy, plastic, or a combination thereof (e.g. a monolithic housing, such as 4508 in FIG. 45). A single component overall pump housing (such as shown in FIG. 45, for example) may provide improved strength. In some embodiments, the overall pump housing may be formed by two or more components that are able to be mechanically secured together to form the overall pump housing. For example, the power end housing 413 and the fluid end housing 323 may be coupled together to jointly form the overall pump housing.

The piston element 410 of FIG. 36 is disposed at least partially within the power end housing 413 and includes a head 412 and a rod portion 414. The head 412 may have a larger area (e.g., diameter) than an area at the distal end of the rod portion 414 (e.g., diameter of the rod portion 414). The difference between the area at the proximal end of the head 412 and the area of the distal end of the rod 414 allows for pressure intensification. The exact value of the areas may be selected based on the application that the pump 300 will be deployed in. The piston element 410 is disposed within the power end housing 413, such that the rod portion 414 is at least partially disposed within the second portion 424 of the power end bore 420 and the head 412 is (e.g. entirely) disposed within the first portion 422 of the power end bore 420.

In some embodiments, the first portion 422 of the power end bore 420 of the power end housing 413 is cylindrically shaped, having the walls of the power end housing 413 define the first portion 422 of the power end bore 420. In other embodiments, the first portion 422 of the power end bore 420 may have different shapes defined by the walls of the power end housing 413. The head 412 of the piston element 410 can have a shape that is similar to the shape of the first portion 422 of the power end bore 420. For example, the head 412 may also be cylindrically shaped such that a pressure differential on either side of the head 412 within the first portion 422 of the power end bore 420 can cause the piston element 410 to be displaced or moved. In some embodiments, the head 412 may have grooves designed to hold one or more gaskets, or other features, that allow for the head 412 to create a traveling seal (e.g. a first seal 451) between the outer portion of the head 412 and the internal walls of the power end housing 413 (e.g. the first portion 422 of the power end bore 420).

As indicated above, in some embodiments, the cross-sectional area of the proximal end of the head 412 is larger than the cross-sectional area of the distal end of the of the rod portion 414. This area contrast allows for the intensification of the fluid pressure. In some embodiments, the area ratio may range from approximately 1.1:1 up to 10:1 depending on the available driver fluid pressure provided to first port 432, and the desired discharge pressure from the fluid end 320.

In some embodiments, piston element 410 may also include a seal (e.g. second seal 453), which may allow for sealed movement of the rod 414 and/or define a controlled volume of fluid. In some embodiments, the second seal 453 may be a traveling seal, for example disposed on the rod. In other embodiments, the second seal 453 may be fixed in the bore 420 (e.g. in the second portion 424 of the power end bore 420 or in the fluid end bore 3620). In various embodiments, the seals may be metallic or elastomeric. In some embodiments, the seals may comprise a labyrinth seal. In embodiments, similar configurations or grooves may also be employed along portions of rod 414 to create a traveling seal between the outer portions of the rod portion 414 and the inner walls of the channel (e.g. the second portion 424 of the power end bore 420) within the power end housing 413. In this way, the piston 410 when disposed within the power end housing 413 may define a first cavity 422*a*, a second cavity 422*b*, and a third cavity 424*a*. For example, the first cavity 422*a* may be defined by the volume of space beyond the proximal end of the head 412, the second cavity 422*b* may be defined by the volume of space at the distal end of the head 414 (e.g., around the rod portion 414 which is within the internal cavity (e.g. within the first portion 422 of the power end bore) 420, and the third cavity 424*a* may be defined by the volume between the distal end of the rod portion 414 and the first opening/face 3607 (or when the power end 310 is attached to the fluid end 420, the bellows 330).

The power end housing 413 may also include a first port 432, into which driving fluid (e.g., hydraulic oil) can be introduced to urge the piston element 410 toward the fluid end 320. The first port 432 allows for the driving fluid to be introduced into the first cavity 422*a*. In other words, the first port 432 extends through the outer wall of the power end housing 413 into the first cavity 422*a*. In some embodiments, the first port 432 may be located along any of the walls of the power end housing 413.

The power end housing 413 may also include a second port 434 into which fluid can be introduced to retract piston element 410 away from fluid end 320. The second port 434 allows for the driving fluid to be introduced into the second cavity 422*b*. In other words, the second port 434 extends through the outer wall of the power end housing 413 into the second cavity 422*b*. In some embodiments, the second port 434 may be located along any of the walls of the power end housing 413.

The power end housing 413 may also include a third port (e.g. the make-up port 515), as shown in FIG. 36. The make-up port 515 can be configured to allow for the movement of fluid into and out of an interior volume that is at least partially defined by the third cavity 424*a* (e.g. when the power end 310 is coupled to the fluid end 320, between the rod 414 and the bellows 330). In some embodiments, the make-up port 515 can extend into the second portion 424 of the power end bore 420 formed within the power end housing 413. The make-up port 515 may connect the exterior of the power end housing 413 to the third cavity 424*a*, for example, when the piston element 410 is moved away from the fluid end 320 (e.g., the first opening). In some embodiments, multiple make-up ports can be included and may be used to circulate fluid through the interior volume.

The fluid end 320 may include a fluid end housing 323 and a bellows 330, as shown in FIG. 36. In some embodiments, the fluid end housing 323 may be formed of a single component or multiple components. For example, the fluid end housing 323 may be formed of the same or similar material to the material used to form the power end housing 413. The fluid end housing 323 of FIG. 36 includes a first opening (e.g. the open end of the fluid end bore 3620). In some embodiments, the fluid end housing 323 may include a face 3608 that is structured to mechanically secure to the face 3608 of the power end 310 as described above. That is, in various embodiments, the face 3608 of the fluid end housing 323 may structurally correspond to the face 3607 of the power end 310 such that the fluid end housing 323 and the power end 310 can be mechanically secured together directly. This direct connection eliminates the need for piping to connect the third cavity (e.g. the power end bore 420) to the first opening of the fluid end housing 323 (e.g. no piping need to connect the second portion 424 of the power end bore 420 to the fluid end bore 3620). The corresponding face structures incorporated into the fluid end housing 323 and the power end housing 413 may allow for this direct mechanical and/or hermetic coupling.

The first opening of the fluid end housing 323 is structured such that the interior volume (e.g. controlled volume) is formed when the fluid end housing 323 is mechanically secured to the power end housing 413. The interior volume may be defined by the third cavity 424*a*, a channel (e.g. the fluid end bore 3620) of the first opening of the fluid end housing 323, and the bellows 330.

In FIG. 36, the bellows 330 is coupled to the fluid end housing 323 such that it defines the first volume 373 and the second volume 375 (e.g. as shown in FIG. 3, the bellows 330 is fluidly coupled to the fluid end bore 3620 and/or the power end bore 420, and acts to separate the drive fluid therein from the treatment fluid in the chamber 321). In other words, the bellows 330 is structured to hermetically seal the first opening of the fluid end housing 323 (e.g. the opening configured to couple to the second portion 424 of the power end bore 420 and/or disposed in proximity to the face 3608) from the remaining interior portions of the fluid end housing 323 (e.g. the chamber 321). The bellows 330 is structured and formed such that the bellows 330 is movable (e.g., extendable/expandable) and allows for the remaining interior portion of the fluid end housing 323 (e.g. the open portion of the chamber 321 outside the bellows 330, configured to receive treatment fluid) to grow in volume and shrink in volume depending upon the volume of the interior volume within the bellows 330. In embodiments, once the fluid end housing 323 is coupled to the power end housing 413, the bellows 330 may separate/segregate fluid in the power end bore 420 from the chamber 321, serving as a barrier therebetween.

In embodiments, the pump system 300 may also include a suction valve 326 having a first side connected to the remaining interior portion of the fluid end housing 323 (e.g. the chamber 321) and a discharge valve 328 having a first side connected to the remaining interior portion of the fluid end housing 323 (e.g. the chamber 321). A second side of the suction valve 326 may be coupled to a reservoir of treatment fluid (e.g., the fluid intended to be pumped). A second side of the discharge valve 328 may be connected to any place in which the treatment fluid is intended to be pumped to. For example, the second side of the discharge valve 328 may be fluidly coupled to an oil and gas fracturing well.

In various embodiments, the make-up port 515 (or additional make-up ports 515) may be positioned such as to allow for a fluid connection between an exterior of the housing and the interior volume (e.g. the inside of the bellows 330). In some embodiments, the make-up port 515 can be used to selectively introduce or remove fluid from the interior volume (e.g. within the bellows 330) to manage the axial position of piston element 410 relative to bellows 330 of the fluid end 320. Properly synchronizing the piston element 410 and the respective bellows 330 in the fluid end 320 can be important to operation of the system. A valving and control system may be used to manage the volume inside the interior volume (e.g. the bellows 330), which in turn controls the axial relationship of piston element 410 and the bellows 330.

For example, after the power end 310 is directly mechanically coupled to the fluid end 320, when piston element 410 is fully extended toward fluid end 320, bellows 330 is fully expanded and displacing most of a treatment fluid from the interior of fluid end housing 323 (e.g. from the chamber 321). And when piston element 410 is fully retracted away from the bellows 330, bellows 330 is displacing the least amount of treatment fluid inside the chamber 321 of the fluid end 320 (e.g. with the bellows 330 at its fully contracted state). The hydraulic reciprocation of piston element 410 causes corresponding reciprocation of bellows 330 inside the chamber 321 of the fluid end 320. In FIG. 36, during the retraction of piston element 410 (e.g. away from the fluid end 320), while make-up port 515 is blocked/closed, treatment fluid is drawn into the fluid end 320 through a suction valve 326 and valve port 3675, and this may be referred to as a suction stroke. During the extension of piston element 410 toward the fluid end 320, while make-up port 515 is blocked/closed, treatment fluid is pushed out of the fluid end 320 through valve port 3675 and discharge valve 328, and this may be referred to as a discharge stroke.

In the depicted embodiment, the fluid end housing 323 and power end housing 413 are shown to be joined with fasteners. Fasteners may include be screws, bolts, clamps, etc. The connection may also include a sealing element to contain the fluid in interior volume. Alternatively, in some embodiments, the fluid end housing 323 and power end housing 413 can also be made from a single piece of material such that they are a mono-block and do not require being fastened together.

In some embodiments, multiple pump systems can be joined together to form a larger multi-cylinder pumping system. For example, in some embodiments, the power end housing may be formed to include multiple-cylinder systems that may be formed of a single mono-block of material. That is, in some embodiments, the power end housing may have multiple piston elements disposed within respective cylinders of the power end housing that have corresponding fluid ends directly connected to the respective opening or channel driven by the respective piston element.

FIG. 39 is a two-dimension cross-sectional diagram illustrating an example of a pump, according to one or more aspects of the present disclosure. More particularly, FIG. 39 is a cross-sectional diagram of a pump 300 with a mounting arrangement between a power end 310 (e.g. pressure intensifier) and a fluid end 320. For example, the power end 310 and the fluid end 320 may be joined at a 90 degree angle. While the axial relationship between the piston element 410 and the bellows 330 in FIG. 36 was along the same (e.g., parallel) axis, in FIG. 39 the arrangement is such that the axial relationship between the piston element 410 and the bellows 330 still exists, but the respective axes are 90 degrees relative to one another. In other examples, the power end 310 and the fluid end 320 (e.g. the power end bore 420 and the bellows 330) may be arranged in any angle and fluidly connected via interior volume. In an embodiment, the power end 310 and a fluid end 320 may be joined near 90 degrees. In various embodiments, the power end 310 and fluid end 320 may be joined at other angles to accommodate system packaging envelope requirements. The system shown in FIG. 39 may function in similar manner as that of FIG. 36. The fluid end housing 323 of FIG. 39 is functionally similar to that of FIG. 36, however, with a different design of the face end and first opening and/or shape of the fluid end bore 3620 to allow for the direct connection between the power end housing 413 and the fluid end housing 323. For example, such a configuration may provide for a particularly shaped or packaged pump, while also providing the benefits of the direct connections described above.

FIG. 40 is a two-dimension cross-sectional diagram illustrating an example of a pump, according to one or more aspects of the present disclosure. The pump in FIG. 40 may be similar to the pump in FIG. 36 and may be operationally similar. However, FIG. 40 includes a fluid end with a modified fluid end housing 323. In particular, the fluid end housing 323 of FIG. 40 includes the suction valve 326 and the discharge valve 328 disposed within respective openings within the fluid end housing 323. In such an embodiment, the suction valve 326 and discharge valve 328 may be packaged directly as part of the housing system (e.g., mechanically secured to the fluid end housing 323 during manufacturing), which may further reduce the need for external components and/or piping that may fatigue due to the intensity of pressure. In some embodiments, the suction valve 326 and the discharge valve 328 may be included in the fluid end housing 323 during manufacturing. In various embodiments, the respective openings within the fluid end housing 323 may be designed to mechanically secure respective valves 326 or 328 therein. In this embodiment, the valves may be replaced more easily while also providing the advantages described herein.

FIG. 41 is a two-dimension cross-sectional diagram illustrating an example of a pump 300, according to one or more aspects of the present disclosure. The pump 300 in FIG. 41 may be similar to the pumps in FIG. 39 and FIG. 40, respectively, and may be operationally similar to them. For example, in this embodiment, the pump 300 may include a fluid end housing 323 that is arranged at a 90 degree angle similar to that described with reference to FIG. 39, and also includes the respective openings for housing the suction valve 326 and the discharge valve 328 as part of the fluid end housing 323 similar to that of FIG. 40. In various embodiments, the openings along with the respective valves 326 and 328 may be positioned on other locations within the fluid end housing 323, for example depending upon the envelope and application needed for the pumps intended application.

FIG. 43 is a two-dimension cross-sectional diagram illustrating an example of a pump, according to one or more aspects of the present disclosure. FIG. 43 shows a double-acting pump system (e.g. dual bellows pump). In FIG. 43, two fluid ends 320*a*, 320*b* may be fluidly coupled and directly mechanically coupled to a single power end 310, with the piston 410 of the power end 310 being configured to reciprocate the bellows 330*a*, 330*b* in both fluid ends. Each fluid end may be similar to those described with regard to FIGS. 36-42 and may function in similar manner, as may the power end.

The pump system of FIG. 43 may include a power end housing 413 that includes the first opening. In this embodiment, the power end housing 413 may also include a second opening (e.g. the power end 413 comprises a larger first portion 422 of the power end bore 420 (configured for movement of the head 412 of the piston 410) and two smaller diameter second portions 424 of the power end bore 420 (e.g. configured for movement of corresponding piston rods 414*a*, 414*b* therein)). The power end housing 413 may include a first face (similar to the face 3607) and a second face (similar to the face 3607) corresponding to the respective first and second openings. The first opening (e.g. the is fluidly coupled to a first fluid end 320*a* via a direct mechanical connection between the power end housing 413 and a first fluid end housing 323*a*. The second opening is fluidly coupled to a second fluid end 320*b* via a direct mechanical connection between the power end housing 413 and a second fluid end housing 323*b*. In this example, the first fluid end 320*a* includes a first bellow 330*a* that defines a first internal volume and the second fluid end 320*b* includes a second bellow 330*b* that defines a second internal volume. The first and second fluid ends 320*a* and 320*b* may be similar to the fluid end described with reference to FIG. 36, and the mechanical connections may be similar to those described with reference to FIG. 36.

In this example, the second opening can also extend from an exterior of the power end housing 413 to form a second channel in the power end housing 413 (e.g. a second portion 424 of the power end bore 420 configured for fluid connection with the second fluid end 320*b*). The piston element 410 may include a first rod portion 414*a* and a second rod portion 414*b*. In an embodiment, the first and second rod portions 414*a*, 414*b* can extend from a head portion 412 in opposite directions along the same or parallel axes. The first and second rod portions 414*a*, 414*b* may extend into the respective first and second channels (e.g. second portion 424 of the power end bore 420) within the power end housing 413 and may involve second seals (e.g. 453*a*, 453*b*) like as described with reference to FIG. 36.

A first port 432 and a second port 434 are used to drive piston element 410 in a reciprocating manner. In this double-acting case, a driving area of the piston element 410 is defined as being that bounded by the piston head 412 diameter and the first and second rod portion 414*a*, 414*b* diameters. In various embodiments, the driving area is larger than the rod end area (e.g., the cross-sectional area's of the respective rod portion ends) in order to provide pressure intensification. The area ratio may range from 1.1:1 and 10:1.

FIG. 44 is a two-dimension cross-sectional diagram illustrating an example of a pump, according to one or more aspects of the present disclosure. FIG. 44 depicts an alternative configuration for a double-acting (e.g. dual bellows) pump system. In this configuration the fluid ends 320*a*, 320*b* may be mounted at approximately 90 degrees to the power end and fluidly communicate through corresponding second portions 424 of the power end bore 410 and fluid end bores 3620*a*, 3620*b*, respectively. The system may have suction and discharge valves integrated into the fluid end housings 323*a*, 323*b*, respectively, and may function similar to the fluid ends described with reference to FIG. 41.

Disclosed embodiments also comprise exemplary methods for pumping treatment fluid into a well. Such methods may use any of the disclosed pump or system embodiments, such as the examples illustrated in FIGS. 36-45. For example, an exemplary method embodiment may comprise: providing a power end having a piston disposed in a power end bore; providing a (e.g. separate) fluid end having a fluid end bore and a chamber; and fluidly coupling the power end and the fluid end (e.g. the power end bore and the fluid end bore) without external piping therebetween, without unswept volume therebetween, and/or forming a continuous, unbroken, and/or unitary pump bore (which may consist essentially of the power end bore and the fluid end bore and/or may be entirely disposed within the power end housing and the fluid end housing), thereby forming a bellows pump which may be used to pump treatment fluid. Some embodiments may further comprise pumping treatment fluid into the well using the bellows pump (e.g. with treatment fluid moving through the chamber of the fluid end to the well due to movement of the bellows within the chamber).

In some embodiments, the power end may further comprise a power end housing (e.g. with the power end bore disposed therein), the fluid end may further comprise a fluid end housing (e.g. with the chamber and the fluid end bore disposed therein), and fluidly coupling the power end to the fluid end may comprise mating (e.g. physically contacting/bringing into direct physical contact/abutting) the power end housing and the fluid end housing (e.g. the corresponding faces of the power and fluid end housings) and physically coupling the power end housing and the fluid end housing (e.g. the corresponding faces of the power and fluid end housings) together (e.g. to form a unitary body, with no external piping therebetween). Some embodiments may further comprise sealing a joint between the power end housing and the fluid end housing (e.g. between the corresponding faces of the power and fluid end housings). For example, sealing may comprise disposing a housing seal between the corresponding faces of the power and fluid end housings, which is configured to seal the joint therebetween when the housings are coupled together.

Some embodiments may further comprise providing a make-up port in the fluid end, and providing a second seal in the fluid end bore (e.g, wherein the second seal is configured to allow sealing movement of the rod of the piston within the fluid end bore). In embodiments, the make-up port may be disposed between the second seal and the bellows. Some method embodiments may further comprise pumping treatment fluid (e.g. through the chamber, based on reciprocal movement of the piston with respect to the bellows), wherein the sealed joint between the power end housing and the fluid end housing (e.g. the housing seal) is not exposed to high pressure of the bellows (e.g, wherein the second seal shields the housing seal from the high pressure in the bellows, such that the housing seal is only exposed to the lower pressure applied to a head of the piston). Alternate embodiments may comprise providing a make-up port in the fluid end, and providing a second seal at or proximate to the sealed joint (e.g. the housing seal). For example, the second seal may be disposed at the joint between the power end housing and the fluid end housing. Some embodiments may further comprise performing maintenance (e.g. after pumping treatment fluid) by uncoupling the power end housing from the fluid end housing and inspecting and/or replacing the second seal and/or the housing seal. For example, the seals may be readily accessible for maintenance (e.g. based on specific configuration).

Some method embodiments comprise orienting the bellows to expand downwards (e.g. with respect to gravity). For example, in some embodiments orienting the bellows may be accomplished by orienting the pump (e.g. so that the bellows is configured to expand downward) and/or by orienting the fluid end or a portion of the fluid end bore (e.g. so that it is angled with respect to the power end). Some embodiments may further comprise disposing the chamber/fluid end so that the fluid connection to the suction and discharge valves is located below the bellows (e.g. with respect to gravity). For example, this may entail disposing the fluid end so that the suction valve and the discharge valve are below (e.g. with respect to gravity) the bellows, and/or disposing the suction and discharge valves to be located below the bellows.

One or more of the pump embodiments disclosed herein (e.g. relating to FIGS. 36-45) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments or aspects thereof, and/or a non-transitory computer-readable medium can have program instructions stored thereon configured to cause a control system (e.g. of the bellows pump system) to perform any of the disclosed method embodiments or aspects thereof. Such instructions may be used by the control system of the disclosed bellows pump system embodiments, for example to operate the bellows pump system (which may include disclosed pump embodiments).

Variations of all disclosed embodiments, for example having and/or deleting one or more aspects of various disclosed embodiments illustrated in the figures herein, are included herein. As persons of skill will appreciate, various aspects illustrated in one or more of the disclosed embodiments may be combined and/or deleted, thereby illustrating still further disclosed embodiments included within the scope of this disclosure. Additionally, one or more disclosed embodiment and/or variations or combinations thereof may be used to implement one or more of the methods disclosed herein.

Various combinations of disclosed embodiments are also contemplated and included within this disclosure. While all possible combinations are included in the scope of this disclosure, the following examples provide specific illustrative embodiments regarding the type of combinations available and included under this disclosure. It should also be noted that integral pump embodiments (e.g. as discussed above with respect to FIGS. 36-45) can be used with any of the other embodiments, for example with an integral pump embodiment serving as the pump described in any specific system or method embodiment or with the power end and/or fluid end aspects of the integral pump being used in any specific pump embodiment. In contemplating embodiment combinations, consider the following by way of example:

FIGS. 46A-B schematically illustrate an exemplary bellows pump system having a make-up system 510 which is also configured for fluid cooling, while additionally being configured to monitor for leaks and to isolate the bellows 330 from the make-up system (e.g. make-up fluid source 2705) in the event of leak detection, according to an embodiment of the disclosure. FIG. 46A illustrates the system prior to leak detection, when the make-up system 510 may be configured to maintain the controlled volume of fluid between the piston 410 and the bellows 330 and to circulate fluid for cooling (e.g. similar to the discussion above with respect to FIGS. 27-31). FIG. 46B illustrates a leak in the bellows 330 (e.g. a leak being detected), which may result in isolation of the bellows 330 from the make-up fluid system 510 (e.g. similar to the discussion above with respect to FIGS. 32-35). In this way, fluid circulation (e.g. for cooling) between the bellows 330 and the make-up fluid source 2705 and/or the at least one additional component of the system (e.g. either separate component 2799 or the power end 310 of the pump 300) may stop when a leak is detected, for example in order to prevent spread of contamination which could damage further components via the fluid circulation (e.g. minimizing damage to the overall system, even though the system typically can be fluidly interconnected, for example for cooling circulation).

Figure 47:
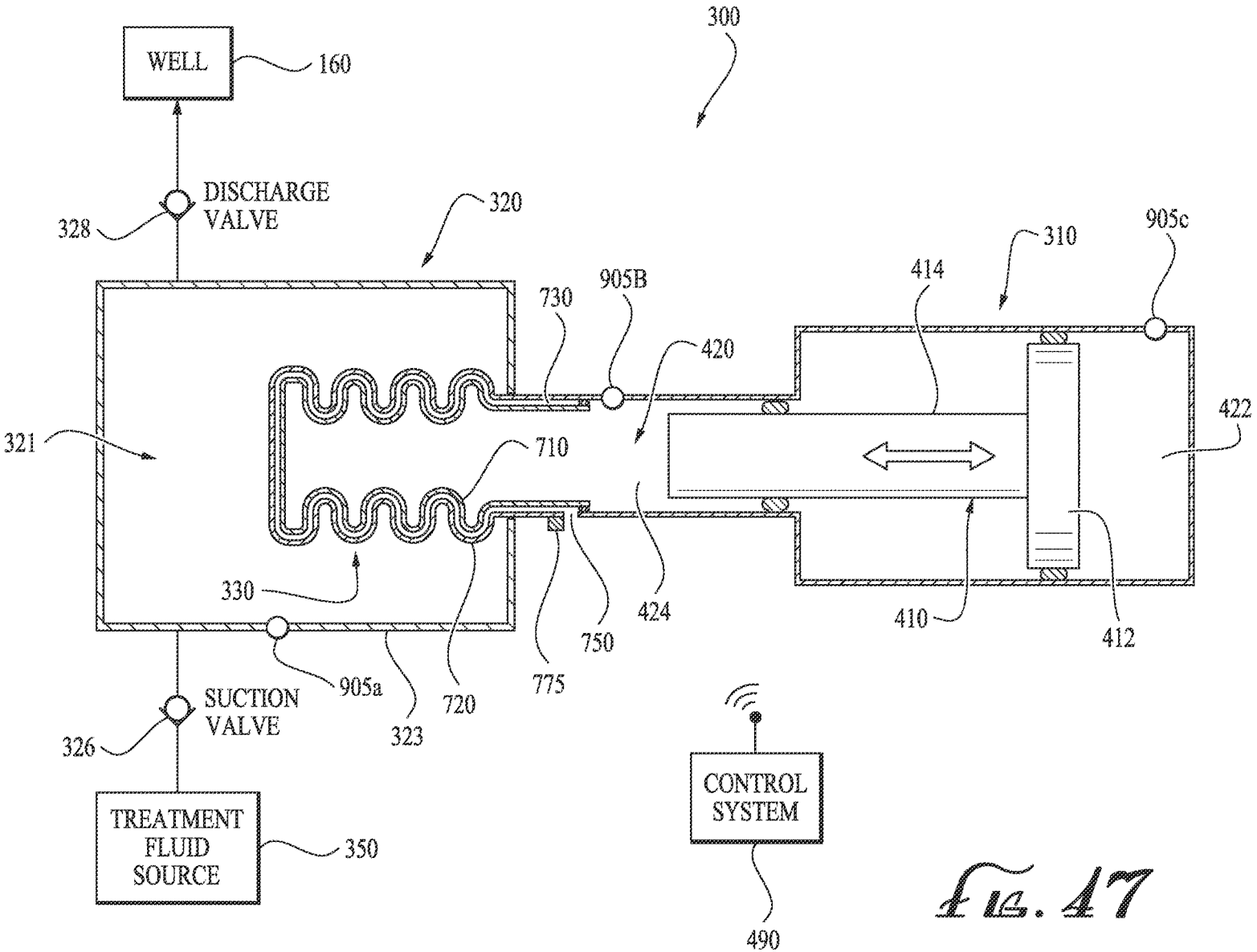
FIG. 47 is a schematic illustration of an exemplary bellows pump having an exemplary double-walled bellows, as well as one or more additional sensors, according to an embodiment of the disclosure.

FIG. 47 is a schematic illustration of an exemplary bellows pump 300 having an exemplary double-walled bellows 330 (e.g. having an inner wall 710, and outer wall 720, and an annulus 730 therebetween), as well as one or more additional sensors, according to an embodiment of the disclosure. The double-walled bellows 330 of FIG. 47 may be similar to that discussed above with respect to FIGS. 7-8. In embodiments, the double-walled bellows 330 may be configured to detect leakage (e.g. with a sensor configured to detect leakage of fluid into the annulus 730). The additional sensors of FIG. 47 may be similar to those described above with respect to FIGS. 9-18. In embodiments, the one or more additional sensors may include one or more strain gauge 905*a*-905*c*, which can be configured to detect valve leakage (e.g. discharge or suction valve leakage). The system of FIG. 47 may jointly use the double-walled bellows 330 and the one or more additional sensors 905*a-c* to more fully monitor health of the system (e.g. both valve health and bellows health) and/or as inputs for determining one or more course of action (e.g. using a control system 490), which may better protect the system from damage and/or improve maintenance and/or durability.

Figure 48:
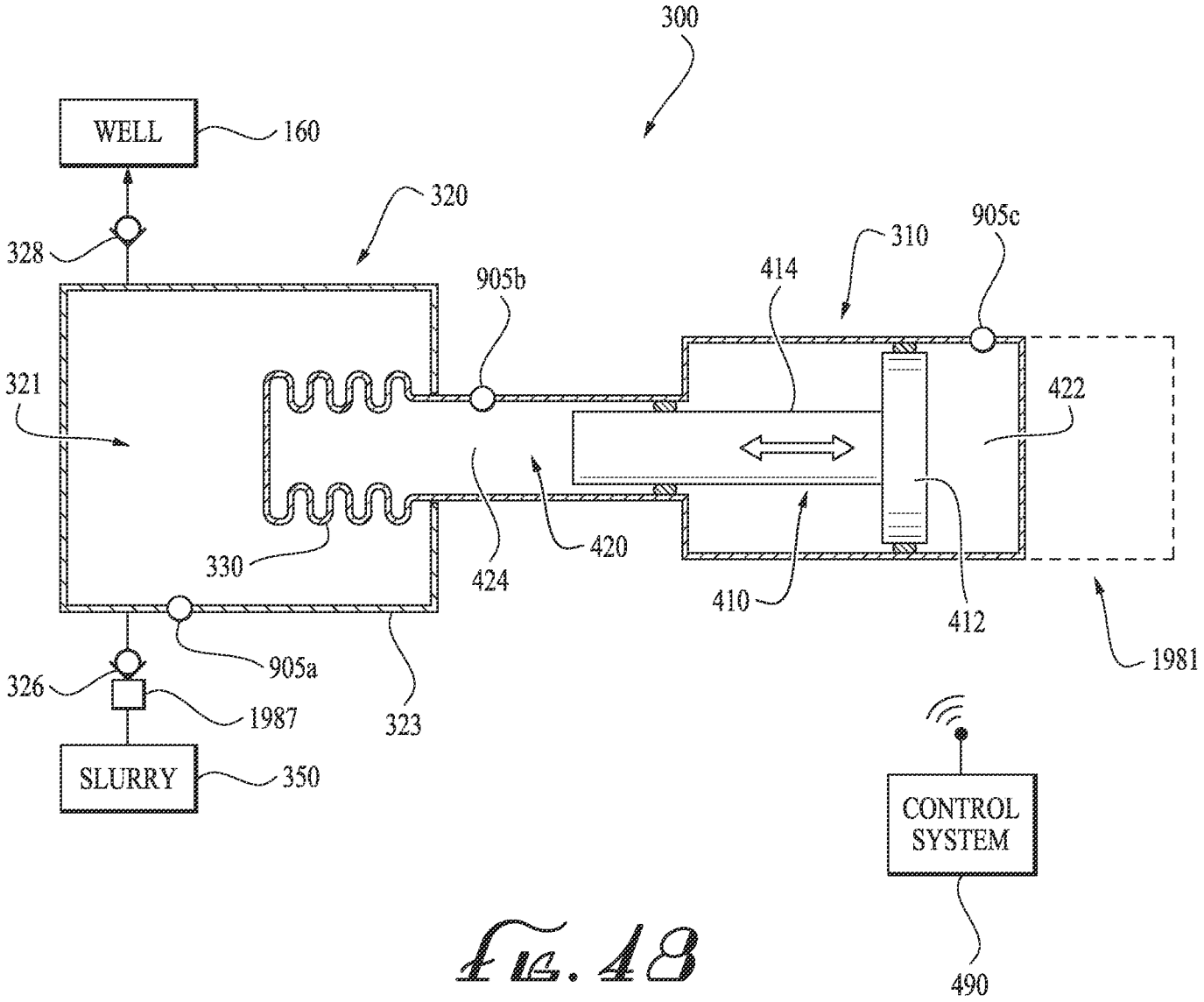
FIG. 48 is a schematic illustration of an exemplary bellows pump having one or more sensor (e.g. a strain gauge) and a venting mechanism, according to an embodiment of the disclosure.
Figure 19A:
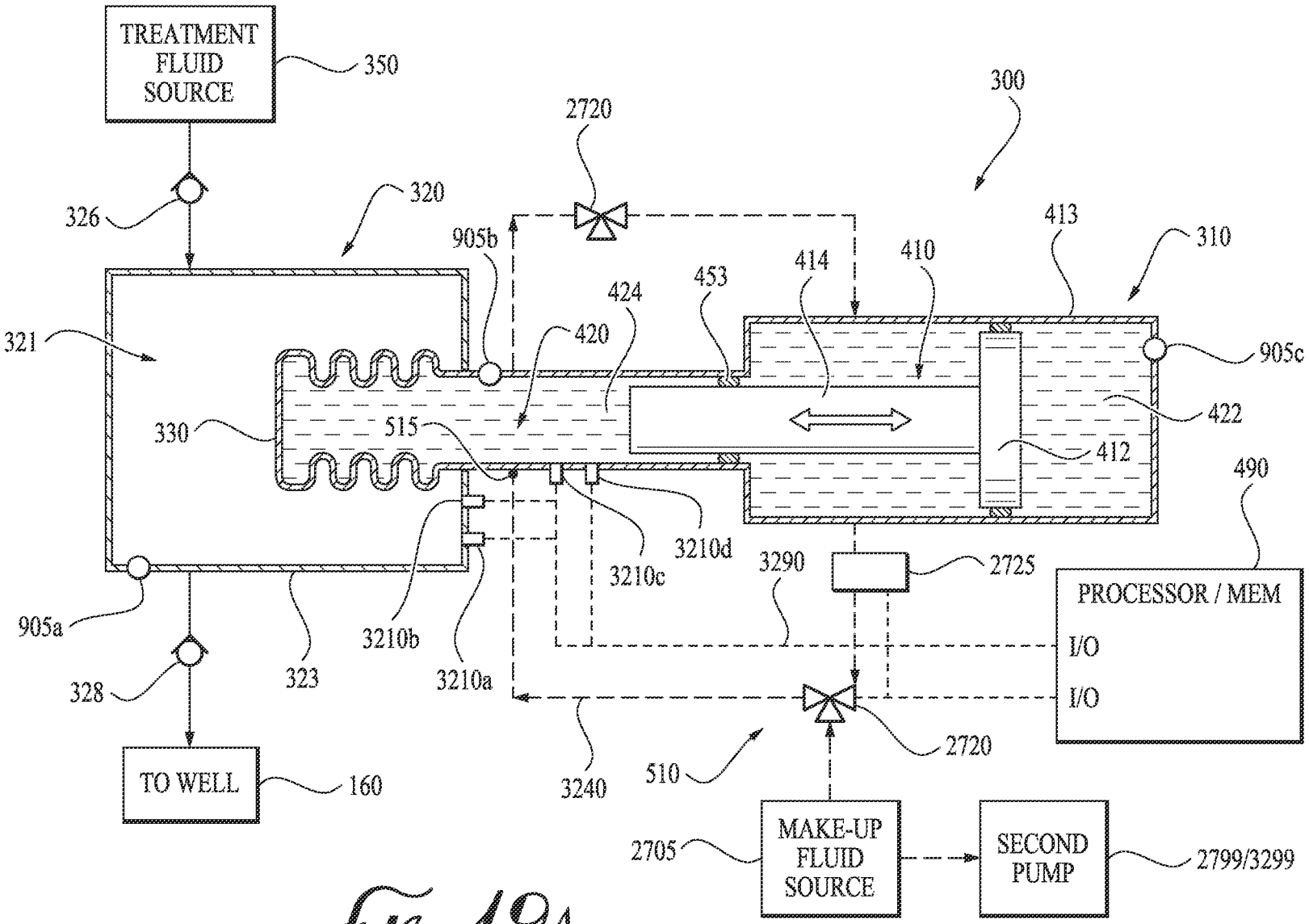
Figure 19B:
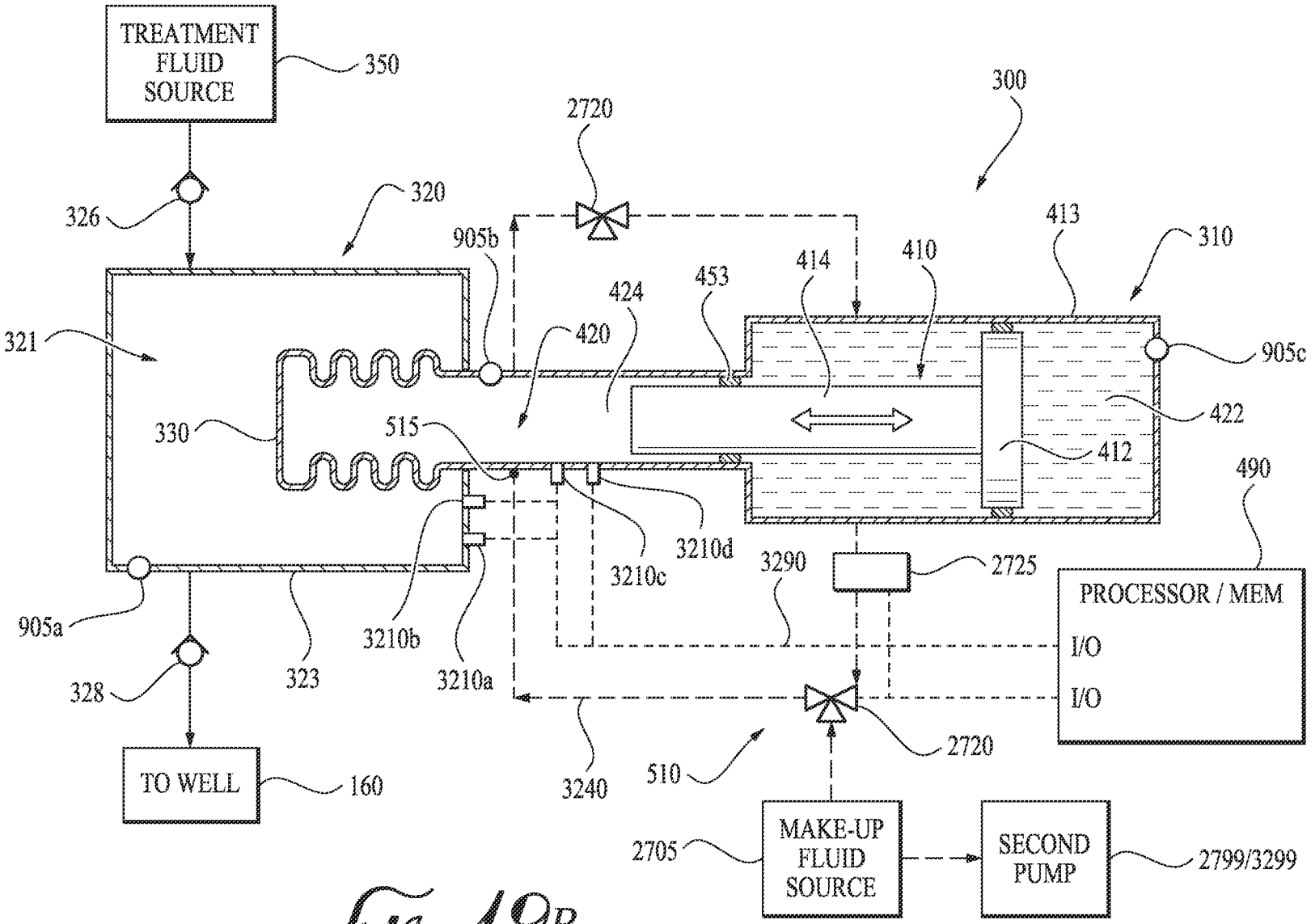

FIG. 48 is a schematic illustration of an exemplary bellows pump having one or more sensor (e.g. a strain gauge 905) and a venting mechanism 1987, according to an embodiment of the disclosure. The one or more sensor of FIG. 48 may be similar to those described above with respect to FIGS. 9-18. In embodiments, the one or more additional sensors may include one or more strain gauge 905*a*-905*c*, which can be configured to detect valve leakage (e.g. discharge or suction valve leakage). The venting mechanism 1987 may be similar to that described above with respect to FIGS. 19-26, for example being configured to vent the chamber 321 when the pump stops and/or when a leak (e.g. a discharge valve leak) is detected. In the embodiment of FIG. 48, the strain gauge data may be used to detect discharge valve leakage, and this data may then be used (e.g. by the control system 490, which evaluates the data to determine whether to vent the chamber and then operates the venting mechanism accordingly) to vent the chamber 321 (e.g. by holding open the suction valve 326), to stop the pump, or to correlate with other sensed data to determine one or more course of action.

FIG. 49A is a schematic illustration of an exemplary bellows pump system having a make-up system 510, also illustrating one or more exemplary sensor (e.g. strain gauge 905*a-c*), according to an embodiment of the disclosure. The make-up system 510 may be similar to that discussed above with respect to FIGS. 32-35. For example, the make-up system 510 may be configured (e.g. in addition to maintaining the controlled volume of fluid between the piston and the bellows) to isolate the bellows 330 from the make-up fluid source 2705 and/or additional component (which could be a second pump 3299 or the power end 310 of the pump 300) in the event a leak is detected (see for example FIG. 49B). In the embodiment of FIGS. 49A-B, the sensor data (e.g. from the one or more strain gauge 905*a-c* and/or other sensors, which may be similar to that discussed with respect to FIGS. 9-18) may be used by the control system 490 as it determines a course of action (e.g. whether to isolate the bellows 330). For example, leakage into the chamber 321 through the discharge valve 328 could lead to damage to the bellows 330 (which may in turn lead to leakage into the bellows which could be in fluid communication with the make-up system, 510 and thereby one or more additional system component such as additional pump 3299). The control system 490 may stop pumping, signal an alert, and/or isolate the bellows 330 in response to leak detection (e.g. from the one or more strain gauge). In embodiments, the strain gauge data may be used in conjunction with other data (e.g. from one or more other sensor, such as 3210*a-d*) to determine a course of action.

Figure 50A:
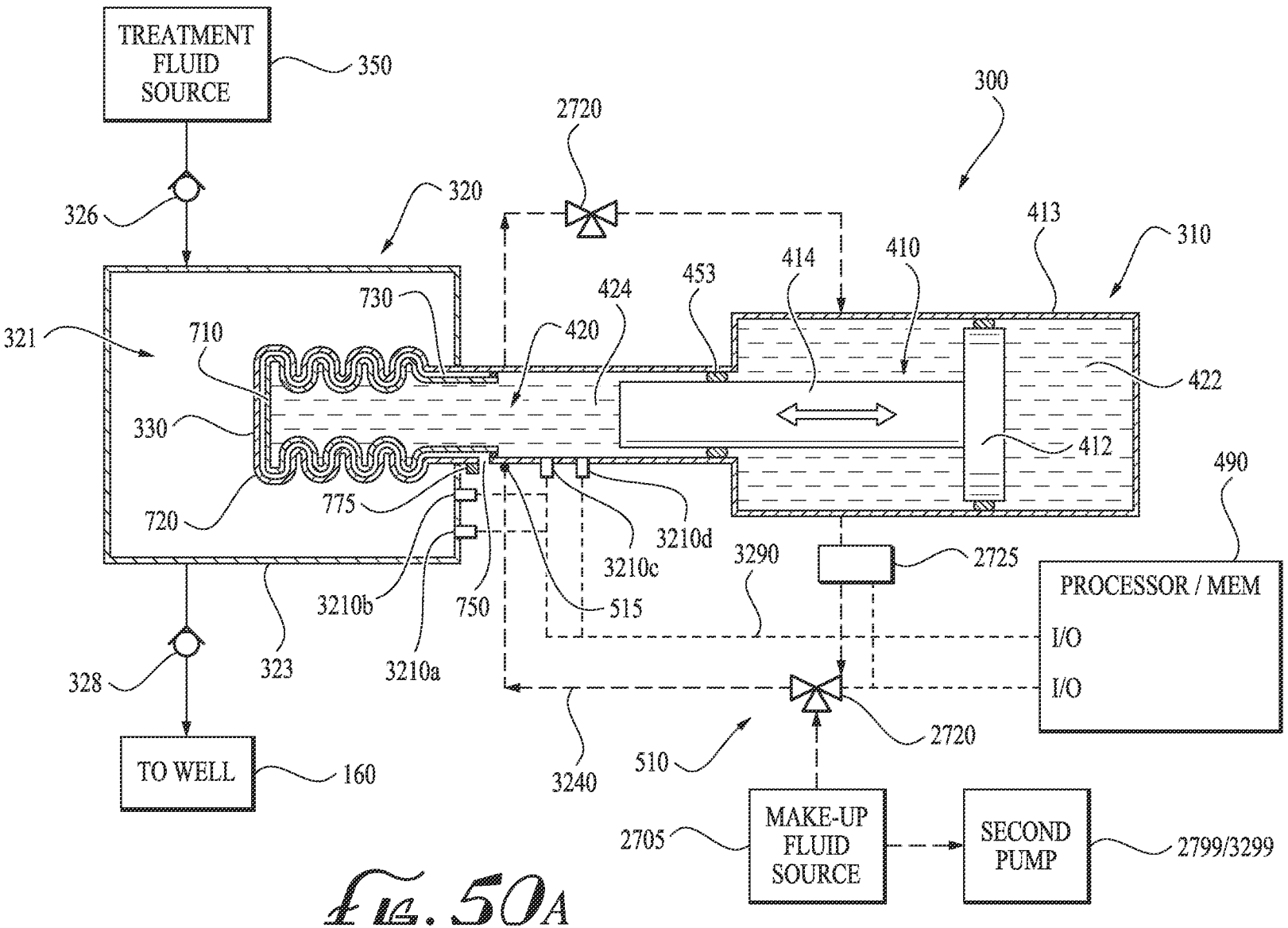
FIG. 50A is a schematic illustration of an exemplary bellows pump system having a make-up system and an exemplary double-walled bellows, according to an embodiment of the disclosure.
Figure 50B:
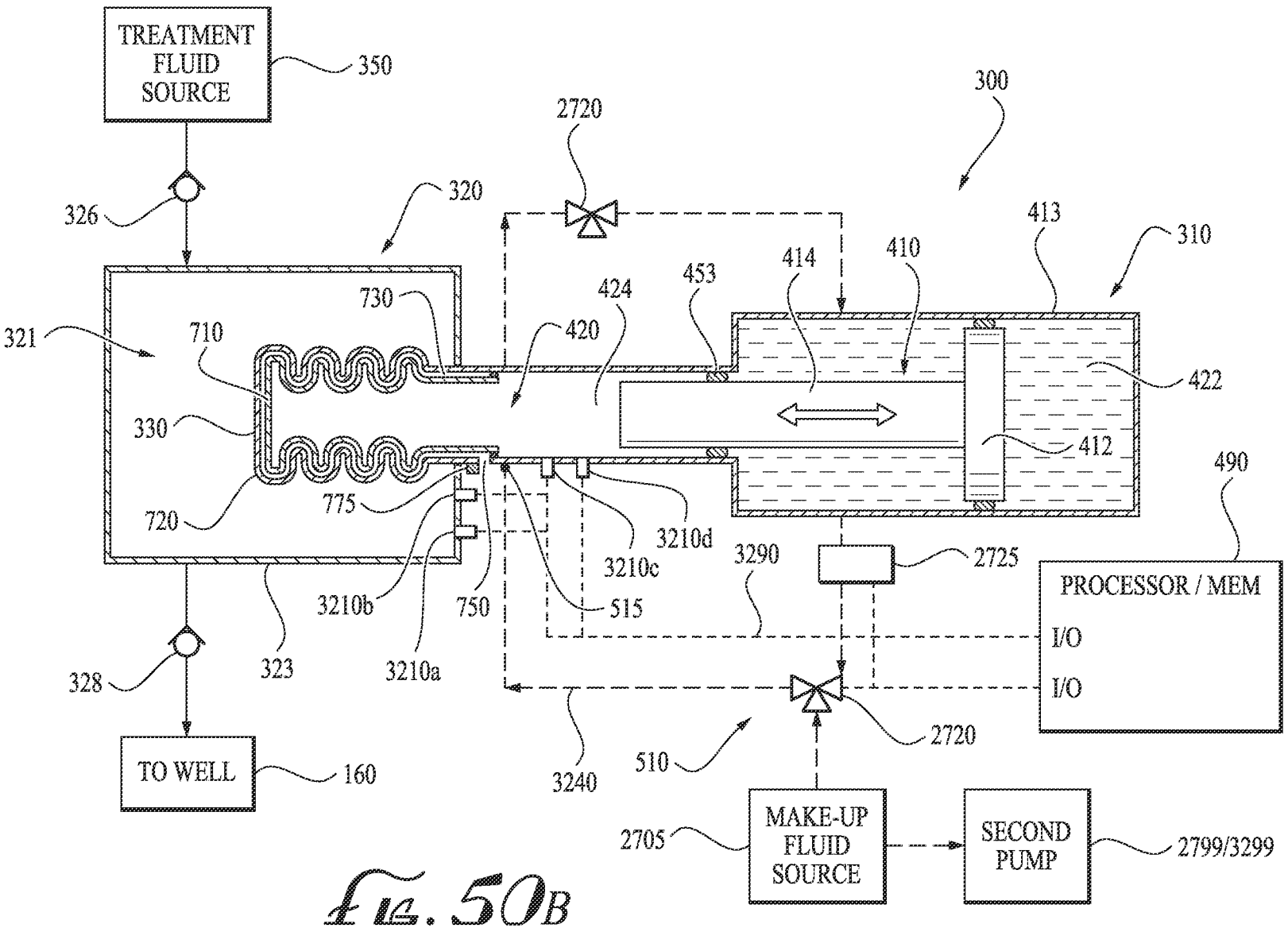
FIG. 50B is a schematic illustration of the exemplary bellows pump system of FIG. 50A, illustrating a leak in the bellows, according to an embodiment of the disclosure.

FIG. 50A is a schematic illustration of an exemplary bellows pump system having a make-up system 510 and an exemplary double-walled bellows 330, according to an embodiment of the disclosure. The make-up system 510 may be similar to that described above with respect to FIGS. FIGS. 32-35 (for example, in addition to maintaining the controlled volume of fluid between the piston 410 and the bellows 330, being configured to isolate the bellows 330 in the event that leakage is detected, as shown in FIG. 50B for example). The double-walled bellows 330 may be similar to that described above with respect to FIGS. 7-8 (for example, being configured to detect leakage of fluid into the annulus 730 of the double-walled bellows 330). In FIGS. 50A-B, the leak detection via the double-walled bellows 330 may be used by the control system 490 to determine bellows isolation (e.g. either as the sole sensor input for leakage detection or in conjunction with one or more additional sensor).

Figure 51A:
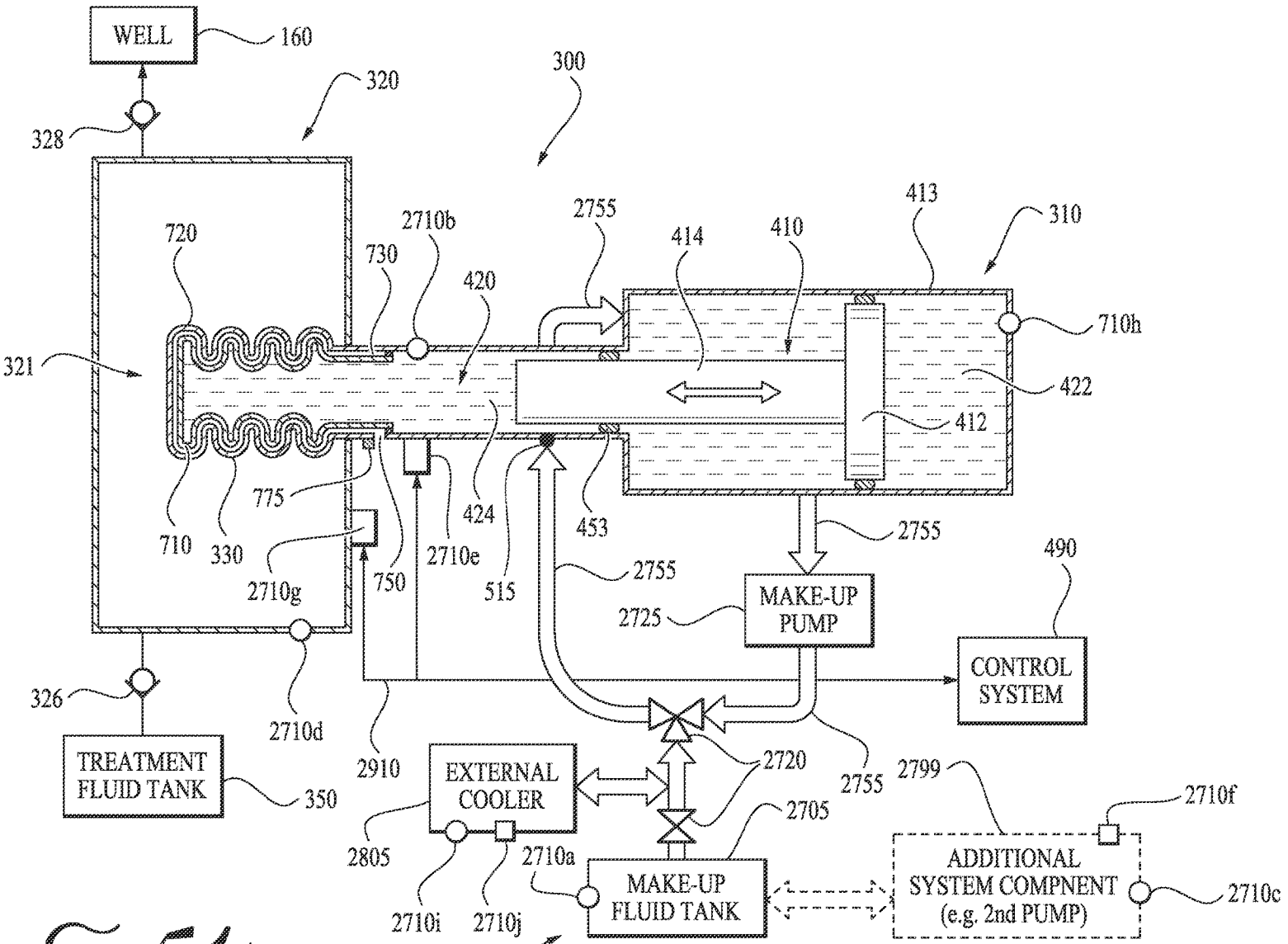
FIG. 51A is a schematic illustration of another exemplary bellows pump system having a make-up system configured for fluid cooling, and a double-walled bellows, according to an embodiment of the disclosure.
Figure 51B:
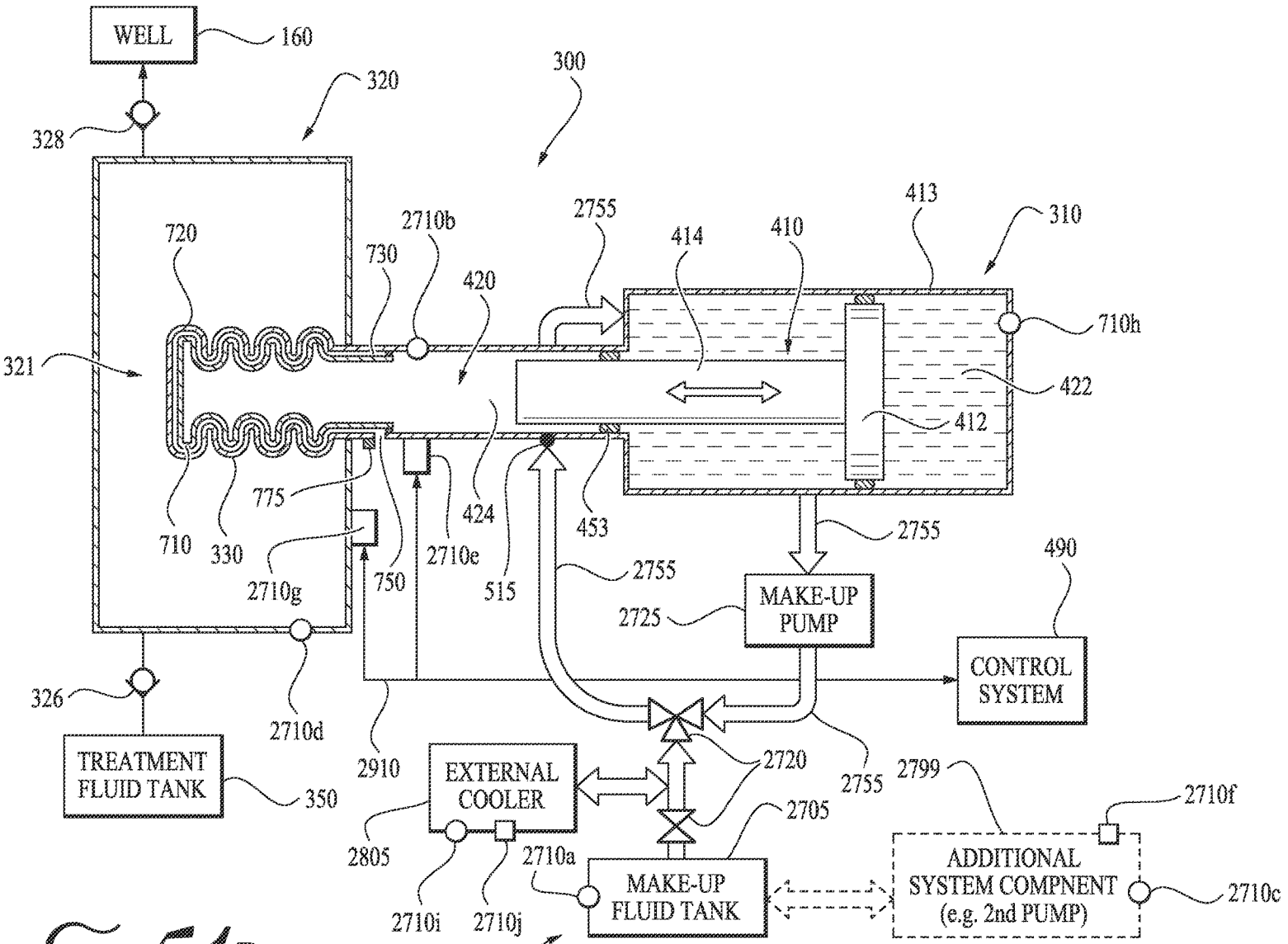
FIG. 51B is a schematic illustration of the exemplary bellows pump system of FIG. 51A, illustrating a leak in the bellows, which may result in isolation of the bellows from the make-up system, according to an embodiment of the disclosure.

FIGS. 51A-B schematically illustrate another exemplary bellows pump system having a make-up system 510 configured for fluid cooling (e.g. in addition to maintaining a controlled volume of fluid between the piston 410 and the bellows 330), and a double-walled bellows 330, according to an embodiment of the disclosure. For example, the make-up system of FIG. 51A may be configured similar to that of FIGS. 27-31 (e.g. configured to circulate fluid between the make-up system 510 (e.g. the make-up fluid source 2705) and the double-walled bellows 330 for cooling). The double-walled bellows 330 may be similar to that described above with respect to FIGS. 7-8 (e.g. configured for leak detection, for example based on fluid in the annulus 730 of the double-walled bellows 330). FIG. 51B illustrates a leak, and the system of FIGS. 51A-B may also be configured to isolate the double-walled bellows 330 (e.g. similar to the discussion above with respect to FIGS. 32-35) in the event that a leak is detected. For example, leak detection may use the double-walled bellows leak detection/sensing and may be used by the control system 490 to determine bellows isolation (e.g. either as the sole sensor input or in conjunction with one or more other sensor). Make-up cooling circulation may fluidly link the double-walled bellows 330 to one or more additional system component (e.g. another system component 2799 and/or power end 310), and the make-up isolation configuration may protect those additional components from damage if there is a leak (e.g. preventing or minimizing damage due to circulation of fluid for cooling). When there is no leakage, circulation of fluid between the make-up system 510 and the bellows 330 can cool the system and/or dissipate heat build-up.

These exemplary embodiments illustrate a few of the ways that various embodiments may be used jointly, in combination, and/or synergistically (e.g. as part of an overall system). Persons of skill will understand from this disclosure these and other embodiments, all of which are included in the scope of disclosure. By way of further example, please consider the following:

ADDITIONAL DISCLOSURE

The following are non-limiting, specific embodiments in accordance with the present disclosure:

In a first embodiment, a system for pumping treatment fluid into a well can comprise: a bellows pump configured to pump treatment fluid into the well, having: a power end comprising a piston; a fluid end having a chamber; and an expandable bellows, wherein the power end is configured to reciprocally expand and contract the bellows within the chamber based on movement of fluid by the piston; a make-up system configured to maintain a controlled volume of fluid between the piston and the bellows; and a control system having one or more sensor configured to detect one or more parameters of the system; wherein: the make-up system comprises a make-up fluid source fluidly coupled to the bellows and to at least one additional component of the system; the make-up system is configured to receive heat via circulation of fluid with the at least one additional component of the system, and to discharge heat via circulation of the fluid with the bellows; and the control system is configured to receive data from the one or more sensor, to evaluate the sensor data to detect a leak, and responsive to detecting a leak, to fluidly isolate the make-up system (e.g. the make-up fluid source) from the bellows.

A second embodiment can include the system of the first embodiment, wherein the control system is configured to evaluate the sensor data to determine a circulation protocol for circulating fluid between the make-up system and bellows for cooling, and responsive to determining a circulation protocol, to circulate fluid between the make-up system and the bellows based on the circulation protocol.

A third embodiment can include the system of the first or second embodiment, wherein the control system is further configured to evaluate the sensor data to determine whether the bellows and piston are out of sync, and responsive to determining that the bellows and piston are out of sync, to use the make-up system to adjust the amount of fluid between the piston and the bellows to return the piston and bellows to sync (e.g. to correct back to the controlled volume of fluid).

A fourth embodiment can include the system of any one of the first to third embodiments, wherein the at least one additional component of the system comprises: one or more additional pump, an intensifier, the power end of the bellows pump, a hydraulic circuit configured to reciprocally move the piston within a bore of the power end, hydraulics, lube pumps, cylinders, bellows, pistons/plungers, packing, and/or combinations thereof.

A fifth embodiment can include the system of any one of the second to fourth embodiments, wherein the control system determines an amount of time to hold fluid in the bellows, which source of fluid to circulate to the bellows, and/or an amount of fluid to circulate to optimize cooling of the fluid.

A sixth embodiment can include the system of any one of the second to fifth embodiments, wherein the control system uses temperature of the bellows and temperature of the make-up fluid source to determine the circulation protocol.

A seventh embodiment can include the system of the sixth embodiment, wherein the control system further uses temperature of the at least one additional component to determine the circulation protocol.

An eighth embodiment can include the system of any one of the second to seventh embodiments, wherein the control system determines the circulation protocol based on temperature, prioritizing flow from whichever of the make-up fluid source or the at least one additional component is hotter (e.g. has hotter fluid) to the bellows.

A ninth embodiment can include the system of any one of the second to eighth embodiments, wherein the control system is configured to hold fluid in the bellows until the fluid in the bellows is cooler than the make-up fluid source or the at least one additional component, and then to circulate fluid (e.g. to whichever is hotter).

A tenth embodiment can include the system of any one of the first to ninth embodiments, further comprising an external cooler fluidly coupled to the make-up system.

An eleventh embodiment can include the system of any one of the first to tenth embodiments, wherein the one or more sensor is configured to detect one or more of the following parameters at one or more location within the system: pressure, temperature, flow rate, viscosity, contamination, and/or position of one or more component of the system.

A twelfth embodiment can include the system of any one of the first to eleventh embodiments, wherein the one or more sensor comprise a sensor configured to monitor one or more parameter within the chamber.

A thirteenth embodiment can include the system of any one of the first to twelfth embodiments, wherein the one or more sensor comprises a sensor configured to monitor one or more parameter in the bellows.

A fourteenth embodiment can include the system of any one of the first to thirteenth embodiments, wherein the one or more sensor comprises a sensor configured to monitor one or more parameter of the make-up fluid system.

A fifteenth embodiment can include the system of any one of the first to fourteenth embodiments, wherein the one or more sensor comprises a sensor configured to monitor one or more parameter relating to the power end.

A sixteenth embodiment can include the system of any one of the first to fifteenth embodiments, wherein the control system detects a leak based on the sensor data by comparing the sensor data to a corresponding threshold.

A seventeenth embodiment can include the system of any one of the first to sixteenth embodiments, wherein the one or more sensor detects position of the bellows relative to position of the piston.

An eighteenth embodiment can include the system of any one of the first to seventeenth embodiments, wherein the one or more sensor detects pressure in the chamber relative to pressure in the bellows.

A nineteenth embodiment can include the system of any one of the first to eighteenth embodiments, wherein the one or more sensor detects flow rate of make-up/drive fluid through the (e.g. one or more) make-up port (e.g. in and out) of the bellows.

A twentieth embodiment can include the system of any one of the first to nineteenth embodiments, wherein the one or more sensor detects contamination (e.g. particle count) within the bellows.

A twenty-first embodiment can include the system of any one of the first to twentieth embodiments, wherein the one or more sensor detects viscosity of fluid in the bellows.

A twenty-second embodiment can include the system of any one of the first to twenty-first embodiments, wherein the one or more sensor detects temperature of make-up/drive fluid within the bellows (e.g. compared to expected temperature and/or compared to temperature in the chamber).

A twenty-third embodiment can include the system of any one of the first to twenty-second embodiments, wherein the make-up fluid is drive fluid (e.g. hydraulic fluid, such as hydraulic oil, which may be the same fluid used as drive fluid for the pump).

A twenty-fourth embodiment can include the system of any one of the first to twenty-third embodiments, wherein the pump comprises an intensifier (e.g. fluidly coupled to and/or in fluid communication with the make-up fluid source).

A twenty-fifth embodiment can include the system of any one of the first to twenty-fourth embodiments, wherein the make-up system further comprises a make-up port in fluid communication with the bellows and the make-up fluid source, at least one make-up valve configured to control (e.g. open or close or partially close—e.g. to control speed of flow) fluid flow between the make-up port/bellows and the make-up fluid source, and/or at least one make-up pump configured to pump fluid between the bellows and the make-up fluid source.

A twenty-sixth embodiment can include the system of the twenty-fifth embodiment, wherein the make-up fluid source is in fluid communication with the bellows when the make-up valve is open, and the make-up fluid source is fluidly isolated from the bellows when the make-up valve is closed.

A twenty-seventh embodiment can include the system of any one of the twenty-fifth to twenty-sixth embodiments, wherein fluidly isolating the make-up system from the bellows comprises closing the make-up valve and/or shutting off/deactivating the make-up pump (e.g. automatically by the control system—e.g. the control system may instruct a valve mechanism/actuator to close the make-up valve and/or to shut off the pump).

In a twenty-eighth embodiment, a method for cooling a bellows pump system during introduction of treatment fluid into a well can comprise: pumping treatment fluid into the well using the bellows pump system, wherein the bellows pump system comprises a pump having a bellows and a piston, a control system, and a make-up system configured to maintain a controlled volume of drive fluid between the piston and the bellows (e.g. keep the piston and bellows in sync), and wherein the make-up system is fluidly coupled to the bellows and to at least one additional component of the system; responsive to receiving, at the control system, sensor data from one or more sensor configured to detect one or more parameter at one or more location of the bellows pump system, determining a circulation protocol for cooling based on the sensor data; responsive to determining a circulation protocol, circulating fluid between the make-up system and the bellows based on the circulation protocol; responsive to receiving, at the control system, sensor data from the one or more sensor, detecting a leak in the bellows based on the sensor data; and responsive to detecting a leak, fluidly isolating the bellows from a fluid source of the make-up system, thereby fluidly uncoupling the at least one additional component of the system from the bellows.

A twenty-ninth embodiment can include the method of the twenty-eighth embodiment, further comprising evaluating the sensor data to determine whether the bellows and piston are out of sync, and responsive to determining that the bellows and piston are out of sync, using the make-up system to adjust the amount of fluid between the piston and the bellows to return the piston and bellows to sync.

A thirtieth embodiment can include the method of any one of the twenty-eighth to twenty-ninth embodiments, further comprising receiving heat from the at least one additional component into the make-up fluid system; wherein circulating fluid comprises circulating heated fluid into the bellows and dissipating heat from the bellows into the treatment fluid.

A thirty-first embodiment can include the method of any one of the twenty-eighth to thirtieth embodiments, wherein determining a circulation protocol comprises determining an amount of time to hold fluid in the bellows, a source of fluid to circulate to the bellows, and/or an amount of fluid to circulate to optimize cooling of the fluid.

A thirty-second embodiment can include the method of any one of the twenty-eighth to thirty-first embodiments, wherein the additional component comprises a power end of the pump fluidly coupled to the make-up system, and wherein the make-up system comprises a make-up fluid source.

A thirty-third embodiment can include the method of the thirty-second embodiment, wherein determining a circulation protocol further comprises determining which of the power end and the make-up fluid source contains hotter fluid, and circulating the hotter fluid to the bellows.

A thirty-fourth embodiment can include the method of the thirty-third embodiment, further comprising holding fluid in the bellows until the fluid is cooler than either fluid in the make-up fluid source or fluid in the power end.

A thirty-fifth embodiment can include the method of the thirty-fourth embodiment, further comprising, responsive to the fluid in the bellows being cooler than either the make-up fluid source or the power end, circulating fluid from the bellows into the hotter of the make-up fluid source or the power end.

A thirty-sixth embodiment can include the method of any one or the twenty-eighth to thirty-fifth embodiments, further comprising circulating fluid with an external cooler.

A thirty-seventh embodiment can include the method of any one of the twenty-eighth to thirty-sixth embodiments, wherein detecting a leak comprises comparing, using the control system, the sensor data to a corresponding threshold.

A thirty-eighth embodiment can include the method of any one of the twenty-eighth to thirty-seventh embodiments, wherein fluidly isolating the bellows comprises closing a make-up valve of the make-up system and/or shutting off a make-up pump of the make-up system.

In a thirty-ninth embodiment, a bellows pump configured to introduce treatment fluid into a well can comprise: a power end; a fluid end having a fluid end housing with a chamber in fluid communication with a suction valve and a discharge valve; an expandable double-walled bellows configured to extend into the chamber of the fluid end based on application of drive fluid therein by the power end, comprising: an inner wall enclosing an inner volume in fluid communication with the power end; and an outer wall encompassing the inner wall; one or more sensor configured to measure strain and/or pressure at one or more location in the pump; and a control system configured to receive data from the one or more sensor and to monitor for pump/valve health; wherein: an annulus is disposed between the inner wall and the outer wall of the bellows, and the annulus is in fluid communication with a port.

A fortieth embodiment can include the pump of the thirty-ninth embodiment, wherein the one or more sensor comprises one or more strain gauge.

A forty-first embodiment can include the pump of the fortieth embodiment, wherein the one or more strain gauge is disposed in the fluid end and/or on (e.g. configured to measure strain in) the fluid end housing (e.g. in the chamber wall, a slurry valve housing, a suction valve housing, a discharge valve housing, a bellows housing, and/or a manifold member between the valve housing and the bellows) and/or the power end housing (e.g. with respect to the first portion of the bore and/or the second portion of the bore).

A forty-second embodiment can include the pump of any one of the thirty-ninth to forty-first embodiments, wherein strain decay from peak is monitored (e.g. by the control system) as an indicator of discharge valve health/leakage.

A forty-third embodiment can include the pump of any one of the thirty-ninth to forty-second embodiments, wherein an amount of time for strain decay from peak exceeding a first threshold is indicative of a discharge valve leak.

A forty-fourth embodiment can include the pump of any one of the thirty-ninth to forty-third embodiments, wherein strain rise to peak is monitored (e.g. by the control system) as an indicator of suction valve health/leakage.

A forty-fifth embodiment can include the pump of any one of the thirty-ninth to forty-fourth embodiments, wherein an amount of time for strain rise to peak exceeding a second threshold is indicative of a suction valve leak.

A forty-sixth embodiment can include the pump of any one of the fortieth to forty-fifth embodiments, wherein the one or more strain gauge comprises a plurality of strain gauges (for example with a first strain gauge disposed on the fluid end and a second strain gauge disposed on the power end), and wherein offset between the first strain gauge and the second strain gauge is monitored (e.g. by the control system).

A forty-seventh embodiment can include the pump of any one of the fortieth to forty-sixth embodiments, further comprising one or more position sensor, wherein the controller is configured to correlate data from the one or more position sensor with data from the one or more strain gauge (e.g. overlay the position chart and the strain chart and/or use position data to check/match-up timing with the strain data).

A forty-eighth embodiment can include the pump of the forty-seventh embodiment, wherein the control system uses data from the one or more position sensor to interpret the data from the one or more strain gauge.

A forty-ninth embodiment can include the pump of any one of the forty-seventh to forty-eighth embodiments, wherein offset between the data/chart of the one or more position sensor and the one or more strain gauge is monitored (e.g. by the control system).

A fiftieth embodiment can include the pump of any one of the forty-seventh to forty-ninth embodiments, wherein the one or more position sensor is disposed on the fluid end (e.g. within the chamber) (e.g. configured to detect position of the bellows in the chamber) and/or the power end (e.g. in the first portion of the bore and/or the second portion of the bore) (e.g. configured to detect the position of the piston—e.g. the head and/or the rod of the piston).

A fifty-first embodiment can include the pump of any one of the forty-seventh to fiftieth embodiments, wherein the one or more position sensor comprises two position sensors, wherein a first of the two position sensors is configured to detect the position of the bellows and a second of the two position sensors is configured to detect the position of the piston—e.g. head and/or rod).

A fifty-second embodiment can include the pump of the fifty-first embodiment, wherein the control system is further configured to receive data from the two position sensors and to monitor for bellows health (e.g. sync).

A fifty-third embodiment can include the pump of any one of the fiftieth to fifty-second embodiments, wherein a difference (e.g. offset) between the position of the bellows (e.g. with respect to the chamber) and the position of the piston (e.g. the rod and/or head) (e.g. determining the position of the bellows relative to the position of the piston) is monitored (e.g. by the control system) as an indicator of bellows health.

A fifty-fourth embodiment can include the pump of the fifty-third embodiment, wherein the difference (e.g. offset) between the position of the bellows and the position of the piston (e.g. the rod/head) extending beyond (e.g. +/−) a threshold range is indicative of potential leakage with respect to the bellows (e.g. which could impact whether the bellows is in sync with the piston/plunger) and/or the bellows being out of sync with the piston/plunger.

A fifty-fifth embodiment can include the pump of any one of the fortieth to fifty-fourth embodiments, wherein one or more pressure sensor may be used in place of or in conjunction with the one or more strain gauge (e.g. with a first pressure sensor configured to detect pressure in the chamber of the fluid end and/or a second pressure sensor configured to detect pressure in the power end (e.g. the first portion of the bore and/or the second portion of the bore)), wherein an amount of time for pressure decay from peak exceeding a first threshold is indicative of a discharge valve leak, and/or wherein an amount of time for pressure rise to peak exceeding a second threshold is indicative of a suction valve leak.

A fifty-sixth embodiment can include the pump of any one of the thirty-ninth to fifty-fifth embodiments, wherein the inner wall is sealingly coupled to an interior surface of the outer wall in proximity to the port, but the inner wall and the outer wall are substantially uncoupled within the chamber.

A fifty-seventh embodiment can include the pump of any one of the thirty-ninth to fifty-sixth embodiments, wherein the annulus is configured to provide a sealed annular space between the inner wall and the outer wall of the bellows with no fluid communication out (e.g. no fluid communication with an external environment) except via the port.

A fifty-eighth embodiment can include the pump of any one of the thirty-ninth to fifty-seventh embodiments, wherein there is fluid connection/communication between any portion of the annulus and the port.

A fifty-ninth embodiment can include the pump of any one of the thirty-ninth to fifty-eighth embodiments, wherein the inner and outer walls are substantially uncoupled (e.g. not coupled together) within the chamber (e.g. the portions of the inner wall and the outer wall disposed in the chamber are substantially uncoupled and/or the annulus comprises an open space between the entirety (e.g. the entire portion) of the inner wall and the outer wall which is disposed in the chamber) (e.g. with the inner wall loose or slip fit within the outer wall).

A sixtieth embodiment can include the pump of any one of the thirty-ninth to fifty-ninth embodiments, wherein the inner wall and/or outer wall is configured to not restrain expandable motion of the other wall during expansion and contraction of the expandable bellows.

A sixty-first embodiment can include the pump of any one of the thirty-ninth to sixtieth embodiments, further comprising one or more annulus sensor disposed in proximity to the port.

A sixty-second embodiment can include the pump of the sixty-first embodiment, wherein the one or more annulus sensor comprises a fluid sensor (e.g. configured to detect the presence of fluid) and/or a contamination sensor (e.g. configured to detect contamination, solids/particles, and/or fluid other than drive fluid).

A sixty-third embodiment can include the pump of any one of the sixty-first to sixty-second embodiments, wherein the control system uses data from the one or more annulus sensor and data from the one or more sensor configured to measure strain and/or pressure at one or more location in the pump to evaluate health of the pump and to determine an action responsive to the evaluation (e.g. correlating data and/or using one to verify the other and/or evaluating additional issues with the pump).

A sixty-fourth embodiment can include the pump of any one of the thirty-ninth to sixty-third embodiments, wherein the inner wall and the outer wall are formed of similar material.

A sixty-fifth embodiment can include the pump of any one of the thirty-ninth to sixty-third embodiments, wherein a first one of the inner wall and the outer wall is formed of metal having an accordion-like configuration, and a second one of the inner wall and the outer wall is formed of an elastomeric material.

A sixty-sixth embodiment can include the pump of any one of the sixty-first to sixty-fifth embodiments, wherein the control system is configured to receive data from the one or more annulus sensor, compare the data to a corresponding threshold, and responsive to the data exceeding the threshold, initiate an action.

A sixty-seventh embodiment can include the pump of any one of the thirty-ninth to sixty-sixth embodiments, wherein the control system is configured to initiate an action in response to detecting a leak.

A sixty-eighth embodiment can include the pump of the sixty-seventh embodiment, wherein the action comprises sending an alert (e.g. with visual and/or audio display, for example regarding replacement of one or more valve) and/or stopping pumping of treatment fluid (e.g. shutting down the driver and/or preventing movement of the bellows and/or the piston/plunger) and/or automatically adjusting drive fluid between the bellows and the piston using a make-up system and/or venting a chamber of the pump (e.g. by opening a suction valve) and/or isolating the bellows from the make-up system.

In a sixty-ninth embodiment, a method of monitoring health of a bellows pump (e.g. while introducing treatment fluid into a well) can comprise: receiving (e.g. at a control system) strain data associate with the bellows pump (e.g. strain data for the fluid end housing and/or strain data for the power end housing); detecting valve leakage in the bellows pump based on the strain data; and responsive to detecting valve leakage, initiating action (e.g. by a controller), wherein leakage in a discharge valve of the bellows pump is detected based on (time for) strain decay from peak exceeding a first threshold, and leakage in a suction valve of the bellows pump is detected based on (time for) strain rise to peak exceeding a second threshold, and wherein the bellows pump comprises an expandable double-walled bellows.

A seventieth embodiment can include the method of the sixty-ninth embodiment, further comprising detecting strain in the bellows pump (e.g. at the fluid end and/or at the power end) (e.g. using one or more sensor—e.g. strain gauge) and sending strain data to the control system.

A seventy-first embodiment can include the method of any one of the sixty-ninth to seventieth embodiments, further comprising pumping treatment fluid downhole in a well using the bellows pump.

A seventy-second embodiment can include the method of any one of the sixty-ninth to seventy-first embodiments, further comprising receiving (e.g. at the control system) position data associate with the bellows pump (e.g. position data for the bellows and/or position data for the piston), and correlating the position data and the strain data.

A seventy-third embodiment can include the method of the seventy-second embodiment, wherein the position data comprises data for both the bellows and the piston, further comprising monitoring bellows health based on the amount of sync between the position of the bellows and the position of the piston (e.g, wherein out-of-sync movement is detected based on difference between the position of the bellows and the position of the piston (e.g. rod and/or head) extending beyond (e.g. +/−) a threshold range).

A seventy-fourth embodiment can include the method of any one of the sixty-ninth to seventy-third embodiments, further comprising receiving (e.g. at the control system) pressure data associated with the bellows pump (e.g. pressure data for the chamber of the fluid end of the pump and/or pressure data for the bore of the power end of the pump), and correlating the pressure data with the strain data.

A seventy-fifth embodiment can include the method of any one of the sixty-ninth to seventy-fourth embodiments, further comprising detecting fluid in an annulus of the expandable double-walled bellows, wherein detecting fluid comprises visually inspecting a weep hole in fluid communication with the annulus or detecting via one or more annulus sensor in proximity to a port in fluid communication with the annulus.

A seventy-sixth embodiment can include the method of the seventy-fifth embodiment, further comprising comparing detected fluid to a corresponding threshold, and taking action responsive to the detected fluid exceeding the corresponding threshold.

A seventy-seventh embodiment can include the method of any one of the seventy-fifth to seventy-sixth embodiments, wherein responsive to detecting fluid, determining whether the detected fluid is drive fluid or treatment fluid.

A seventy-eighth embodiment can include the method of any one of the sixty-ninth to seventy-seventh embodiments, wherein the control system evaluates both the strain data and the fluid detection data to determine the action to initiate and/or the action comprises sending an alert (e.g. with visual and/or audio display) and/or stopping pumping of treatment fluid (e.g. shutting down the driver and/or preventing movement of the bellows and/or the piston/plunger) and/or using a make-up system to introduce or remove drive fluid between the piston and the bellows to provide synchronous movement of the bellows with the piston and/or venting a chamber of the pump (e.g. opening a suction valve) and/or isolating the make-up system from the bellows.

In a seventy-ninth embodiment, a pump configured to introduce treatment fluid into a well can comprise: a power end; a fluid end having a fluid end housing with a chamber in fluid communication with a suction valve and a discharge valve; an expandable bellows configured to extend into the chamber of the fluid end based on application of drive fluid therein by the power end; one or more sensor configured to measure strain and/or pressure at one or more location in the pump; a venting mechanism configured to vent the chamber of treatment fluid; and a control system configured to receive data from the one or more sensor and to monitor for valve health.

An eightieth embodiment can include the pump of the seventy-ninth embodiment, wherein the one or more sensor comprises one or more strain gauge.

An eighty-first embodiment can include the pump of the eightieth embodiment, wherein the one or more strain gauge is disposed in the fluid end and/or on (e.g. configured to measure strain in) the fluid end housing (e.g. in the chamber wall, a slurry valve housing, a suction valve housing, a discharge valve housing, a bellows housing, and/or a manifold member between the valve housing and the bellows) and/or the power end housing (e.g. with respect to the first portion of the bore and/or the second portion of the bore).

An eighty-second embodiment can include the pump of any one of the seventy-ninth to eighty-first embodiments, wherein strain decay from peak is monitored (e.g. by the control system) as an indicator of discharge valve health/leakage.

An eighty-third embodiment can include the pump of any one of the seventy-ninth to eighty-second embodiments, wherein an amount of time for strain decay from peak exceeding a first threshold is indicative of a discharge valve leak.

An eighty-fourth embodiment can include the pump of any one of the seventy-ninth to eighty-third embodiments, wherein strain rise to peak is monitored (e.g. by the control system) (as an indicator of suction valve health/leakage).

An eighty-fifth embodiment can include the pump of any one of the seventy-ninth to eighty-fourth embodiments, wherein an amount of time for strain rise to peak exceeding a second threshold is indicative of a suction valve leak.

An eighty-sixth embodiment can include the pump of any one of the eightieth to eighty-fifth embodiments, wherein the one or more strain gauge comprises a plurality of strain gauges (for example with a first strain gauge disposed on the fluid end and a second strain gauge disposed on the power end), and wherein offset between the first strain gauge and the second strain gauge is monitored (e.g. by the control system).

An eighty-seventh embodiment can include the pump of any one of the seventy-ninth to eighty-sixth embodiments, further comprising one or more position sensor, wherein the controller is configured to correlate data from the one or more position sensor with data from the one or more strain gauge (e.g. overlay the position chart and the strain chart and/or use position data to check/match-up timing with the strain data).

An eighty-eighth embodiment can include the pump of the eighty-seventh embodiment, wherein the control system uses data from the one or more position sensor to interpret the data from the one or more strain gauge.

An eighty-ninth embodiment can include the pump of any one of the eighty-seventh to eighty-eighth embodiments, wherein offset between the data/chart of the one or more position sensor and the one or more strain gauge is monitored (e.g. by the control system).

A ninetieth embodiment can include the pump of any one of the eighty-seventh to eighty-ninth embodiments, wherein the one or more position sensor is disposed on the fluid end (e.g. within the chamber) (e.g. configured to detect position of the bellows in the chamber) and/or the power end (e.g. in the first portion of the bore and/or the second portion of the bore) (e.g. configured to detect the position of the piston—e.g. the head and/or the rod of the piston).

A ninety-first embodiment can include the pump of any one of the eighty-seventh to ninetieth embodiments, wherein the one or more position sensor comprises two position sensors, wherein a first of the two position sensors is configured to detect the position of the bellows and a second of the two position sensors is configured to detect the position of the piston—e.g. head and/or rod).

A ninety-second embodiment can include the pump of the ninety-first embodiment, wherein the control system is further configured to receive data from the two position sensors and to monitor for bellows health (e.g. sync).

A ninety-third embodiment can include the pump of any one of the ninetieth to ninety-second embodiments, wherein a difference (e.g. offset) between the position of the bellows (e.g. with respect to the chamber) and the position of the piston (e.g. the rod and/or head) (e.g. determining the position of the bellows relative to the position of the piston) is monitored (e.g. by the control system) as an indicator of bellows health.

A ninety-fourth embodiment can include the pump of the ninety-third embodiment, wherein the difference (e.g. offset) between the position of the bellows and the position of the piston (e.g. the rod/head) extending beyond (e.g. +/−) a threshold range is indicative of potential leakage with respect to the bellows (e.g. which could impact whether the bellows is in sync with the piston/plunger) and/or the bellows being out of sync with the piston/plunger.

A ninety-fifth embodiment can include the pump of any one of the eightieth to ninety-fourth embodiments, wherein one or more pressure sensor may be used in place of or in conjunction with the one or more strain gauge (e.g. with a first pressure sensor configured to detect pressure in the chamber of the fluid end and/or a second pressure sensor configured to detect pressure in the power end (e.g. the first portion of the bore and/or the second portion of the bore)), wherein an amount of time for pressure decay from peak exceeding a first threshold is indicative of a discharge valve leak, and wherein an amount of time for pressure rise to peak exceeding a second threshold is indicative of a suction valve leak.

A ninety-sixth embodiment can include the pump of any one of the seventy-ninth to ninety-fifth embodiments, wherein the venting mechanism is configured to vent the chamber responsive to pump stoppage.

A ninety-seventh embodiment can include the pump of the ninety-sixth embodiment, wherein venting the chamber comprises venting the chamber for the duration of pump stoppage.

A ninety-eighth embodiment can include the pump of any one of the seventy-ninth to ninety-seventh embodiments, wherein: the suction valve comprises a one-way check valve having a poppet and a seat; the poppet is biased against the seat to a closed position but is configured so that, when biasing force is overcome, the poppet lifts off the seat to an open position; and the venting mechanism is configured to force the suction valve to the open position, responsive to pump stoppage, and to hold the suction valve in the open position for the duration of pump stoppage.

A ninety-ninth embodiment can include the pump of any one of the seventy-ninth to ninety-eighth embodiments, further comprising a control system, wherein responsive to receiving a stop command, the control system is configured to stop the pump and to operate the venting mechanism to vent the chamber.

A one hundredth embodiment can include the pump of any one of the seventy-ninth to ninety-ninth embodiments, wherein the control system comprises one or more sensor configured to detect one or more parameter of the system at one or more location in the system (and in some embodiments, the one or more sensor may comprise or consist of the one or more strain gauge, the one or more pressure sensor, and/or the one or more position sensor discussed above), wherein the control system is configured to receive data from the one or more sensor, to evaluate the sensor data to detect pump stoppage, and responsive to detecting pump stoppage, to operate the venting mechanism to vent the chamber.

A one hundred first embodiment can include the pump of any one of the seventy-ninth to one hundredth embodiments, wherein responsive to restarting of the pump, the control system is configured to operate the venting mechanism to stop venting the chamber (e.g. to close the suction valve).

A one hundred second embodiment can include the pump of any one of the seventy-ninth to one hundred first embodiments, wherein the venting mechanism is configured to vent the chamber responsive to detection of leakage of treatment fluid into the chamber through the discharge valve (e.g. based on strain decay from peak evaluation, for example based on strain gauge data).

A one hundred third embodiment can include the pump of any one of the seventy-ninth to one hundred second embodiments, wherein the control system is configured to evaluate the sensor data (e.g. the strain gauge data) to detect a leak of treatment fluid into the chamber through the discharge valve (e.g. when strain decay from peak exceeds a threshold), and responsive to detecting a leak, to operate the venting mechanism to vent the chamber.

A one hundred fourth embodiment can include the pump of any one of the seventy-ninth to one hundred third embodiments, wherein venting the chamber comprises holding the suction valve open, even while the pump runs.

A one hundred fifth embodiment can include the pump of any one of the seventy-ninth to one hundred fourth embodiments, wherein: the bellows pump comprises a dual-bellows pump further comprising a second fluid end having a second chamber, a second suction valve, a second discharge valve, and a second expandable bellows disposed in the second chamber and in fluid communication with the power end; the power end is configured to reciprocally expand and contract the both the first bellows and the second bellows based on movement of drive fluid; and the venting mechanism is configured to vent the chamber responsive to detection of leakage of fluid into the chamber through the discharge valve, and wherein venting the chamber comprises holding the suction valve open, even while the dual bellows pump continues to run.

A one hundred sixth embodiment can include the pump of any one of the seventy-ninth to one hundred fifth embodiments, further comprising one or more additional pump and a common driver element, wherein: the common driver element is configured to drive the power end of the bellows pump and the one or more additional pumps; the bellows pump and the one or more additional pumps are configured to jointly introduce treatment fluid to the well; and wherein venting the chamber comprises holding the suction valve open, even while the one or more additional pump continues to introduce treatment fluid into the well.

A one hundred seventh embodiment can include the pump of any one of the seventy-ninth to one hundred sixth embodiments, wherein the suction valve is in fluid communication with a source of treatment fluid.

A one hundred eighth embodiment can include the pump of any one of the eighty-second to one hundred seventh embodiments, wherein responsive to detecting a discharge valve leak (e.g. based on time for strain decay from peak exceeding the first threshold), the control system is configured to stop the pump and/or to operate the venting mechanism to vent the chamber.

In a one hundred ninth embodiment, a method of monitoring health of a bellows pump (e.g. while introducing treatment fluid into a well) can comprise: receiving (e.g. at a control system) strain data associate with the bellows pump (e.g. strain data for the fluid end housing and/or strain data for the power end housing); detecting valve leakage in the bellows pump based on the strain data; and responsive to detecting valve leakage, initiating action (e.g. by a controller), wherein leakage in a discharge valve of the bellows pump is detected based on (time for) strain decay from peak exceeding a first threshold, and/or leakage in a suction valve of the bellows pump is detected based on (time for) strain rise to peak exceeding a second threshold.

A one hundred tenth embodiment can include the method of any one of the one hundred ninth embodiment, further comprising detecting strain in the bellows pump (e.g. at the fluid end and/or at the power end) (e.g. using one or more sensor—e.g. strain gauge) and sending strain data to the control system.

A one hundred eleventh embodiment can include the method of any one of the one hundred ninth to one hundred tenth embodiments, further comprising receiving (e.g. at the control system) position data associate with the bellows pump (e.g. position data for the bellows and/or position data for the piston), and correlating the position data and the strain data.

A one hundred twelfth embodiment can include the method of the one hundred eleventh embodiment, wherein the position data comprises data for both the bellows and the piston, further comprising monitoring bellows health based on the amount of sync between the position of the bellows and the position of the piston (e.g, wherein out-of-sync movement is detected based on difference between the position of the bellows and the position of the piston (e.g. rod and/or head) extending beyond (e.g. +/−) a threshold range).

A one hundred thirteenth embodiment can include the method of any one of the one hundred ninth to one hundred twelfth embodiments, further comprising receiving (e.g. at the control system) pressure data associated with the bellows pump (e.g. pressure data for the chamber of the fluid end of the pump and/or pressure data for the bore of the power end of the pump), and correlating the pressure data with the strain data.

A one hundred fourteenth embodiment can include the method of any one of the seventy-fifth to seventy-eighth or one hundred ninth to one hundred thirteenth embodiments, further comprising pumping treatment fluid into the well using the bellows pump having a chamber with a bellows disposed therein; and responsive to pump stoppage, venting fluid from the chamber (e.g. using a venting mechanism).

A one hundred fifteenth embodiment can include the method of the one hundred fourteenth embodiment, wherein venting fluid from the chamber comprises venting the chamber for the duration of pump stoppage.

A one hundred sixteenth embodiment can include the method of any one of the one hundred fourteenth to one hundred fifteenth embodiments, wherein venting fluid from the chamber comprises opening a suction valve in fluid communication with the chamber, and holding the suction valve open for the duration of pump stoppage.

A one hundred seventeenth embodiment can include the method of the one hundred sixteenth embodiment, further comprising releasing the suction valve responsive to re-starting the pump.

A one hundred eighteenth embodiment can include the method of any one of the one hundred fourteenth to one hundred seventeenth embodiments, further comprising: responsive to receiving, at the control system, sensor data from one or more sensor configured to detect one or more parameter at one or more location of the bellows pump (and in some embodiments, the one or more sensor may comprise or consist of the one or more strain gauge, the one or more pressure sensor, and/or the one or more position sensor discussed above), detecting pump stoppage based on the sensor data; and responsive to detecting pump stoppage, opening the suction valve and holding the suction valve open for the duration of pump stoppage.

A one hundred nineteenth embodiment can include the method of any one of the one hundred fourteenth to one hundred eighteenth embodiments, further comprising, responsive to receiving, at a control system, a stop command, opening the suction valve and holding the suction valve open for the duration of pump stoppage.

A one hundred twentieth embodiment can include the method of any one of the seventy-fifth to seventy-eighth or one hundred ninth to one hundred nineteenth embodiments, comprising: pumping treatment fluid into the well using the bellows pump having a chamber with a bellows disposed therein; responsive to receiving, at a control system, sensor data from one or more sensor configured to detect one or more parameter of the bellows pump system (and in some embodiments, the one or more sensor may comprise or consist of the one or more strain gauge, the one or more pressure sensor, and/or the one or more position sensor discussed above), detecting a leak based on the sensor data; and responsive to detecting a leak, venting fluid from the chamber.

A one hundred twenty-first embodiment can include the method of the one hundred twentieth embodiment, wherein detecting a leak is based on time for strain decay from peak exceeding the first threshold.

A one hundred twenty-second embodiment can include the method of any one of the one hundred twentieth to one hundred twenty-first embodiments, wherein responsive to detecting a discharge valve leak (e.g. based on time for strain decay from peak exceeding the first threshold), the control system is configured to stop the pump and/or to operate the venting mechanism to vent the chamber A one hundred twenty-third embodiment can include the method of any one of the one hundred twentieth to one hundred twenty-second embodiments, wherein venting the fluid occurs even while the pump is running.

In a one hundred twenty-fourth embodiment, a system for pumping treatment fluid into a well can comprise: a source of treatment fluid; a bellows pump in fluid communication with the source of treatment fluid and configured to pump treatment fluid into the well, comprising: a power end comprising a piston disposed within a bore; a fluid end having a fluid end housing with a chamber in fluid communication with a suction valve and a discharge valve (e.g. with the suction valve configured for introduction of treatment fluid into the chamber from the source of treatment fluid, and the discharge valve configured for introduction of treatment fluid from the chamber into the well); and an expandable bellows, wherein the power end is configured to reciprocally expand and contract the bellows within the chamber based on movement of fluid by the piston; a make-up system configured to maintain a controlled volume of fluid between the piston and the bellows; and a control system having one or more sensor configured to detect one or more parameters of the system; wherein: the make-up system comprises a make-up fluid source fluidly coupled to the bellows and to at least one other component of the system; the one or more sensor comprises one or more sensor configured to measure strain and/or pressure at one or more location in the pump; and the control system is configured to receive data from the one or more sensor, to evaluate the sensor data to detect a leak, and responsive to detecting a leak, to fluidly isolate the make-up system from the bellows.

A one hundred twenty-fifth embodiment can include the system of the one hundred twenty-fourth embodiment, wherein the control system is configured to evaluate the sensor data to determine whether the bellows and piston are out of sync, and responsive to determining that the bellows and piston are out of sync, using the make-up system to adjust the amount of fluid between the piston and the bellows to return the piston and bellows to sync.

A one hundred twenty-sixth embodiment can include the system of any one of the one hundred twenty-fourth to one hundred twenty-fifth embodiments, wherein the one or more sensor comprises one or more strain gauge.

A one hundred twenty-seventh embodiment can include the system of the one hundred twenty-sixth embodiment, wherein the one or more strain gauge is disposed in the fluid end and/or on (e.g. configured to measure strain in) the fluid end housing (e.g. in the chamber wall, a slurry valve housing, a suction valve housing, a discharge valve housing, a bellows housing, and/or a manifold member between the valve housing and the bellows) and/or the power end housing (e.g. with respect to the first portion of the bore and/or the second portion of the bore).

A one hundred twenty-eight embodiment can include the system of any one of the one hundred twenty-sixth to one hundred twenty-seventh embodiments, wherein strain decay from peak is monitored (e.g. by the control system) as an indicator of discharge valve health/leakage.

A one hundred twenty-ninth embodiment can include the system of any one of the one hundred twenty-sixth to one hundred twenty-eighth embodiments, wherein an amount of time for strain decay from peak exceeding a first threshold is indicative of a discharge valve leak.

A one hundred thirtieth embodiment can include the system of any one of the one hundred twenty-sixth to one hundred twenty-ninth embodiments, wherein strain rise to peak is monitored (e.g. by the control system) as an indicator of suction valve health/leakage.

A one hundred thirty-first embodiment can include the system of any one of the one hundred twenty-sixth to one hundred thirtieth embodiments, wherein an amount of time for strain rise to peak exceeding a second threshold is indicative of a suction valve leak.

A one hundred thirty-second embodiment can include the system of any one of the one hundred twenty-sixth to one hundred thirty-first embodiments, wherein the one or more strain gauge comprises a plurality of strain gauges (for example with a first strain gauge disposed on the fluid end and a second strain gauge disposed on the power end), and wherein offset between the first strain gauge and the second strain gauge is monitored (e.g. by the control system).

A one hundred thirty-third embodiment can include the system of any one of the one hundred twenty-sixth to one hundred thirty-second embodiments, further comprising one or more position sensor, wherein the controller is configured to correlate data from the one or more position sensor with data from the one or more strain gauge (e.g. overlay the position chart and the strain chart and/or use position data to check/match-up timing with the strain data).

A one hundred thirty-fourth embodiment can include the system of the one hundred thirty-third embodiment, wherein the control system uses data from the one or more position sensor to interpret the data from the one or more strain gauge.

A one hundred thirty-fifth embodiment can include the system of any one of the one hundred thirty-third to one hundred thirty-fourth embodiments, wherein offset between the data/chart of the one or more position sensor and the one or more strain gauge is monitored (e.g. by the control system).

A one hundred thirty-sixth embodiment can include the system of any one of the one hundred thirty-third to one hundred thirty-fifth embodiments, wherein the one or more position sensor is disposed on the fluid end (e.g. within the chamber) (e.g. configured to detect position of the bellows in the chamber) and/or the power end (e.g. in the first portion of the bore and/or the second portion of the bore) (e.g. configured to detect the position of the piston—e.g. the head and/or the rod of the piston).

A one hundred thirty-seventh embodiment can include the system of any one of the one hundred thirty-third to one hundred thirty-sixth embodiments, wherein the one or more position sensor comprises two position sensors, wherein a first of the two position sensors is configured to detect the position of the bellows and a second of the two position sensors is configured to detect the position of the piston—e.g. head and/or rod).

A one hundred thirty-eighth embodiment can include the system of the one hundred thirty-seventh embodiment, wherein the control system is further configured to receive data from the two position sensors and to monitor for bellows health (e.g. sync).

A one hundred thirty-ninth embodiment can include the system of any one of the one hundred thirty-third to one hundred thirty-eighth embodiments, wherein a difference (e.g. offset) between the position of the bellows (e.g. with respect to the chamber) and the position of the piston (e.g. the rod and/or head) (e.g. determining the position of the bellows relative to the position of the piston) is monitored (e.g. by the control system) as an indicator of bellows health.

A one hundred fortieth embodiment can include the system of the one hundred thirty-ninth embodiment, wherein the difference (e.g. offset) between the position of the bellows and the position of the piston (e.g. the rod/head) extending beyond (e.g. +/−) a threshold range is indicative of potential leakage with respect to the bellows (e.g. which could impact whether the bellows is in sync with the piston/plunger) and/or the bellows being out of sync with the piston/plunger.

A one hundred forty-first embodiment can include the system of any one of the one hundred twenty-sixth to one hundred fortieth embodiments, wherein one or more pressure sensor may be used in place of or in conjunction with the one or more strain gauge (e.g. with a first pressure sensor configured to detect pressure in the chamber of the fluid end and/or a second pressure sensor configured to detect pressure in the power end (e.g. the first portion of the bore and/or the second portion of the bore)), wherein an amount of time for pressure decay from peak exceeding a first threshold is indicative of a discharge valve leak, and wherein an amount of time for pressure rise to peak exceeding a second threshold is indicative of a suction valve leak.

A one hundred forty-second embodiment can include the system of any one of the one hundred twenty-sixth to one hundred forty-first embodiments, wherein detecting a leak comprises detecting a leak of the discharge valve (e.g. using the strain gauge data, for example based on strain decay from peak exceeding the first threshold).

A one hundred forty-third embodiment can include the system of any one of the one hundred twenty-fourth to one hundred forty-second embodiments, wherein the one or more sensor comprises one or more sensor configured to detect one or more of the following parameters at one or more location within the system: pressure, temperature, flow rate, viscosity, contamination, and/or position of one or more component of the system.

A one hundred forty-fourth embodiment can include the system of any one of the one hundred twenty-fourth to one hundred forty-third embodiments, wherein the one or more sensor comprise a sensor configured to monitor one or more parameter within the chamber.

A one hundred forty-fifth embodiment can include the system of any one of the one hundred twenty-fourth to one hundred forty-fourth embodiments, wherein the one or more sensor comprises a sensor configured to monitor one or more parameter in the bellows.

A one hundred forty-sixth embodiment can include the system of any one of the one hundred twenty-fourth to one hundred forty-fifth embodiments, wherein the one or more sensor comprises a sensor configured to monitor one or more parameter of the make-up fluid system.

A one hundred forty-seventh embodiment can include the system of any one of the one hundred twenty-fourth to one hundred forty-sixth embodiments, wherein the one or more sensor comprises a sensor configured to monitor one or more parameter relating to the power end.

A one hundred forty-eighth embodiment can include the system of any one of the one hundred twenty-fourth to one hundred forty-seventh embodiments, wherein the control system detects a leak based on the sensor data by comparing the sensor data to a corresponding threshold.

A one hundred forty-ninth embodiment can include the system of any one of the one hundred twenty-fourth to one hundred forty-eighth embodiments, wherein the one or more sensor detects position of the bellows relative to position of the piston.

A one hundred fiftieth embodiment can include the system of any one of the one hundred twenty-fourth to one hundred forty-ninth embodiments, wherein the one or more sensor detects pressure in the chamber relative to pressure in the bellows A one hundred fifty-first embodiment can include the system of any one of the one hundred twenty-fourth to one hundred fiftieth embodiments, wherein the one or more sensor detects flow rate of make-up/drive fluid through the (e.g. one or more) make-up port (e.g. in and out) of the bellows.

A one hundred fifty-second embodiment can include the system of any one of the one hundred twenty-fourth to one hundred fifty-first embodiments, wherein the one or more sensor detects contamination (e.g. particle count) within the bellows.

A one hundred fifty-third embodiment can include the system of any one of the one hundred twenty-fourth to one hundred fifty-second embodiments, wherein the one or more sensor detects viscosity of fluid in the bellows.

A one hundred fifty-fourth embodiment can include the system of any one of the one hundred twenty-fourth to one hundred fifty-third embodiments, wherein the one or more sensor detects temperature of make-up/drive fluid within the bellows (e.g. compared to expected temperature and/or compared to temperature in the chamber).

A one hundred fifty-fifth embodiment can include the system of any one of the one hundred twenty-fourth to one hundred fifty-fourth embodiments, wherein the make-up fluid is drive fluid (e.g. hydraulic fluid, such as hydraulic oil, which may be the same fluid used as drive fluid for the pump).

A one hundred fifty-sixth embodiment can include the system of any one of the one hundred twenty-fourth to one hundred fifty-fifth embodiments, wherein the control system uses the strain gauge data and other sensor data (e.g. data from a plurality of different sensors) to detect a leak (e.g. correlating data and/or using one to verify another).

A one hundred fifty-seventh embodiment can include the system of any one of the one hundred twenty-fourth to one hundred fifty-sixth embodiments, wherein the make-up system further comprises a make-up port in fluid communication with the bellows and the make-up fluid source, at least one make-up valve configured to control (e.g. open or close or partially close—e.g. to control speed of flow) fluid flow between the make-up port/bellows and the make-up fluid source, and/or at least one make-up pump configured to pump fluid between the bellows and the make-up fluid source.

A one hundred fifty-eighth embodiment can include the system of the one hundred fifty-seventh embodiment, wherein the make-up fluid source is in fluid communication with the bellows when the make-up valve is open, and the make-up fluid source is fluidly isolated from the bellows when the make-up valve is closed.

A one hundred fifty-ninth embodiment can include the system of any one of the one hundred fifty-seventh to one hundred fifty-eighth embodiments, wherein fluidly isolating the make-up system from the bellows comprises closing the make-up valve and/or shutting off/deactivating the make-up pump (e.g. automatically by the control system—e.g. the control system instructs a valve mechanism/actuator to close the make-up valve and/or to shut off the pump).

A one hundred sixtieth embodiment can include the system of any one of the one hundred twenty-fourth to one hundred fifty-ninth embodiments, wherein: the piston comprises a head and a rod, with the rod extending from the head towards the bellows; the power end further comprises a first seal configured to seal the head with respect to a first portion of the bore and a second seal configured to seal the rod with respect to a second portion of the bore; and the second seal is configured for exposure to abrasive and/or corrosive treatment fluid, despite being shielded from the treatment fluid in the chamber by the bellows.

A one hundred sixty-first embodiment can include the system of any one of the one hundred twenty-fourth to one hundred sixtieth embodiments, wherein the at least one other component of the system comprises: one or more additional bellows, one or more additional pump, an intensifier, a head of the piston of the pump, a hydraulic circuit configured to reciprocally move the piston within a bore of the power end, and/or combination thereof.

A one hundred sixty-second embodiment can include the system of any one of the one hundred twenty-fourth to one hundred sixty-first embodiments, wherein the at least one other component of the system comprises a second bellows, wherein the piston is configured to reciprocally expand and contract both the first and second bellows, wherein the make-up fluid system is fluidly coupled to the second bellows, and wherein fluidly isolating the first bellows from the make-up system also fluidly uncouples the second bellows from the first bellows.

In a one hundred sixty-third embodiment, a method for protecting a bellows pump system during introduction of treatment fluid into a well can comprise: pumping treatment fluid into the well using the bellows pump system, wherein the bellows pump system comprises a pump having a bellows and a piston, a control system, and a make-up system configured to maintain a controlled volume of drive fluid between the piston and the bellows, and wherein the make-up system is fluidly coupled to the bellows and to at least one additional component of the system; responsive to receiving, at the control system, sensor data from one or more sensor configured to detect one or more parameter at one or more location of the bellows pump system, detecting a leak in the bellows based on the sensor data; and responsive to detecting a leak, fluidly isolating the bellows from a fluid source of the make-up system, thereby fluidly uncoupling the at least one additional component of the system from the bellows.

A one hundred sixty-fourth embodiment can include the method of the one hundred sixty-third embodiment, wherein detecting a leak comprises comparing, using the control system, the sensor data to a corresponding threshold.

A one hundred sixty-fifth embodiment can include the method of the any one of the one hundred sixty-third to one hundred sixty-fourth embodiments, wherein fluidly isolating the bellows comprises closing a make-up valve of the make-up system and/or shutting off a make-up pump of the make-up system.

A one hundred sixty-sixth embodiment can include the method of any one of the one hundred sixty-third to one hundred sixty-fifth embodiments, further comprising evaluating the sensor data to determine whether the bellows and piston are out of sync, and responsive to determining that the bellows and piston are out of sync, using the make-up system to adjust the amount of drive fluid between the piston and the bellows to return the piston and bellows to sync.

A one hundred sixty-seventh embodiment can include the method of any one of the one hundred sixty-third to one hundred sixty-sixth embodiments, wherein: the pump further comprises a seal disposed between the piston and a bore in which the piston is disposed which is configured to maintain the controlled volume of fluid between the piston and the bellows, and the seal is configured for an abrasive and/or corrosive environment even though shielded from exposure to treatment fluid by the bellows.

A one hundred sixty-eighth embodiment can include the method of the one hundred sixty-seventh embodiment, further comprising continuing to pump treatment fluid into the well using the bellows pump while the bellows pump is isolated.

A one hundred sixty-ninth embodiment can include the method of any one of the one hundred sixty-fifth to one hundred sixty-eighth embodiments, wherein the pump further comprises a hydraulic circuit configured to reciprocally drive the piston in a power end bore, wherein the hydraulic circuit is fluidly coupled to the fluid source of the make-up system, and wherein closing the make-up valve fluidly isolates the bellows from the hydraulic circuit.

A one hundred seventieth embodiment can include the method of any one of the one hundred sixty-fifth to one hundred sixty-ninth embodiments, further comprising pumping treatment fluid into the well using a second bellows, wherein closing the make-up valve isolates the first bellows from the second bellows.

A one hundred seventy-first embodiment can include the method of any one of the one hundred sixty-third to one hundred seventieth embodiments, further comprising: detecting strain in the bellows pump using one or more strain gauge (e.g. which may be part of the one or more sensor) and sending strain data to the control system; receiving, at the control system, the strain data; detecting valve leakage in the bellows pump based on the strain data; and responsive to detecting valve leakage, initiating an action.

A one hundred seventy-second embodiment can include the method of the one hundred seventy-first embodiment, wherein leakage in a discharge valve of the bellows pump is detected based on strain decay from peak exceeding a first threshold and/or leakage in a suction valve of the bellows pump is detected based on strain rise to peak exceeding a second threshold.

A one hundred seventy-third embodiment can include the method of any one of the one hundred seventy-first to one hundred seventy-second embodiments, wherein the action comprises sending an alert and/or stopping pumping of treatment fluid and/or correlating strain data with data from the one or more sensor.

A one hundred seventy-fourth embodiment can include the method of any one of the one hundred seventy-first to one hundred seventy-third embodiments, further comprising receiving, at the control system, position data associate with the bellows pump, and correlating the position data and the strain data.

A one hundred seventy-fifth embodiment can include the method of the one hundred seventy-fourth embodiment, wherein the position data comprises data for both position of a bellows and position of a piston in fluid communication with the bellows, further comprising monitoring bellows health based on the amount of sync between the position of the bellows and the position of the piston.

A one hundred seventy-sixth embodiment can include the method of any one of the one hundred seventy-first to one hundred seventy-fifth embodiments, further comprising receiving, at the control system, pressure data associated with the bellows pump, and correlating the pressure data with the strain data.

In a one hundred seventy-seventh embodiment, a system for pumping treatment fluid into a well can comprise: a bellows pump configured to pump treatment fluid into the well, comprising: a power end comprising a piston; a fluid end having a chamber; and an expandable double-walled bellows, wherein the power end is configured to reciprocally expand and contract the bellows within the chamber based on movement of fluid by the piston; a make-up system configured to maintain a controlled volume of fluid between the piston and the bellows; and a control system having one or more sensor configured to detect one or more parameters of the system; wherein: the expandable double-walled bellows comprises an inner wall, enclosing an inner volume, and an outer wall encompassing the inner wall; an annulus is disposed between the inner wall and the outer wall of the bellows; the annulus is in fluid communication with a port; the one or more sensor comprises one or more annulus sensor disposed in proximity to the port (e.g. configured to detect a leak of fluid, for example caught in the annulus); the make-up system comprises a make-up fluid source fluidly coupled to the bellows and to at least one additional component of the system; and the control system is configured to receive data from the one or more sensor, to evaluate the sensor data to detect a leak, and responsive to detecting a leak, to fluidly isolate the make-up system (e.g. the make-up fluid source) from the bellows.

A one hundred seventy-eighth embodiment can include the system of the one hundred seventy-seventh embodiment, wherein the inner wall is sealingly coupled to an interior surface of the outer wall in proximity to the port, but the inner wall and the outer wall are substantially uncoupled within the chamber.

A one hundred seventy-ninth embodiment can include the system of any one of the one hundred seventy-seventh to one hundred seventy-eighth embodiments, wherein the annulus is configured to provide a sealed annular space between the inner wall and the outer wall of the bellows with no fluid communication out (e.g. no fluid communication with an external environment) except via the port.

A one hundred eightieth embodiment can include the system of any one of the one hundred seventy-seventh to one hundred seventy-ninth embodiments, wherein there is fluid connection/communication between any portion of the annulus and the port.

A one hundred eighty-first embodiment can include the system of any one of the one hundred seventy-seventh to one hundred eightieth embodiments, wherein the inner and outer walls are substantially uncoupled (e.g. not coupled together) within the chamber (e.g. the portions of the inner wall and the outer wall disposed in the chamber are substantially uncoupled) and/or the annulus comprises an open space between the entirety (e.g. the entire portion) of the inner wall and the outer wall which is disposed in the chamber (e.g. in some embodiments, the inner wall may be loose or slip fit within the outer wall).

A one hundred eighty-second embodiment can include the system of any one of the one hundred seventy-seventh to one hundred eighty-first embodiments, wherein the inner wall and/or outer wall is configured to not restrain expandable motion of the other wall during expansion and contraction of the expandable bellows (e.g. the walls do not constrain each other's expansion and contraction motions, for example the inner wall does not restrict the movement of the outer wall).

A one hundred eighty-third embodiment can include the system of any one of the one hundred seventy-seventh to one hundred eighty-second embodiments, wherein the one or more annulus sensor comprises a fluid sensor in proximity to the port, configured to detect the presence of fluid (e.g. at the port and/or in the annulus).

A one hundred eighty-fourth embodiment can include the system of any one of the one hundred seventy-seventh to one hundred eighty-third embodiments, wherein the one or more annulus sensor comprises a contamination sensor in proximity to the port (e.g. configured to detect contaminants and/or non-drive fluid at the port and/or in the annulus).

A one hundred eighty-fifth embodiment can include the system of any one of the one hundred seventy-seventh to one hundred eighty-fourth embodiments, wherein the inner wall and the outer wall are formed of similar material.

A one hundred eighty-sixth embodiment can include the system of any one of the one hundred seventy-seventh to one hundred eighty-fourth embodiments, wherein a first one of the inner wall and the outer wall is formed of metal having an accordion-like configuration, and a second one of the inner wall and the outer wall is formed of an elastomeric material (e.g. the inner wall may be elastomeric, while the outer wall may be formed of metal and/or have an accordion-like configuration).

A one hundred eighty-seventh embodiment can include the system of any one of the one hundred seventy-seventh to one hundred eighty-sixth embodiments, wherein the control system is configured to receive data from the one or more annulus sensor, compare the data to a corresponding threshold, and responsive to the data exceeding the threshold, initiate an action.

A one hundred eighty-eighth embodiment can include the system of any one of the one hundred seventy-seventh to one hundred eighty-seventh embodiments, wherein the control system is configured to initiate an action in response to detecting a leak.

A one hundred eighty-ninth embodiment can include the system of any one of the one hundred eighty-seventh to one hundred eighty-eighth embodiments, wherein the action comprises sending an alert (e.g. with visual and/or audio display, for example regarding replacement of one or more valve) and/or stopping pumping of treatment fluid (e.g. shutting down the driver and/or preventing movement of the bellows and/or the piston/plunger) and/or automatically adjusting drive fluid between the bellows and the piston using a make-up system and/or fluidly isolate the make-up system from the bellows and/or venting the chamber of the pump (e.g. opening a suction valve).

A one hundred ninetieth embodiment can include the system of any one of the one hundred seventy-seventh to one hundred eighty-ninth embodiments, wherein the control system is further configured to evaluate the sensor data to determine whether the bellows and piston are out of sync, and responsive to determining that the bellows and piston are out of sync, to use the make-up system to adjust the amount of fluid between the piston and the bellows to return the piston and bellows to sync.

A one hundred ninety-first embodiment can include the system of any one of the one hundred seventy-seventh to one hundred ninetieth embodiments, wherein the at least one additional component of the system comprises: one or more additional pump, an intensifier, the power end of the pump, a hydraulic circuit configured to reciprocally move the piston within a bore of the power end, hydraulics, lube pumps, cylinders, bellows, pistons/plungers, packing, and/or combinations thereof.

A one hundred ninety-second embodiment can include the system of any one of the one hundred seventy-seventh to one hundred ninety-first embodiments, wherein the one or more sensor is configured to detect one or more of the following parameters at one or more location within the system: pressure, temperature, flow rate, viscosity, contamination, and/or position of one or more component of the system.

A one hundred ninety-third embodiment can include the system of any one of the one hundred seventy-seventh to one hundred ninety-second embodiments, wherein the one or more sensor comprise a sensor configured to monitor one or more parameter within the chamber, the bellows, the make-up fluid system and/or the power end.

A one hundred ninety-fourth embodiment can include the system of any one of the one hundred seventy-seventh to one hundred ninety-third embodiments, wherein the one or more sensor detects position of the bellows relative to position of the piston.

A one hundred ninety-fifth embodiment can include the system of any one of the one hundred seventy-seventh to one hundred ninety-fourth embodiments, wherein the one or more sensor detects pressure in the chamber relative to pressure in the bellows.

A one hundred ninety-sixth embodiment can include the system of any one of the one hundred seventy-seventh to one hundred ninety-fifth embodiments, wherein the one or more sensor detects flow rate of make-up/drive fluid through the (e.g. one or more) make-up port (e.g. in and out) of the bellows.

A one hundred ninety-seventh embodiment can include the system of any one of the one hundred seventy-seventh to one hundred ninety-sixth embodiments, wherein the one or more sensor detects contamination (e.g. particle count) within the bellows.

A one hundred ninety-eighth embodiment can include the system of any one of the one hundred seventy-seventh to one hundred ninety-seventh embodiments, wherein the one or more sensor detects viscosity of fluid in the bellows.

A one hundred ninety-ninth embodiment can include the system of any one of the one hundred seventy-seventh to one hundred ninety-eighth embodiments, wherein the one or more sensor detects temperature of make-up/drive fluid within the bellows (e.g. compared to expected temperature and/or compared to temperature in the chamber).

A two hundredth embodiment can include the system of any one of the one hundred seventy-seventh to one hundred ninety-ninth embodiments, wherein the control system detects a leak based on the sensor data by comparing the sensor data to a corresponding threshold.

A two hundred first embodiment can include the system of any one of the one hundred seventy-seventh to two hundredth embodiments, wherein the make-up fluid is drive fluid (e.g. hydraulic fluid, such as hydraulic oil, which may be the same fluid used as drive fluid for the pump).

A two hundred second embodiment can include the system of any one of the one hundred seventy-seventh to two hundred first embodiments, wherein the control system uses data from multiple sensors to detect a leak (e.g. the annulus sensor plus at least one other sensor) (e.g. which may be correlated and/or used for verification).

A two hundred third embodiment can include the system of any one of the one hundred seventy-seventh to two hundred second embodiments, wherein the make-up system further comprises a make-up port in fluid communication with the bellows and the make-up fluid source, at least one make-up valve configured to control (e.g. open or close or partially close—e.g. to control speed of flow) fluid flow between the make-up port/bellows and the make-up fluid source, and/or at least one make-up pump configured to pump fluid between the bellows and the make-up fluid source.

A two hundred fourth embodiment can include the system of the two hundred third embodiments, wherein the make-up fluid source is in fluid communication with the bellows when the make-up valve is open, and the make-up fluid source is fluidly isolated from the bellows when the make-up valve is closed.

A two hundred fifth embodiment can include the system of any one of the two hundred third to two hundred fourth embodiments, wherein fluidly isolating the make-up system from the bellows comprises closing the make-up valve and/or shutting off/deactivating the make-up pump (e.g. automatically by the control system—e.g. the control system instructs a valve mechanism/actuator to close the make-up valve and/or to shut off the pump).

A two hundred sixth embodiment can include the system of any one of the one hundred seventy-seventh to two hundred fifth embodiments, wherein the make-up system is configured to receive heat via circulation of fluid with the at least one additional component of the system, and to discharge heat via circulation of the fluid with the bellows.

A two hundred seventh embodiment can include the system of the two hundred sixth embodiment, wherein the control system is configured to evaluate the sensor data to determine a circulation protocol for circulating fluid between the make-up system and bellows, and responsive to determining a circulation protocol, to circulate fluid between the make-up system and the bellows based on the circulation protocol.

A two hundred eighth embodiment can include the system of any one of the two hundred sixth to two hundred seventh embodiments, wherein the control system determines an amount of time to hold fluid in the bellows, which source of fluid to circulate to the bellows, and/or an amount of fluid to circulate to optimize cooling of the fluid.

A two hundred ninth embodiment can include the system of any one of the two hundred sixth to two hundred eighth embodiments, wherein the control system uses temperature of the bellows and temperature of the make-up fluid source to determine the circulation protocol.

A two hundred tenth embodiment can include the system of the two hundred ninth embodiment, wherein the control system further uses temperature of the at least one additional component to determine the circulation protocol.

A two hundred eleventh embodiment can include the system of any one of the two hundred seventh to two hundred tenth embodiments, wherein the control system determines the circulation protocol based on temperature, prioritizing flow from whichever of the make-up fluid source or the at least one additional component is hotter (e.g. currently has hotter fluid) to the bellows.

A two hundred twelfth embodiment can include the system of any one of the two hundred sixth to two hundred eleventh embodiments, wherein the control system is configured to hold fluid in the bellows until the fluid in the bellows is cooler than the make-up fluid source or the at least one additional component, and then to circulate fluid.

A two hundred thirteenth embodiment can include the system of any one of the two hundred sixth to two hundred twelfth embodiments, further comprising an external cooler fluidly coupled to the make-up system.

A two hundred fourteenth embodiment can include the system of the two hundred thirteenth embodiment, wherein fluidly isolating the make-up system from the bellows further comprises fluidly isolating the external cooler from the bellows.

In a two hundred fifteenth embodiment, a method for protecting a bellows pump system during introduction of treatment fluid into a well can comprise: pumping treatment fluid into the well using the bellows pump system, wherein the bellows pump system comprises a pump having an expandable double-walled bellows and a piston, a control system, and a make-up system configured to maintain a controlled volume of drive fluid between the piston and the bellows, and wherein the make-up system is fluidly coupled to the bellows and to at least one additional component of the system; responsive to receiving (e.g. at the control system) sensor data from one or more sensor configured to detect one or more parameter at one or more location of the bellows pump system, detecting a leak in the bellows based on the sensor data; and responsive to detecting a leak, fluidly isolating the bellows from a fluid source of the make-up system, thereby fluidly uncoupling the at least one additional component of the system from the bellows.

A two hundred sixteenth embodiment can include the method of the two hundred fifteenth embodiment, wherein detecting a leak further comprises detecting fluid in an annulus of the expandable double-walled bellows, wherein detecting fluid comprises visually inspecting a weep hole in fluid communication with the annulus or detecting via one or more annulus sensor in proximity to a port in fluid communication with the annulus (e.g, wherein the one or more sensor comprises the one or more annulus sensor).

A two hundred seventeenth embodiment can include the method of the two hundred sixteenth embodiment, wherein the one or more annulus sensor comprises a fluid sensor and/or a contamination sensor.

A two hundred eighteenth embodiment can include the method of any one of the two hundred fifteenth to two hundred seventeenth embodiments, wherein responsive to detecting a leak/fluid, determining (e.g. by the control system) whether the detected fluid is drive fluid or treatment fluid.

A two hundred nineteenth embodiment can include the method of any one of the two hundred fifteenth to two hundred eighteenth embodiments, wherein detecting a leak comprises comparing, using the control system, the sensor data to a corresponding threshold.

A two hundred twentieth embodiment can include the method of any one of the two hundred fifteenth to two hundred nineteenth embodiments, wherein fluidly isolating the bellows comprises closing a make-up valve of the make-up system and/or shutting off a make-up pump of the make-up system.

A two hundred twenty-first embodiment can include the method of any one of the two hundred fifteenth to two hundred twentieth embodiments, further comprising evaluating the sensor data to determine whether the bellows and piston are out of sync, and responsive to determining that the bellows and piston are out of sync, using the make-up system to adjust the amount of drive fluid between the piston and the bellows to return the piston and bellows to sync.

A two hundred twenty-second embodiment can include the pump or system of any one of the first to twenty-seventh, thirty-ninth to sixty-eighth, seventy-ninth to one hundred eighth, one hundred twenty-fourth to one hundred sixty-second, or one hundred seventy-seventh to two hundred fourteenth embodiments, wherein the piston is disposed in a power end bore; the fluid end has a fluid end bore; and the power end bore and the fluid end bore are fluidly coupled to form a continuous pump bore without external piping therebetween (e.g, wherein the bore of the pump comprises a power end bore and a fluid end bore and/or wherein the continuous pump bore consists essentially of the power end bore and the fluid end bore).

A two hundred twenty-third embodiment can include the pump or system of the two hundred twenty-second embodiment, wherein: the power end further comprises a power end housing (e.g. having the power end bore disposed therein), the fluid end further comprises a fluid end housing (e.g. having the fluid end bore disposed therein), the power end housing and the fluid end housing are configured to be directly coupled together, and the continuous pump bore is entirely disposed within the power end housing and the fluid end housing.

A two hundred twenty-fourth embodiment can include the pump or system of the two hundred twenty-third embodiment, further comprising a housing seal disposed between the power end housing and the fluid end housing, wherein the housing seal is configured to seal fluid coupling between the power end bore and the fluid end bore.

A two hundred twenty-fifth embodiment can include the pump or system of the two hundred twenty-fourth embodiment, wherein the piston further comprises a head and a rod, wherein the rod extends away from the head towards the bellows, the pump further comprising: a first seal configured to allow the head to sealingly move within the pump bore; a second seal configured to allow the rod to sealingly move within the pump bore; and a make-up port in fluid communication with the power end bore or the fluid end bore, wherein the make-up port is disposed between the second seal and the bellows.

A two hundred twenty-sixth embodiment can include the pump or system of the two hundred twenty-fifth embodiment, wherein the make-up port is disposed in the fluid end and in fluid communication with the fluid end bore.

A two hundred twenty-seventh embodiment can include the pump or system of the two hundred twenty-sixth embodiment, wherein the second seal is disposed in the fluid end bore between the make-up port and the housing seal.

A two hundred twenty-eighth embodiment can include the pump or system of the two hundred twenty-seventh embodiment, wherein the housing seal is shielded from high pressure within the bellows by the second seal.

A two hundred twenty-ninth embodiment can include the pump or system of the two hundred twenty-sixth embodiment, wherein the second seal is disposed proximate to the housing seal.

A two hundred thirtieth embodiment can include the pump or system of any one of the two hundred twenty-second to two hundred twenty-ninth embodiments, wherein the fluid end bore includes an angled portion, which is in fluid communication with the power end bore but not aligned with the power end bore.

A two hundred thirty-first embodiment can include the pump or system of any one of the two hundred twenty-second to two hundred thirtieth embodiments, wherein the bellows is configured to expand downward, and wherein the chamber is configured so that fluid connection to the suction and discharge valves is located below the bellows.

A two hundred thirty-second embodiment can include the pump or system of any one of the two hundred twenty-third to two hundred thirty-first embodiments, wherein the suction valve and the discharge valve are integrated into the fluid end housing, and wherein the suction valve and the discharge valve are disposed on a same side of the chamber.

A two hundred thirty-third embodiment can include the pump or system of any one of the two hundred twenty-fifth to two hundred thirty-second embodiments, wherein the rod is configured to extend into the fluid end bore, and wherein a distal end of the rod is configured to remain in the fluid end bore throughout reciprocal movement of the piston.

A two hundred thirty-fourth embodiment can include the pump or system of any one of the two hundred twenty-fifth to two hundred thirty-third embodiments, further comprising: a second fluid end having a second fluid end housing with a second fluid end bore and a second chamber which is in fluid communication with a second suction valve and a second discharge valve; and a second expandable bellows disposed within the second chamber; wherein: the power end bore is fluidly coupled to both the first and second fluid end bores to form the continuous pump bore consisting essentially of the power end bore and the two fluid end bores, the power end is configured to reciprocally expand and contract both the first and second bellows based on movement of fluid by the piston, the piston comprises a head and two rods, the rods extend from opposite sides of the head, and the pump further comprises a second housing seal disposed between the power end housing and the second fluid end housing.

A two hundred thirty-fifth embodiment can include the pump or system of the two hundred thirty-fourth embodiment, wherein one or both of the first and second fluid end bore includes an angled portion, which is in fluid communication with the power end bore but not aligned with the power end bore.

A two hundred thirty-sixth embodiment can include the pump or system of the two hundred twenty-third embodiment, wherein the power end housing and the fluid end housing are both portions of a unitary housing having the continuous pump bore therethrough.

A two hundred thirty-seventh embodiment can include the method of any one of the twenty-eighth to thirty-eighth, sixty-ninth to seventy-eighth, one hundred ninth to one hundred twenty-third, one hundred sixty-third to one hundred seventy-sixth, or two hundred fifteenth to two hundred twenty-first embodiments, using the pump or system of any one of the two hundred twenty-second to two hundred thirty-sixth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

It should similarly be understood that terms such as "hot," "cold," "hotter," "cooler," "colder," and other such temperature terms are relative terms and do not denote any specific temperature. Rather, reference to a hot fluid means that the fluid is hotter than a cool fluid of the system and/or has been heated, while reference to a cool fluid means a fluid that is cooler/colder than a hot fluid of the system and/or has not been heated or has been heated less than the fluid of another portion of the system (for example another portion of the system with which the fluid is interacting).

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for pumping treatment fluid into a well, comprising:

a bellows pump configured to pump treatment fluid into the well, comprising:

a power end comprising a piston;

a fluid end having a chamber; and an expandable bellows, wherein the power end is configured to reciprocally expand and contract the bellows within the chamber based on movement of fluid by the piston;

a make-up system configured to maintain a controlled volume of fluid between the piston and the bellows; and a control system having one or more sensor configured to detect one or more parameters of the system;

wherein:

the make-up system comprises a make-up fluid source fluidly coupled to the bellows and to at least one additional component of the system;

the make-up system is configured to receive heat via circulation of fluid with the at least one additional component of the system, and to discharge heat via circulation of the fluid with the bellows, wherein the at least one additional component comprises another pump;

the control system is configured to receive data from the one or more sensor, to evaluate the sensor data to detect a leak, and responsive to detecting a leak, to fluidly isolate the make-up system from the bellows; and the control system is further configured to evaluate the sensor data to determine whether the bellows and piston are out of sync, and responsive to determining that the bellows and piston are out of sync, to use the make-up system to adjust the amount of fluid between the piston and the bellows to return the piston and bellows to sync.

2. The system of claim 1, wherein the control system is configured to evaluate the sensor data to determine a circulation protocol for circulating fluid between the make-up system and bellows for cooling, and responsive to determining a circulation protocol, to circulate fluid between the make-up system and the bellows based on the circulation protocol.

3. The system of claim 2, wherein the control system determines an amount of time to hold fluid in the bellows, which source of fluid to circulate to the bellows, and/or an amount of fluid to circulate to optimize cooling of the fluid.

4. The system of claim 2, wherein the control system determines the circulation protocol based on temperature, prioritizing flow from whichever of the make-up fluid source or the at least one additional component is hotter to the bellows.

5. The system of claim 1, wherein the one or more sensor is configured to detect one or more of the following parameters at one or more location within the system: pressure, temperature, flow rate, viscosity, contamination, and/or position of one or more component of the system; and wherein the control system detects a leak based on the sensor data by comparing the sensor data to a corresponding threshold.

6. The system of claim 1, wherein the make-up system further comprises at least one make-up valve and/or at least one make-up pump configured to pump fluid between the bellows and the make-up fluid source, and wherein fluidly isolating the make-up system from the bellows comprises closing the make-up valve and/or deactivating the make-up pump.

7. A system for pumping treatment fluid into a well, comprising:

a bellows pump configured to pump treatment fluid into the well, comprising:

a power end comprising a piston;

a fluid end having a chamber; and an expandable double-walled bellows, wherein the power end is configured to reciprocally expand and contract the bellows within the chamber based on movement of fluid by the piston;

a make-up system configured to maintain a controlled volume of fluid between the piston and the bellows; and a control system having one or more sensor configured to detect one or more parameters of the system;

wherein:

the expandable double-walled bellows comprises an inner wall, enclosing an inner volume, and an outer wall encompassing the inner wall;

an annulus is disposed between the inner wall and the outer wall of the bellows;

the annulus is in fluid communication with a port;

the one or more sensor comprises one or more annulus sensor disposed in proximity to the port;

the make-up system comprises a make-up fluid source fluidly coupled to the bellows and to at least one additional component of the system;

the control system is configured to receive data from the one or more sensor, to evaluate the sensor data to detect a leak, and responsive to detecting a leak, to fluidly isolate the make-up system from the bellows; and the control system is further configured to evaluate the sensor data to determine whether the bellows and piston are out of sync, and responsive to determining that the bellows and piston are out of sync, to use the make-up system to adjust the amount of fluid between the piston and the bellows to return the piston and bellows to sync.

8. The system of claim 7, wherein the inner and outer walls are uncoupled within the chamber.

9. The system of claim 7, wherein the one or more annulus sensor comprises a fluid sensor and/or a contamination sensor.

10. The system of claim 7, wherein the make-up system further comprises at least one make-up valve and/or at least one make-up pump, wherein fluidly isolating the make-up system from the bellows comprises closing the make-up valve and/or deactivating the make-up pump.

11. The system of claim 7, wherein the make-up system is configured to receive heat via circulation of fluid with the at least one additional component of the system, and to discharge heat via circulation of the fluid with the bellows.

12. The system of claim 11, wherein the control system determines an amount of time to hold fluid in the bellows, which source of fluid to circulate to the bellows, and/or an amount of fluid to circulate to optimize cooling of the fluid.

13. The system of claim 11, wherein the control system determines a circulation protocol based on temperature, prioritizing flow from whichever of the make-up fluid source or the at least one additional component is hotter to the bellows.

14. The system of claim 11, further comprising an external cooler fluidly coupled to the make-up system.

15. A system for pumping treatment fluid into a well, comprising:

a bellows pump configured to pump treatment fluid into the well, comprising:

a power end comprising a piston;

a fluid end having a chamber; and an expandable bellows, wherein the power end is configured to reciprocally expand and contract the bellows within the chamber based on movement of by the piston;

a make-up system configured to maintain a controlled volume of fluid between the piston and the bellows; and a control system having one or more sensor configured to detect one or more parameters of the system;

wherein:

the make-up system comprises a make-up fluid source fluidly coupled to the bellows and to at least one additional component of the system;

the make-up system is configured to receive heat via circulation of fluid with the at least one additional component of the system, and to discharge heat via circulation of the fluid to the bellows, wherein the bellows is configured to discharge heat to the treatment fluid in the chamber by conduction;

the control system is configured to receive data from the one or more sensor, to evaluate the sensor data to detect a leak, and responsive to detecting a leak, to fluidly isolate the make-up system from the bellows;

the control system is further configured to evaluate the sensor data to determine whether the bellows and piston are out of sync, and responsive to determining that the bellows and piston are out of sync, to use the make-up system to adjust the amount of fluid between the piston and the bellows to return the piston and bellows to sync; and the control system is further configured to evaluate the sensor data to determine a circulation protocol for circulating fluid between the make-up system and bellows for cooling, and responsive to determining a circulation protocol, to circulate fluid between the make-up system and the bellows based on the circulation protocol.

16. The system of claim 15, wherein the control system determines an amount of time to hold fluid in the bellows, which source of fluid to circulate to within the bellows, and/or an amount of fluid to circulate to optimize cooling of the fluid.

17. The system of claim 16, wherein the control system determines the circulation protocol based on temperature, prioritizing flow from whichever of the make-up fluid source or the at least one additional component is hotter to the bellows.

18. The system of claim 15, wherein the one or more sensor is configured to detect one or more of the following parameters at one or more location within the system: pressure, temperature, flow rate, viscosity, contamination, and/or position of one or more component of the system; and wherein the control system detects a leak based on the sensor data by comparing the sensor data to a corresponding threshold.

19. The system of claim 15, wherein the one or more sensor comprises a temperature sensor at the make-up fluid source and a temperature sensor at the bellows.

20. The system of claim 19, wherein the one or more sensor further comprises a temperature sensor at the at least one additional component of the system.

* * * * *